US006916251B2

(12) United States Patent
Shiraishi et al.

(10) Patent No.: US 6,916,251 B2
(45) Date of Patent: Jul. 12, 2005

(54) GOLF CLUB SET AND GOLF CLUB SHAFT SET

(75) Inventors: Takayuki Shiraishi, Hiratsuka (JP); Masayoshi Kogawa, Hiratsuka (JP); Yoh Nishizawa, Hiratsuka (JP); Masaki Akie, Hiratsuka (JP)

(73) Assignee: The Yokohama Rubber Co., Ltd. (JP)

( * ) Notice: Subject to any disclaimer, the term of this patent is extended or adjusted under 35 U.S.C. 154(b) by 0 days.

(21) Appl. No.: 10/135,822

(22) Filed: May 1, 2002

(65) Prior Publication Data

US 2003/0104877 A1 Jun. 5, 2003

(30) Foreign Application Priority Data

May 2, 2001 (JP) ..... 2001-135342
May 2, 2001 (JP) ..... 2001-135355
Sep. 3, 2001 (JP) ..... 2001-266049
Sep. 3, 2001 (JP) ..... 2001-266080

(51) Int. Cl.[7] ..... A63B 53/10; A63B 53/12
(52) U.S. Cl. ..... 473/289; 473/316
(58) Field of Search ..... 473/289, 290, 473/291, 316

(56) References Cited

U.S. PATENT DOCUMENTS 3,984,103 A * 10/1976 Nix ..... 473/291
4,280,700 A * 7/1981 Plagenhoef ..... 473/289
4,679,791 A * 7/1987 Hull ..... 473/201
4,725,060 A * 2/1988 Iwanaga ..... 473/289
4,784,390 A * 11/1988 Horgen ..... 473/409
4,971,321 A * 11/1990 Davis ..... 473/287
5,121,918 A * 6/1992 Teramoto et al. ..... 473/290
5,228,688 A * 7/1993 Davis ..... 473/290
5,259,617 A * 11/1993 Soong ..... 473/305
5,333,859 A * 8/1994 Teramoto et al. ..... 473/290
5,716,291 A * 2/1998 Morell et al. ..... 473/319
5,924,936 A * 7/1999 Penley ..... 473/289
6,607,450 B1 * 8/2003 Hackman ..... 473/223

* cited by examiner

*Primary Examiner*—Stephen Blau
(74) *Attorney, Agent, or Firm*—Finnegan, Henderson, Farabow, Garrett & Dunner, L.L.P.

(57) ABSTRACT

Disclosed is a golf club set having harmonized golf club performance among the club numbers. In the golf club set, for at least three golf clubs, a ratio or a sum of a frequency per unit time, the frequency being measured by vibrating a tip portion of a golf club shaft constituting each of the golf clubs, and a frequency per unit time, the frequency being measured by vibrating a rear end portion of the golf club shaft, is determined in relation with order of the club number.

11 Claims, 98 Drawing Sheets

GOLF CLUB SET AND GOLF CLUB SHAFT SET

BACKGROUND OF THE INVENTION

The present invention relates to a golf club set comprising a plurality of golf clubs having various different loft angles and a golf club shaft set used for the golf club set.

An iron golf club set is constituted of about 10 golf clubs from long irons to short irons, where club length and a loft angle differ for each club number so that different flying distance can be obtained for each club number.

In the foregoing golf club set, it is preferable to establish harmony on height of trajectory of a hit ball by a golf club among the club numbers. As a yardstick to evaluate the height of trajectory of a hit ball by a golf club, a kick point and the like are generally used. However, since the kick point only indicates the top position of bending of a golf club shaft, it has been difficult to show the height of trajectory of a hit ball by a golf club exactly with the yardstick. Therefore, even when a golf club set is designed to establish harmony on the height of trajectory of a hit ball by a golf club among the club numbers based on conventional yardstick, it is the present situation that harmony on actual height of trajectory of a hit ball by a golf club is not established among the club numbers.

In addition, in the foregoing golf club set, it is preferable to establish harmony on flexibility of a golf club shaft actually felt by a person among the club numbers. As a yardstick to evaluate flexibility of a golf club shaft, frequency (cpm) and the like are generally used. However, when flexibility of a golf club shaft is evaluated based on such a yardstick and even when the value is large, a person did not always actually feel stiff. Specifically, depending on the difference of a kick point, the result based on the foregoing yardstick is sometimes different. For example, in two golf club shafts having kick points different from each other, reversal phenomena that one golf club shaft indicates higher frequency than the other golf club shaft while the latter one is felt stiffer than the former one, is occurred. Therefore, even when a golf club set is designed to establish harmony on flexibility of a golf club shaft based on conventional yardstick among the club numbers, it is the present situation that harmony on flexibility of golf club shafts actually felt by a person is not obtained among the club numbers.

SUMMARY OF THE INVENTION

The first object of the present invention is to provide a golf club set and a golf club shaft set wherein height of trajectory of a hit ball by a golf club is harmonized among the club numbers.

The second object of the present invention is to provide a golf club set and a golf club shaft set wherein flexibility of a golf club shaft actually felt by a person is harmonized among the club numbers.

A golf club set to achieve the foregoing first object in accordance with the present invention comprises a plurality of golf clubs in which a golf club head is assembled on a tip portion of a golf club shaft, the plurality of golf clubs having loft angles different in each club number, wherein, in at least three golf clubs among the plurality of golf clubs, a ratio of a frequency per unit time, the frequency being measured by vibrating a tip portion of a golf club shaft constituting each of the golf clubs in a state that a rear end portion of the golf club shaft is fastened, and a frequency per unit time, the frequency being measured by vibrating the rear end portion of the golf club shaft in a state that the tip portion of the golf club shaft is fastened, is determined in relation with order of the club number. The ratio of frequencies is preferably varied almost linearly in accordance with order of the club number.

When the foregoing ratio of frequencies is varied almost linearly in accordance with order of the club number, it is preferable to satisfy the following conditions in the present invention.

Specifically, in a golf club set comprising a plurality of golf clubs in which a golf club head is assembled on a tip portion of a golf club shaft, the plurality of golf clubs having loft angles different in each club number, the plurality of golf clubs include a group of at least three golf clubs having loft angles in a range of 16 degree or more and 41 degree or less. Further, all of the golf clubs in the group are denoted by continuous natural numbers X starting at 1 in order of increasing loft angle from the lowest loft angle. In addition, a ratio of frequencies calculated from a frequency per unit time as a numerator, the frequency being measured by vibrating a tip portion of a golf club shaft constituting each of the golf clubs in a state that a rear end portion of the golf club shaft is fastened, and a frequency per unit time as a denominator, the frequency being measured by vibrating the rear end portion of the golf club shaft in a state that the tip portion of the golf club shaft is fastened, is denoted by Z.

In this case, the ratio Z of frequencies is determined so that an estimated error to a regression line is 0.05 or less, when a distribution of the ratio Z of frequencies to the natural number X in all of the golf clubs in the group is fitted on the regression line.

More preferably, when a sum of the frequency which is measured in the state that the rear end portion of the golf club shaft is fastened and the frequency which is measured in the state that the tip portion of the golf club shaft is fastened is denoted by Y (cpm), the sum Y of frequencies is determined so that an estimated error to a regression line is 30 cpm or less, when a distribution of the sum Y of frequencies to the natural number X in all of the golf clubs in the group is fitted on the regression line.

Another golf club set to achieve the foregoing first object in accordance with the present invention comprises a plurality of golf clubs in which a golf club head is assembled on a tip portion of a golf club shaft, the plurality of golf clubs having loft angles different in each club number, wherein, in at least three golf clubs among the plurality of golf clubs, a ratio of a frequency per unit time, the frequency being measured by vibrating a tip portion of a golf club shaft constituting each of the golf clubs in a state that a rear end portion of the golf club shaft is fastened, and a frequency per unit time, the frequency being measured by vibrating the rear end portion of the golf club shaft in a state that the tip portion of the golf club shaft is fastened, is determined in relation with order of size of the loft angle. The ratio of frequencies is preferably varied corresponding to order of size of the loft angle almost linearly.

When the foregoing ratio of frequencies is varied almost linearly in accordance with order of size of the loft angle, it is preferable to satisfy the following conditions in the present invention.

Specifically, in a golf club set comprising a plurality of golf clubs in which a golf club head is assembled on a tip portion of a golf club shaft, the plurality of golf clubs having loft angles different in each club number, the plurality of golf clubs include a group of at least three golf clubs having loft angles in a range of 16 degree or more and 41 degree or less. Further, the loft angles of the golf clubs in the group are denoted by θ (degree). In addition, a ratio of frequencies calculated from a frequency per unit time as a numerator, the frequency being measured by vibrating a tip portion of a golf club shaft constituting each of the golf clubs in a state that a rear end portion of the golf club shaft is fastened, and a frequency per unit time as a denominator, the frequency being measured by vibrating the rear end portion of the golf club shaft in a state that the tip portion of the golf club shaft is fastened, is denoted by Z.

Then, the ratio Z of frequencies is determined so that an estimated error to a regression line is 0.05 or less, when a distribution of the ratio Z of frequencies to the loft angle θ in all of the golf clubs in the group is fitted on the regression line.

More preferably, when a sum of the frequency which is measured in the state that the rear end portion of the golf club shaft is fastened and the frequency which is measured in the state that the tip portion of the golf club shaft is fastened, is denoted by Y (cpm), the sum Y of frequencies is determined so that an estimated error to a regression line is 30 cpm or less, when a distribution of the sum Y of frequencies to the loft angle θ in all of the golf clubs in the group is fitted on the regression line.

In the present invention, a ratio of a frequency per unit time, the frequency being measured by vibrating a tip portion of a golf club shaft in a state that a rear end portion of the golf club shaft is fastened, and a frequency per unit time, the frequency being measured by vibrating the rear end portion of the golf club shaft in a state that the tip portion of the golf club shaft is fastened, is used as a yardstick for height of trajectory of a hit ball by the golf club. Since the ratio of frequencies is composed of a combination of frequency performance obtained in a state that a rear end portion of a golf club shaft is fastened and frequency performance obtained in a state that a tip portion of the golf club shaft is fastened, it indicates bending characteristics of a golf club shaft well, and it also indicates height of trajectory of a hit ball by a golf club more exactly with numeral values. Therefore, when the ratio of frequencies has a correlation with order of the club number or order of loft angle size, a sense of incongruity such that in only specified golf clubs through a golf club set, a trajectory in accordance with a loft angle can not be obtained, can be avoided.

Measurement of frequency is preferably carried out as a simple golf club shaft. It is possible to adjust golf clubs as a whole golf club set with more accuracy by measuring frequency of a simple golf club shaft, adjusting it, adjusting other parts appropriately and fabricating a golf club. Accordingly, harmonized height of trajectory of a hit ball through a whole golf club set is obtained more exactly.

The club number is mainly identification information on an order of loft angle denoted by numbers, letters, marks and the like, which are added on golf clubs, so that golf clubs having different loft angles can be placed in order of loft angle and a loft angle of each club number is decided with a constant difference or almost constant difference appropriately among those skilled in the art. Moreover, a bigger club number means a club number for a bigger loft angle.

The present invention also includes golf club shaft sets before those are fabricated as golf club. A golf club shaft set is generally composed of a plurality of golf club shafts having different length, and those golf club shafts in order of longer shaft length are assembled in golf club heads in order of smaller loft angle to become golf clubs. Those skilled in the art may use the golf club shafts in the golf club shaft set as they are or may use after cutting if necessary when they fabricate golf clubs.

A golf club shaft set to achieve the foregoing first object in accordance with the present invention comprises a plurality of golf club shafts to constitute a golf club set, wherein, in at least three golf club shafts among the plurality of golf club shafts, a ratio of a frequency per unit time, the frequency being measured by vibrating a tip portion of a golf club shaft in a state that a rear end portion of the golf club shaft is fastened, and a frequency per unit time, the frequency being measured by vibrating a rear end portion of the golf club shaft in a state that a tip portion of the golf club shaft is fastened, is determined in relation with order of the club number and preferably it is varied almost linearly in accordance with order of the club number.

When the foregoing ratio of frequencies is varied almost linearly in accordance with order of the club number, it is preferable to satisfy the following conditions in the present invention.

Specifically, in a golf club shaft set comprising a plurality of golf club shafts to constitute a golf club set, the plurality of golf club shafts must include a group of at least three golf club shafts. The group of golf club shafts is preferably composed of golf club shafts, which are combined to golf clubs having loft angles in a range of 16 degree or more and 41 degree or less. Further, all of the golf club shafts in the group are denoted by continuous natural numbers X starting at 1 in order from the largest golf club shaft length. In addition, a ratio of frequencies calculated from a frequency per unit time as a numerator, the frequency being measured by vibrating a tip portion of a golf club shaft in a state that a rear end portion of the golf club shaft is fastened, and a frequency per unit time as a denominator, the frequency being measured by vibrating a rear end portion of the golf club shaft in a state that a tip portion of the golf club shaft is fastened, is denoted by Z.

Then, when a distribution of the foregoing ratio Z of frequencies is fitted on a regression line to the foregoing natural number X in all of the golf club shafts of the foregoing group, the foregoing ratio Z of frequencies is set so that estimated error to the regression line is 0.05 or less.

More preferably, when the sum of a frequency measured in the state that a rear portion of the golf club shaft is fastened and a frequency measured in the state that a tip portion of the golf club shaft is fastened is denoted by Y (cpm). Then, when a distribution of the foregoing sum Y of frequencies is fitted on a regression line to the foregoing natural number X for all of the foregoing golf club shafts, the foregoing sum Y of frequencies is set so that an estimated error to the regression line is 30 cpm or less.

Other golf club shaft set to achieve the foregoing first object in accordance with the present invention comprises a plurality of golf club shafts to constitute a golf club set, wherein in at least three golf club shafts among the plurality of golf club shafts, a ratio of a frequency per unit time, the frequency being measured by vibrating a tip portion of a golf club shaft in a state that a rear end portion of each golf club shaft is fastened, and a frequency per unit time, the frequency being measured by vibrating a rear end portion of the golf club shaft in a state that a tip portion of the golf club shaft is fastened, is determined in relation with order of golf club shaft length and preferably it is varied almost linearly corresponding to golf club shaft length.

When the foregoing ratio of frequencies is varied almost linearly corresponding to order of length of the golf club shaft, it is preferable to satisfy the following conditions in the present invention.

Specifically, in a golf club shaft set comprising a plurality of golf club shafts to constitute a golf club set, the foregoing golf club shafts include a group of at least three golf club shafts. The group of golf club shafts is preferably composed of golf club shafts, which are assembled to golf clubs having loft angles in a range of 16 degree or more and 41 degree or less. The length of the golf club shaft is denoted by L (mm), and, in addition, a ratio of frequencies calculated from a frequency per unit time as a numerator, the frequency being measured by vibrating a tip portion of a golf club shaft in a state that a rear end portion of each golf club shaft is fastened, and a frequency per unit time as a denominator, the frequency being measured by vibrating a rear end portion of the golf club shaft in a state that a tip portion of the golf club shaft is fastened, is denoted by Z.

Then, when a distribution of the foregoing ratio Z of frequencies to the foregoing length L is fitted on a regression line in all of the golf club shafts of the foregoing group, the foregoing ratio Z of frequencies is set so that estimated error to the regression line is 0.05 or less.

More preferably, when the sum of a frequency which is measured in the state that a rear portion of the foregoing golf club shaft is fastened and a frequency which is measured in the state that a tip portion of the golf club shaft is fastened, is denoted by Y (cpm) and when a distribution of the foregoing sum Y of frequencies to the foregoing length is fitted on a regression line L, the foregoing sum Y of frequencies is set so that estimated error to the regression line is 30 cpm or less.

As described above, in a golf club shaft set, when the ratio of frequencies has a correlation with order of the club number or order of length of golf club shafts, a sense of incongruity such that in only specified golf clubs through a golf club set, a trajectory in accordance with a loft angle can not be obtained, can be avoided.

On the other hand, a golf club set to achieve the foregoing second object in accordance with the present invention comprises a plurality of golf clubs in which a golf club head is assembled on a tip portion of a golf club shaft, wherein the plurality of golf clubs have different loft angles in each club number, wherein, in at least three golf clubs among the plurality of golf clubs, a sum of a frequency per unit time, the frequency being measured by vibrating a tip portion of a golf club shaft constituting each of the golf clubs in a state that a rear end portion of the golf club shaft is fastened, and a frequency per unit time, the frequency being measured by vibrating the rear end portion of the golf club shaft in a state that the tip portion of the golf club shaft is fastened, is determined in relation with order of the club number and preferably it is varied almost linearly corresponding to order of the club number.

When the foregoing ratio of frequencies is varied almost linearly corresponding to order of the club number, it is preferable to satisfy the following conditions in the present invention.

Specifically, in a golf club set comprising a plurality of golf clubs in which a golf club head is assembled on a tip portion of a golf club shaft, loft angles of which are different in each club number, wherein the plurality of golf clubs must include a group of at least three golf clubs having loft angles in a range of 16 degree or more and 41 degree or less. All of the golf clubs in the group are denoted by continuous natural number X starting at 1 in order from the smallest loft angle, and, in addition, the sum of a frequency per unit time, the frequency being measured by vibrating a tip portion of a golf club shaft in a state that a rear end portion of the golf club shaft is fastened for a length of 178 mm from the rear end and a 200 g weight is loaded on a tip portion for a length of 30 mm from the tip end, and a frequency per unit time, the frequency being measured by vibrating the rear end portion of the golf club shaft in a state that the tip portion of the golf club shaft is fastened for a length of 178 mm from the tip end and a 200 g weight is loaded on the rear end portion for a length of 30 mm from the rear end, is denoted by Y (cpm).

Then the foregoing sum Y of frequencies is determined in a range of the following formula (1) to the foregoing natural number X in all of the golf clubs of the foregoing group, $$aX+b \leqq Y \leqq aX+b+12 \quad (1)$$

where coefficients a and b are arbitrary constants.

Alternatively, when a distribution of the foregoing sum Y of frequencies to the foregoing natural number X is fitted on a regression line, the foregoing sum Y of frequencies is determined so that estimated error to the regression line is 8 (cpm) or less in all of the golf clubs in the foregoing group.

More preferably, when a ratio of frequencies calculated from a frequency as a numerator, the frequency being measured in the state that the rear end portion of the golf club shaft is fastened, and a frequency as a denominator, the frequency being measured in the state that the tip portion of the golf club shaft is fastened, is denoted by Z, the ratio Z of frequencies is determined so that an estimated error to a regression line is 0.15 or less, when a distribution of the ratio Z of frequencies to the natural number X in all of the golf clubs in the group is fitted on the regression line.

Another golf club set to achieve the foregoing second object in accordance with the present invention comprises a plurality of golf clubs in which a golf club head is assembled on a tip portion of a golf club shaft, the plurality of golf clubs having loft angles different in each club number, wherein, in at least three golf clubs among the plurality of golf clubs, a sum of a frequency per unit time, the frequency being measured by vibrating a tip portion of a golf club shaft constituting each of the golf clubs in a state that a rear end portion of the golf club shaft is fastened, and a frequency per unit time, the frequency being measured by vibrating the rear end portion of the golf club shaft in a state that the tip portion of the golf club shaft is fastened, is determined in relation with order of size of the loft angle. The sum of frequencies is preferably varied corresponding to order of size of the loft angle almost linearly.

When the foregoing sum of frequencies is varied almost linearly corresponding to order of size of the loft angle, it is preferable to satisfy the following conditions in the present invention.

Specifically, in a golf club set comprising a plurality of golf clubs in which a golf club head is assembled on a tip portion of a golf club shaft, the plurality of golf clubs having loft angles different in each club number, the plurality of golf clubs include a group of at least three golf clubs having loft angles in a range of 16 degree or more and 41 degree or less. Further, the loft angles in the group are denoted by θ (degree). In addition, a sum of a frequency per unit time, the frequency being measured by vibrating a tip portion of a golf club shaft to constituting each of the golf clubs in a state that a rear end portion of the golf club shaft is fastened for a length of 178 mm from the rear end and a 200 g weight is loaded on the tip portion for a length of 30 mm from the tip end, and a frequency per unit time, the frequency being measured by vibrating the rear end portion of the golf club shaft in a state that the tip portion of the golf club shaft is fastened for a length of 178 mm from the tip end and a 200 g weight is loaded on the rear end portion for a length of 30 mm from the rear end, is denoted by Y (cpm).

Then, the sum Y of frequencies is determined in a range of the following formula (2) to the loft angle θ in all of the golf clubs of the group, $$c\theta+d \leqq Y \leqq c\theta+d+12 \quad (2)$$

where coefficients c and d are arbitrary constants.

Alternatively, for all of the golf clubs in the foregoing group, the foregoing sum Y of frequencies is determined so that an estimated error to a regression line is 8 (cpm) or less, when a distribution of the foregoing sum Y of frequencies to the foregoing loft angle θ is fitted on the regression line.

More preferably, when a ratio of frequencies calculated from a frequency as a numerator, the frequency being measured in the state that the rear end portion of the golf club shaft is fastened, and a frequency as a denominator, the frequency being measured in the state that the tip portion of the golf club shaft is fastened, is denoted by Z, the ratio Z of frequencies is determined so that an estimated error to a regression line is 0.15 or less, when a distribution of the ratio Z of frequencies to the loft angle θ in all of the golf clubs in the group is fitted on the regression line.

In the present invention, a sum of a frequency per unit time, the frequency being measured by vibrating a tip portion of a golf club shaft in a state that a rear end portion of a golf club shaft is fastened, and a frequency per unit time, the frequency being measured by vibrating the rear end portion of the golf club shafts in a state that the tip portion of the golf club shafts is fastened, is used as a yardstick for flexibility of a golf shaft. Since the sum of frequencies is composed of a combination of frequency performance obtained in a state that a rear end portion of a golf club shaft is fastened and frequency performance obtained in a state that a tip portion of the golf club shaft is fastened, it indicates flexibility of a golf club shaft more exactly with numeral values regardless of location of kick point. Therefore, when the sum of frequencies has a correlation with order of the club number or order of loft angle size, a sense of incongruity such that only specified golf clubs through a golf club set are felt stiffer, can be avoided.

Measurement of frequency is preferably carried out as a simple golf club shaft. It is possible to adjust golf clubs as a whole golf club set with more accuracy by measuring a frequency of a simple golf club shaft, adjusting it, adjusting other parts appropriately and fabricating a golf club. Accordingly, it is possible to harmonize flexibility actually felt by a person among the club numbers.

The club number is mainly identification information on an order of loft angles denoted on each golf club by numbers, letters, marks and the like so that golf clubs having different loft angle can be placed in order of loft angles, and a loft angle for each club number is decided with a constant difference or almost constant difference appropriately among ones skilled in the art. Further, a bigger club number means a club number having a bigger loft angle.

The present invention also includes golf club shaft sets before those are fabricated as golf club sets. A golf club shaft set is generally composed of a plurality of golf shafts having different length, and those golf shafts in order of decreasing shaft length are assembled in golf club heads in order of increasing loft angle to become golf clubs. Ones skilled in the art may use the golf club shafts of the golf club shaft set as they are or may use after cutting if necessary when they fabricate golf clubs.

A golf club shaft set to achieve the foregoing second object in accordance with the present invention comprises a plurality of golf club shafts to constitute a golf club set, wherein in at least three golf club shafts among the plurality of golf club shafts, a sum of a frequency per unit time, the frequency being measured by vibrating a tip portion of a golf club shaft in a state that a rear end portion of the golf club shaft is fastened, and a frequency per unit time, the frequency being measured by vibrating the rear end portion of the golf club shaft in a state that the tip portion of the golf club shaft is fastened, is determined in relation with order of the club number and preferably it is varied almost linearly corresponding to order of the club number.

When the foregoing sum of frequencies is varied almost linearly corresponding to order of the club number, it is preferable to satisfy the following conditions in the present invention.

Specifically, in a golf club shaft set comprising a plurality of golf club shafts to constitute a golf club set, the plurality of golf club shafts must include a group of at least three golf club shafts. The group of the golf club shafts is preferably composed of golf club shafts, which are assembled in golf clubs having loft angles in a range of 16 degree or more and 41 degree or less. And all of the golf club shafts of the group are denoted by continuous natural number X starting at 1 in order from the longest length of golf club shaft. In addition, a sum of a frequency per unit time, the frequency being measured by vibrating a tip portion of a golf club shaft in a state that a rear end portion of the golf club shaft is fastened for a length of 178 mm from the rear end and a 200 g weight is loaded on a tip portion for a length of 30 mm from the tip, and a frequency per unit time, the frequency being measured by vibrating the rear end portion of the golf club shaft in a state that the tip portion of the golf club shaft is fastened for a length of 178 mm from the tip and a 200 g weight is loaded on a rear end portion for a length of 30 mm from the rear end, is denoted by Y (cpm).

At this time, when a distribution of the foregoing sum Y of frequencies to the foregoing natural number X is fitted on a regression line, the foregoing sum Y of frequencies is determined so that estimated error to the regression line is 8 (cpm) or less in all of the golf club shafts in the foregoing group.

More preferably, a ratio of frequencies calculated from a frequency per unit time as a numerator, the frequency being measured in a state that a rear end portion of the foregoing golf club shafts is fastened, and a frequency per unit time as a denominator, the frequency being measured in a state that a tip portion of the golf club shafts is fastened, is denoted by Z. Then, when a distribution of the foregoing ratio Z of frequencies to the foregoing natural number X is fitted on a regression line in all of the golf club shafts of the foregoing group, the foregoing ratio Z of frequencies is determined so that estimated error to the regression line is 0.15 or less.

Moreover, other golf club shaft sets to achieve the foregoing second object in accordance with the present invention comprises a plurality of golf club shafts to constitute a golf club set, wherein, in at least three golf club shafts among the plurality of golf club shafts, a sum of a frequency per unit time, the frequency being measured by vibrating a tip portion of each of the golf club shafts in a state that a rear end portion of the golf club shaft is fastened, and a frequency per unit time, the frequency being measured by vibrating the rear end portion of the golf club shaft in a state that the tip portion of the golf club shaft is fastened, is determined in relation with an order of length of golf club shafts and preferably it is varied almost linearly corresponding to an order of length of golf club shafts.

When the foregoing sum of frequencies is varied almost linearly corresponding to order of length of golf club shafts, it is preferable to satisfy the following conditions in the present invention.

Specifically, in a golf club shaft set comprising a plurality of golf club shafts to constitute a golf club set, the plurality of golf club shafts must include a group of at least three golf club shafts. The group of the golf club shafts is preferably composed of golf club shafts, which are assembled in golf clubs having loft angles in a range of 16 degree or more and 41 degree or less. The length of the golf club shafts in the group is denoted by L (mm). In addition, the sum of a frequency per unit time, which is measured by vibrating a tip portion of a golf club shaft in a state that a rear end portion of the golf club shaft is fastened for a length of 178 mm from the rear end and a 200 g weight is loaded on a tip portion for a length of 30 mm from the tip and a frequency per unit time, which is measured by vibrating the rear end portion of the golf club shaft in a state that the tip portion of the golf club shaft is fastened for a length of 178 mm from the tip and a 200 g weight is loaded on the rear end portion for a length of 30 mm from the rear end, is denoted by Y (cpm).

At this time, when a distribution of the foregoing sum Y of frequencies to the foregoing length L is fitted on a regression line, the foregoing sum Y of frequencies is determined so that estimated error to the regression line is 8 (cpm) or less in all of the golf club shafts in the foregoing group.

More preferably, a ratio of frequencies calculated from a frequency per unit time as a numerator, the frequency being measured in a state that a rear end portion of the foregoing golf club shafts is fastened, and a frequency per unit time as a denominator, the frequency being measured in a state that the tip portion of the golf club shafts is fastened, is denoted by Z. Then, when a distribution of the foregoing ratio Z of frequencies to the foregoing length L is fitted on a regression line in all of the golf club shafts of the foregoing group, the foregoing ratio Z of frequencies is determined so that estimated error to the regression line is 0.15 or less.

As described above, if the sum of frequencies in a golf club shaft set has a correlation with order of the club number or order of length of golf club shafts, when it is constituted to a golf club set, a sense of incongruity such that only specified golf clubs through a golf club set are felt stiffer, can be avoided.

BRIEF DESCRIPTION OF THE DRAWINGS

FIG. 5(*a*) is a side view showing a state that a golf club head is placed on a device for measuring the center of gravity in the position to balance, and FIG. 5(*b*) is a side view showing a state that a golf club head is placed on a device for measuring the center of gravity in a position not to balance.

DETAILED DESCRIPTION OF THE PREFERRED EMBODIMENTS

Next, constituents of the present invention will be described with reference to the accompanying drawings in detail.

Figure 1:
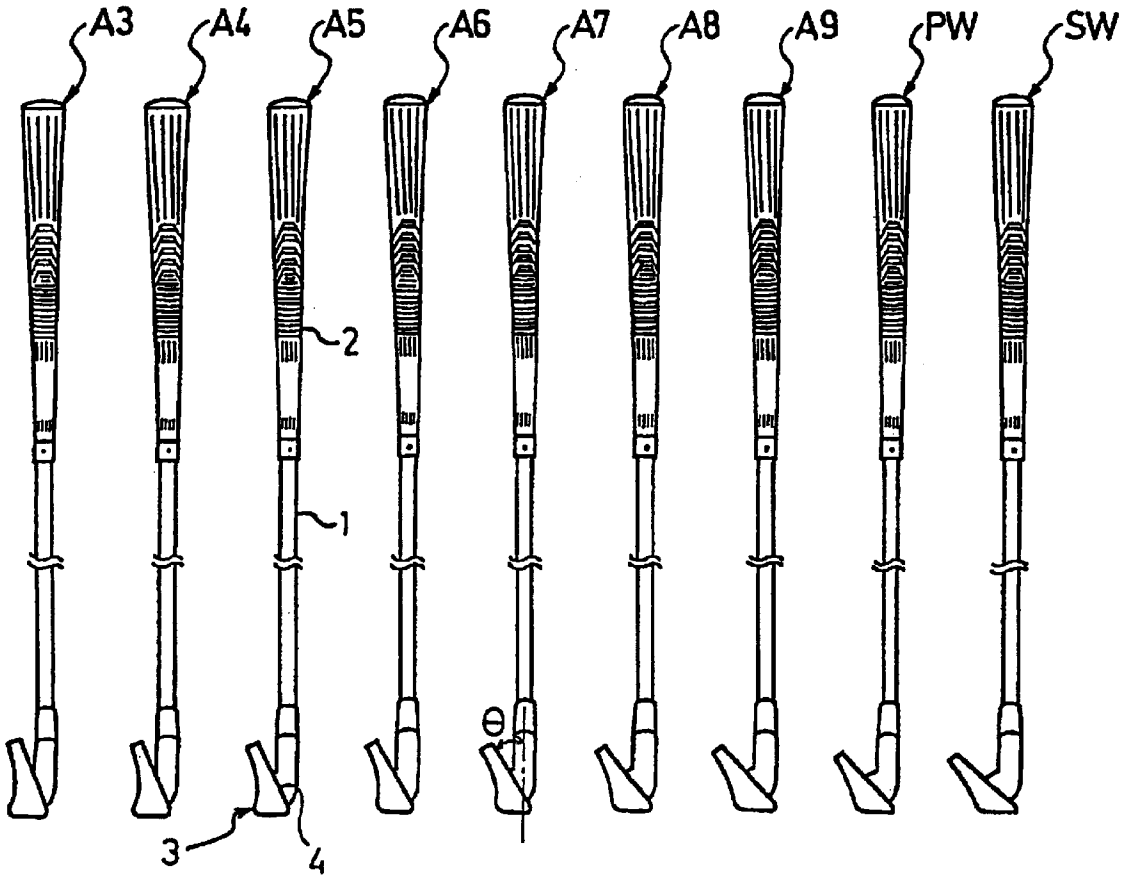
FIG. 1 is a side view showing a plurality of iron golf clubs to compose a golf club set in accordance with preferred embodiments in the present invention, omitting a part of them.

FIG. 1 shows an example of a golf club set according to the preferred embodiments in the present invention comprising nine pieces of golf clubs A3 to A9 (3 iron to 9 iron), a golf club PW (pitching wedge) and a golf club SW (sand wedge). Each golf club has a structure that a grip 2 is assembled in a rear end portion of a golf club shaft 1 and a golf club head 3 is assemble in a tip portion of a golf club shaft 1.

It is determined that in these golf clubs A3 to A9, PW and SW, the bigger the club number is, the bigger a loft angle θ (degree) of a face plane 4 to a shaft axis is as well as the shorter club length is. Specifically, it is determined that the bigger the club number is, the shorter flying distance of a hit ball is. For example the loft angles θ of the golf clubs A3 to A9, PW and SW are determined to be respectively 20 degree, 24 degree, 28 degree, 32 degree, 36 degree, 40 degree, 44 degree, 48 degree, and 58 degree. It means this golf club set comprises 3 pieces or more of golf clubs with loft angles θ in a range of 16 degree to 41 degree, preferably 5 pieces or more.

In the foregoing golf club set, it is necessary to establish harmony among, in particular, golf clubs having loft angles θ being in a range of 16 degree to 41 degree. The reason is that harmonized performance is required to those clubs in the range so that flying distance can be different corresponding to the club number. On the contrary, a golf club having a loft angle less than 16 degree is a golf club to be used mainly for hitting a ball on a tee and, so to speak, is a golf club to pursue long flying distance without any relation with swing patterns of other clubs. So it is not necessarily needed to establish harmony within a golf club set. On the other hand, a golf club having a loft angle more than 41 degree is mostly used for control shots or approach shots where swing force must be controlled and, so to speak, is a golf club, controllability of which is regarded to be important without any relation with swing patterns of other clubs. Therefore it is not necessarily needed to establish harmony within a golf club set.

Figure 2:
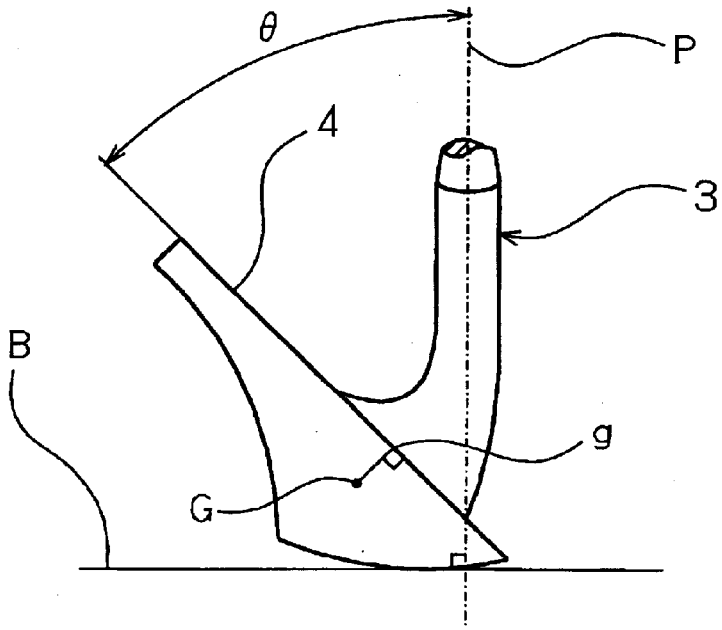
FIG. 2 is a side view showing a golf club head to explain a loft angle θ.

The foregoing loft angle θ, as shown in FIG. 2, is an angle which a plane P forms with the face plane 4, when a golf club head 3 is placed on a standard plane B according to lie angle, the plane P including the shaft axis and orthogonal to the standard plane B is supposed, and the face plane 4 is turned to targeted direction orthogonal to the plane P. This loft angle θ is measured at the position of a sweet spot of the face plane 4. The sweet spot is an intersecting point g, at which a perpendicular drawn from the center of gravity G of the golf club head 3 to the face plane 4 intersects the face plane 4. Specifically, in either case that the face plane 4 is a plane or a curved surface, the loft angle θ is specified by setting the sweet spot as a contact point.

Measurement of the loft angle θ can be performed by use of measuring device such as a golf club head gauge manufactured by Sheng Feng Company (Taiwan), a golf club angle measurement apparatus manufactured by Golf Garage, a golf club gauge manufactured by Golfsmith and the like. These devices may be conventional ones and is not limited particularly in the present invention.

This measurement of the loft angle θ may be performed not only in a state of a golf club but also in a state that a shaft pin is inserted in a simple golf club head. Numerical value of the loft angle θ measured in a simple golf club head is substantially the same as a value of the loft angle θ obtained at the measurement of a golf club itself.

Figure 3:
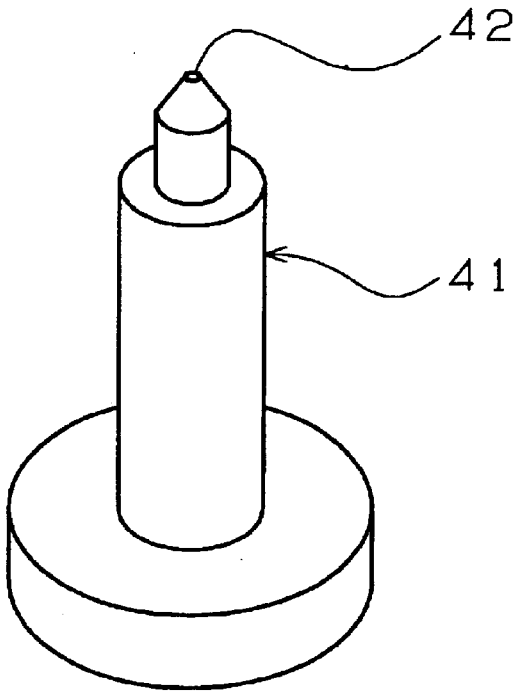
FIG. 3 is a perspective view showing a device for measuring the center of gravity of a golf club head.
Figure 4:
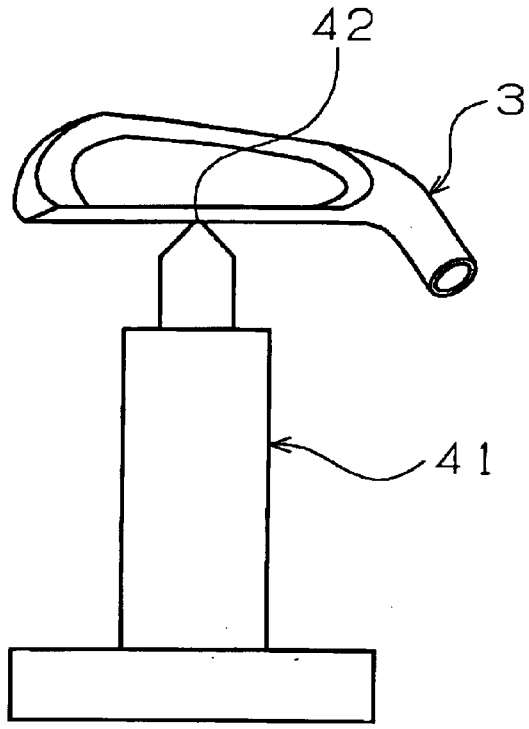
FIG. 4 shows a method to measure the center of gravity of a golf club head and is a side view showing a state that a golf club head is placed on a device for measuring the center of gravity.
Figure 5A:
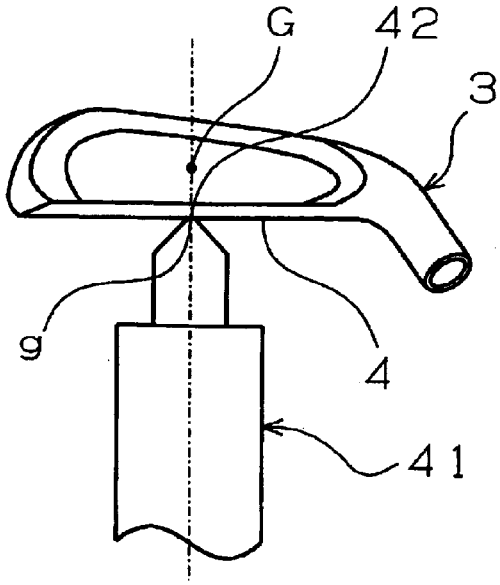
FIGS. 5(*a*) and 5(*b*) show a method to measure the center of gravity of a golf club head.
Figure 5B:
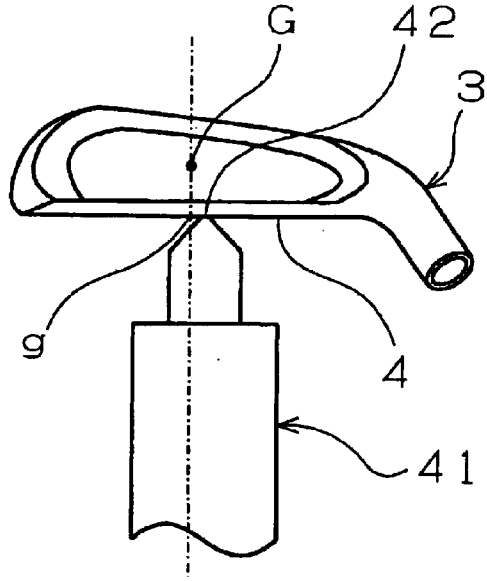

The intersecting point g on the face plane 4 indicating the position of the foregoing sweet spot is obtained by use of a measuring device of the center of gravity 41 as shown in FIG. 3. The measuring device of the center of gravity 41 has a supporting portion 42 to support an object to be measured at the top area and this supporting portion 42 can specify a position of the object, which may support the object in balance. Specifically, a measuring method of the center of gravity, as shown in FIG. 4, is to place a golf club head 3 on the supporting portion 42 and find a balanced position where the golf club head is not dropped even when holding by hand is released. Specifically, as shown in FIG. 5(*a*), when the point g is included in contact point of the face plane 4 and the supporting portion 42, the golf club head 3 placed on the supporting portion 42 is not dropped when holding by hand is released, but, as shown in FIG. 5(*b*), the point g is not included in contact point of the face plane 4 and the supporting portion 42, the golf club head 3 placed on the supporting portion 42 is dropped when holding by hand is released. Using this phenomenon, the point g is obtained.

The supporting portion 42 has preferably a shape of a plane support or supports by three points or more. Further, the area of the supporting portion 42 is preferably 15 $mm^2$ or less. The lowest limit is not specified as far as a golf club head 3 can be supported. The area of the supporting portion 42 is indicated in the area of plane portion when it is a plane and indicated in the area of a figure formed by connecting the points when it is a shape of supports by three points or more. The area of the supporting portion 42 is determined in the foregoing range, and the point g can be obtained more exactly.

Figure 6:
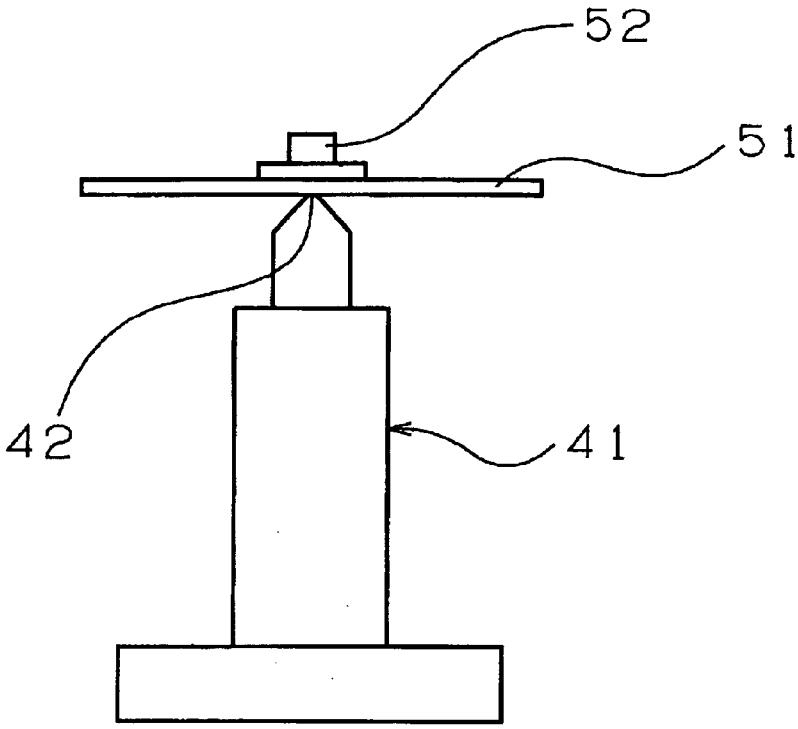
FIG. 6 shows a method to confirm a degree of horizontal level of a support of a device for measuring the center of gravity and is a side view showing a state that a level vial is placed on the device for measuring the center of gravity.

A plane supported by the supporting portion 42 is preferably horizontal or almost horizontal. Here, almost horizontal means that gradient to horizontal plane is within 2 degree, preferably within 1 degree. Whether it is horizontal or almost horizontal, or not, can be confirmed and be adjusted by placing a plane plate 51 on the supporting portion 42 and thus supporting the plane plate, then placing a level 52 on the plane plate 51 as shown, in FIG. 6, for example. By determining the gradient within the foregoing range, the point g can be obtained more exactly.

Here, placing according to lie angle means a state that a gap between a round of a sole surface of the golf club head 3 and the standard plane is almost equal at an edge of toe side of the sole surface and an edge of heel side. When the round of the sole surface is not clear, it is determined by placing the golf club head so that score lines are parallel to the standard plane. When the parallel to the standard plane can not be judged in the case that the round of the sole surface is not clear and in addition the score lines are not straight lines and the like, it is determined by using a formula, lie angle (degree)=(100−club length (inches)). For example, when the golf club length is 36 inches, the lie angle is 100−36=64 degree.

The club length is measured in accordance with Traditional Standard Measuring Method, which is standardized by Japan Golf Goods Association. Specifically, it is length from a contact point of the sole surface and a back portion of a neck of a golf club head to a grip end (round portion of a cap is not included). As a measuring device, Club Measure II manufactured by Kamoshita Seikosho Co. is included.

In the foregoing golf club set, regarding the golf clubs having the loft angles in a range of 16 degree to 41 degree, a ratio of a frequency f1 (cpm) per unit time, the frequency f1 being measured by vibrating a tip portion of a golf club shaft 1 constituting each of the golf clubs in a state that a rear end portion of the golf club shaft 1 is fastened, and a frequency f2 (cpm) per unit time, the frequency f2 being measured by vibrating the rear end portion of the golf club shaft in a state that the tip portion of the golf club shaft 1 is fastened, is varied almost linearly corresponding to order of the club number or order of size of the loft angle θ.

Further, in the foregoing golf club set, regarding the golf clubs having the loft angles θ in a range of 16 degree to 41 degree, a sum of the frequency f1 (cpm) per unit time, the frequency f1 being measured by vibrating a tip portion of a golf club shaft 1 constituting each of the golf clubs in a state that a rear end portion of the golf club shaft 1 is fastened, and a frequency f2 (cpm) per unit time, the frequency f2 being measured by vibrating the rear end portion of the golf club shaft 1 in a state that the tip portion of the golf club shaft 1 is fastened, is varied almost linearly corresponding to order of the club number or order of size of the loft angle θ.

A method to adjust the size of the ratio of frequencies among the club numbers is not limited specifically, and, for example, a method by adjusting cutting length at the tip portion or the rear end portion of a shaft material is included. For example, when a simple shaft material having a length of 1000 mm is cut into 960 mm to fabricate the golf club shaft and the golf club is fabricated by using the golf club shaft, there is difference in the ratio of frequencies and the sum of frequencies between the case that 40 mm of the rear end portion of the shaft material is cut and the case that 40 mm of the tip portion of the shaft material is cut. By using this fact, it is possible to adjust the sizes of the ratio and the sum of frequencies among the club numbers. Of course at the stage of designing golf club shafts, the sizes of the ratio and the sum of frequencies may be adjusted by determining flexural rigidity and the like among the club numbers.

Figure 7:
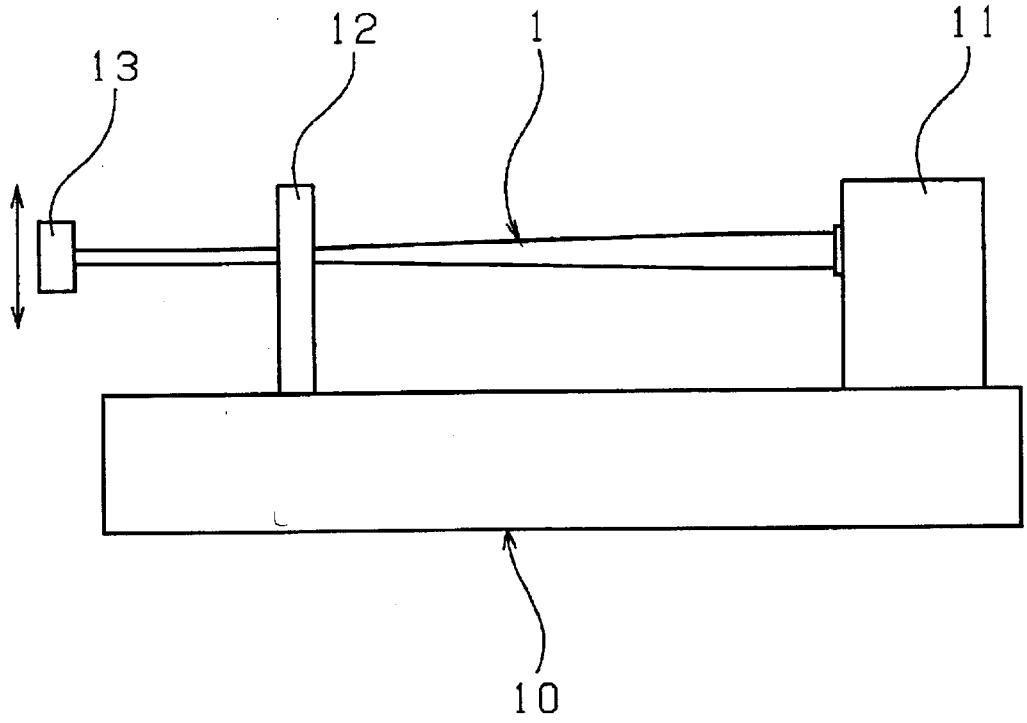
FIG. 7 is a side view of a device of measuring a frequency to explain a method to measure a frequency in a state that a rear end portion of a golf club shaft is fastened.
Figure 8:
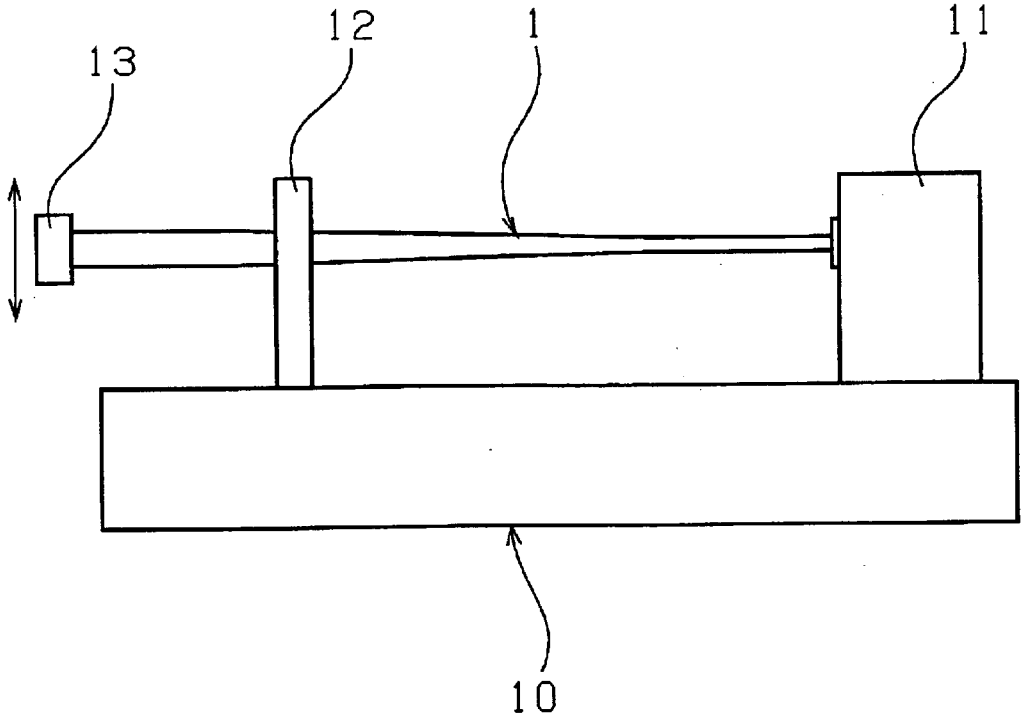
FIG. 8 is a side view of a device of measuring frequency to explain a method to measure a frequency in a state that a tip portion of a golf club shaft is fastened.

Next, a method to measure a frequency of a golf club shaft is described. The frequency is measured by use of a device of measuring a frequency 10 as shown in FIG. 7 and FIG. 8. The device of measuring a frequency 10 comprises a chuck 11 to fasten one of the ends of a golf club shaft 1 of the golf club and a measuring portion 12 where a frequency of the other end of a golf club shat 1 is measured by use of a photo sensor. Such a device of measuring frequencies may be conventional one available in the market, for example, Club Timing Harmonizer (manufactured by Fujikura Rubber Industry Co.) and the like are exemplified.

Using the foregoing device 10 of measuring frequencies, as shown in FIG. 7, the rear end of a golf club shaft 1 is fastened to a chuck portion 11 and at the same time a weight 13 is loaded on the tip portion of the golf club shaft 1. Then the tip portion of the golf club shaft 1 is vibrated in the vertical direction from the foregoing state and the frequency f1 (cpm) per 1 minute of the golf club shaft 1 is measured. Further, as shown in FIG. 8, the tip portion of the golf club shaft 1 is fastened to the chuck portion 11 and at the same time the weight 13 is loaded on the rear end portion of the golf club shaft 1. Then the rear end portion of the golf club shaft 1 is vibrated in the vertical direction from the foregoing state and the frequency f2 (cpm) per 1 minute of the golf club shaft 1 is measured. Then a ratio of both frequencies (f1/f2) is obtained. By obtaining this ratio of frequencies (f1/f2), bending performance of a golf club shaft which affects height of trajectory of a hit ball by a golf club, is obtained. Further, a sum of both frequencies (f1+f2) is obtained. By obtaining this sum of frequencies (f1+f2), variation of frequency value caused by a distribution of rigidity of the golf club shaft 1 is offset and effective flexibility of a golf club shaft is obtained.

Figure 9:
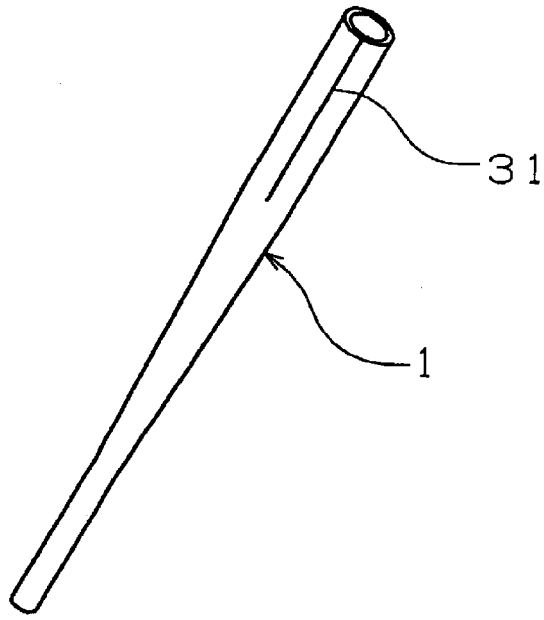
FIG. 9 is a perspective view showing a golf club shaft having a reference line.
Figure 10:
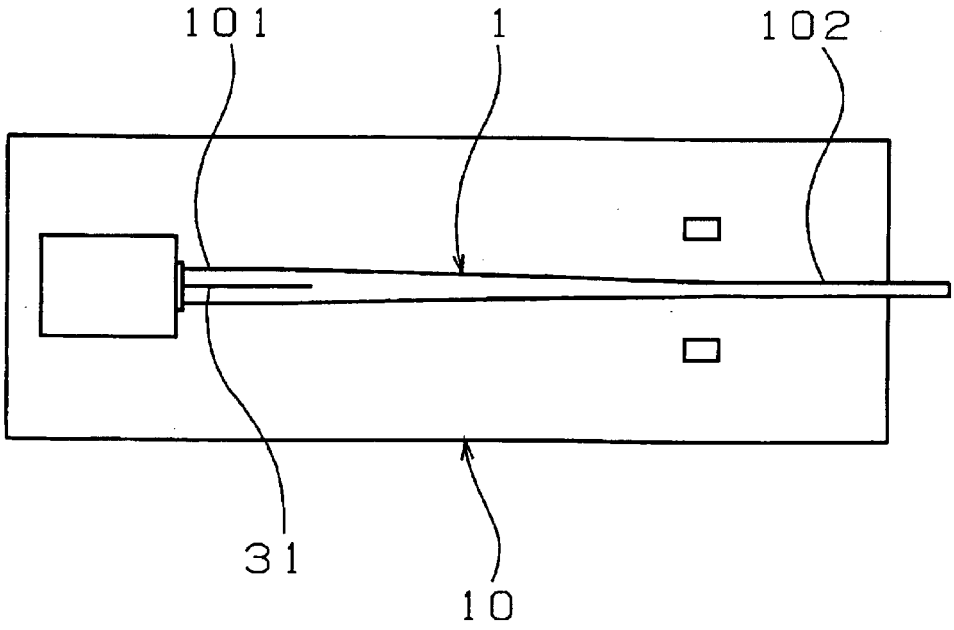
FIG. 10 is a plane view showing a state that a rear portion of the golf club shaft of FIG. 9 is fastened to the device of measuring a frequency.
Figure 11:
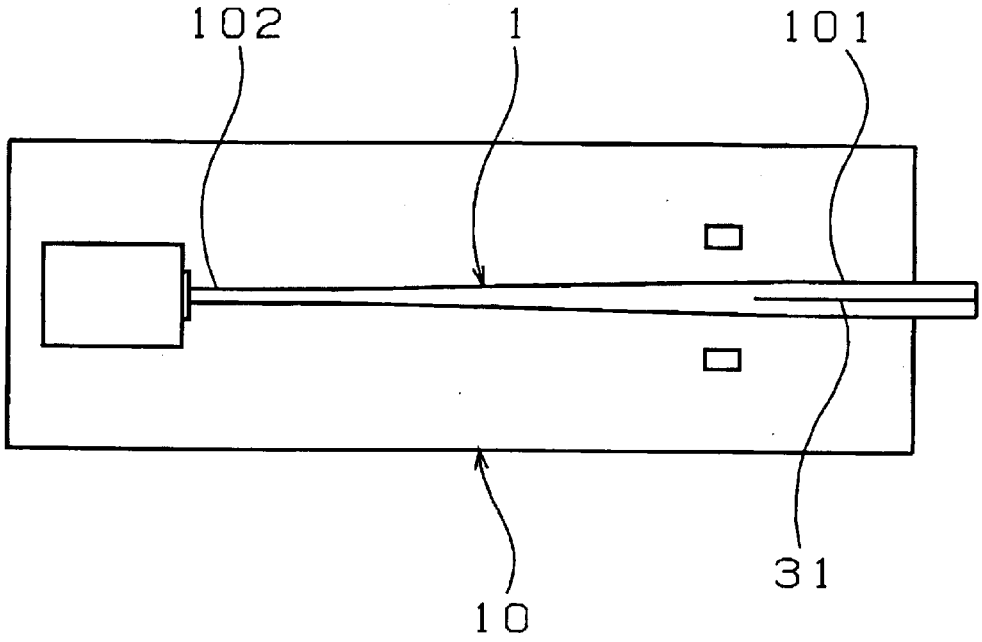
FIG. 11 is a plane view showing a state that a tip portion of the golf club shaft of FIG. 9 is fastened to the device of measuring a frequency.

In a method to measure frequencies in accordance with the present invention, a position in circumference direction where a golf club shaft is fastened to a device of measuring frequencies, is preferably kept constant or almost constant both in fastening a rear end portion and fastening a tip portion. It is easily kept constant by marking a line 31 on the golf club shaft as shown in FIG. 9 and by facing line 31 toward the same direction or almost same direction with respect to the device of measuring frequencies both in the case of fastening the rear end portion 101 as shown in FIG. 10 and in the case of fastening the tip portion 102 as shown in FIG. 11. The foregoing almost constant means that line 31 shown in FIG. 10 and FIG. 11 is deviated in circumference direction within 20 degree from the position facing right above, preferably within 10 degree, more preferably within 5 degree. Since there is a possibility that frequency value of a golf club shaft varies a bit depending on circumference directions due to variation of golf club shaft itself as a product, it is preferable to measure frequencies at the constant circumference direction or almost constant circumference direction as mentioned before.

Figure 12:
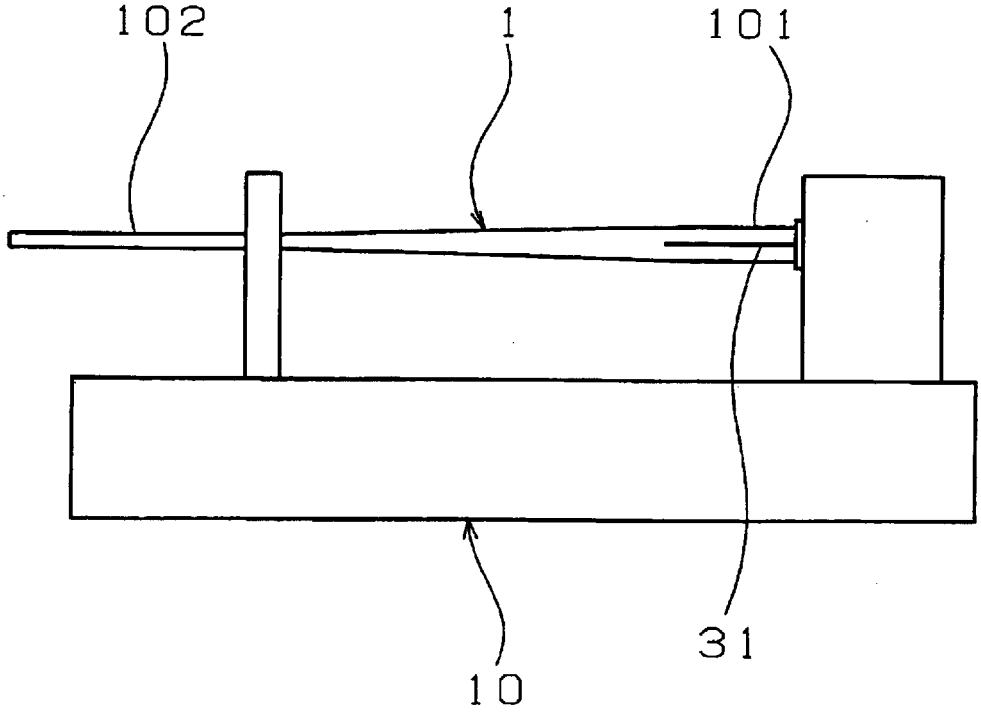
FIG. 12 is a side view showing a state that the rear portion of the golf club shaft of FIG. 9 is fastened to the device of measuring a frequency.
Figure 13:
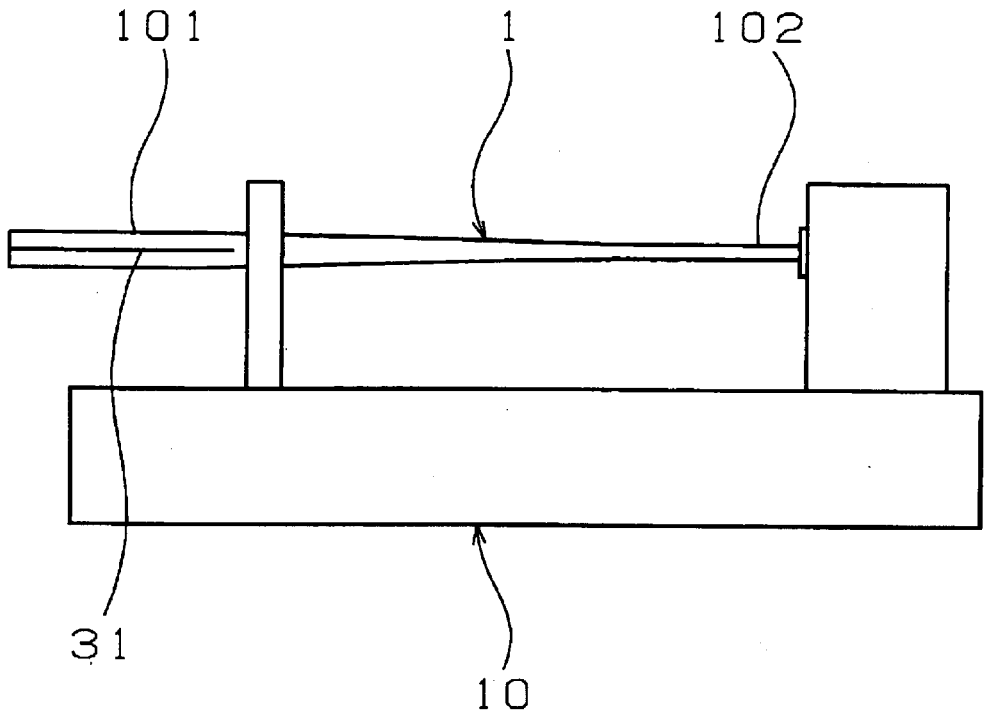
FIG. 13 is a side view showing a state of the tip portion of the golf club shaft of FIG. 9 is fastened to the device of measuring a frequency.
Figure 14:
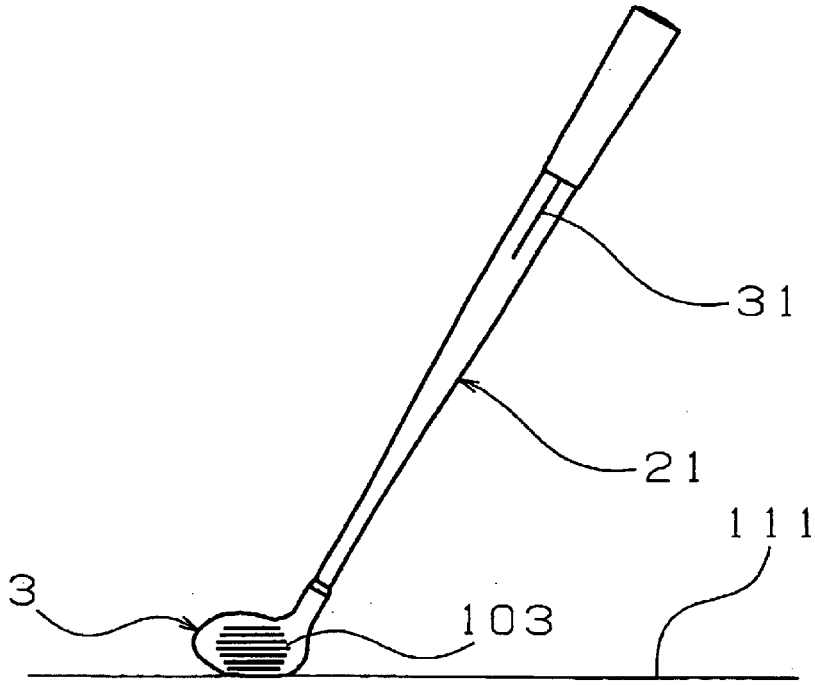
FIG. 14 is a front view showing a golf club using the golf club shaft of FIG. 9.

As mentioned before, since frequency values possibly vary a bit in the circumference direction of a golf club shaft itself, there may be some difference in the ratio and the sum of frequencies between the case of measuring a golf club shaft as shown in FIG. 10 and FIG. 11 and the case of measuring the same golf club shaft rotating 90 degree in the circumference direction from the each position of FIG. 10 and FIG. 11 as shown in FIG. 12 and FIG. 13. Then, when a golf club shaft is fabricated to be a golf club, fastened position of golf club shafts is preferably kept constant. For more details, a golf club shaft shown in FIG. 9, which was measured with fastening methods as shown in FIG. 10 and FIG. 11, is preferably fastened at such a position that line 31 faces to the front or to almost front, in a front view which the golf club head 3 of a golf club 21 is placed according to the lie angle in a manner as face portion 103 is facing to the front as shown in FIG. 14. To reflecting measured value of a golf club shaft to a golf club, vibration direction of a golf club shaft 1, which is measured with a device of measuring frequencies 10 shown in FIG. 15, most preferably conforms to main bending direction of a golf club 21 during actual swing shown in FIG. 16. For that, it is understood that a golf club shaft 1, which was measured with fastening methods as shown in FIG. 10 and FIG. 11, should be fabricated to be a golf club 21 by fastening at the position shown in FIG. 14. The foregoing position facing to almost front means that deflection in circumference direction from the position that line 31 in FIG. 14 faces to the front, is within 15 degree, preferably within 10 degree, more preferably within 5 degree, further more preferably within 3 degree.

Figure 17:
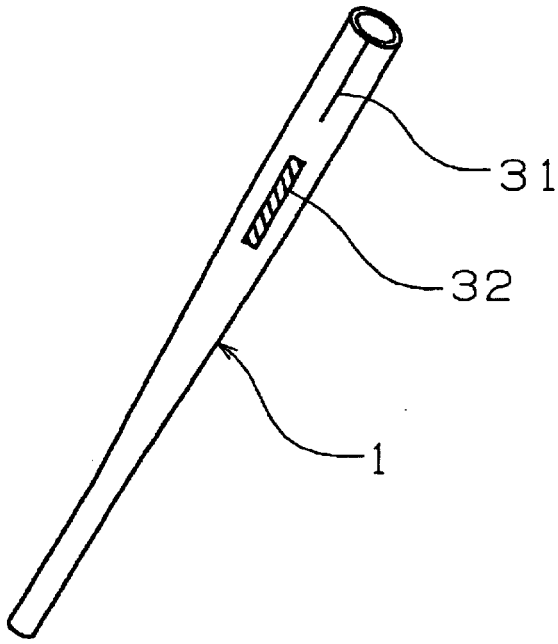
FIG. 17 is a perspective view showing a golf club shaft having a reference line and a logo mark added thereto in coaxial relation to each other.
Figure 18:
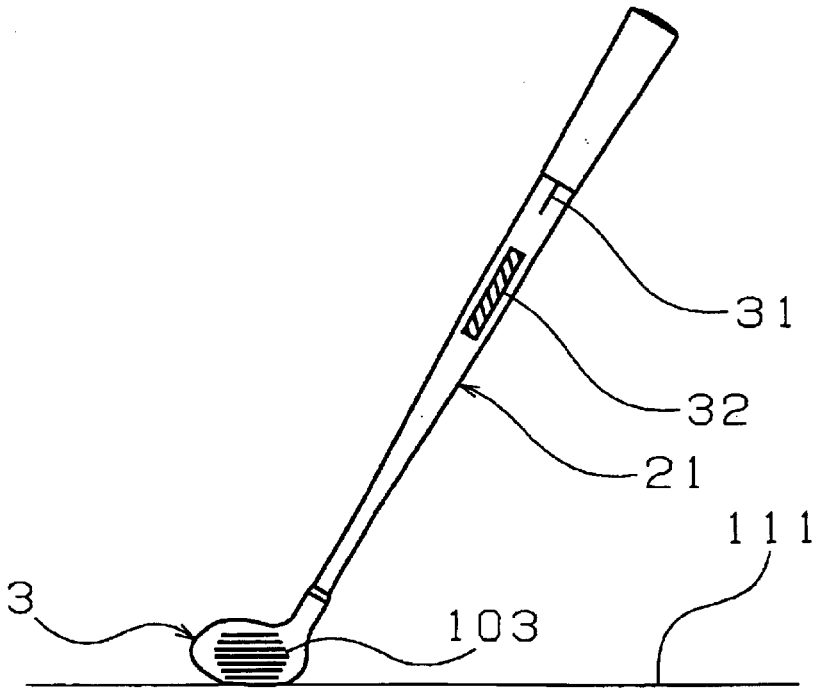
FIG. 18 is a front view showing a golf club using the golf club shaft of FIG. 17.
Figure 19:
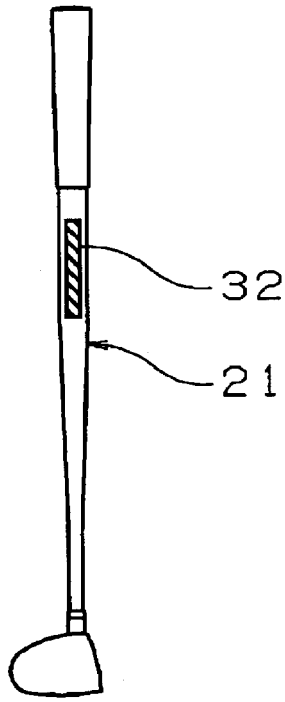
FIG. 19 is a side view showing a golf club using a golf club shaft of FIG. 20 from a toe side.
Figure 20:
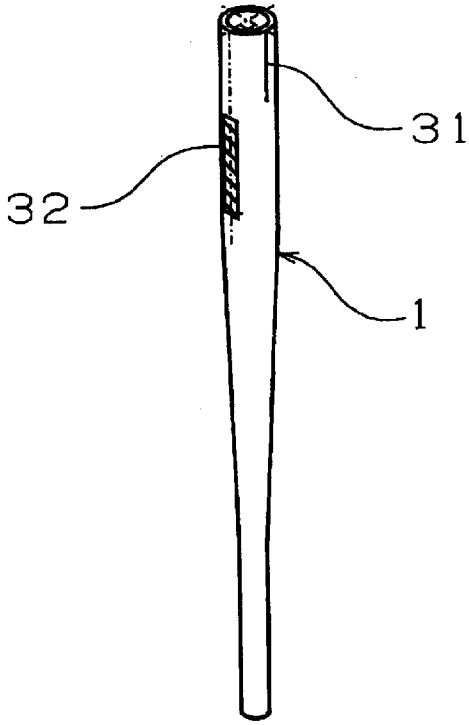
FIG. 20 is a perspective view showing the golf club shaft having a reference line and a logo mark added on different positions in a circumferential direction.

Further, in a simple golf club shaft, a logo mark 32 is marked by means of printing, etc., on the golf club shaft 1 in the same axle with line 31, as shown in FIG. 17 and the golf club shaft 1 is preferably fastened at the position that line 31 and logo mark 32 face to the front or to almost front in a front view which a golf club head of a golf club 21 is placed on plane 111 according to the lie angle, in a manner as face portion 103 is facing to the front as shown in FIG. 18. Moreover, as shown in FIG. 19, when the logo mark 32 is provided to the front in a view of golf club 21 from toe side, line 31 may be placed at the position deflecting 90 degree in circumference direction from the position of logo mark 32 at the stage of being a golf club shaft, as shown in FIG. 20.

Figure 15:
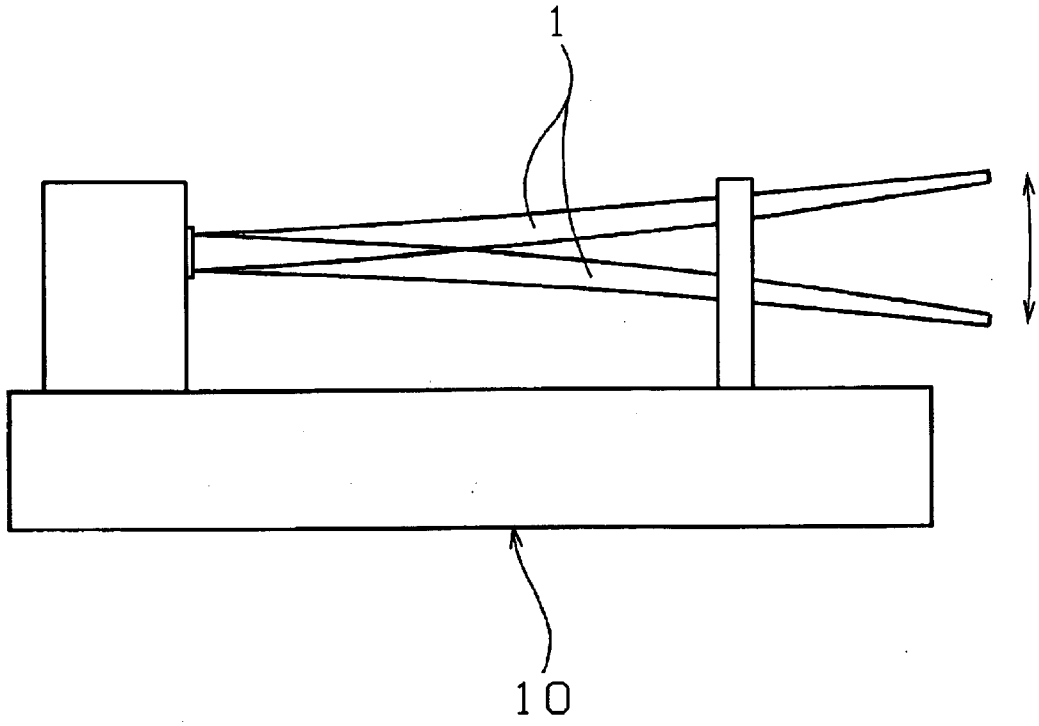
FIG. 15 is a side view showing a shaft vibration direction in the device of measuring a frequency.
Figure 16:
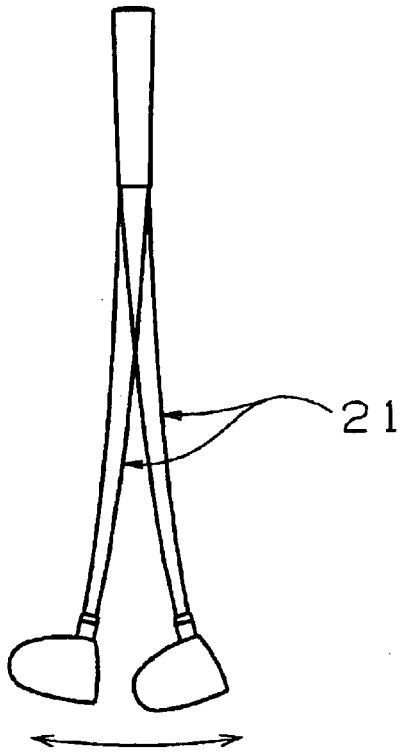
FIG. 16 is a side view showing a main direction of a shaft bending during swinging a golf club.
Figure 21:
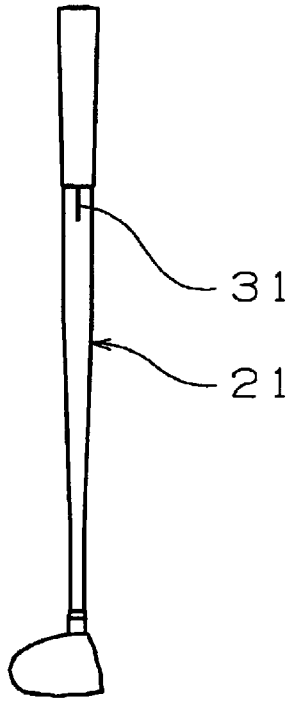
FIG. 21 is a side view showing another golf club using the golf club shaft of FIG. 9 from a toe side.
Figure 22:
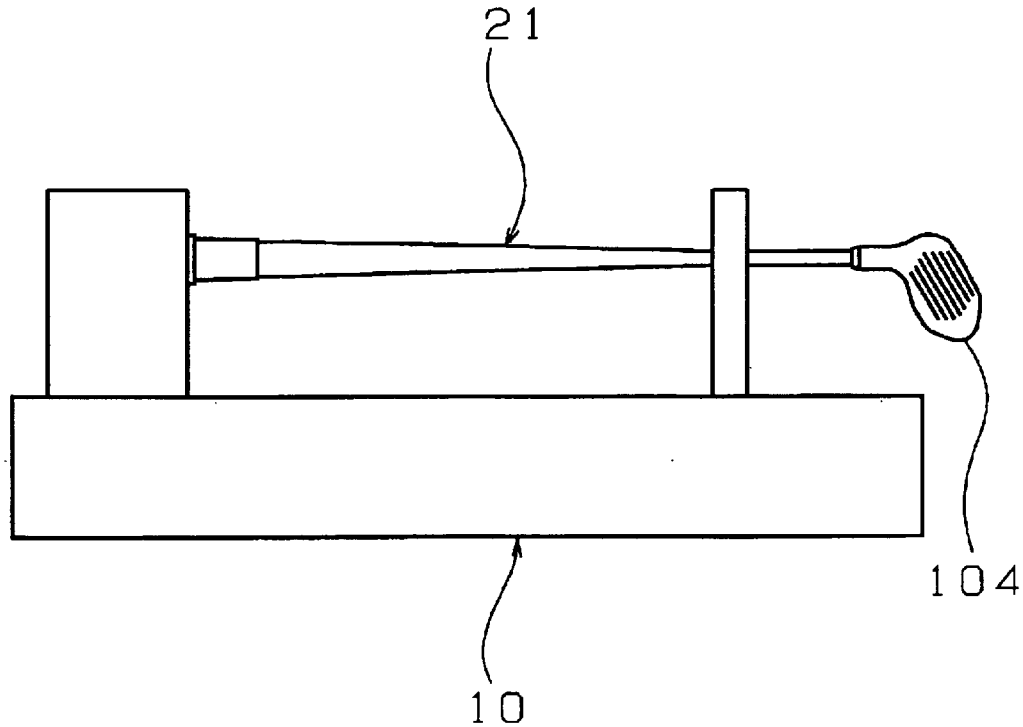
FIG. 22 is a side view showing a state of a rear end portion of a golf club fastened to a device of measuring a frequency used for a conventional evaluation method of a golf club.

As mentioned above, it was described that in measuring frequencies in FIG. 15, vibrating direction of a golf club shaft most preferably accords to main bending direction of the golf club during actual swing in FIG. 16. For example, a golf club shaft shown in FIG. 9, which was measured with fastening methods as shown in FIG. 10 and FIG. 11, is conceivably assembled to be a golf club as shown in FIG. 21. Specifically, vibrating direction of a golf club shaft is deflected at 90 degree from main bending direction of the golf club during actual swing. It is surely most preferable that vibrating direction of a golf club shaft accords to the main bending direction of the golf club during actual swing. But, to determine vibrating direction of a golf club shaft with a constant relation with main vending direction of the golf club during actual swing, is more preferable than to determine without a constant relation. In an actual conventional method to measure frequencies, as shown in FIG. 22, the measurement is mostly carried out in a manner of fastening a golf club 21 as toe portion 104 of the golf club 21 turns down. This means an example that vibration direction of a golf shaft is deflected at 90 degree from main bending direction of a golf club during actual swing.

Needless to say, line 31 used for determining direction in measuring frequencies as mentioned above may be hidden under a grip in a completed golf club. Line 31 may be used as a mark in measuring frequencies, and whether line 31 appears or is hidden in a golf club may be decided appropriately from a viewpoint of designing.

Figure 23:
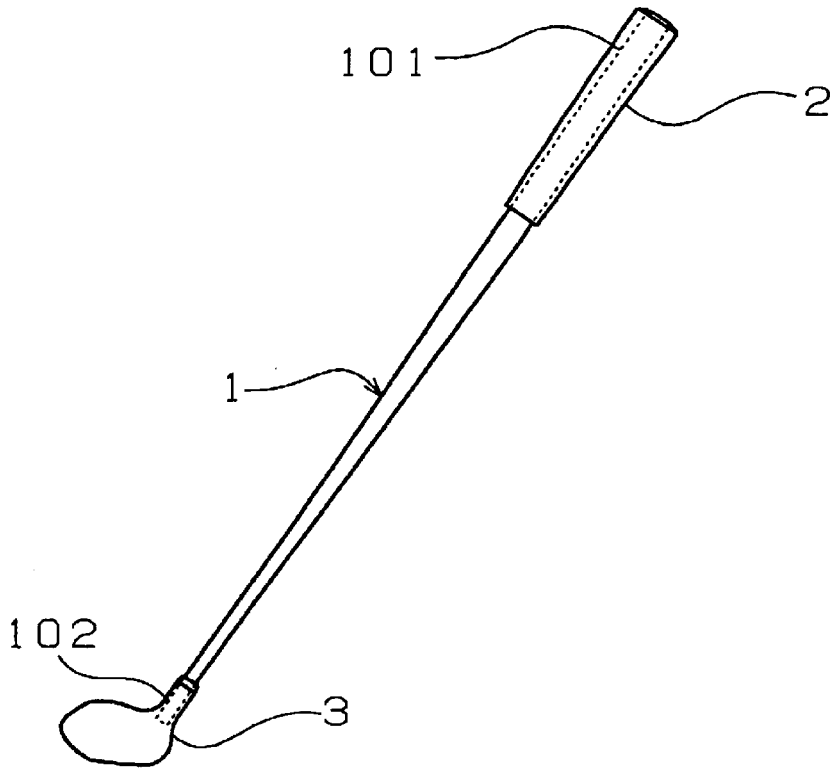
FIG. 23 is a front view showing a golf club having a grip attached to a rear end portion of a golf club shaft according to the present invention.
Figure 24:
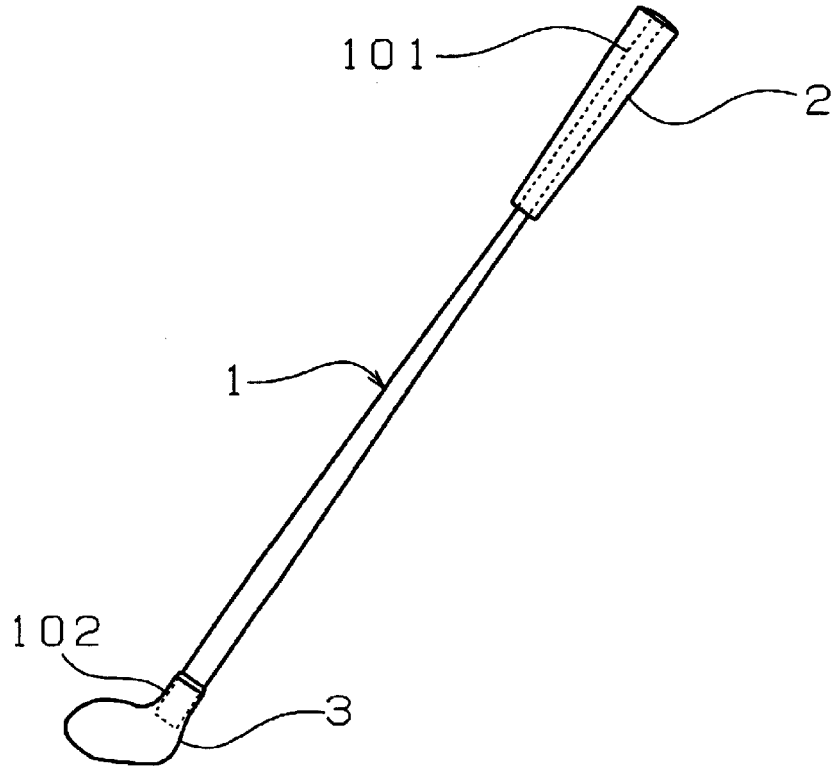
FIG. 24 is a front view showing an example of a golf club, where a tip portion of a golf club shaft is thicker than a rear end portion, according to the present invention.

A tip portion of a golf club shaft in accordance with the present invention means an end portion where a golf club head is assembled, and a rear end portion means an end portion where a grip or a grip portion is assembled. In a golf club shown in FIG. 23, the end portion where grip 2 is assembled is denoted by a rear end portion 101 and the end portion where golf club head 3 is assembled, is denoted by tip portion 102. In typical golf club shaft 1, the rear end portion 101 where the grip 2 is assembled has bigger diameter than tip portion 102 where golf club head 3 is assembled. But as shown in FIG. 24, a golf club in which tip portion 102 where golf club head 3 is assembled has bigger diameter than rear end portion 101 where grip 2 is assembled, is conceivable.

Figure 25:
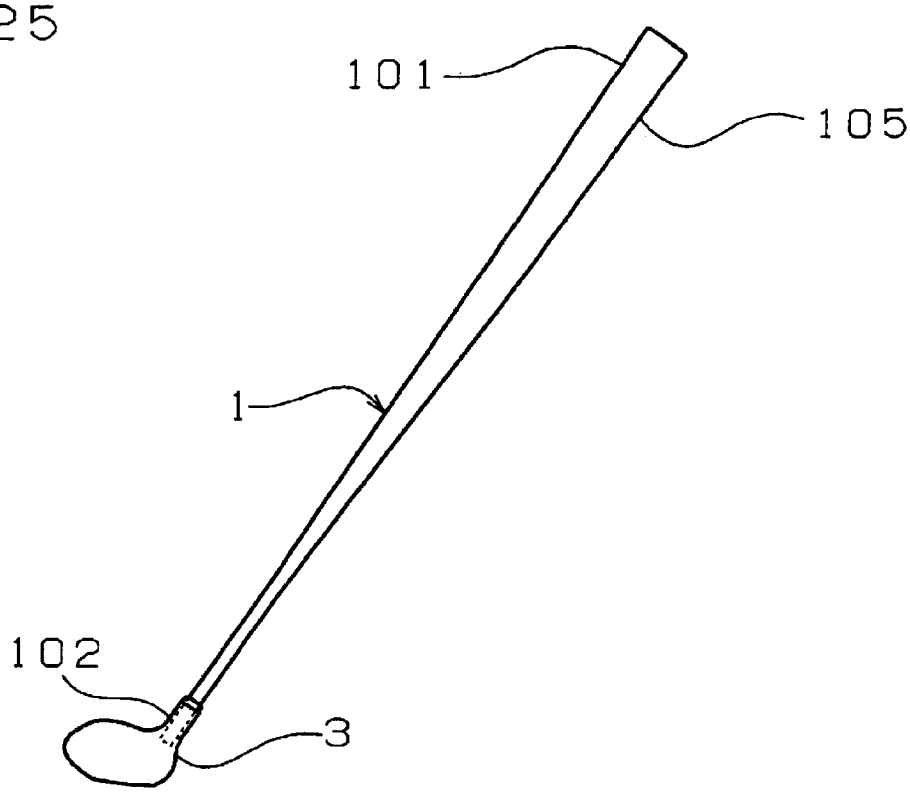
FIG. 25 is a front view showing a golf club, where a portion of a golf club shaft constitutes a grip portion, according to the present invention.

Further a golf club where a golf club shaft 1 becomes partly grip portion 105 may exist as shown in FIG. 25. In this case, end portion to become grip portion 105 is denoted by rear end portion 101 and the other end portion where golf club head 3 is assembled is denoted by tip portion 102.

In the foregoing measurement of frequencies, the length to fasten a golf club shaft 1 is 178 mm, but, when it is in a range of 177.5 mm to 178.5 mm, frequencies obtained are substantially same. Accordingly, those are included in the present invention. Moreover, the mass of the weight 13 is set to 200 g, but, when the mass is in a range of 199.5 g to 200.5 g, frequencies obtained are substantially same. Accordingly, those are included in the present invention. Further, the loading length of weight 13 is set to 30 mm, but, when it is in a range of 29.5 mm to 30.5 mm, frequencies obtained are substantially same. Accordingly, those are included in the present invention.

Figure 26A:
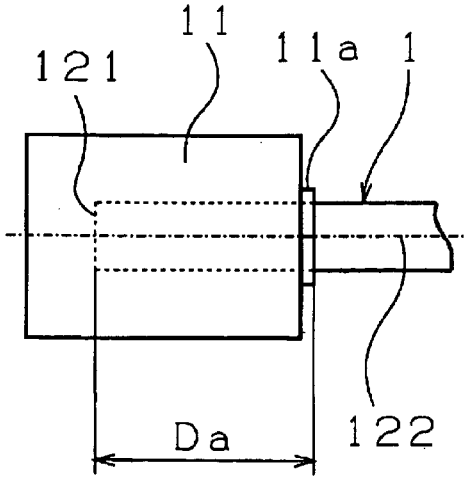
FIGS. 26(*a*) and 26(*b*) are plane views, each thereof showing a portion of a golf club shaft fastened to a device of measuring a frequency.
Figure 26B:
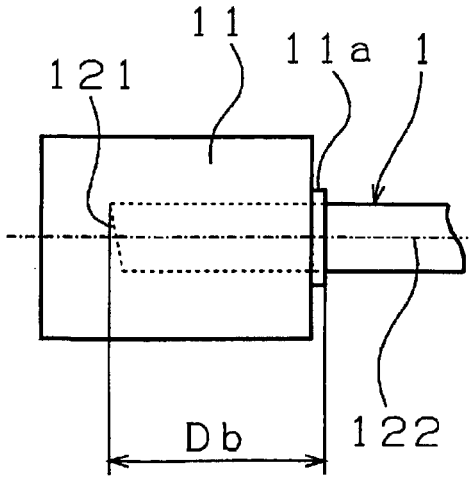

Fastening length in the present invention is a distance (Da) from the end portion 121 to chuck 11*a* of chuck portion 11 when end surface 121 of a golf club shaft 1 is vertical to a golf club shaft axis 122 as shown in FIG. 26(*a*). Further, as shown in FIG. 26(*b*), when the end surface 121 is not vertical to the golf club shaft axis 122, fastening length is a distance (Db) from the most projected position of the end surface 121 to chuck 11*a* of chuck portion 11. Moreover, a fastening method may be a method to fasten by nipping from the upper and lower sides, a method to fasten with a drill chuck and the like, and the method is not limited as far as golf club shafts are fastened firmly.

The weight is one which can be firmly fixed on a golf club shaft and it may have cylindrical, rectangular, polygonal pillar shape and the like, but it is not particularly limited. Such sticky material having some weight as lead tape may be wounded on the golf club shaft. Preferably the center of gravity of the weight is located close to the golf club shaft axis. The center of gravity is preferably located numerically within 5 mm from the golf club axis in a fasten state of a golf club shaft.

Figure 27:
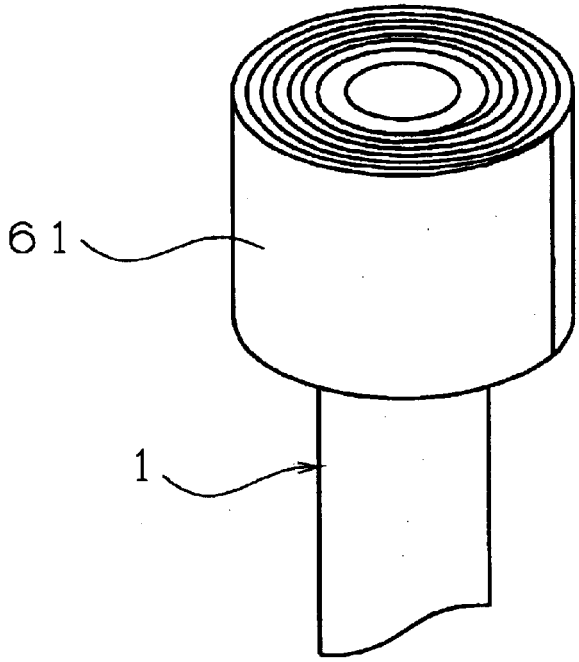
FIG. 27 is a perspective view showing an example of a weight used in the present invention.
Figure 28A:
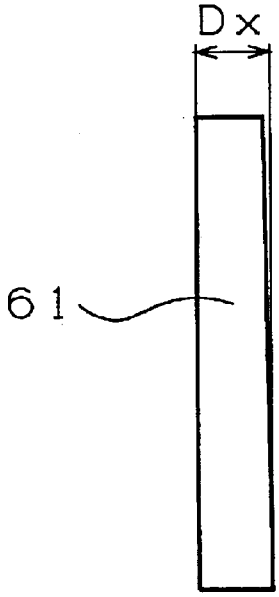
FIGS. 28(*a*) and 28(*b*) are respectively development and plane views, each thereof showing the weight of FIG. 27.
Figure 28B:
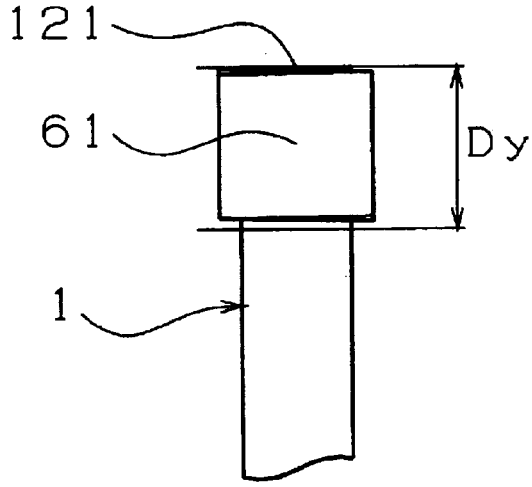

As a structure of the weight, a drill chuck structure and the like may be conceivable to fasten golf club shafts having different diameter firmly. As other examples of the weight, as shown in FIG. 27, a weight tape 61 composed of lead, etc., may be conceivably wounded around a golf club shaft 1 to be fastened. The material of the weight tape is not particularly limited, but materials which can be fastened by winding around a golf club shaft are preferable. Structures of the weight tape are generally a plurality of layers composed of weight layers and sticky layers such as double-faced sticky tape. Shape of the tape is preferably rectangular same as typical tapes having small variation in width. Variation in width to longitudinal direction is preferably within 1 mm. When maximum width in longitudinal direction of weight tape 61 is denoted by Dx as shown in FIG. 28(*a*), all lead tapes are preferably wounded within distance Dy (Dy≧Dx) from end surface 121, as shown in FIG. 28(*b*), satisfying a formula Dy≦=Dx+5 mm, preferably satisfying a formula Dy≦Dx+3 mm.

In the foregoing golf club set, golf clubs having loft angles in a range of 16 degree to 41 degree is denoted by continuous natural number X starting from 1 in order of increasing loft angle from the lowest, and, in addition, the foregoing ratio of frequencies is denoted by Z. When the ratio Z of frequencies corresponding to natural number X of each golf clubs is plotted on coordinate axis X-Z, plots of all of the golf clubs having loft angle θ in a range of 16 degree to 41 degree become a straight line or almost straight line.

Figure 29:
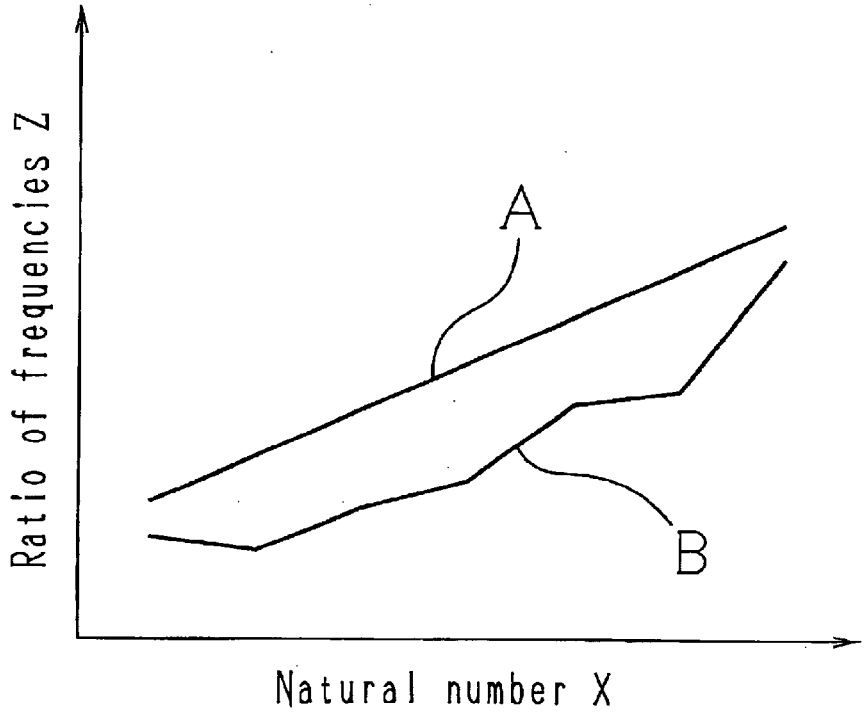
FIG. 29 is a graph showing relations between natural numbers X and ratios Z of frequencies according to the present invention.

FIG. 29 is a graph showing a relation of natural number X corresponding to an order of the club number and ratio Z of frequencies. A shows a relation in an ideal golf club set in accordance with the present invention, and B shows a relation in a conventional golf club set. Specifically, in a conventional golf club set, the club number has no constant correlation with ratio of frequencies. However, since the club number has a constant correlation with ratio of frequencies in an ideal golf club set in accordance with the present invention, harmonized height of trajectory of a hit ball through a whole golf club set can be obtained.

More concretely, in golf clubs having loft angles θ in a range of 16 degree to 41 degree, when a distribution of ratio Z of frequencies to the natural number X is fitted on a regression line, the ratio Z of frequencies is determined so that estimated error to the regression line is 0.05 or less. What the estimated error is 0.05 or less means that the error between estimated value calculated by inputting natural number X, which is determined corresponding to the club number, and by inputting the ratio Z of frequencies in a function of the regression line and the ratio Z of frequencies, is 0.05 or less in the absolute value, that is, it indicates −0.05 or more and +0.05 or less. In this case estimated error is preferably 0.03 or less, more preferably 0.015 or less.

Slope of the foregoing regression line is not particularly limited, but by limiting the scope of the value, it is possible to constitute a golf club set meeting golfer's preference.

When the foregoing slope of a regression line is determined as −0.01 or less, preferably −0.3 or more and −0.01 or less, more preferably −0.25 or more and −0.02 or less, a golf club set in which height of trajectory of a hit ball by golf clubs having comparatively smaller loft angle θ becomes higher, may be fabricated. These golf club sets may be mainly suitable to golfers who want to get sufficient flying distance by heightening trajectory of a hit ball by golf clubs having smaller loft angle θ.

When the foregoing slope of a regression line is determined as −0.01 or more, preferably −0.01 or more and 0.2 or less, more preferably 0 or more and 0.15 or less, a golf club set in which height of trajectory of a hit ball by golf clubs having comparatively smaller loft angle θ becomes lower, may be fabricated. These golf club sets may be mainly suitable for golfers who want to get certain direction by lowering trajectory of a hit ball by golf clubs having smaller loft angle θ.

Effect of the foregoing slope of a regression line shows just general trends. Therefore, golfers can select a golf club set having specified value as a slope of the foregoing regression line considering own skill level, preferable bending of golf club shafts, feeling, preferable strategy, preferable feeling of hitting a ball and the like.

Adding to varying ratio Z of frequencies to natural number X linearly as described above, it is preferable to vary the sum Y of frequencies to natural number X linearly, wherein a sum (f1+f2) of a frequency f1 obtained by measuring in a state that rear end portion of a golf club shaft is fastened and a frequency f2 obtained by measuring in a state that the tip portion of the golf club shaft is fastened, is denoted by Y (cpm).

Specifically, in golf clubs having loft angles θ in a range of 16 degree to 41 degree, when a distribution of the sum Y of frequencies to the natural number X is fitted on a regression line, the sum Y of frequencies is preferably determined so that estimated error to the regression line is 30 cpm or less, preferably 20 cpm or less, more preferably 10 cpm or less. By determining Y as foregoing relations, harmonized height of trajectory of a hit ball is obtained more exactly through a whole golf club set.

Moreover, when, in the foregoing golf club set, using loft angle θ instead of natural number X, ratio Z of frequencies corresponding to loft angle θ of each golf club is plotted on θ-Z coordinate, the plots for all of the golf clubs having loft angle θ in a range of 16 degree to 41 degree become a straight line or almost straight line.

Figure 30:
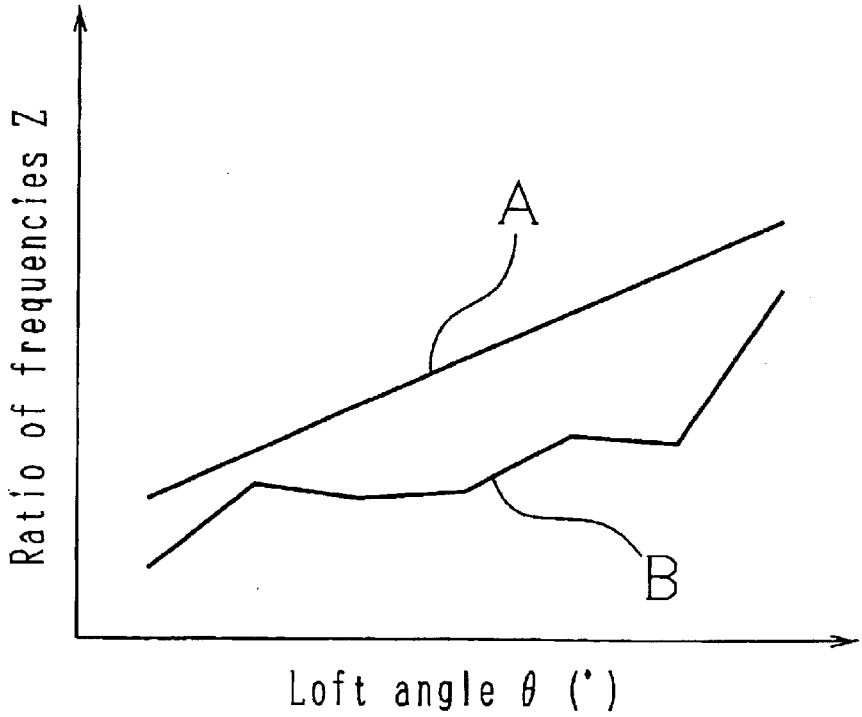
FIG. 30 is a graph showing relations between loft angles θ and the ratios Z of frequencies according to the present invention.

FIG. 30 is a graph showing a relation between loft angle θ and ratio Z of frequencies. A shows a relation in an ideal golf club set according to the present invention, and B shows a relation in conventional golf club set. Specifically, in a conventional golf club set, loft angle θ has no constant correlation with ratio of frequencies. However, since the loft angle θ has a constant correlation with ratio of frequencies in an ideal golf club set in accordance with the present invention, harmonized height of trajectory of a hit ball can be obtained through a whole golf club set.

More concretely, in golf clubs having loft angles θ in a range of 16 degree to 41 degree, when a distribution of ratio Z of frequencies to loft angle θ is fitted on a regression line, the ratio Z of frequencies is determined so that estimated error to the regression line is 0.05 or less. What the estimated error is 0.05 or less means that the error between estimated values calculated by inputting loft angle θ of the golf club and the ratio Z of frequencies in a function of the regression line and the ratio Z of frequencies, is 0.05 or less in the absolute value, that is, it indicates −0.05 or more and +0.05 or less. In this case estimated error is preferably 0.03 or less, more preferably 0.015 or less.

Slope of the foregoing regression line is not particularly limited, but, by limiting the scope of the value, it is possible to constitute a golf club set meeting golfer's preference.

When the foregoing slope of a regression line is determined as −0.0025 or less, preferably −0.075 or more and −0.0025 or less, more preferably −0.0625 or more and −0.005 or less, a golf club set in which height of trajectory of a hit ball by golf clubs having comparatively smaller loft angle θ becomes higher, may be fabricated. These golf club sets may be mainly suitable for golfers who want to get sufficient flying distance by heightening trajectory of a hit ball by golf clubs having smaller loft angle θ.

When the foregoing slope of a regression line is determined as −0.0025 or more, preferably −0.0025 or more and 0.05 or less, more preferably 0 or more and 0.0375 or less, a golf club set in which height of trajectory of a hit ball by golf clubs having comparatively smaller loft angle θ becomes lower, may be fabricated. These golf club sets may be mainly suitable for golfers who want to get certain direction by lowering trajectory of a hit ball by golf clubs having smaller loft angle θ.

Effect of the foregoing slope of a regression line shows just general trends. Therefore, golfers can select a golf club set having specified value as a slope of the foregoing regression line, considering own skill level, preferable bending of golf club shafts, feeling, preferable strategy, preferable feeling of hitting a ball and the like.

Adding to varying ratio Z of frequencies to a loft angle θ linearly as described above, it is preferable to vary the sum Y of frequencies to a loft angle θ linearly, wherein a sum (f1+f2) of a frequency f1 obtained by measuring in a state that a rear end portion of a golf club shaft is fastened and a frequency f2 obtained by measuring in a state that a tip portion of the golf club shaft is fastened, is denoted by Y (cpm).

Specifically, in golf clubs having loft angles θ in a range of 16 degree to 41 degree, when a distribution of the sum Y of frequencies to a loft angle θ is fitted on a regression line, the sum Y of frequencies is preferably determined so that estimated error to the regression line is 30 cpm or less, preferably 20 cpm or less, more preferably 10 cpm or less. By determining Y as foregoing relations, harmonized height of trajectory of a hit ball is obtained more exactly through a whole golf club set.

In the foregoing golf club set, golf club shafts to be assembled to golf clubs having loft angles in a range of 16 degree to 41 degree is denoted by continuous natural number X starting from 1 in order from the longest golf club shaft, and, in addition, the foregoing ratio of frequencies is denoted by Z. When the ratio Z of frequencies corresponding to natural number X of each golf club shaft is plotted on X-Z coordinate, plots of all of the golf club shafts to be assembled to golf clubs having loft angle θ in a range of 16 degree to 41 degree become a straight line or almost straight line.

In a golf club set, in general, the larger the club number is, the shorter shaft length the golf club has. Therefore, the relations between natural number X and ratio Z of frequencies in a golf club shaft set may be determined in the same way as the foregoing golf club set.

Moreover, when, in the foregoing golf club set, using golf club shaft length L instead of natural number X, ratio Z of frequencies corresponding to length L of each golf club shaft is plotted on L-Z coordinate, the plots for all of the golf club shafts to be assembled to golf clubs having loft angle θ in a range of 16 degree to 41 degree become a straight line or almost straight line.

Figure 31:
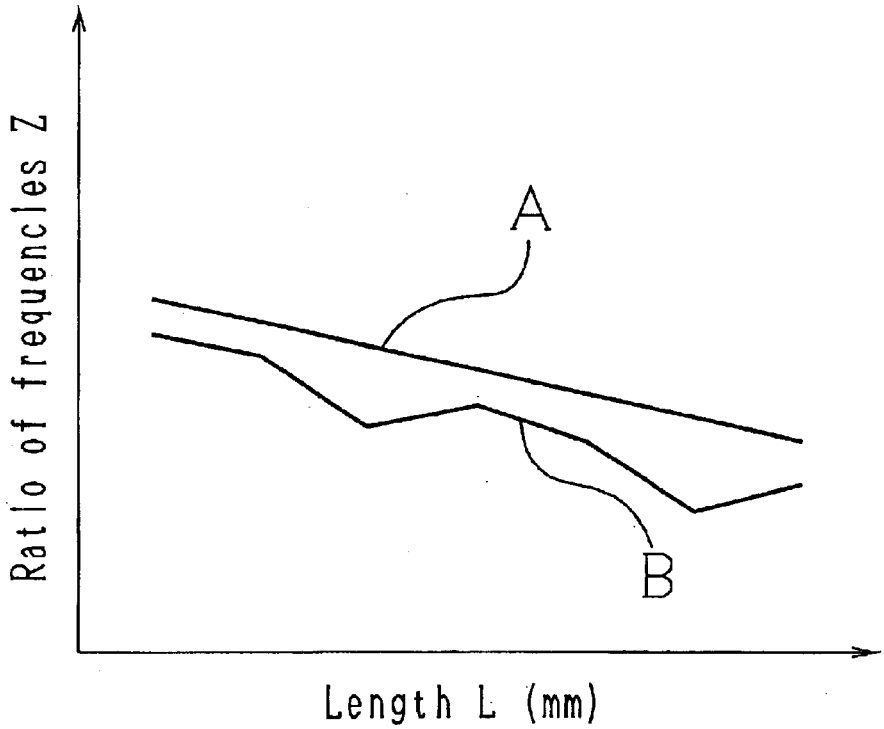
FIG. 31 is a graph showing relations between length L of golf club shafts and ratios Z of frequencies according to the present invention.

FIG. 31 is a graph showing a relation between golf club shaft length L and ratio Z of frequencies. A shows a relation in an ideal golf club set according to the present invention, and B shows a relation in conventional golf club set. Specifically, in a conventional golf club set, golf club shaft length has no constant correlation with ratio of frequencies. However, since golf club shaft length has a constant correlation with ratio of frequencies in an ideal golf club set in accordance with the present invention, harmonized height of trajectory of a hit ball can be obtained through a whole golf club set.

More concretely, in golf club shafts to be assembled to golf clubs having loft angles θ in a range of 16 degree to 41 degree, when a distribution of ratio Z of frequencies to golf club shaft length L is fitted on a regression line, the ratio Z of frequencies is determined so that estimated error to the regression line is 0.05 or less. What the estimated error is 0.05 or less means that the error between estimated value calculated by inputting golf club shaft length L and by inputting the ratio Z of frequencies in a function of the regression line and the ratio Z of frequencies, is 0.05 or less in the absolute value, that is, it indicates −0.05 or more and +0.05 or less. In this case, the estimated error is preferably 0.03 or less, more preferably 0.015 or less.

The above relationship can be maintained for golf club shafts to be assembled to golf clubs having loft angles θ out of the range of 16 degree to 41 degree. For example, the above relationship can be maintained for the entire golf club shaft set.

Slope of the foregoing regression line is not particularly limited, but, by limiting the scope of the value, it is possible to constitute a golf club set meeting golfer's preference.

When the foregoing slope of a regression line is determined as 0.00077 or more, preferably 0.00077 or more and 0.0231 or less, more preferably 0.00154 or more and 0.01925 or less, a golf club set in which height of trajectory of a hit ball by golf clubs having comparatively longer golf club shaft length L becomes higher, may be fabricated. These golf club sets may be mainly suitable for a type of golfers who want to get sufficient flying distance by heightening trajectory of a hit ball by golf clubs having longer golf club shaft length L.

When the foregoing slope of a regression line is determined as 0.00077 or less, preferably −0.0154 or more and 0.0077 or less, more preferably −0.01155 or more and 0 or less, a golf club set in which height of trajectory of a hit ball by golf clubs having comparatively longer golf club shaft length L becomes lower, may be fabricated. These golf club sets may be mainly suitable for a type of golfers who want to get certain direction by lowering trajectory of a hit ball by golf clubs having longer golf club shaft length L.

Effect of the foregoing slope of a regression line shows just general trends. Therefore, golfers can select a golf club set having specified value as a slope of the foregoing regression line, considering own skill level, preferable bending of golf club shafts, feeling, preferable strategy, preferable feeling of hitting a ball and the like.

Adding to varying ratio Z of frequencies to golf club shaft length L linearly as described above, it is preferable to vary the sum Y of frequencies to golf club shaft length L linearly, wherein a sum (f1+f2) of a frequency f1 obtained by measuring in a state that a rear end portion of a golf club shaft is fastened and a frequency f2 obtained by measuring in a state that a tip portion of the golf club shaft is fastened, is denoted by Y (cpm).

Specifically, in golf club shafts to be assemble to golf clubs having loft angles θ in a range of 16 degree to 41 degree, when a distribution of the sum Y of frequencies to length L is fitted on a regression line, the sum Y of frequencies is preferably determined so that estimated error to the regression line is 30 cpm or less, preferably 20 cpm or less, more preferably 10 cpm or less. By determining Y as the foregoing relations, harmonized height of trajectory of a hit ball is obtained more exactly through a whole golf club set.

In the foregoing golf club set, golf clubs having loft angles in a range of 16 degree to 41 degree is denoted by continuous natural number X starting from 1 in order from the club number having the lowest loft angle and, in addition, the foregoing sum of frequencies is denoted by Y (cpm). When the sum Y of frequencies corresponding to natural number X of each golf club is plotted on X-Y coordinate, plots of all of the golf clubs having loft angle θ in a range of 16 degree to 41 degree become a straight line or almost straight line.

Figure 32:
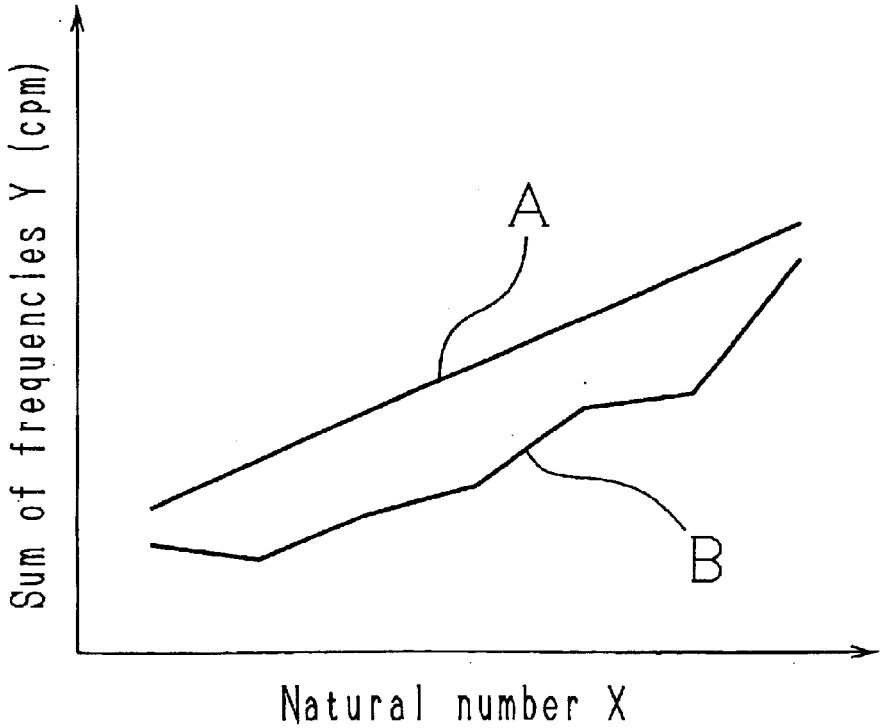
FIG. 32 is a graph showing relations between the natural numbers X and sums Y of frequencies according to the present invention.

FIG. 32 is a graph showing a relation between natural number X corresponding to order of the club number and the sum Y of frequencies. A shows a relation in an ideal golf club set in accordance with the present invention, and B shows a relation in conventional golf club set. Specifically, in a conventional golf club set, the club number has no constant correlation with the sum of frequencies. However, since the club number has a constant correlation with the sum of frequencies in an ideal golf club set in accordance with the present invention, harmonized flexibility of golf club shafts can be obtained through a whole golf club set.

More concretely, in golf clubs having loft angle θ in a range of 16 degree and 41 degree, the sum Y of frequencies is determined to natural number X in a scope of satisfying the following formula, $$aX+b \leqq Y \leqq aX+b+12 \quad (1)$$

where coefficients a and b are arbitrary constants.

Specifically, the sum Y of frequencies is contained in a scope between two parallel straight lines, Y=aX+b and Y=aX+b+12, more preferably contained in a scope between Y=aX+b and Y=aX+b+9, further more preferably contained in a scope between Y=aX+b and Y=aX+b+6. In the present invention, for golf clubs satisfying a formula, $16 \leqq \theta \leqq 41$, at least one combination of coefficients a and b preferably exists so that all plots of the sum Y of frequencies plotted to natural number X are contained in the scope between the foregoing two straight lines.

The above coefficient a is not particularly limited, but by limiting the range of the value, it is possible to constitute a golf club set in accordance with golfer's preference.

When the coefficient a is 24 or less, preferably 0 or more and 24 or less, more preferably 4 or more and 20 or less, a golf club set in which golf club shafts of golf clubs having lower loft angle θ are stiffer, is fabricated. These golf club sets are mainly suitable for a type of golfers who want to get flying distance by swinging with stronger power in clubs having lower loft angle θ.

When the coefficient a is 24 or more, preferably 24 or more and 48 or less, more preferably 28 or more and 44 or less, a golf club set in which golf club shafts of golf clubs having lower loft angle θ are more flexible, is fabricated. These golf club sets are mainly suitable for a type of golfers who want to get certainly flying distance corresponding to the club number by swinging with effective use of the length of club and with easy feeling in clubs having lower loft angle θ.

Effect of the foregoing coefficient a shows just general trends. Therefore, golfers can select a golf club set having specified coefficient a, considering own skill level, preferable bending of golf club shafts, feeling, preferable strategy, preferable feeling of hitting a ball and the like.

Besides specifying linear variation of the sum Y of frequencies using 2 lines with natural number X as a variable as described above, linear variation of the sum Y of frequencies may be specified by using a regression line of all plots of the sum Y of frequencies plotted to natural number X.

Specifically, in golf clubs having loft angle θ in a range of 16 degree to 41 degree, when a distribution of the sum Y of frequencies to natural number X is fitted on a regression line, the sum Y of frequencies is determined so that estimated error to the regression line is 8 (cpm) or less. What the estimated error is 8 (cpm) or less means that the error between estimated value calculated by inputting natural number X corresponding to the club number and the sum Y of frequencies in a function of the regression line and the sum Y of frequencies, is 8 (cpm) or less in the absolute value, that is, it indicates −8 (cpm) or more and +8 (cpm) or less. In this case estimated error is preferably 6 (cpm) or less, more preferably 4 (cpm) or less.

The above slope of a regression line of the sum Y of frequencies to natural number X is not particularly limited, but by limiting the range of the value, it is possible to constitute a golf club set in accordance with golfer's preference.

When the foregoing slope is 24 or less, preferably 0 or more and 24 or less, more preferably 4 or more and 20 or less, a golf club set in which golf club shafts of golf clubs having lower loft angle θ are stiffer, is fabricated. These golf club sets are mainly suitable for a type of golfers who want to get flying distance by swinging with stronger power in clubs having lower loft angle θ.

When the foregoing slope is 24 or more, preferably 24 or more and 48 or less, more preferably 28 or more and 44 or less, a golf club set in which golf club shafts of golf clubs having lower loft angle θ are more flexible, is fabricated. These golf club sets are mainly suitable for a type of golfers who want to get certainly flying distance corresponding to the club number by swinging with effective use of the length of club and with easy feeling in clubs having lower loft angle θ.

Effect of the foregoing slope shows just general trends. Therefore, golfers can select a golf club set having specified slope of the regression line, considering own skill level, preferable bending of golf club shafts, feeling, preferable strategy, preferable feeling of hitting a ball and the like.

Adding to varying the sum Y of frequencies to natural number X linearly as described above, it is preferable to vary the ratio Z of frequencies to natural number X linearly, wherein ratio (f1/f2) of a frequency f1 obtained by measuring in a state that a rear end portion of a golf club shaft is fastened and a frequency f2 obtained by measuring in a state that a tip portion of the golf club shaft is fastened, is denoted by Z.

Specifically, golf clubs having loft angles θ in a range of 16 degree to 41 degree, when a distribution of ratio Z of frequencies to natural number X is fitted on a regression line, the ratio Z of frequencies is preferably determined so that an estimated error to the regression line is 0.15 or less, preferably 0.1 or less, more preferably 0.05 or less. By determining Z as the foregoing relations, harmonized flexibility of golf club shafts is obtained more exactly through a whole golf club set.

Moreover, when in the foregoing golf club set, using loft angle θ instead of natural number X, the sum Y of frequencies corresponding to loft angle θ of each golf club is plotted on θ-Y coordinates, the plots for all of the golf clubs having loft angle θ in a range of 16 degree to 41 degree become a straight line or almost straight line.

Figure 33:
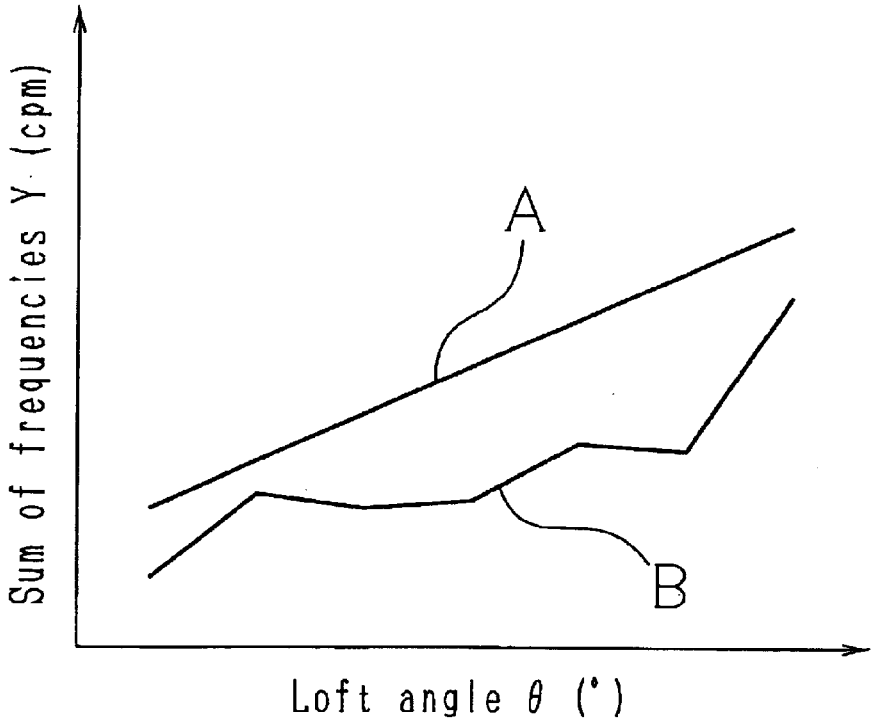
FIG. 33 is a graph showing relations between the loft angles θ and the sums Y of frequencies according to the present invention.

FIG. 33 is a graph showing a relation between loft angle θ and the sum Y of frequencies. A shows a relation in an ideal golf club set according to the present invention, and B shows a relation in conventional golf club set. Specifically, in a conventional golf club set, loft angle θ has no constant correlation with the sum of frequencies. However, since loft angle θ has a constant correlation with the sum of frequencies in an ideal golf club set in accordance with the present invention, harmonized flexibility of golf club shaft can be obtained through a whole golf club set.

More concretely in golf clubs having loft angles in a range of 16 degree to 41 degree, the sum Y of frequencies is determined to loft angle θ in a scope satisfying the following formula (2), $$c\theta+d \leqq Y \leqq c\theta+d+12 \quad (2)$$

where coefficients c and d are arbitrary constants.

Specifically, the sum Y of frequencies is contained in a scope between two parallel straight lines, Y=cθ+d and Y=cθ+d+12, more preferably contained in a scope between Y=cθ+d and Y=cθ+d+9, further more preferably contained in a scope between Y=cθ+d and Y=cθ+d+6. In the present invention, for golf clubs satisfying a formula, 16≦θ≦41, at least one combination of coefficients c and d preferably exists so that all plots of the sum Y of frequencies plotted to loft angle θ are contained in the scope between the foregoing two straight lines.

The above coefficient c is not particularly limited, but, by limiting the range of the value, it is possible to constitute a golf club set in accordance with golfer's preference.

When the coefficient c is 6 or less, preferably 0 or more and 6 or less, more preferably 1 or more and 5 or less, a golf club set in which golf club shafts of golf clubs having comparatively lower loft angle θ are stiffer, is fabricated. These golf club sets are mainly suitable for a type of golfers who want to get flying distance by swinging with stronger power in clubs having lower loft angle θ.

When the coefficient c is 6 or more, preferably 6 or more and 12 or less, more preferably 7 or more and 11 or less, a golf club set in which golf club shafts of golf clubs having comparatively lower loft angle θ are more flexible, is fabricated. These golf club sets are mainly suitable for a type of golfers who want to get certainly flying distance corresponding to the club number by swinging with effective use of the length of club and with easy feeling in clubs having lower loft angle θ.

Effect of the foregoing coefficient c shows just general trends. Therefore, golfers can select a golf club set having specified coefficient c, considering own skill level, preferable bending of golf club shafts, feeling, preferable strategy, preferable feeling of hitting a ball and the like.

Besides specifying linear variation of the sum Y of frequencies using two lines with loft angle θ as a variable, linear variation of the sum Y of frequencies may be specified by using a regression line of all plots of the sum Y of frequencies plotted to loft angle θ.

Specifically, in golf clubs having loft angle θ in a range of 16 degree to 41 degree, when a distribution of the sum Y of frequencies to loft angle θ is fitted on a regression line, the sum Y of frequencies is determined so that estimated error to the regression line is 8 (cpm) or less. What the estimated error is 8 (cpm) or less means that the error between estimated value calculated by inputting loft angle θ of golf clubs and the sum Y of frequencies in a function of the regression line and the sum Y of frequencies, is 8 (cpm) or less in the absolute value, that is, it indicates −8 (cpm) or more and +8 or less. In this case estimated error is preferably 6 (cpm) or less, more preferably 4 (cpm) or less.

The above slope of a regression line of the sum Y of frequencies to loft angle θ is not particularly limited, but, by limiting the range of the value, it is possible to constitute a golf club set in accordance with golfer's preference.

When the foregoing slope is 6 or less, preferably 0 or more and 6 or less, more preferably 1 or more and 5 or less, a golf club set in which golf club shafts of golf clubs having comparatively lower loft angle θ are stiffer, is fabricated. These golf club sets are mainly suitable for a type of golfers who want to get flying distance by swinging with stronger power in clubs having lower loft angle θ.

When the foregoing slope is 6 or more, preferably 6 or more and 12 or less, more preferably 7 or more and 11 or less, a golf club set in which golf club shafts of golf clubs having comparatively lower loft angle θ are more flexible, is fabricated. These golf club sets are mainly suitable for a type of golfers who want to get certainly flying distance corresponding to the club number by swinging with effective use of the length of clubs and with easy feeling in clubs having lower loft angle θ.

Effect of the foregoing slope shows just general trends. Therefore, golfers can select a golf club set having specified slope of the regression line, considering own skill level, preferable bending of golf club shafts, feeling, preferable strategy, preferable feeling of hitting a ball and the like.

Adding to varying the sum Y of frequencies to loft angle θ linearly as described above, it is preferable to vary the ratio Z of frequencies to loft angle θ linearly, wherein ratio (f1/f2) of a frequency f1 obtained by measuring in a state that a rear end portion of a golf club shaft is fastened and a frequency f2 obtained by measuring in a state that a tip portion of the golf club shaft is fastened, is denoted by Z.

Specifically, in golf clubs having loft angles θ in a range of 16 degree to 41 degree, when a distribution of ratio Z of frequencies to loft angle θ is fitted on a regression line, the ratio Z of frequencies is preferably determined so that estimated error to the regression line is 0.15 or less, preferably 0.1 or less, more preferably 0.05 or less. By determining Z as foregoing relations, harmonized flexibility of golf club shafts can be obtained more exactly through a whole golf club set.

In the foregoing golf club set, when golf club shafts to be assembled to golf clubs having loft angles in a range of 16 degree to 41 degree is denoted by continuous natural number X starting from 1 in order from clubs having the longest golf club shaft length, and, in addition, the foregoing sum of frequencies is denoted by Y (cpm). When the sum Y of frequencies corresponding to natural number X of each golf club is plotted on X-Y coordinate, plots of all of the golf club shafts to be assembled to golf clubs having loft angle θ in a range of 16 degree to 41 degree become a straight line or almost straight line.

In a golf club set, in general, the larger the club number is, the shorter length the golf club shaft has. Then the relations between natural number X and the sum Y of frequencies in a golf club shaft set may be determined in the same way as the foregoing golf club set.

Moreover, when, in the foregoing golf club set, using golf club shaft length L instead of natural number X, the sum Y of frequencies corresponding to length L of each golf club shaft is plotted on L-Y coordinate, the plots for all of the golf club shafts to be assembled to golf clubs having loft angle θ in a range of 16 degree to 41 degree become a straight line or almost straight line.

Figure 34:
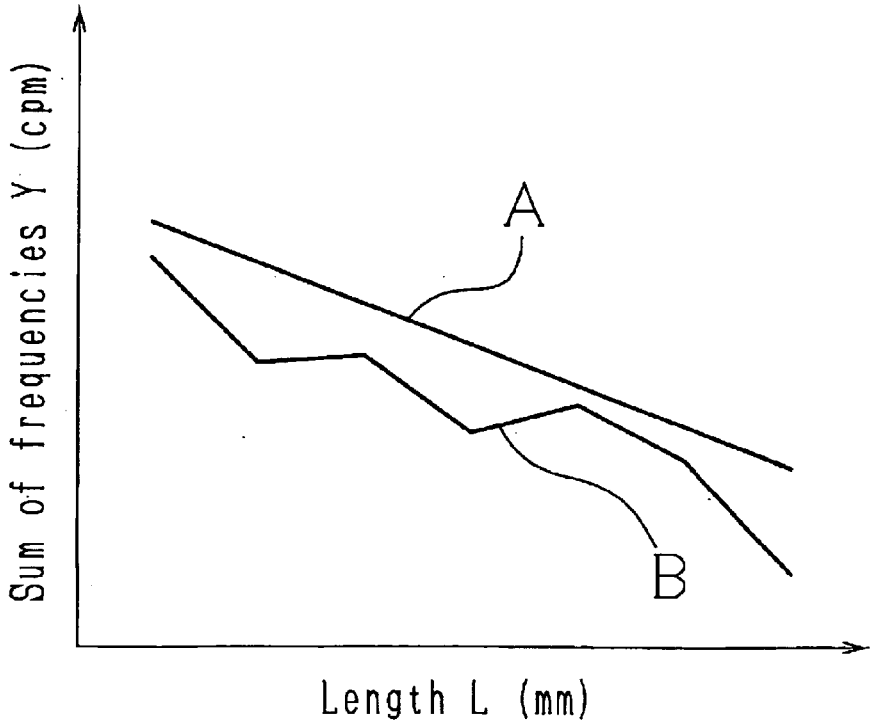
FIG. 34 is a graph showing relations between the length L of golf club shafts and the sums Y of frequencies according to the present invention.

FIG. 34 is a graph showing a relation between golf club shaft length L and the sum Y of frequencies. A shows a relation in an ideal golf club set, and B shows a relation in conventional golf club set. Specifically, in a conventional golf club set, golf club shaft length has no constant correlation with the sum of frequencies. However, since golf club shaft length has a constant correlation with the sum of frequencies in an ideal golf club set in accordance with the present invention, harmonized flexibility of golf club shafts can be obtained through a whole golf club set.

More concretely, in golf club shafts to be assembled to golf clubs having loft angles θ in a range of 16 degree to 41 degree, when a distribution of the sum Y of frequencies to golf club shaft length L is fitted on a regression line, the sum Y of frequencies is determined so that estimated error to the regression line is 8 (cpm) or less. What the estimated error is 8 (cpm) or less means that the error between estimated value calculated by inputting golf club shaft length L and by inputting the sum Y of frequencies in a function of the regression line and the sum Y of frequencies, is 8 (cpm) or less in the absolute value, that is, it indicates −8 (cpm) or more and +8 (cpm) or less. In this case estimated error is preferably 6 (cpm) or less, more preferably 4 (cpm) or less.

The above relationship can be maintained for golf club shafts to be assembled to golf clubs having loft angles θ out of the range of 16 degree to 41 degree. For example, the above relationship can be maintained for the entire golf club shaft set.

The above slope of a regression line of the sum Y of frequencies to golf club shaft length L is not particularly limited, but, by limiting the range of the value, it is possible to constitute a golf club set in accordance with golfer's preference.

When the foregoing slope is −1.85 or more, preferably −1.85 or more and 0 or less, more preferably −1.55 or more and −0.3 or less, a golf club set in which golf club shafts of golf clubs having comparatively longer golf club shaft length L are stiffer, is fabricated. These golf club sets are mainly suitable for a type of golfers who want to get flying distance by swinging with stronger power in clubs having longer golf club shaft length L.

When the foregoing slope is −1.85 or less, preferably −3.7 or more and −1.85 or less, more preferably −3.4 or more and −2.15 or less, a golf club set in which golf club shafts of golf clubs having comparatively longer golf club shaft length L are more flexible, is fabricated. These golf club sets are mainly suitable for a type of golfers who want to get certainly flying distance corresponding to the club number by swinging with effective use of the length of clubs and with easy feeling in clubs having longer golf club shaft length L.

Effect of the foregoing slope shows just general trends. Therefore, golfers can select a golf club set having specified slope, considering own skill level, preferable bending of golf club shafts, feeling, preferable strategy, preferable feeling of hitting a ball and the like.

Adding to varying the sum Y of frequencies to golf club shaft length L linearly as described above, it is preferable to vary the ratio Z of frequencies to golf club shaft length L linearly, wherein ratio (f1/f2) of a frequency f1 obtained by measuring in a state that a rear end portion of a golf club shaft is fastened and a frequency f2 obtained by measuring in a state that a tip portion of the golf club shaft is fastened, is denoted by Z.

Specifically, in golf club shafts to be assembled to golf clubs having loft angles θ in a range of 16 degree to 41 degree, when a distribution of ratio Z of frequencies to length L is fitted on a regression line, the ratio Z of frequencies is preferably determined so that estimated error to the regression line is 0.15 or less, preferably 0.1 or less, more preferably 0.05 or less. By determining Z as the foregoing relations, harmonized flexibility of golf club shafts can be obtained more exactly through a whole golf club set.

The foregoing constituents of the present invention provide remarkable effects particularly when they are applied to a golf club set by use of golf club shafts made of fiber reinforced plastics.

Golf club shafts made of fiber reinforced plastics have more freedom in designing such that kinds of reinforced fiber and orient direction of fibers can be freely selected and rigidity distribution in golf club shafts can be varied in longitudinal direction, than golf club shafts made of metal. In particular, lately length of golf club has become longer and accompanying with the trend, variation of rigidity distribution in golf club shafts has become bigger. Therefore in the case of golf club shafts made of fiber reinforced plastic, when a golf club set is designed based on conventional yardstick so that height of trajectory of a hit ball by the golf clubs can be harmonized among the club numbers, it was very difficult to obtain harmony in height of trajectory of a hit ball actually by the golf clubs among the club numbers.

On the contrary, in the present invention, even when golf club shafts are made of fiber reinforced plastics, a golf club set which can harmonize actually height of trajectory of a hit ball by golf clubs among the club numbers, can be easily constituted.

Further, in the case of golf club shafts made of fiber reinforced plastics, even when a golf club set is designed based on conventional yardstick so that flexibility of golf club shafts can be harmonized among the club numbers, it was very difficult to obtain harmony in flexibility felt actually by a person among the club numbers.

On the contrary, in the present invention, even when golf club shafts are made of fiber reinforced plastics, a golf club set in which flexibility of golf club shafts felt actually by a person, is harmonized among the club numbers, can be easily constituted.

A golf club set in the present invention comprises a plurality of golf clubs having variously different loft angles such as an iron golf club set, a wood golf club set, a golf club set including wood golf clubs and iron golf clubs, a golf club set including only ones corresponding to a long iron, a golf club set including utility golf clubs having middle performances between an wood golf club and an iron golf club, a golf club set comprised of golf clubs which are not classified in a wood golf club or a iron golf club.

EXAMPLE

In a golf club set comprising a plurality of golf clubs having variously different loft angles, golf club sets comprising golf club shafts having variously different frequency performance are fabricated as shown in example 1 to 18 and comparative example 1 to 2. In these golf club sets, golf clubs having the same loft angles are assembled with the same golf club head and the same grip. With regard to club length, the longest golf club (#3) is 39.0 inches and the length is shorten by 0.5 inches each in order of increasing club number and the shortest golf club (#8) is 36.5 inches. As the above golf club shafts, golf club shafts made of fiber reinforced plastics were used.

In Table 1 to Table 20, club number, natural number X, loft angle θ (degree), golf club shaft length L (mm), frequency f1 (cpm), frequency f2 (cpm), ratio Z of frequencies of golf club sets in example 1 to 18 and comparative example 1 to 2 are shown. Here, frequency f1 is a frequency per unit time, the frequency being measured by vibrating a tip portion of a golf club shaft in a state that a rear end portion is fastened for a length of 178 mm from the rear end and a 200 g weight is loaded on a tip portion for a length of 30 mm from the tip end. Frequency f2 is a frequency per unit time, the frequency being measured by vibrating the rear end portion of a golf club shaft in a state that the tip portion is fastened for a length of 178 mm from the tip end and a 200 g weight is loaded on the rear portion for a length of 30 mm from the rear end. The ratio Z of frequencies is a ratio (f1/f2) of frequency f1 to frequency f2.

TABLE 1

Example 1

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 549 | 201 | 2.731 | 16.6 |
| #4 | 2 | 24 | 949 | 548 | 224 | 2.446 | 18.6 |
| #5 | 3 | 28 | 936 | 545 | 251 | 2.171 | 20.5 |
| #6 | 4 | 32 | 923 | 540 | 285 | 1.895 | 22.4 |
| #7 | 5 | 36 | 910 | 532 | 326 | 1.632 | 24.2 |
| #8 | 6 | 40 | 897 | 506 | 378 | 1.339 | 25.9 |

TABLE 2

Example 2

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 632 | 227 | 2.784 | 16.4 |
| #4 | 2 | 24 | 949 | 657 | 252 | 2.607 | 18.6 |
| #5 | 3 | 28 | 936 | 660 | 283 | 2.332 | 20.5 |
| #6 | 4 | 32 | 923 | 672 | 326 | 2.061 | 22.2 |
| #7 | 5 | 36 | 910 | 677 | 367 | 1.845 | 24.3 |
| #8 | 6 | 40 | 897 | 697 | 421 | 1.656 | 26.8 |

TABLE 3

Example 3

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 550 | 256 | 2.148 | 16.2 |
| #4 | 2 | 24 | 949 | 571 | 306 | 1.866 | 18.3 |
| #5 | 3 | 28 | 936 | 588 | 354 | 1.661 | 20.5 |
| #6 | 4 | 32 | 923 | 592 | 423 | 1.400 | 22.2 |
| #7 | 5 | 36 | 910 | 593 | 509 | 1.165 | 24.3 |
| #8 | 6 | 40 | 897 | 594 | 636 | 0.934 | 26.1 |

TABLE 4

Example 4

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 472 | 193 | 2.446 | 16.5 |
| #4 | 2 | 24 | 949 | 506 | 229 | 2.210 | 18.6 |
| #5 | 3 | 28 | 936 | 532 | 269 | 1.978 | 20.6 |
| #6 | 4 | 32 | 923 | 551 | 323 | 1.706 | 22.3 |
| #7 | 5 | 36 | 910 | 568 | 387 | 1.468 | 24.3 |
| #8 | 6 | 40 | 897 | 571 | 463 | 1.233 | 26.2 |

TABLE 5

Example 5

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 411 | 208 | 1.976 | 16.5 |
| #4 | 2 | 24 | 949 | 409 | 224 | 1.826 | 18.3 |
| #5 | 3 | 28 | 936 | 405 | 237 | 1.709 | 20.3 |
| #6 | 4 | 32 | 923 | 403 | 254 | 1.587 | 22.3 |
| #7 | 5 | 36 | 910 | 398 | 270 | 1.474 | 24.3 |
| #8 | 6 | 40 | 897 | 388 | 288 | 1.347 | 26.2 |

TABLE 6

Example 6

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 358 | 203 | 1.764 | 15.9 |
| #4 | 2 | 24 | 949 | 365 | 212 | 1.722 | 17.8 |
| #5 | 3 | 28 | 936 | 390 | 222 | 1.757 | 20.3 |
| #6 | 4 | 32 | 923 | 405 | 231 | 1.753 | 22.6 |
| #7 | 5 | 36 | 910 | 409 | 241 | 1.697 | 24.4 |
| #8 | 6 | 40 | 897 | 416 | 251 | 1.657 | 26.3 |

TABLE 7

Example 7

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 384 | 189 | 2.032 | 16.4 |
| #4 | 2 | 24 | 949 | 399 | 197 | 2.025 | 18.6 |
| #5 | 3 | 28 | 936 | 403 | 205 | 1.966 | 20.4 |
| #6 | 4 | 32 | 923 | 415 | 213 | 1.948 | 22.5 |
| #7 | 5 | 36 | 910 | 420 | 221 | 1.900 | 24.4 |
| #8 | 6 | 40 | 897 | 438 | 230 | 1.904 | 26.8 |

TABLE 8

Example 8

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 481 | 351 | 1.370 | 16.1 |
| #4 | 2 | 24 | 949 | 499 | 366 | 1.363 | 18.3 |
| #5 | 3 | 28 | 936 | 503 | 382 | 1.317 | 20.1 |
| #6 | 4 | 32 | 923 | 514 | 398 | 1.291 | 22.2 |
| #7 | 5 | 36 | 910 | 524 | 416 | 1.260 | 24.2 |
| #8 | 6 | 40 | 897 | 533 | 434 | 1.228 | 26.1 |

TABLE 9

Example 9

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 378 | 284 | 1.331 | 16.1 |
| #4 | 2 | 24 | 949 | 381 | 292 | 1.305 | 18.0 |
| #5 | 3 | 28 | 936 | 396 | 301 | 1.316 | 20.2 |
| #6 | 4 | 32 | 923 | 400 | 310 | 1.290 | 22.1 |
| #7 | 5 | 36 | 910 | 405 | 319 | 1.270 | 24.0 |
| #8 | 6 | 40 | 897 | 415 | 328 | 1.265 | 26.2 |

TABLE 10

Comparative example 1

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 401 | 201 | 1.995 | 17.1 |
| #4 | 2 | 24 | 949 | 408 | 242 | 1.686 | 17.9 |
| #5 | 3 | 28 | 936 | 415 | 256 | 1.621 | 20.3 |
| #6 | 4 | 32 | 923 | 422 | 287 | 1.470 | 22.0 |
| #7 | 5 | 36 | 910 | 429 | 305 | 1.407 | 24.6 |
| #8 | 6 | 40 | 897 | 436 | 369 | 1.182 | 25.0 |

TABLE 11

Example 10

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 332 | 269 | 1.234 | 16.0 |
| #4 | 2 | 24 | 949 | 351 | 280 | 1.254 | 18.2 |
| #5 | 3 | 28 | 936 | 362 | 294 | 1.231 | 20.0 |
| #6 | 4 | 32 | 923 | 380 | 307 | 1.238 | 22.2 |
| #7 | 5 | 36 | 910 | 392 | 321 | 1.221 | 24.0 |
| #8 | 6 | 40 | 897 | 409 | 334 | 1.225 | 26.2 |

TABLE 12

Example 11

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 413 | 307 | 1.345 | 16.3 |
| #4 | 2 | 24 | 949 | 415 | 314 | 1.322 | 18.2 |
| #5 | 3 | 28 | 936 | 429 | 313 | 1.371 | 20.3 |
| #6 | 4 | 32 | 923 | 433 | 311 | 1.392 | 22.4 |
| #7 | 5 | 36 | 910 | 434 | 326 | 1.331 | 23.6 |
| #8 | 6 | 40 | 897 | 445 | 328 | 1.357 | 25.8 |

TABLE 13

Example 12

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 370 | 208 | 1.779 | 16.3 |
| #4 | 2 | 24 | 949 | 382 | 212 | 1.802 | 18.4 |
| #5 | 3 | 28 | 936 | 390 | 217 | 1.797 | 20.3 |
| #6 | 4 | 32 | 923 | 396 | 222 | 1.784 | 22.2 |
| #7 | 5 | 36 | 910 | 411 | 225 | 1.827 | 24.5 |
| #8 | 6 | 40 | 897 | 418 | 233 | 1.794 | 26.1 |

TABLE 14

Example 13

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 433 | 227 | 1.907 | 16.2 |
| #4 | 2 | 24 | 949 | 442 | 228 | 1.939 | 18.4 |
| #5 | 3 | 28 | 936 | 446 | 230 | 1.939 | 20.4 |
| #6 | 4 | 32 | 923 | 447 | 230 | 1.943 | 22.4 |
| #7 | 5 | 36 | 910 | 456 | 234 | 1.949 | 24.4 |
| #8 | 6 | 40 | 897 | 461 | 237 | 1.945 | 26.3 |

TABLE 15

Example 14

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 356 | 237 | 1.502 | 16.2 |
| #4 | 2 | 24 | 949 | 372 | 238 | 1.563 | 18.2 |
| #5 | 3 | 28 | 936 | 396 | 241 | 1.643 | 20.3 |
| #6 | 4 | 32 | 923 | 419 | 243 | 1.724 | 22.5 |
| #7 | 5 | 36 | 910 | 436 | 245 | 1.780 | 24.4 |
| #8 | 6 | 40 | 897 | 457 | 248 | 1.843 | 26.4 |

TABLE 16

Example 15

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 401 | 298 | 1.346 | 16.3 |
| #4 | 2 | 24 | 949 | 407 | 279 | 1.459 | 18.1 |
| #5 | 3 | 28 | 936 | 417 | 259 | 1.610 | 20.3 |
| #6 | 4 | 32 | 923 | 424 | 235 | 1.804 | 22.9 |
| #7 | 5 | 36 | 910 | 436 | 231 | 1.887 | 24.5 |
| #8 | 6 | 40 | 897 | 448 | 220 | 2.036 | 26.6 |

TABLE 17

Example 16

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 305 | 280 | 1.089 | 16.1 |
| #4 | 2 | 24 | 949 | 332 | 269 | 1.234 | 18.3 |
| #5 | 3 | 28 | 936 | 354 | 265 | 1.336 | 20.0 |
| #6 | 4 | 32 | 923 | 392 | 263 | 1.490 | 22.2 |
| #7 | 5 | 36 | 910 | 420 | 257 | 1.634 | 24.3 |
| #8 | 6 | 40 | 897 | 455 | 253 | 1.798 | 26.7 |

TABLE 18

Example 17

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 359 | 229 | 1.568 | 16.3 |
| #4 | 2 | 24 | 949 | 375 | 222 | 1.689 | 18.3 |
| #5 | 3 | 28 | 936 | 395 | 216 | 1.829 | 20.4 |
| #6 | 4 | 32 | 923 | 411 | 210 | 1.957 | 22.4 |
| #7 | 5 | 36 | 910 | 434 | 205 | 2.117 | 24.6 |
| #8 | 6 | 40 | 897 | 455 | 202 | 2.252 | 26.7 |

TABLE 19

Example 18

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 403 | 322 | 1.252 | 16.1 |
| #4 | 2 | 24 | 949 | 422 | 297 | 1.421 | 18.2 |
| #5 | 3 | 28 | 936 | 446 | 278 | 1.604 | 20.4 |
| #6 | 4 | 32 | 923 | 462 | 264 | 1.750 | 22.3 |
| #7 | 5 | 36 | 910 | 481 | 250 | 1.924 | 24.4 |
| #8 | 6 | 40 | 897 | 501 | 238 | 2.105 | 26.7 |

TABLE 20

Comparable example 2

| Club # | Natural number X | Loft angle θ (degree) | Length of golf club shaft L (mm) | Frequency f1 (cpm) | Frequency f2 (cpm) | Ratio of frequencies Z | Launching angle (degree) |
|---|---|---|---|---|---|---|---|
| #3 | 1 | 20 | 962 | 412 | 257 | 1.603 | 16.1 |
| #4 | 2 | 24 | 949 | 422 | 245 | 1.722 | 18.5 |
| #5 | 3 | 28 | 936 | 432 | 252 | 1.714 | 20.0 |
| #6 | 4 | 32 | 923 | 442 | 247 | 1.789 | 22.1 |
| #7 | 5 | 36 | 910 | 452 | 250 | 1.808 | 23.7 |
| #8 | 6 | 40 | 897 | 462 | 227 | 2.035 | 27.2 |

In Table 21, a slope and an intercept in a regression line of ratio of frequencies Z to natural number X, maximum value and minimum value of the difference between the ratio Z of frequencies and the regression line, and a slope and an intercept in a regression line of ratio Z of frequencies to loft angle θ, maximum value and minimum value of the difference between the ratio Z of frequencies and the regression line are shown. Further, in FIG. 35 to FIG. 54, a regression line of ratio Z of frequencies to natural number X of golf club sets in example 1 to 18 and comparative example 1 to 2 is shown. Moreover, in FIG. 55 to FIG. 74, a regression line of ratio Z of frequencies to loft angle θ of golf club sets in example 1 to 18 and comparative example 1 to 2 is shown.

In Table 22, a slope and an intercept in a regression line of ratio of frequencies Z to golf club shaft length L, maximum value and minimum value of the difference between the ratio Z of frequencies and the regression line are shown. Further, in FIG. 75 to FIG. 94, a regression line of ratio Z of frequencies to golf club shaft length L of golf club sets in example 1 to 18 and comparative example 1 to 2 is shown.

TABLE 21

| | Regression line of ratio Z of frequencies to natural number X | | | | Regression line of ratio Z of frequencies to loft angle θ | | | |
|---|---|---|---|---|---|---|---|---|
| | Slope | Intercept | Max. | Min. | Slope | Intercept | Max. | Min. |
| Example 1 | −0.277 | 3.00 | 0.011 | −0.005 | −0.069 | 4.11 | 0.011 | −0.005 |
| Example 2 | −0.234 | 3.03 | 0.041 | −0.036 | −0.059 | 3.97 | 0.041 | −0.036 |
| Example 3 | −0.241 | 2.37 | 0.017 | −0.025 | −0.060 | 3.34 | 0.017 | −0.025 |
| Example 4 | −0.245 | 2.70 | 0.015 | −0.012 | −0.061 | 3.67 | 0.015 | −0.012 |
| Example 5 | −0.123 | 2.09 | 0.014 | −0.012 | −0.031 | 2.58 | 0.014 | −0.012 |
| Example 6 | −0.017 | 1.79 | 0.037 | −0.029 | −0.004 | 1.86 | 0.037 | −0.029 |
| Example 7 | −0.029 | 2.07 | 0.019 | −0.018 | −0.007 | 2.18 | 0.019 | −0.018 |
| Example 8 | −0.030 | 1.41 | 0.014 | −0.009 | −0.007 | 1.53 | 0.014 | −0.009 |
| Example 9 | −0.013 | 1.34 | 0.013 | −0.011 | −0.003 | 1.39 | 0.013 | −0.011 |
| Comparative example 1 | −0.144 | 2.07 | 0.074 | −0.091 | −0.036 | 2.64 | 0.074 | −0.091 |
| Example 10 | −0.004 | 1.25 | 0.014 | −0.009 | −0.001 | 1.26 | 0.014 | −0.009 |
| Example 11 | 0.003 | 1.34 | 0.038 | −0.027 | 0.001 | 1.33 | 0.038 | −0.027 |
| Example 12 | 0.004 | 1.78 | 0.024 | −0.015 | 0.001 | 1.77 | 0.024 | −0.015 |
| Example 13 | 0.006 | 1.91 | 0.011 | −0.014 | 0.002 | 1.89 | 0.011 | −0.014 |
| Example 14 | 0.070 | 1.43 | 0.014 | −0.008 | 0.017 | 1.15 | 0.014 | −0.008 |
| Example 15 | 0.141 | 1.20 | 0.043 | −0.020 | 0.035 | 0.63 | 0.043 | −0.020 |
| Example 16 | 0.140 | 0.94 | 0.018 | −0.025 | 0.035 | 0.38 | 0.018 | −0.025 |
| Example 17 | 0.138 | 1.42 | 0.011 | −0.014 | 0.035 | 0.87 | 0.011 | −0.014 |
| Example 18 | 0.169 | 1.08 | 0.013 | −0.011 | 0.042 | 0.41 | 0.013 | −0.011 |
| Comparative example 2 | 0.071 | 1.53 | 0.078 | −0.078 | 0.018 | 1.24 | 0.078 | −0.078 |

TABLE 22

| | Regression line of ratio Z of frequencies to length L of golf club shaft | | | |
|---|---|---|---|---|
| | Slope | Intercept | Max. | Min. |
| Example 1 | 0.0213 | −17.75 | 0.011 | −0.005 |
| Example 2 | 0.0180 | −14.54 | 0.041 | −0.036 |
| Example 3 | 0.0185 | −15.71 | 0.017 | −0.025 |
| Example 4 | 0.0188 | −15.65 | 0.015 | −0.012 |
| Example 5 | 0.0095 | −7.17 | 0.014 | −0.012 |
| Example 6 | 0.0013 | 0.48 | 0.037 | −0.029 |
| Example 7 | 0.0023 | −0.14 | 0.019 | −0.018 |
| Example 8 | 0.0023 | −0.84 | 0.014 | −0.009 |
| Example 9 | 0.0010 | 0.36 | 0.013 | −0.011 |
| Comparative example 1 | 0.0111 | −8.77 | 0.074 | −0.091 |
| Example 10 | 0.0003 | 0.95 | 0.014 | −0.009 |
| Example 11 | −0.0002 | 1.57 | 0.038 | −0.027 |
| Example 12 | −0.0003 | 2.08 | 0.024 | −0.015 |

TABLE 22-continued

| | Regression line of ratio Z of frequencies to length L of golf club shaft | | | |
|---|---|---|---|---|
| | Slope | Intercept | Max. | Min. |
| Example 13 | −0.0005 | 2.39 | 0.011 | −0.014 |
| Example 14 | −0.0053 | 6.65 | 0.014 | −0.008 |
| Example 15 | −0.0108 | 11.77 | 0.043 | −0.020 |
| Example 16 | −0.0108 | 11.44 | 0.018 | −0.025 |
| Example 17 | −0.0106 | 11.78 | 0.011 | −0.014 |
| Example 18 | −0.0130 | 13.77 | 0.013 | −0.011 |
| Comparative example 2 | −0.0055 | 6.87 | 0.078 | −0.078 |

Figure 35:
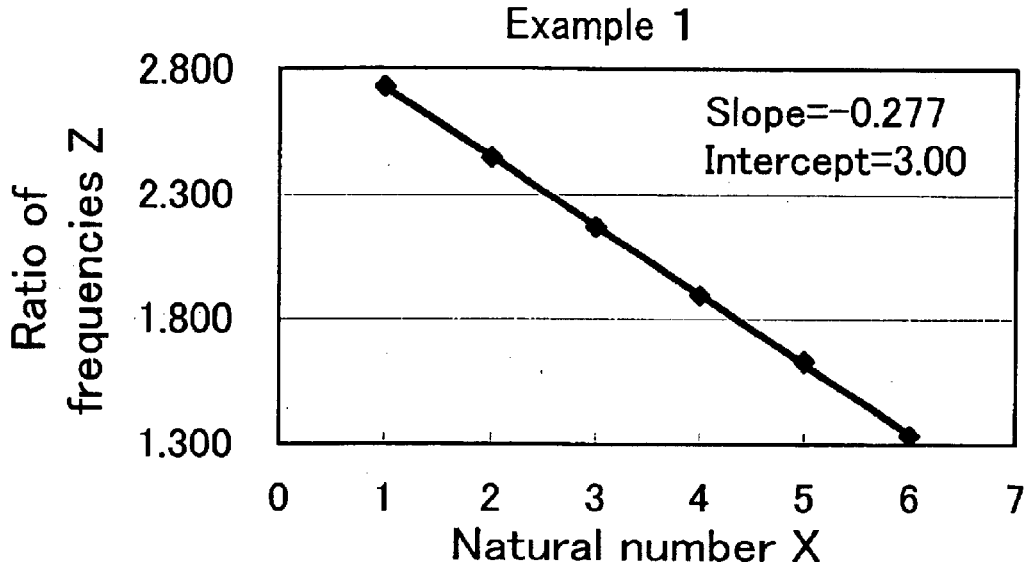
FIG. 35 to FIG. 54 are graphs showing regression lines of the ratios Z of frequencies to the natural numbers X in golf club sets in examples 1 to 18 and comparative examples 1 to 2, respectively.
Figure 36:
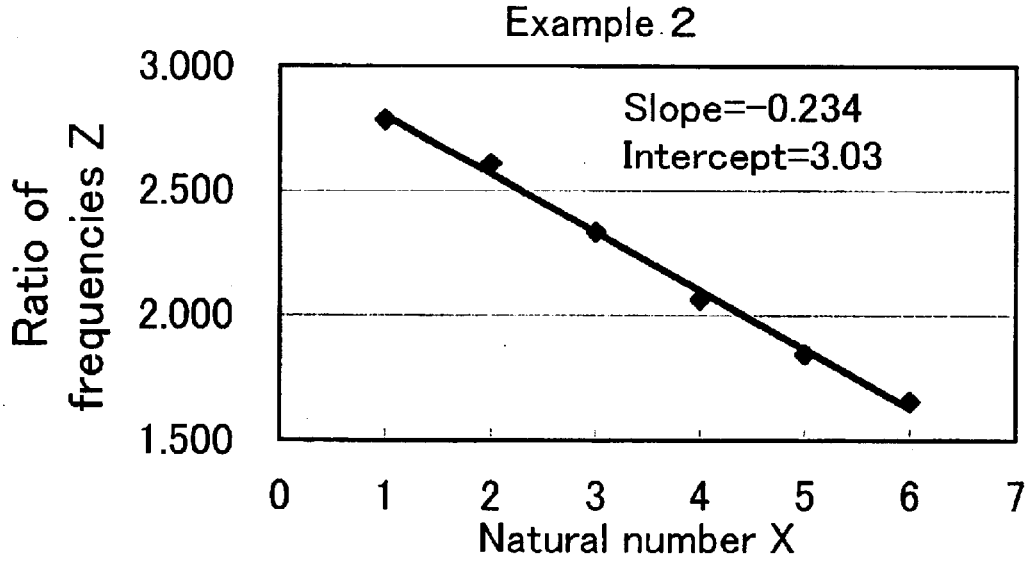
Figure 37:
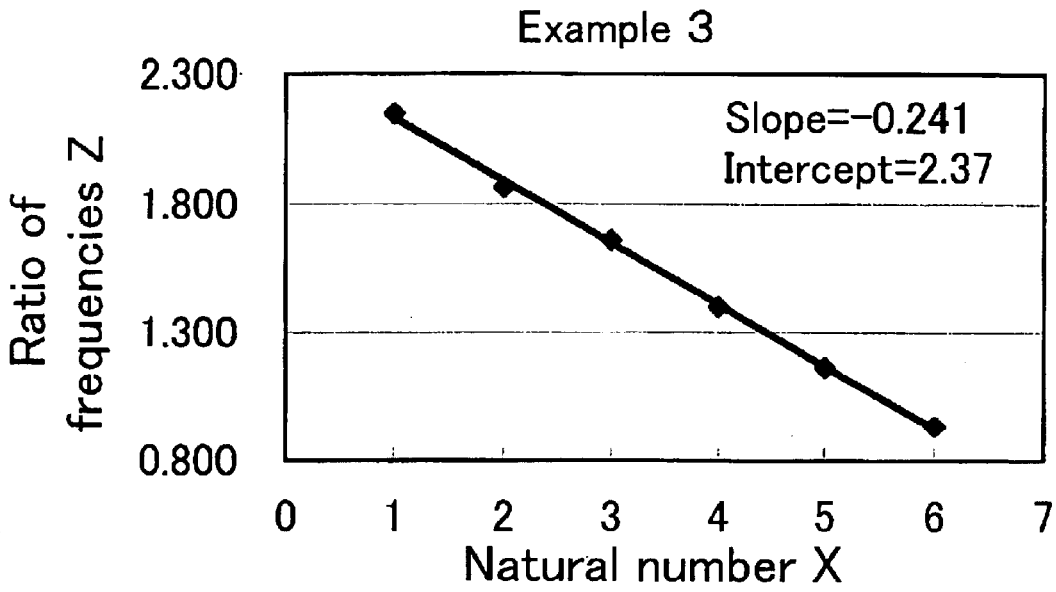
Figure 38:
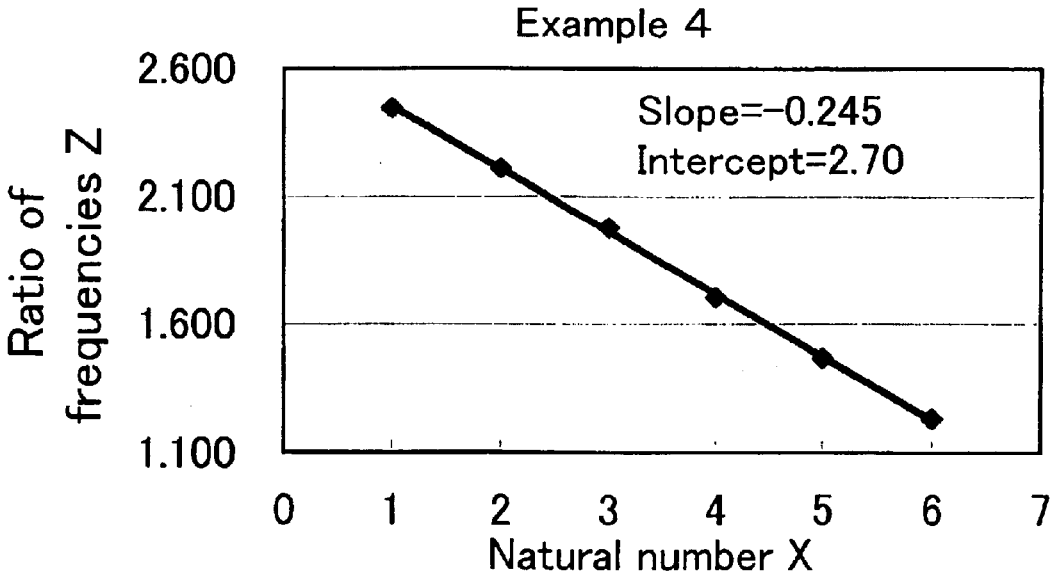
Figure 39:
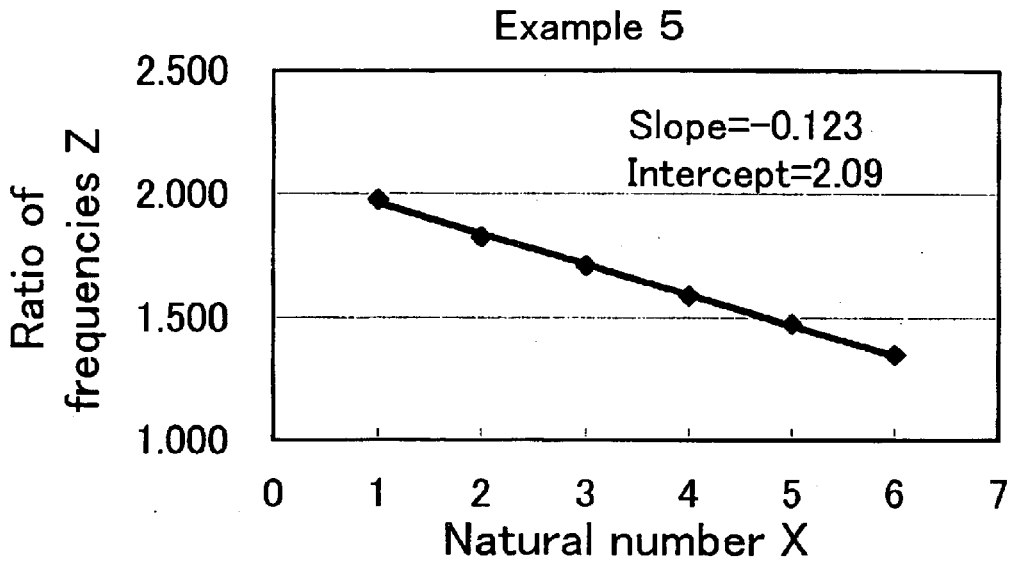
Figure 40:
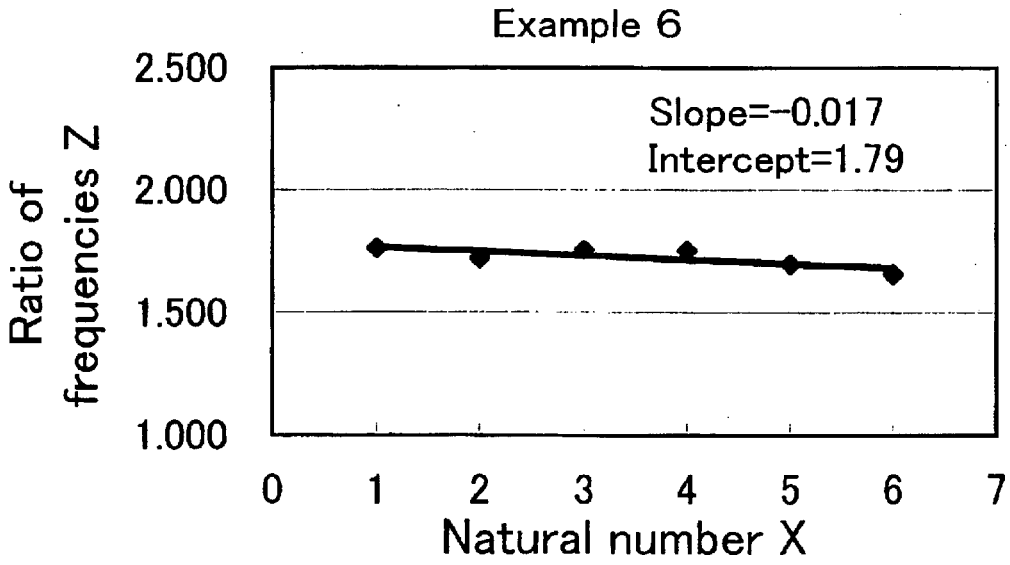
Figure 41:
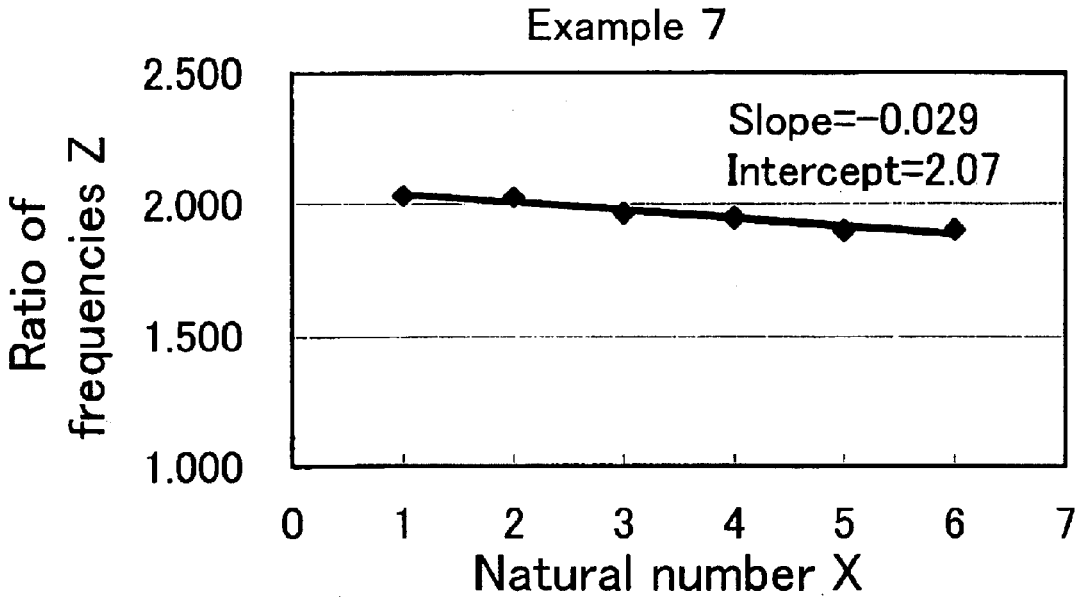
Figure 42:
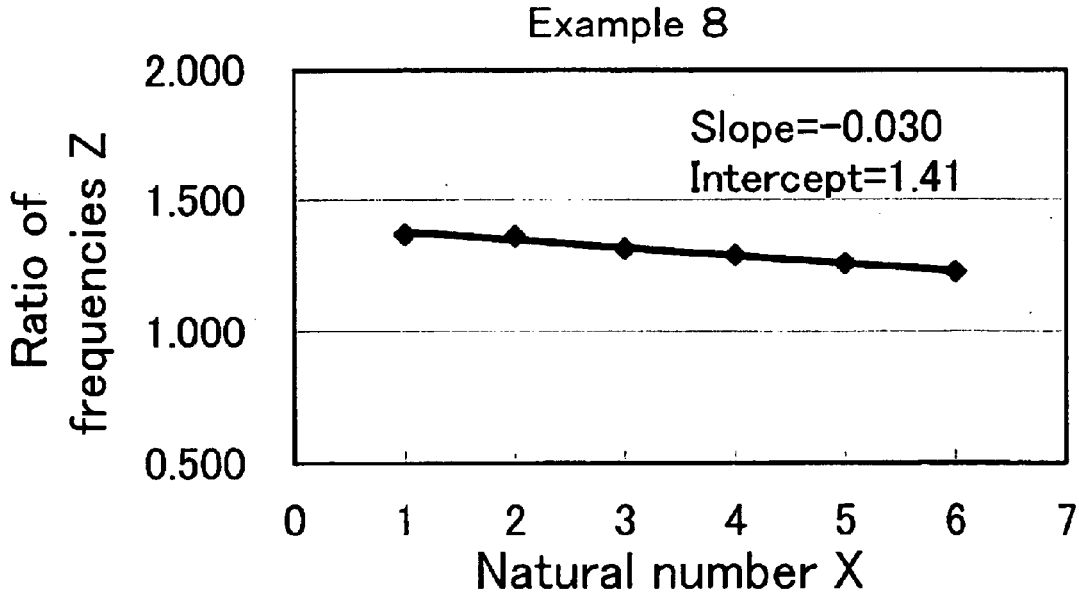
Figure 43:
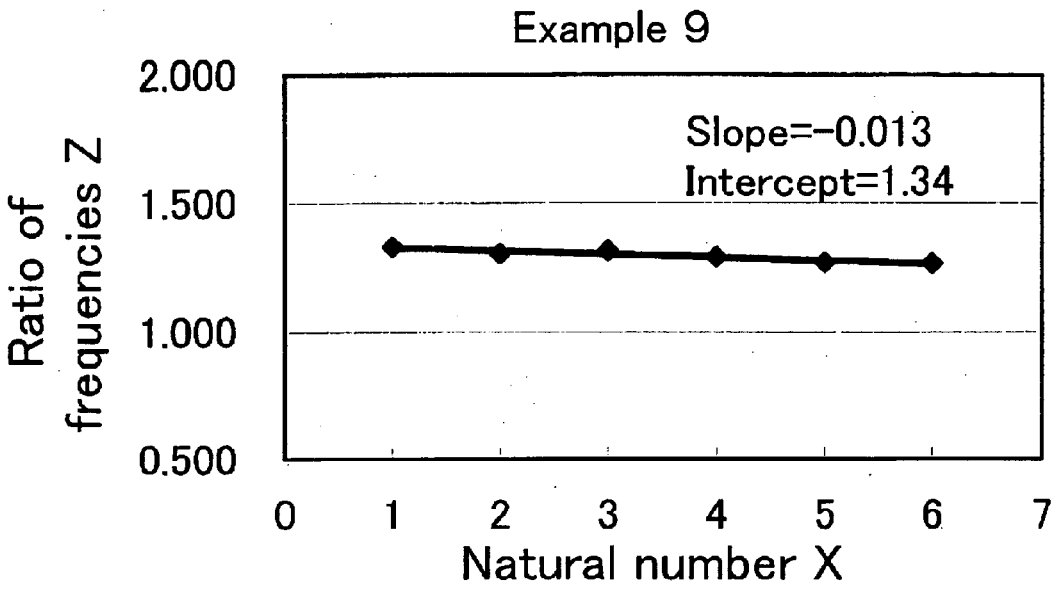
Figure 44:
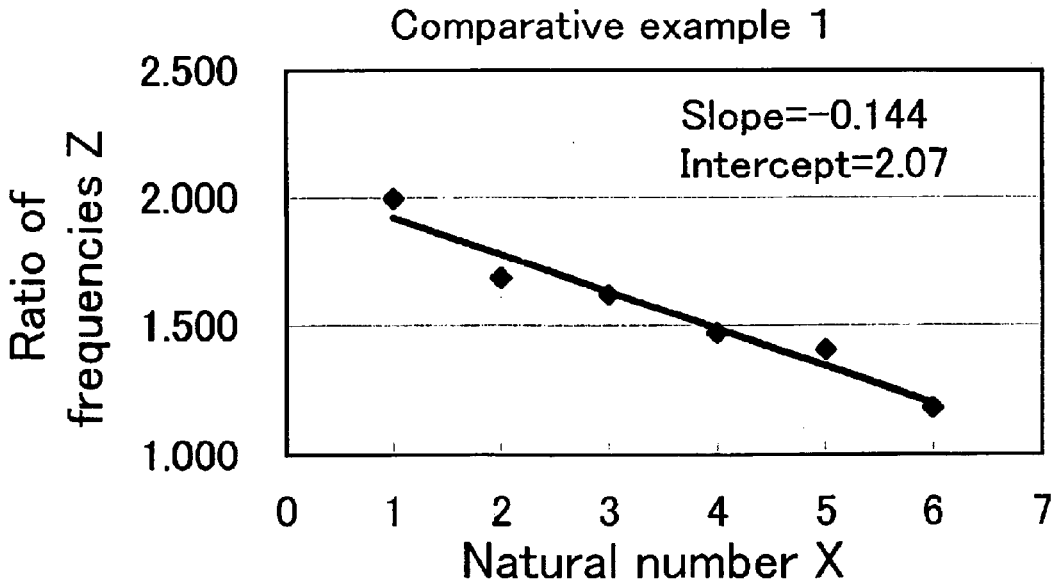
Figure 45:
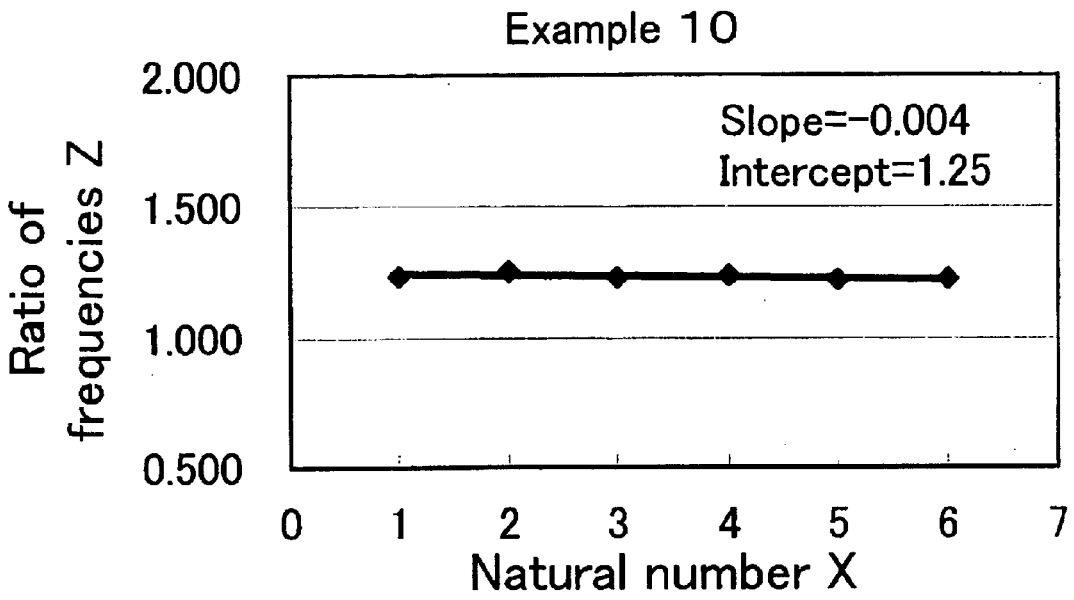
Figure 46:
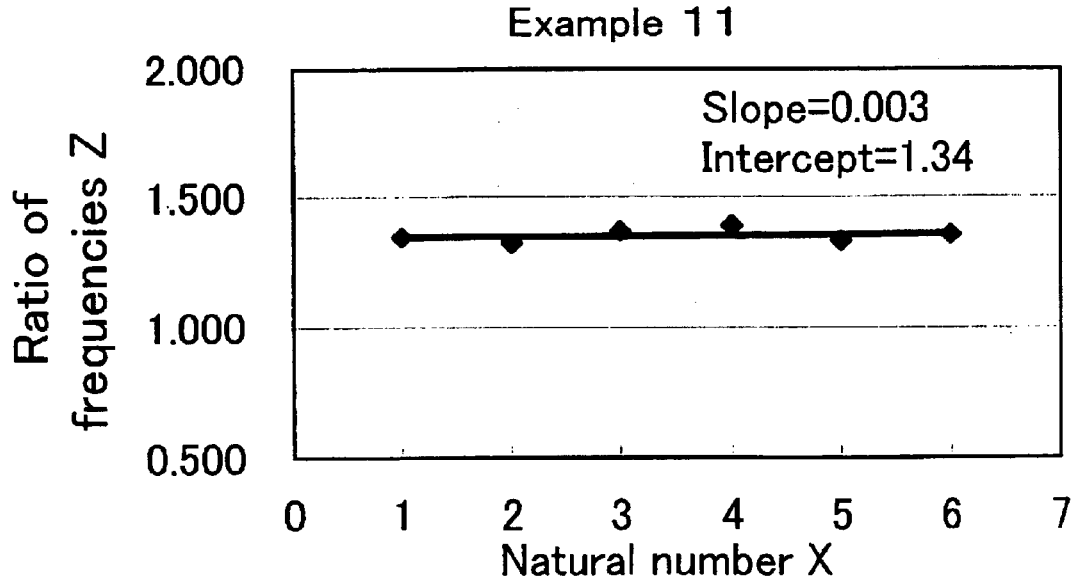
Figure 47:
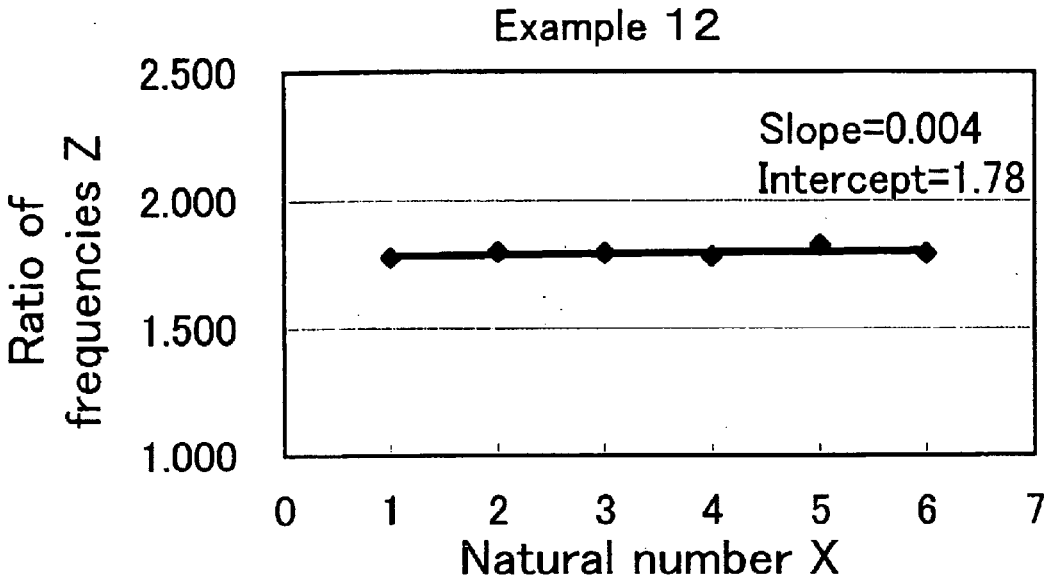
Figure 48:
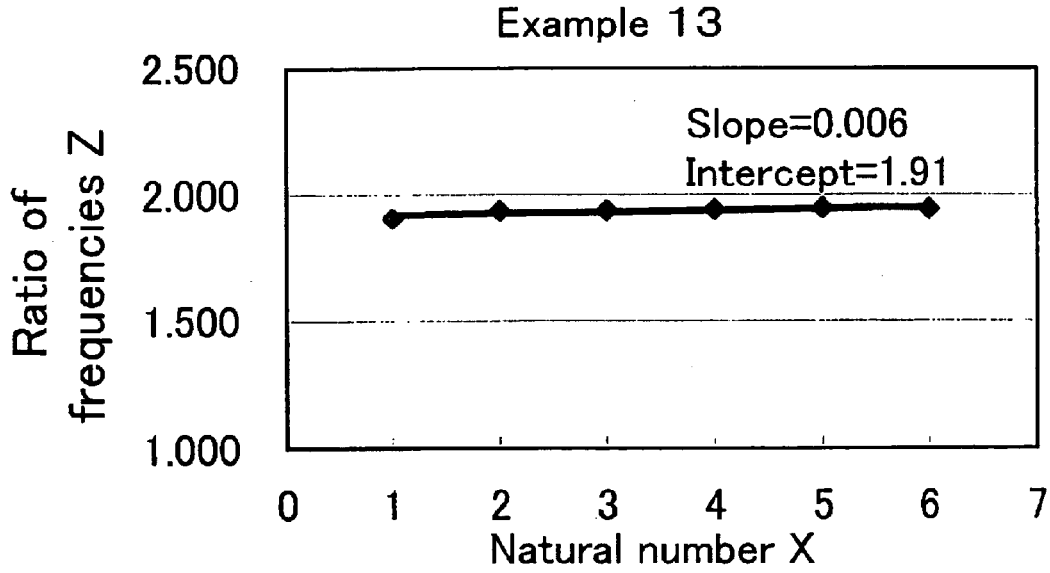
Figure 49:
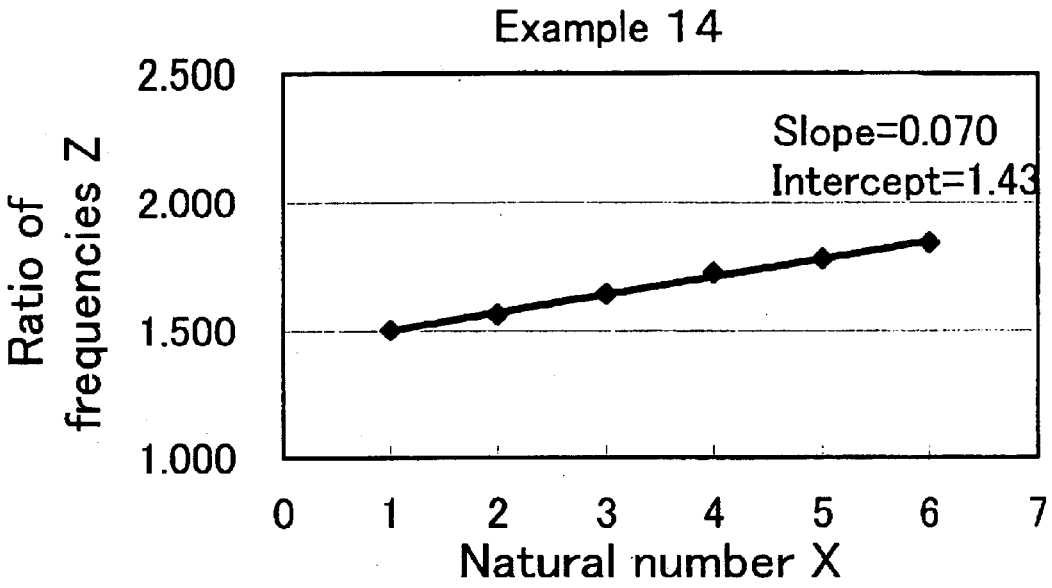
Figure 50:
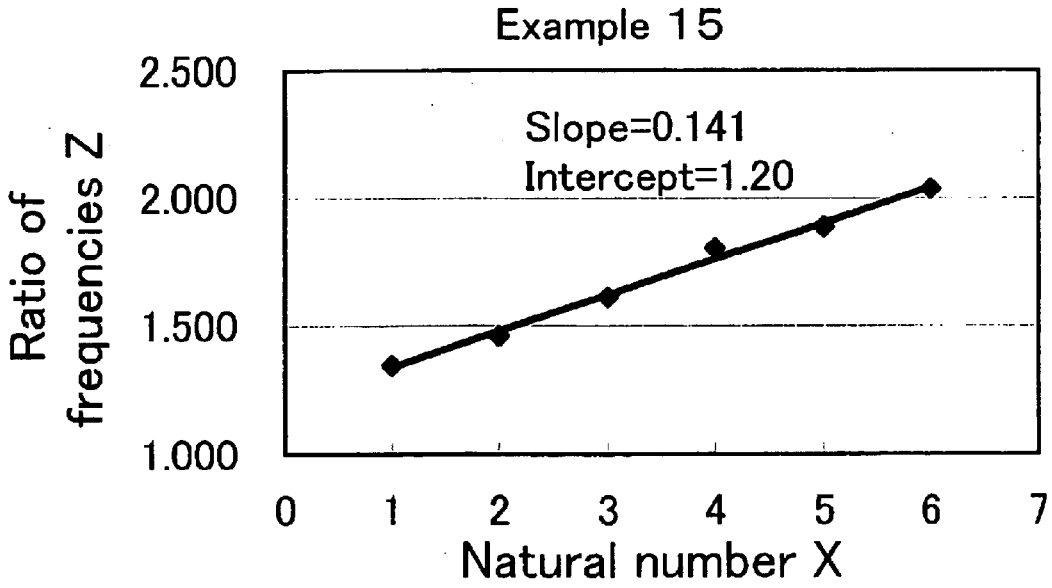
Figure 51:
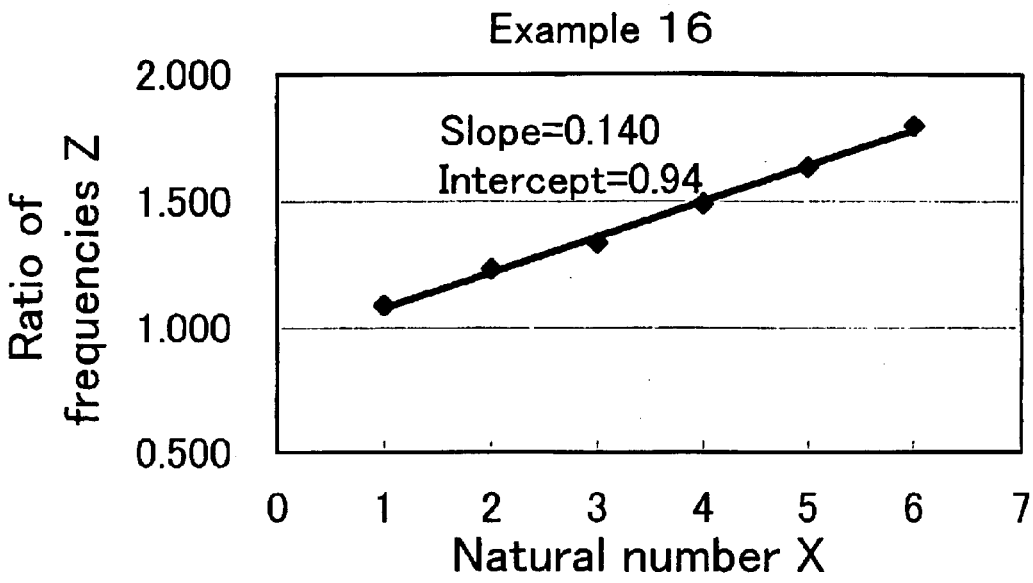
Figure 52:
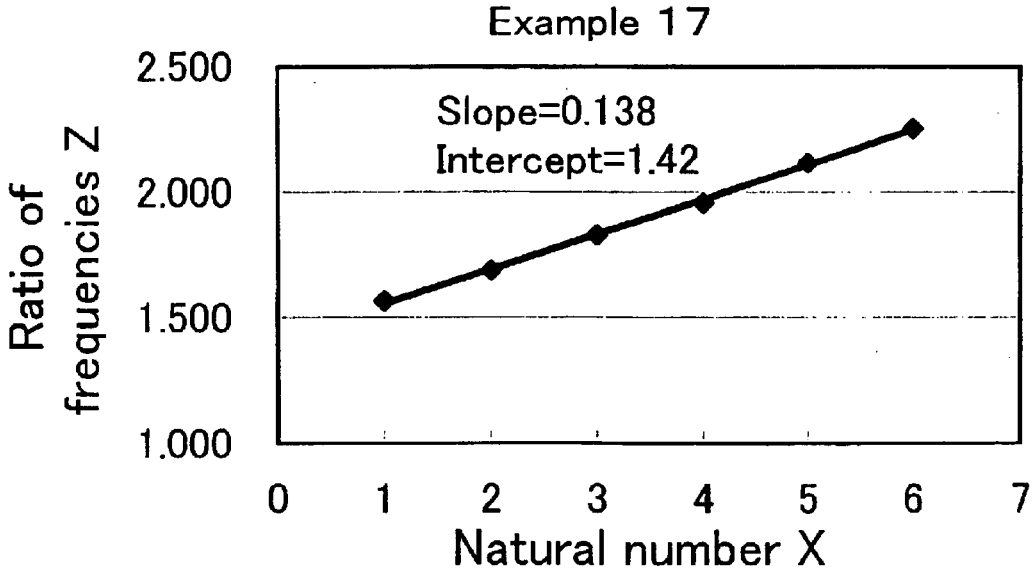
Figure 53:
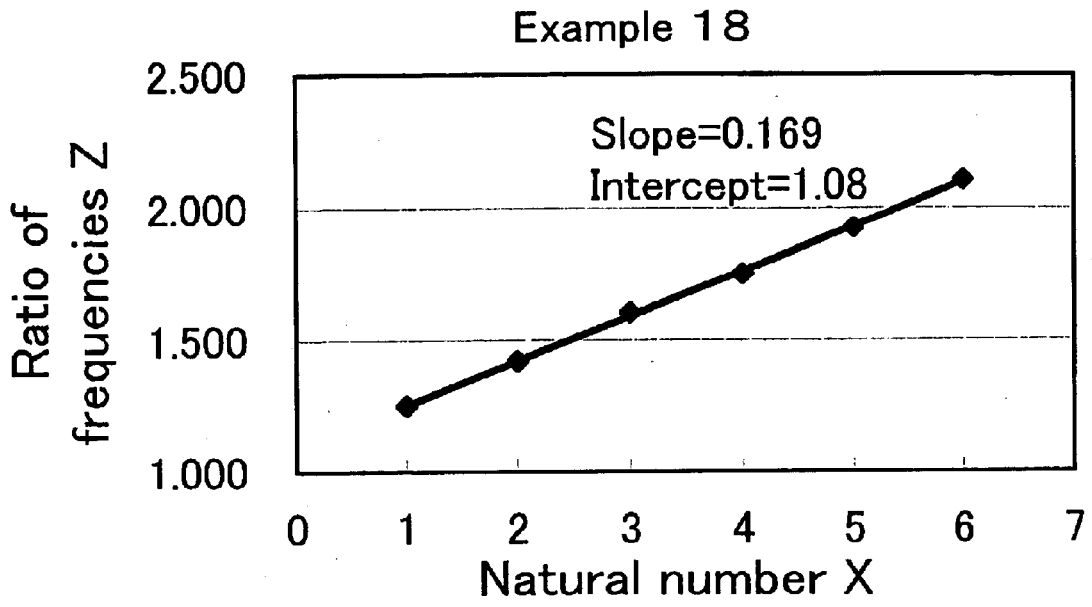
Figure 54:
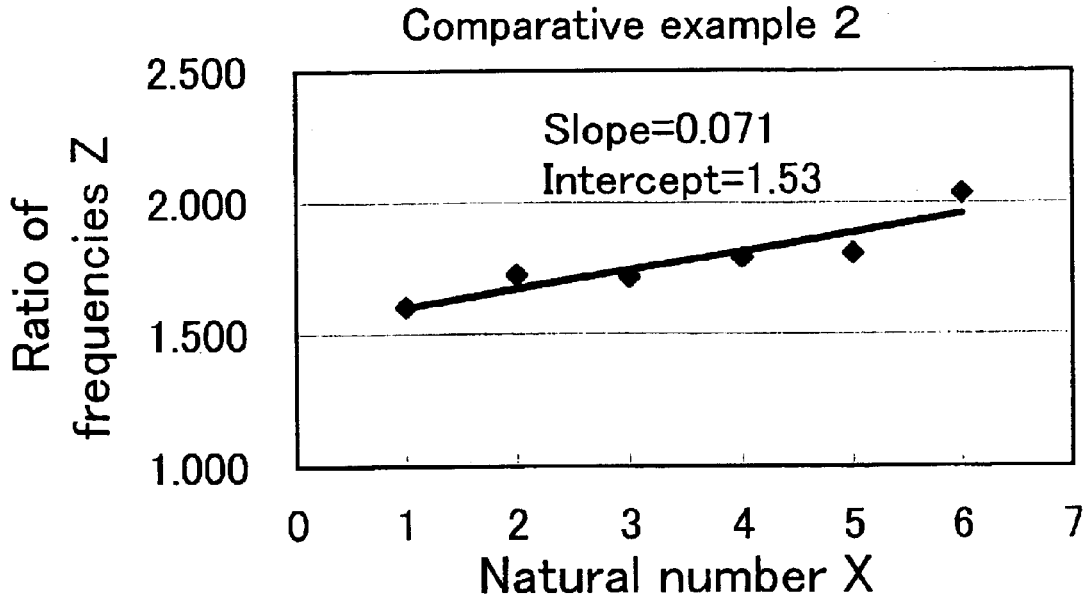
Figure 55:
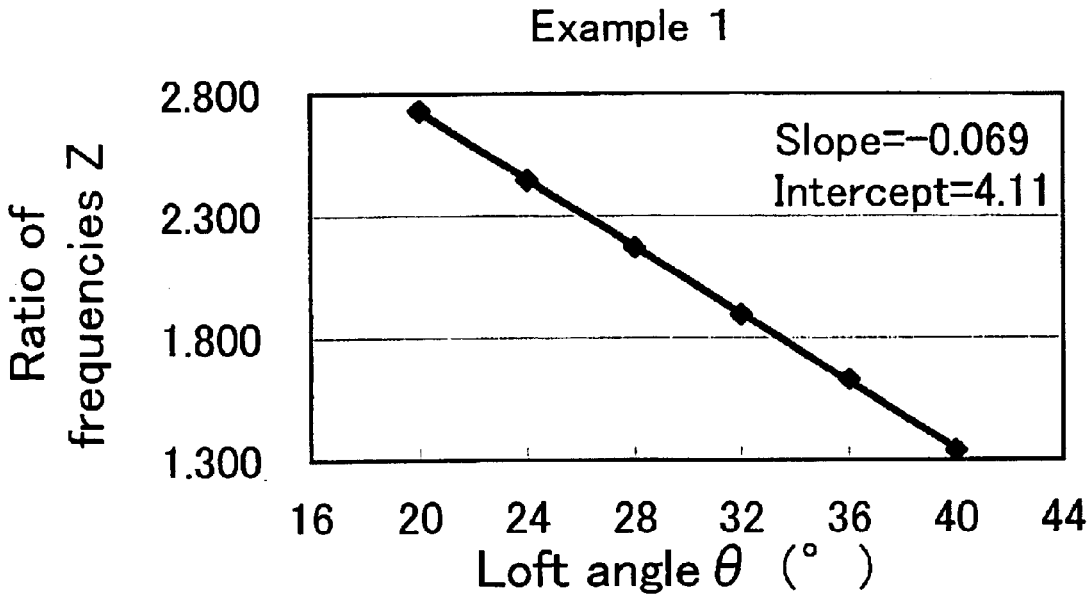
FIG. 55 to FIG. 74 are graphs showing regression lines of the ratios Z of frequencies to the loft angles θ in the golf club sets in the examples 1 to 18 and the comparative examples 1 to 2, respectively.
Figure 56:
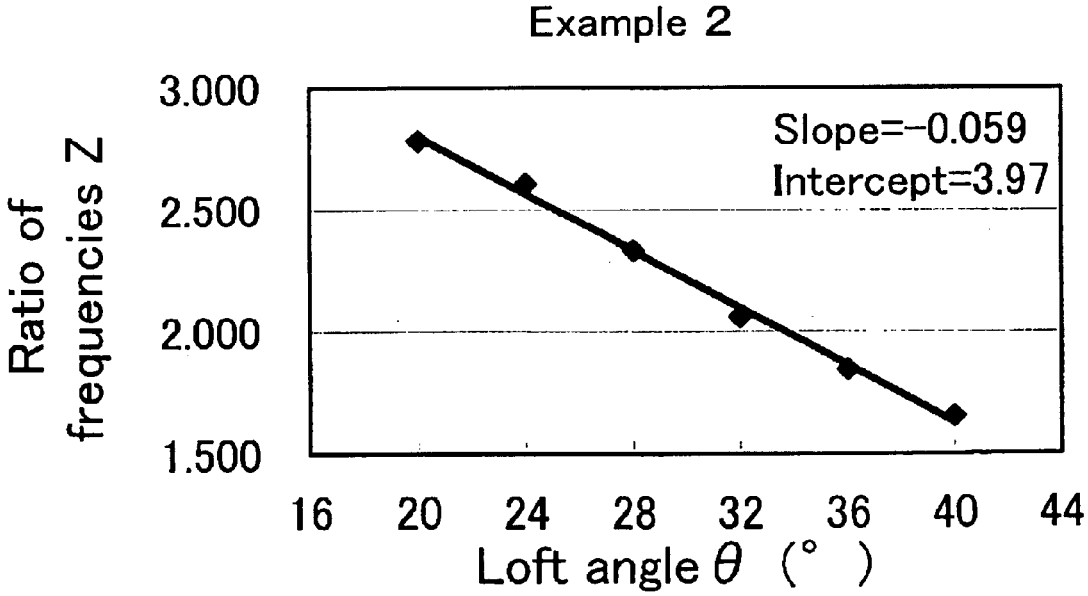
Figure 57:
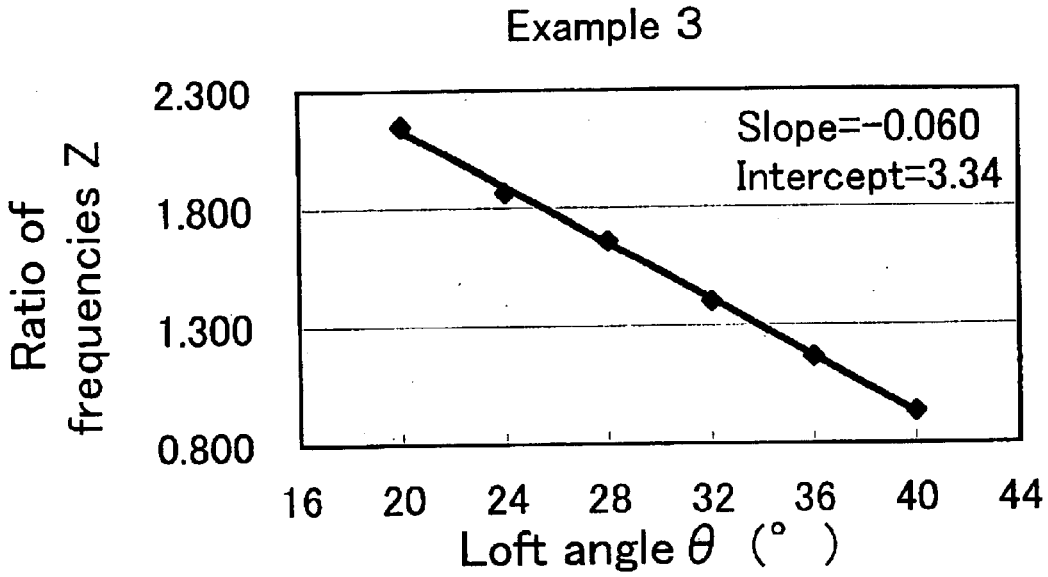
Figure 58:
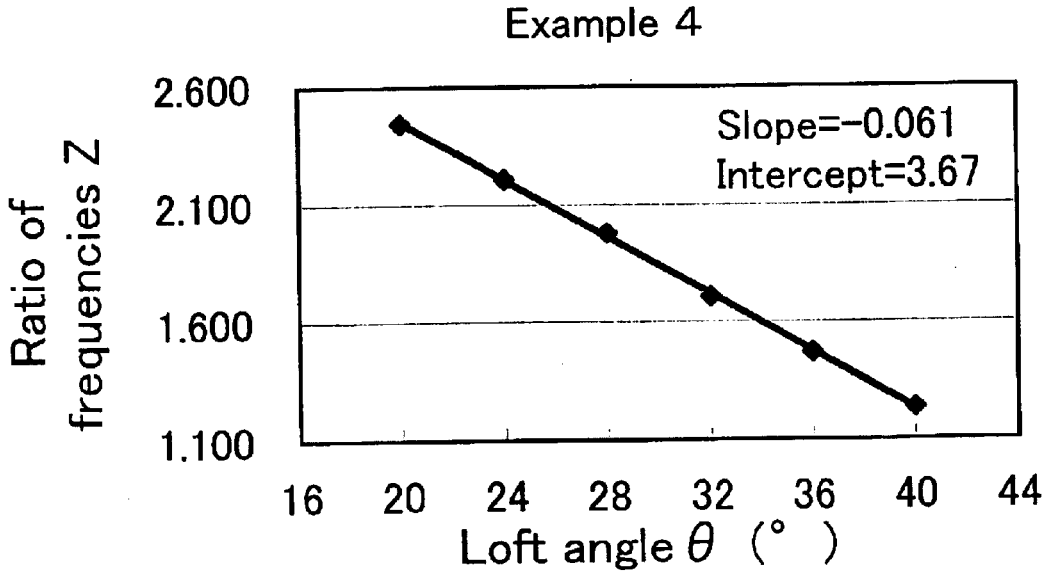
Figure 59:
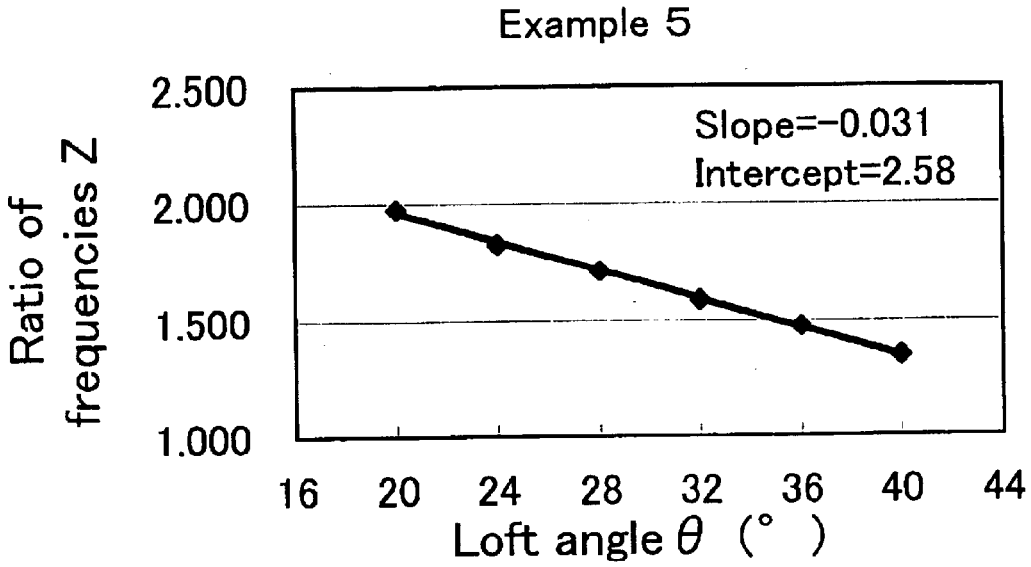
Figure 60:
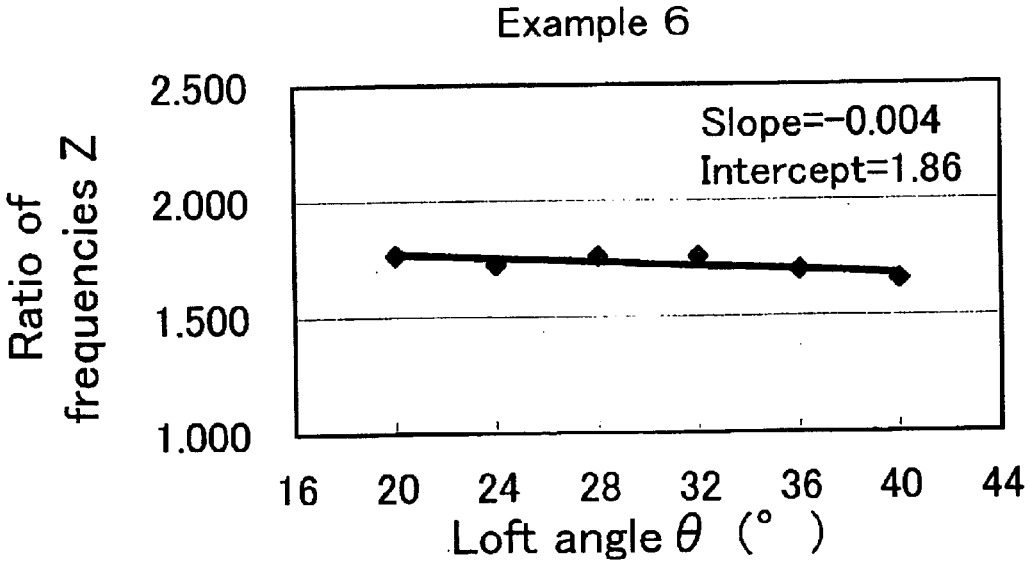
Figure 61:
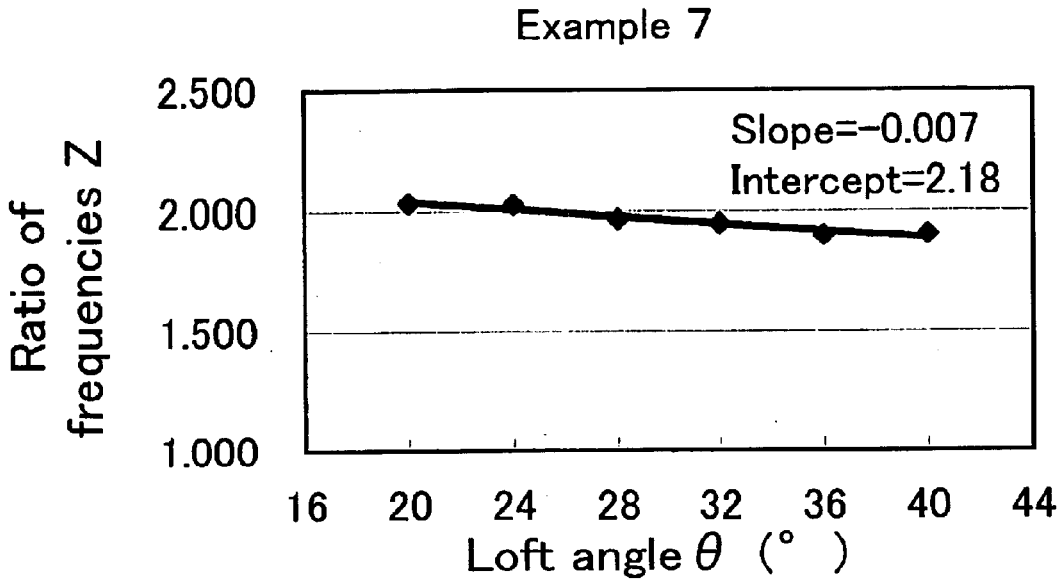
Figure 62:
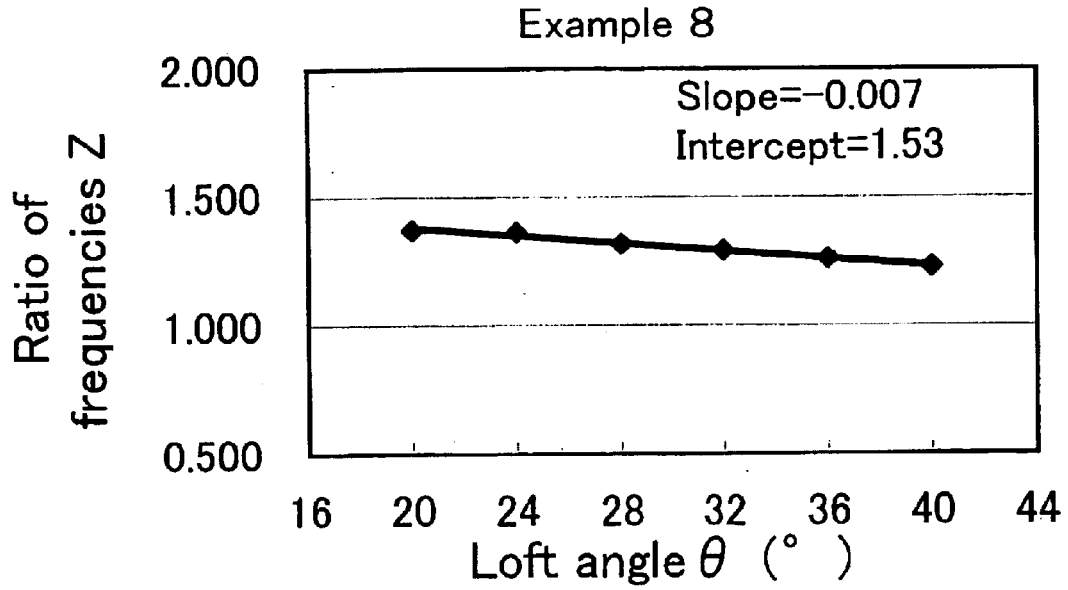
Figure 63:
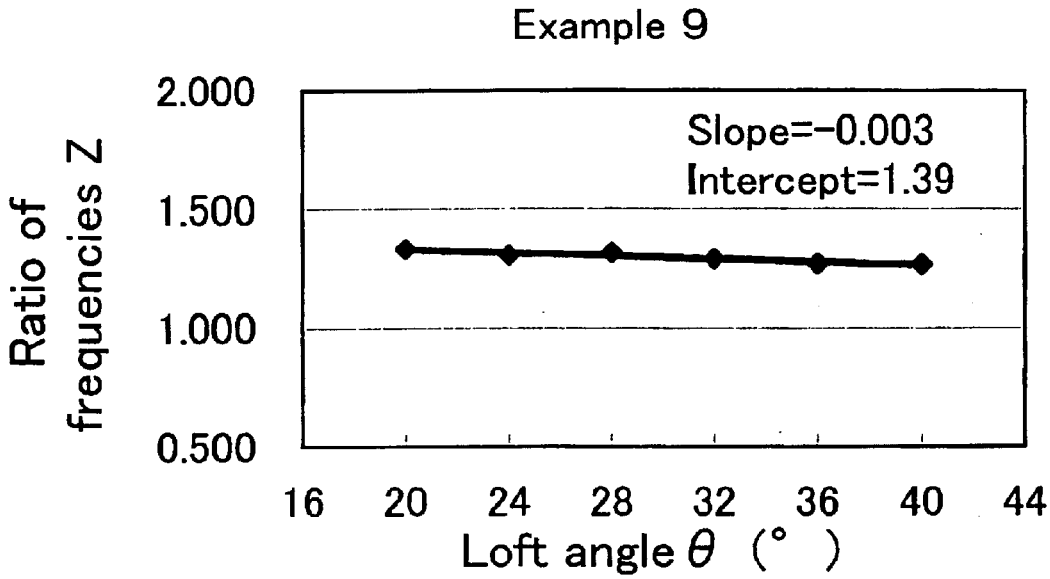
Figure 64:
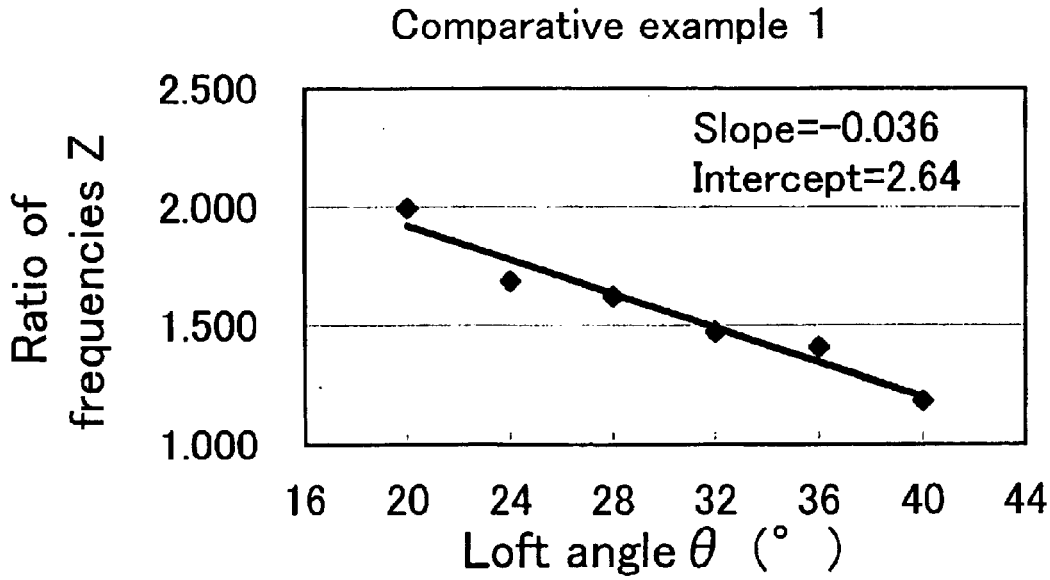
Figure 65:
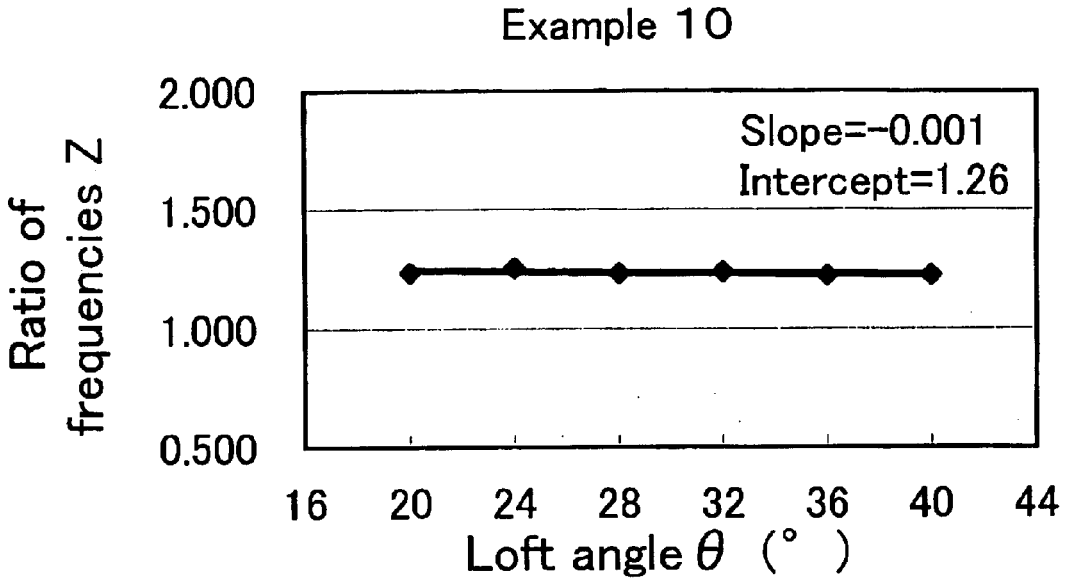
Figure 66:
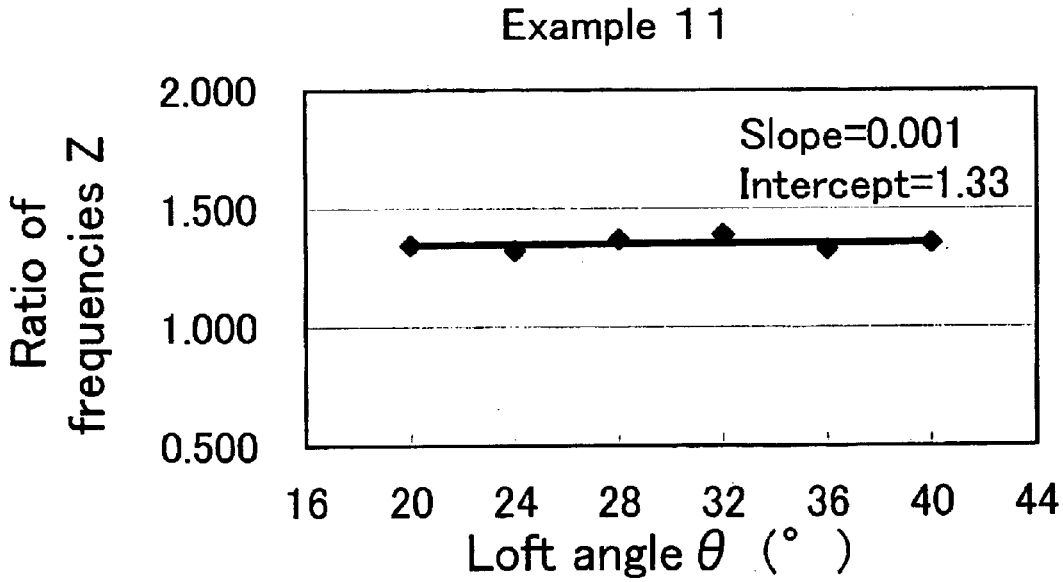
Figure 67:
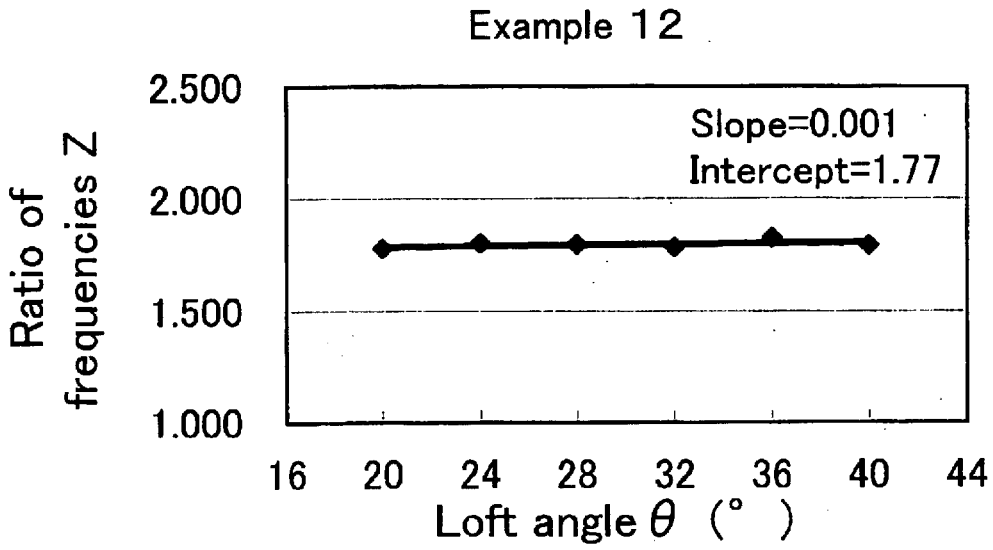
Figure 68:
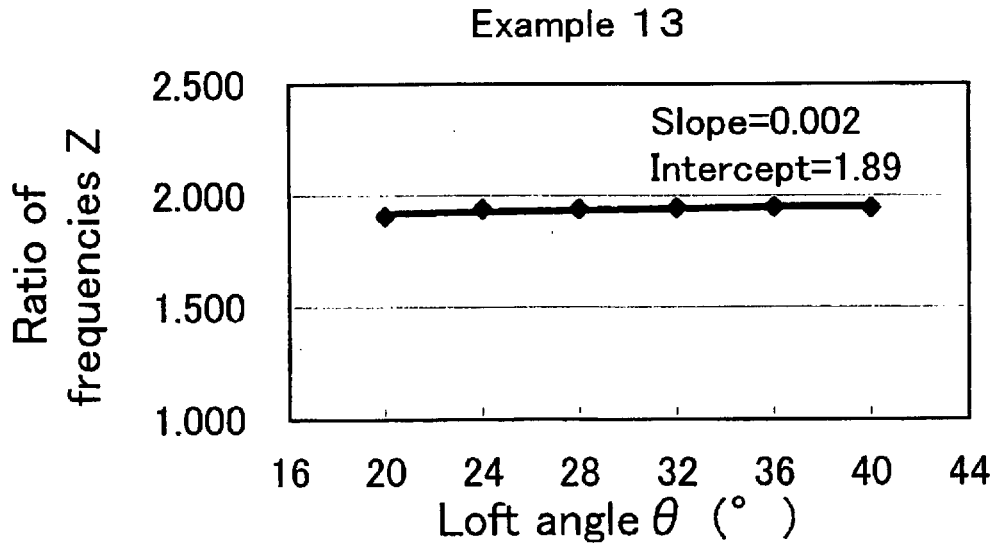
Figure 69:
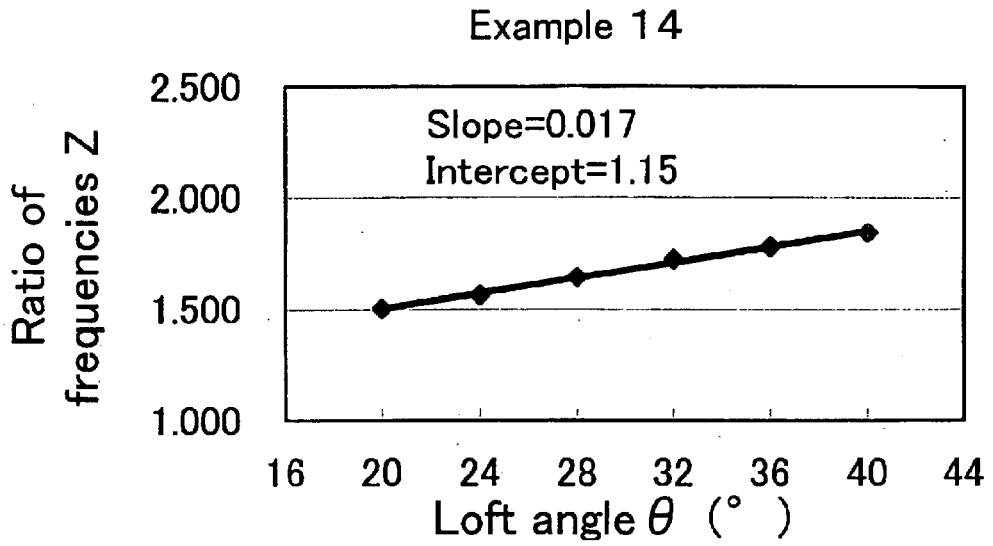
Figure 70:
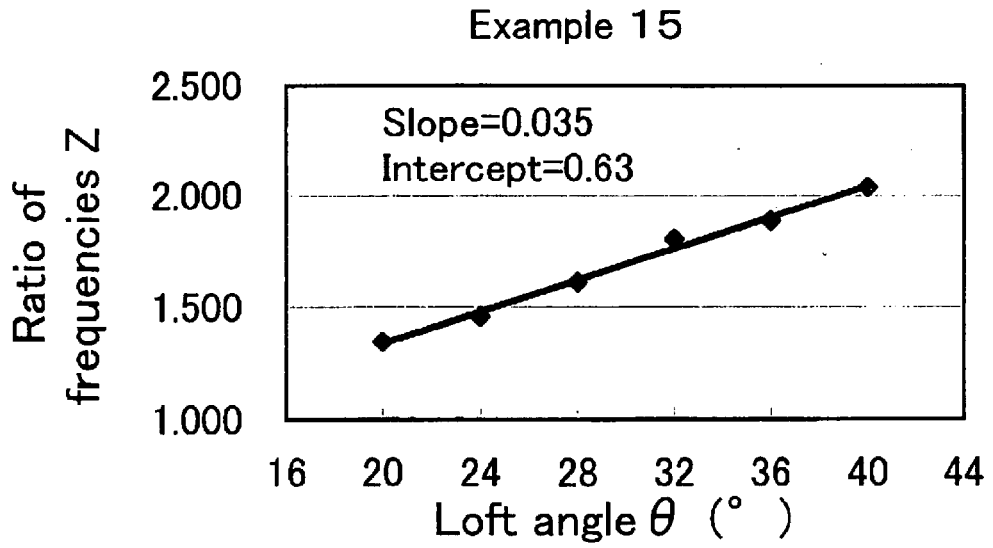
Figure 71:
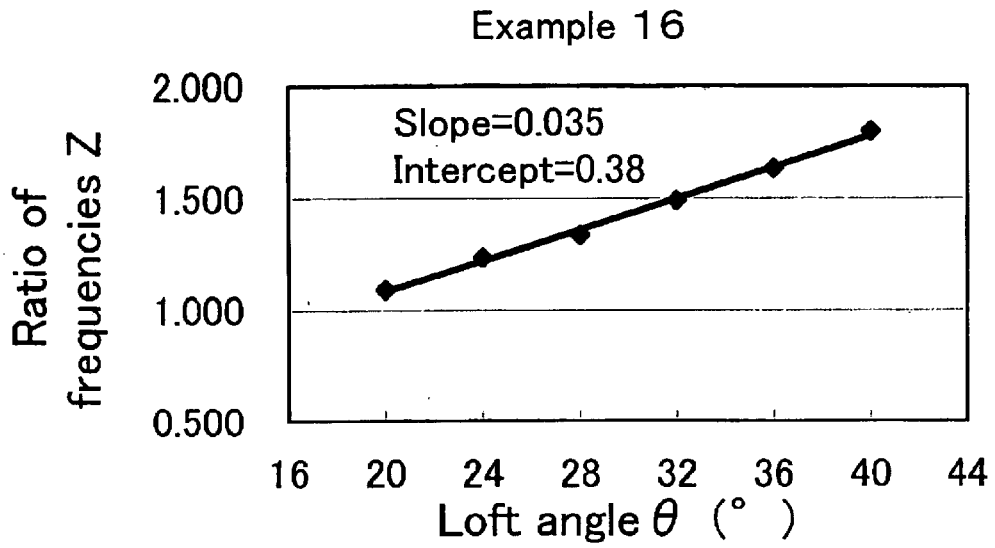
Figure 72:
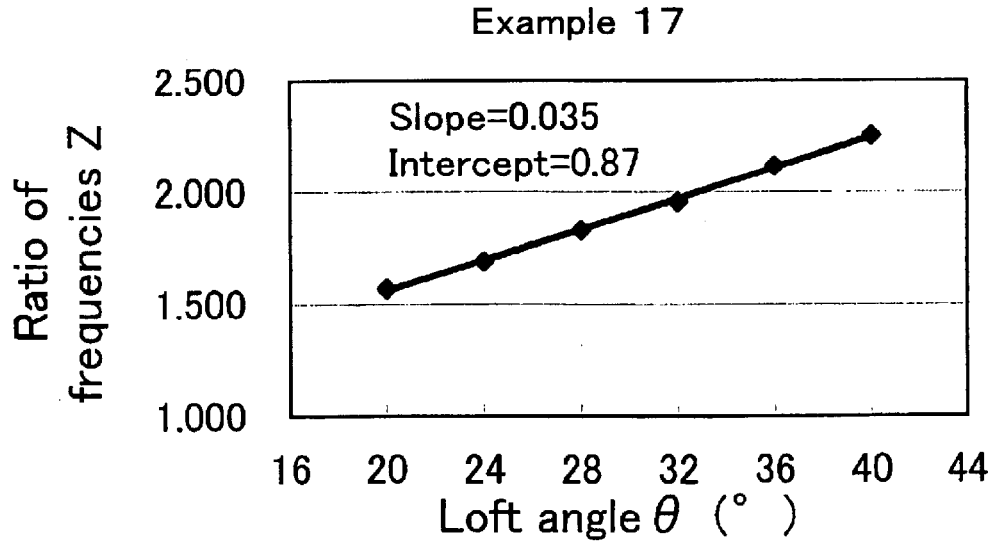
Figure 73:
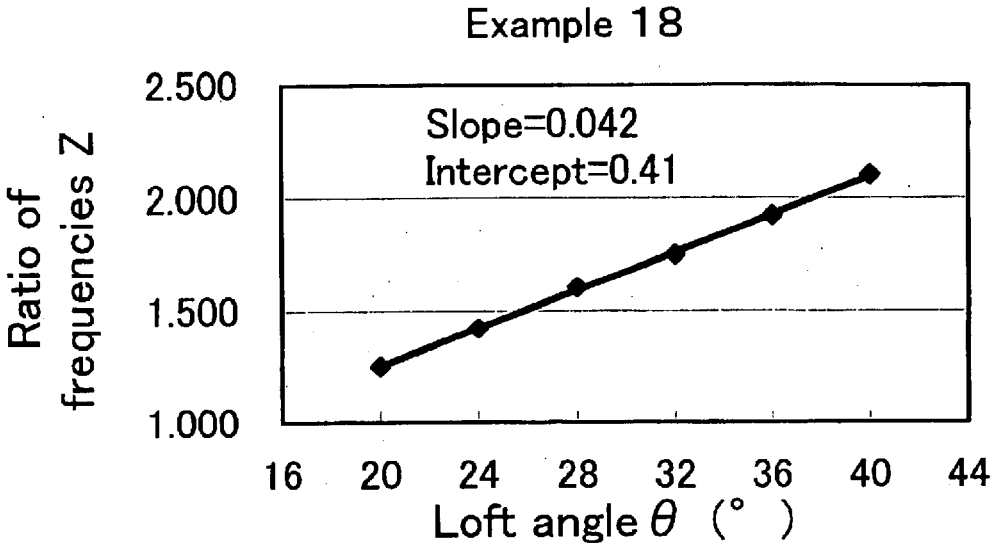
Figure 74:
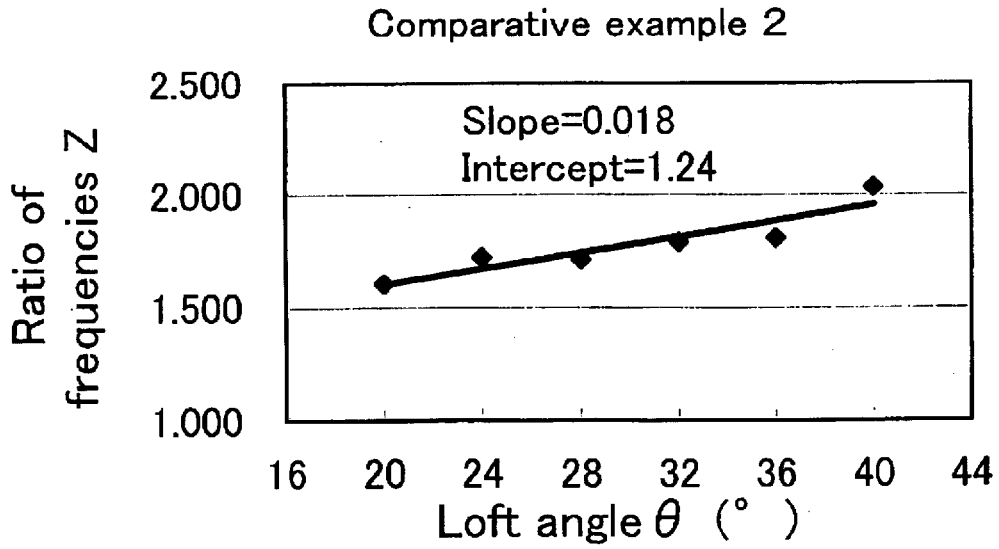
Figure 75:
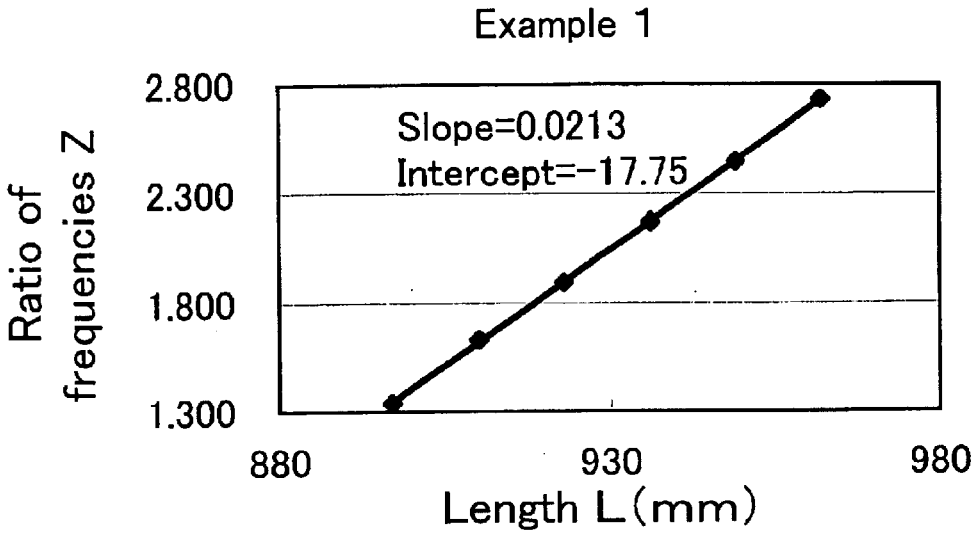
FIG. 75 to FIG. 94 are graphs showing regression lines of the ratios Z of frequencies to the length L of golf club shafts in the golf club sets in the examples 1 to 18 and the comparative examples 1 to 2, respectively.
Figure 76:
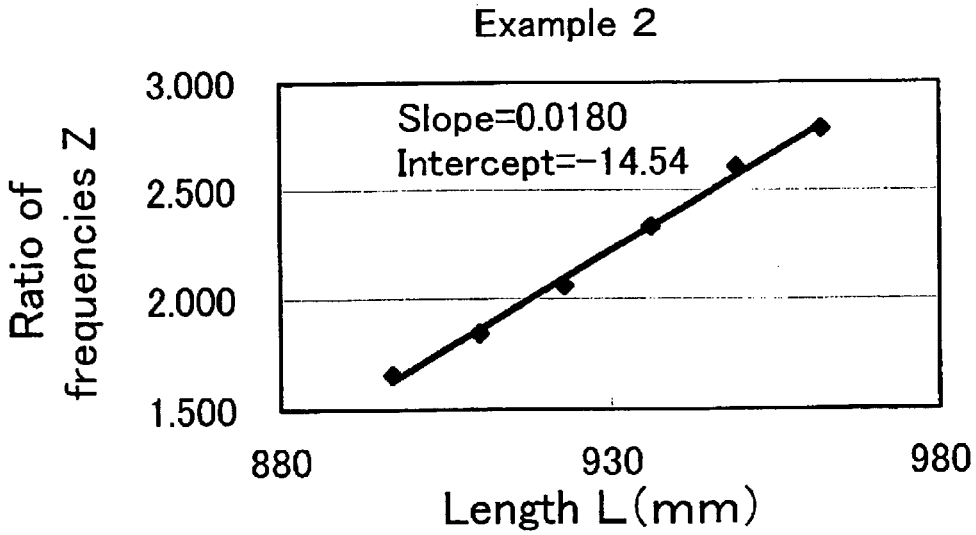
Figure 77:
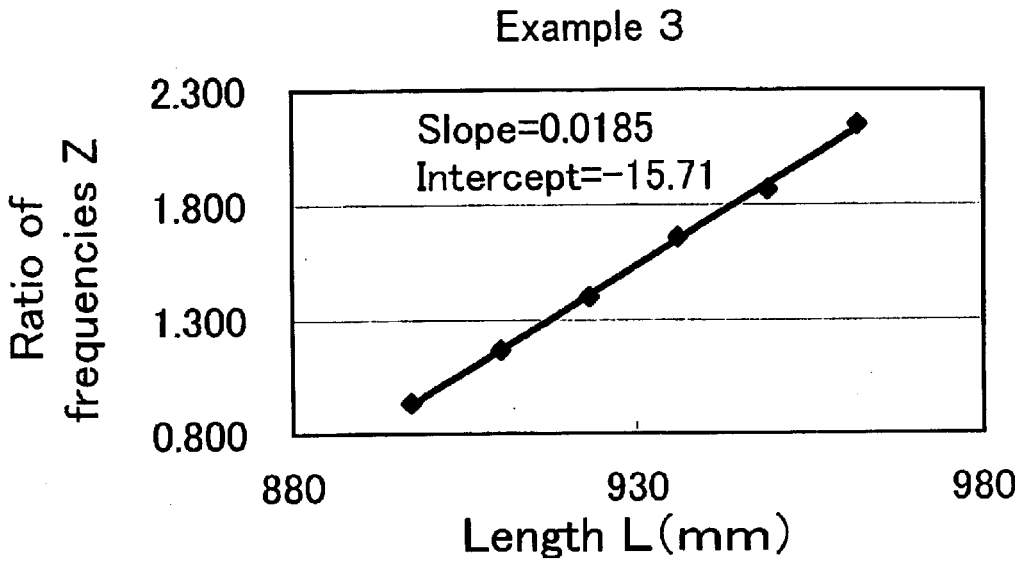
Figure 78:
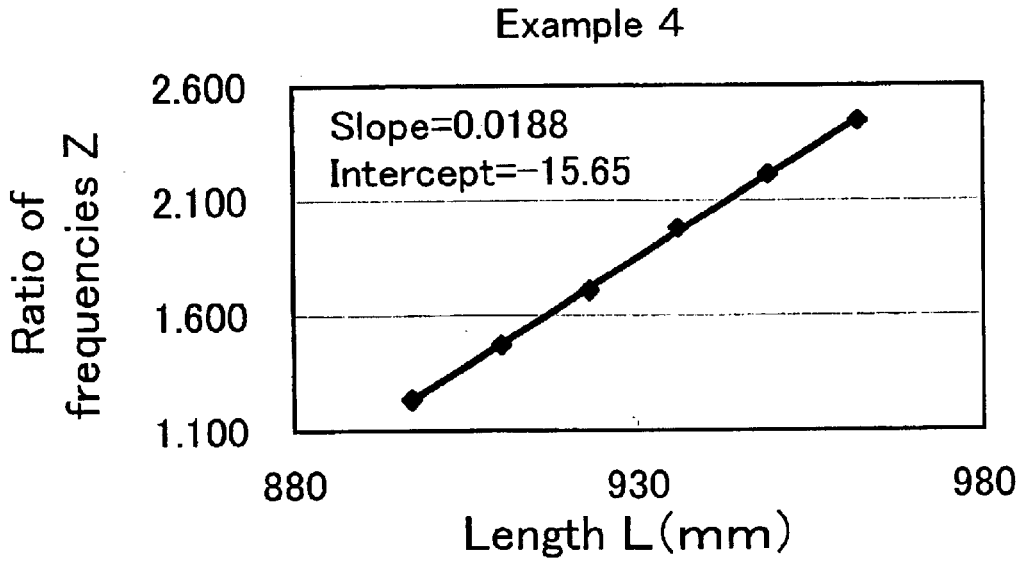
Figure 79:
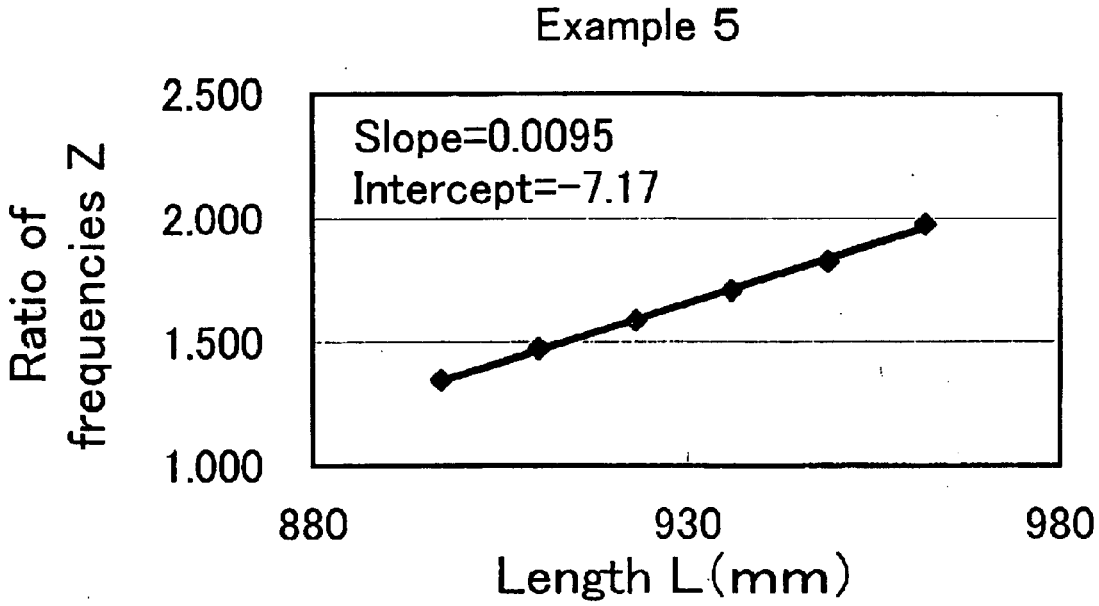
Figure 80:
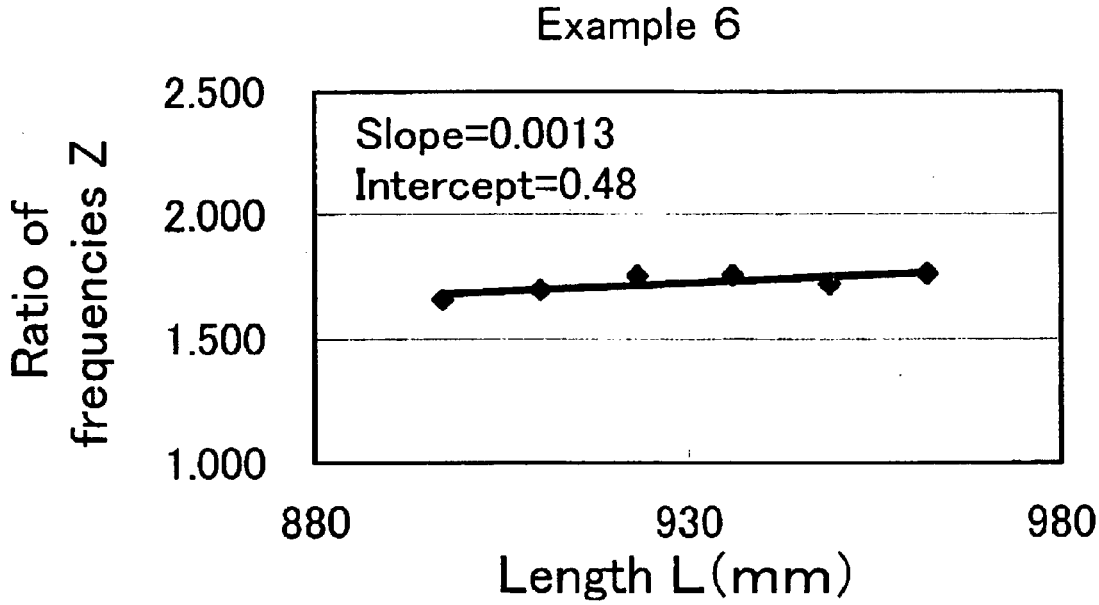
Figure 81:
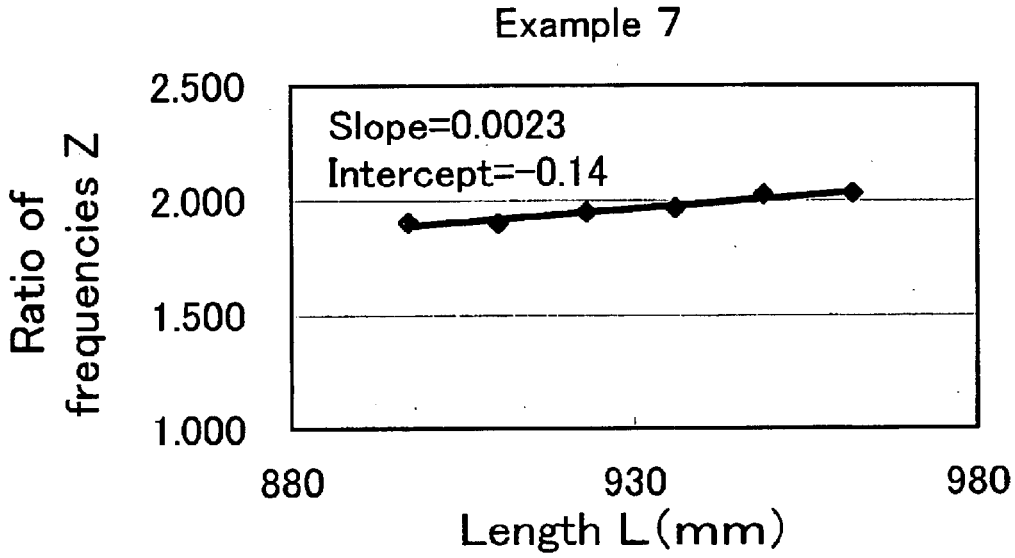
Figure 82:
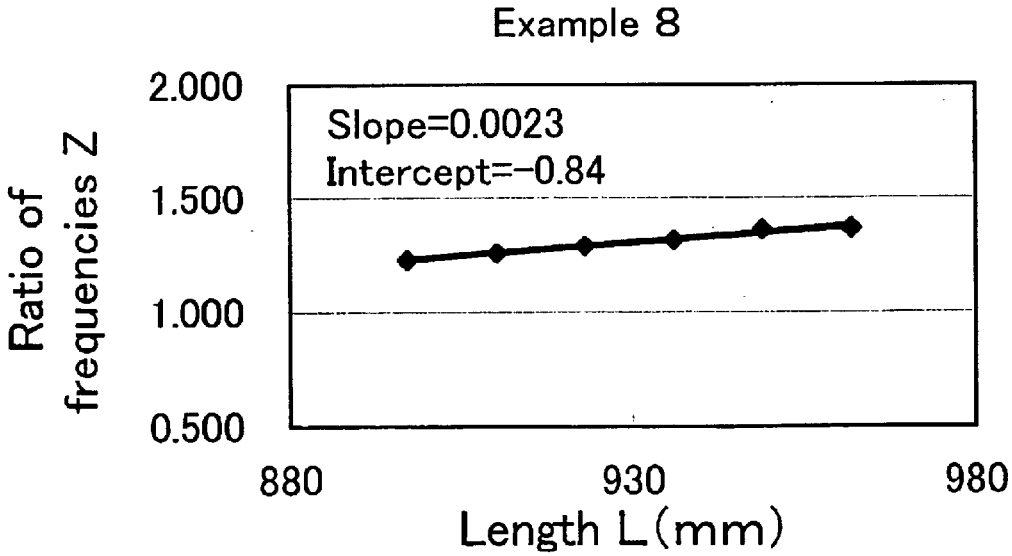
Figure 83:
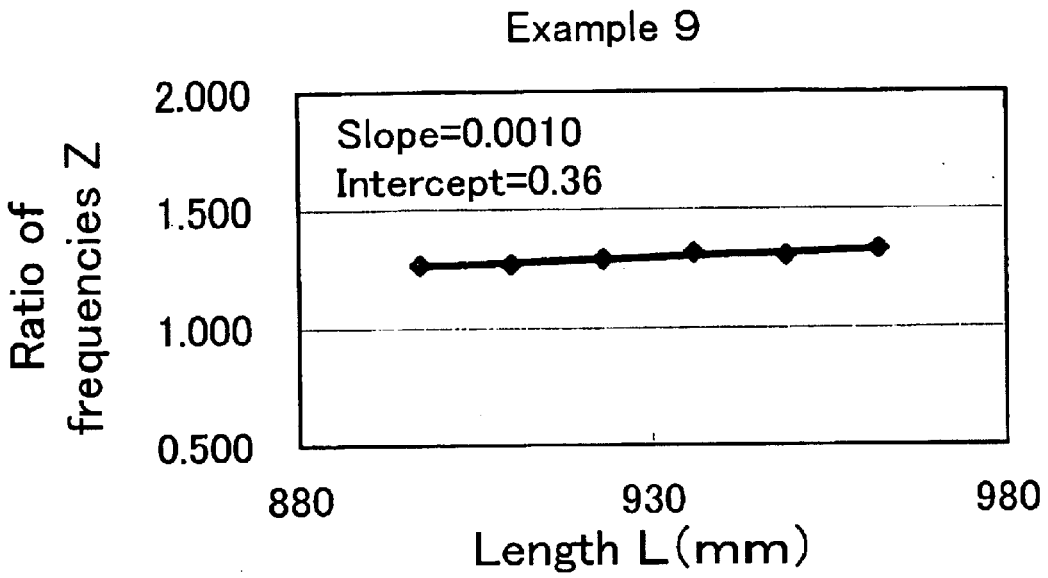
Figure 84:
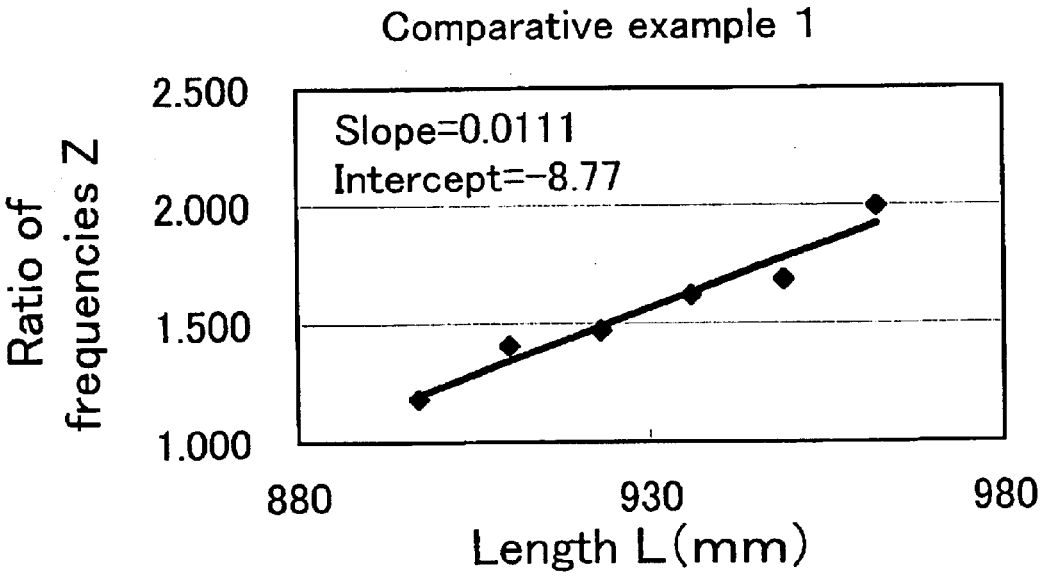
Figure 85:
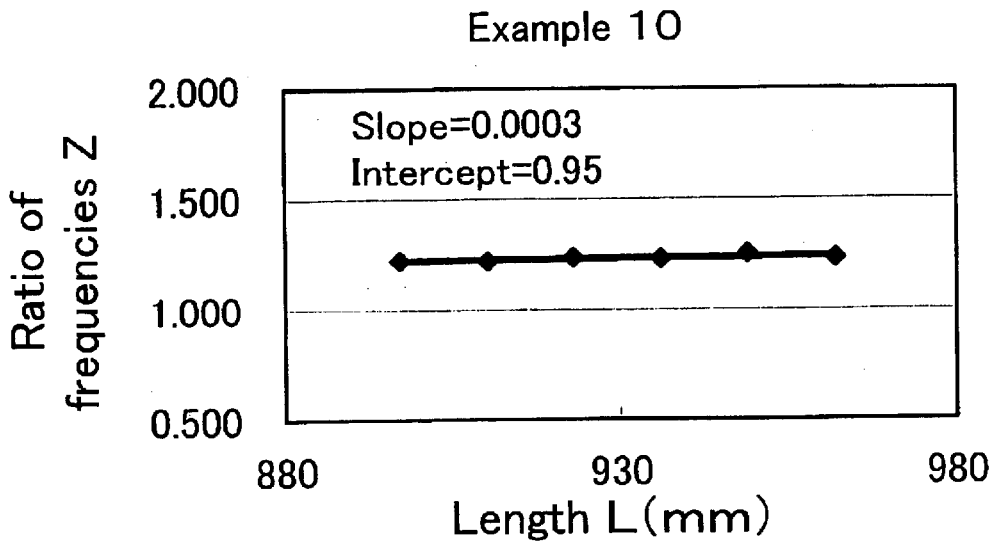
Figure 86:
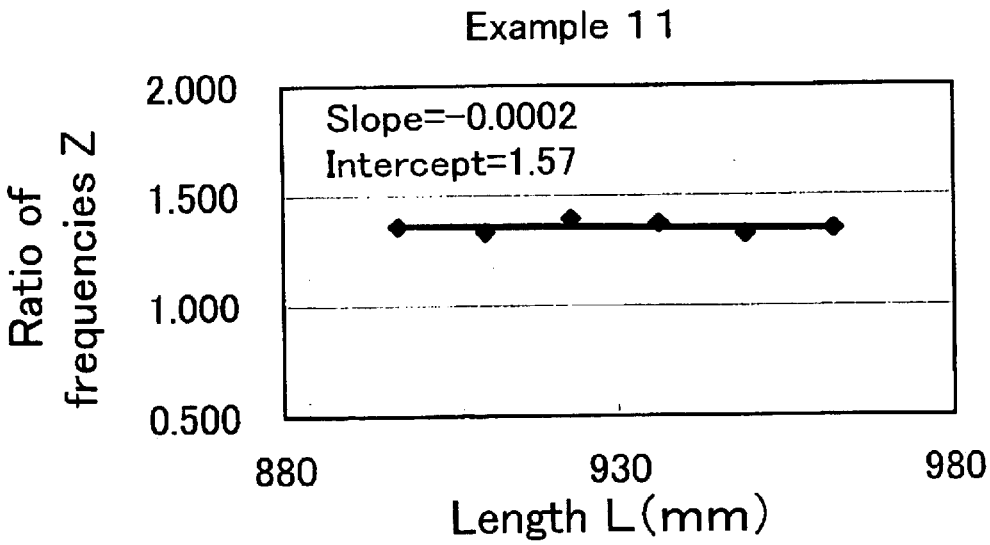
Figure 87:
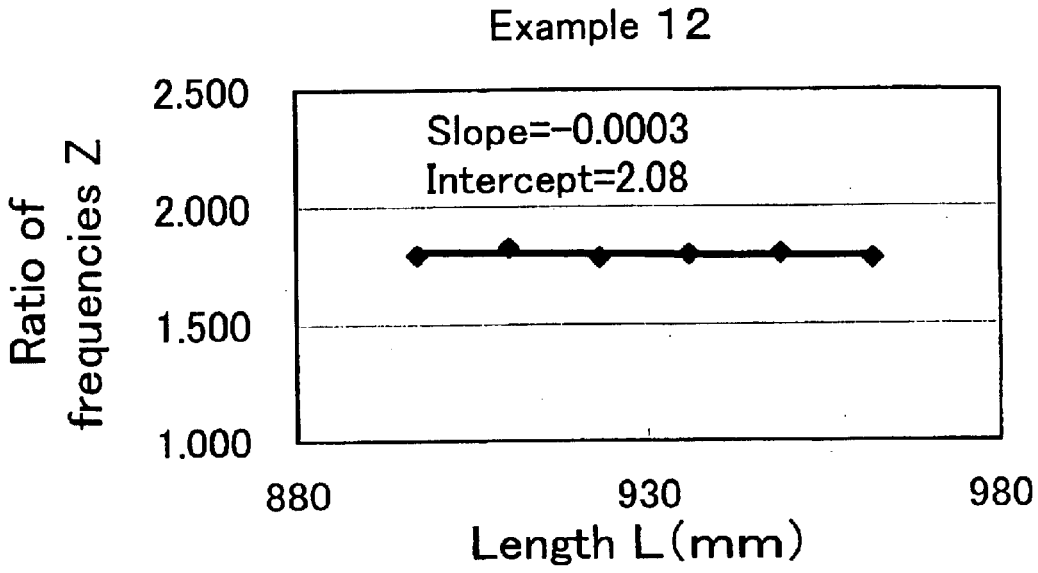
Figure 88:
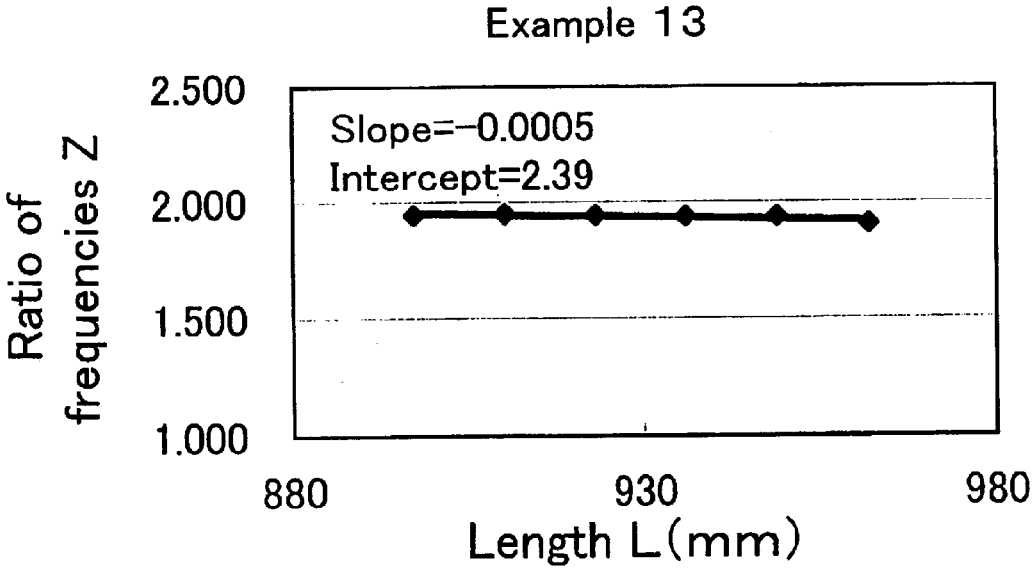
Figure 89:
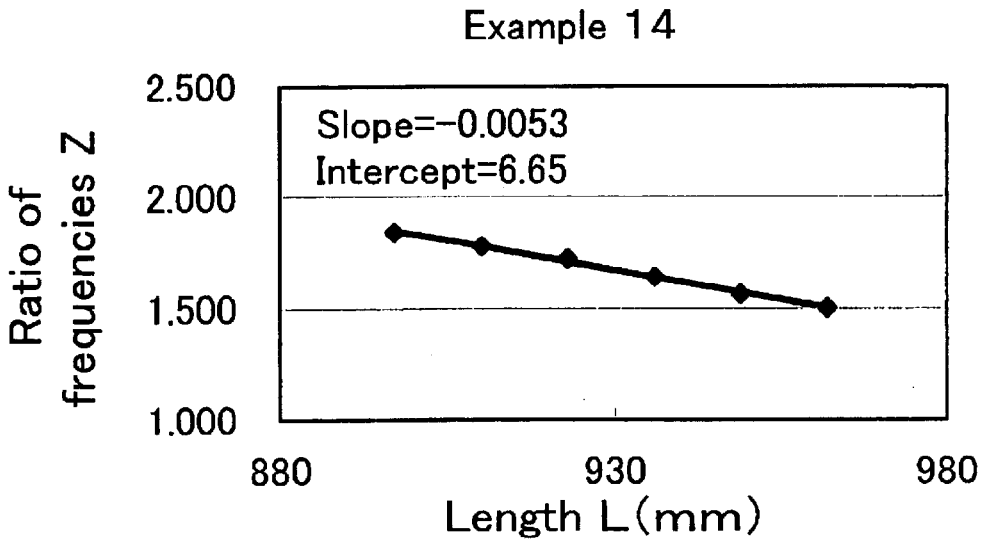
Figure 90:
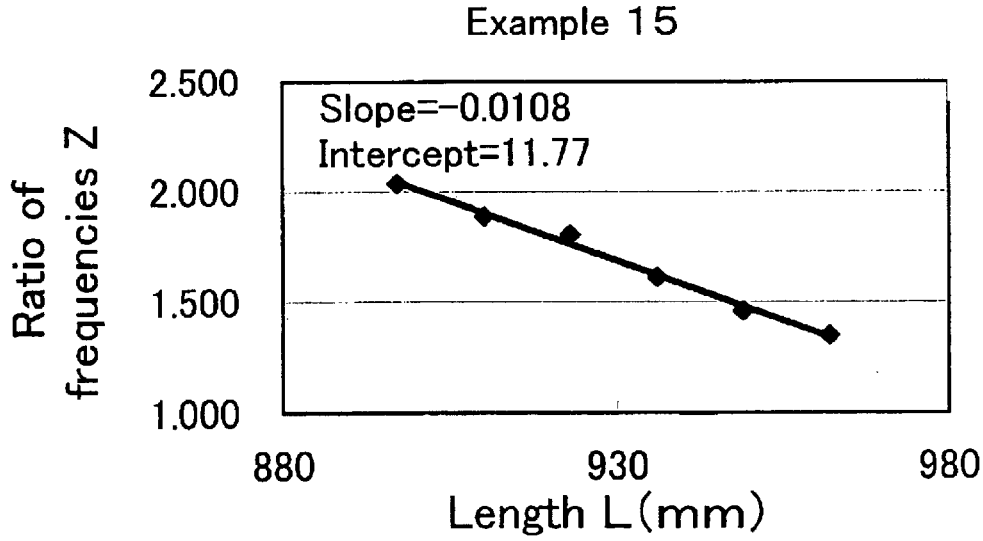
Figure 91:
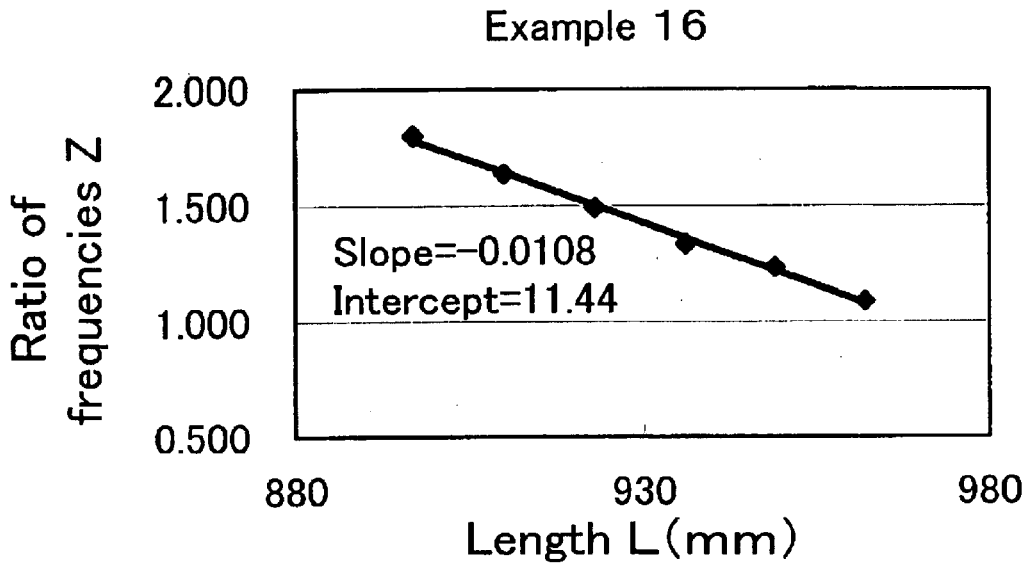
Figure 92:
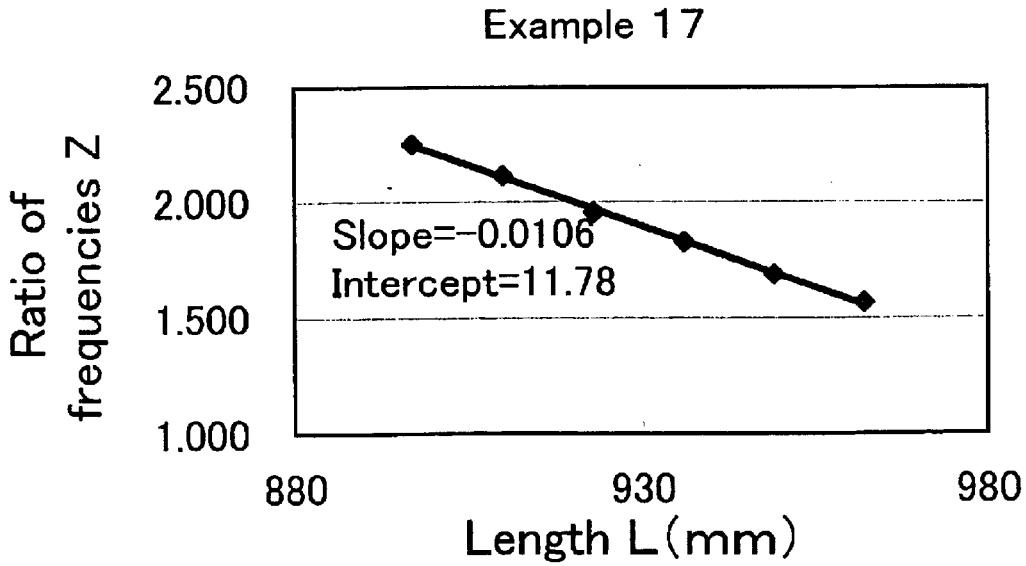
Figure 93:
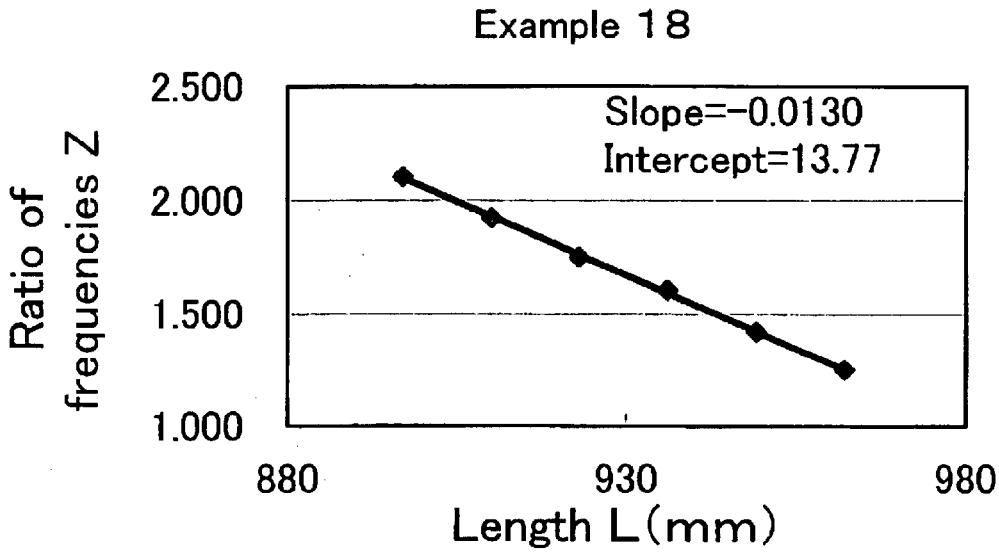
Figure 94:
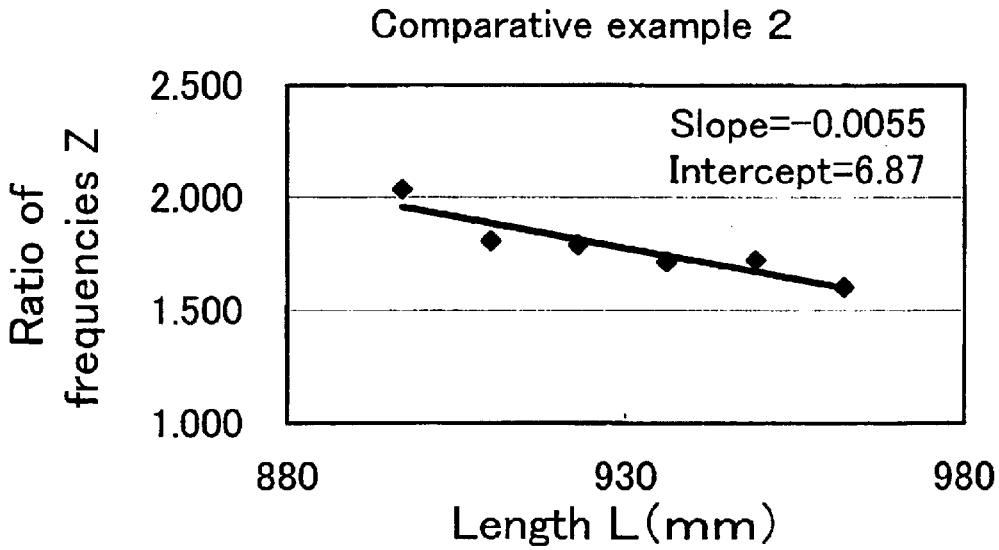

Referring to FIG. 35 to FIG. 94 and Table 21 to 22, it is understood that golf club sets in example 1 to 18 satisfy conditions stipulated in the present invention and golf club sets in comparative example 1 to 2 do not satisfy conditions stipulated in the present invention.

Hitting test using a swing robot of each golf club in the foregoing example 1 to 18 and comparative example 1 to 2 was carried out to measure launching angle of a ball. A swing robot used is Shot Robo 4 manufactured by Miyamae Co. and golf balls used are H/S ball manufactured by Yokohama Rubber Co. Head speed is determined to each club number to hit balls and launching angle just after hitting is measured. Then the average value of ten times hitting is calculated. Head speeds of the swing robot are set as follows: 35.0 m/s for #3, 34.5 m/s for #4, 34.0 m/s for #5, 33.5 m/s for #6, 33.0 m/s for #7, 32.5 m/s for #8. The foregoing launching angles are shown in Table 1 to Table 20 together.

Then regressions line of the launching angles to natural number X in example 1 to 18 and comparative example 1 to 2 are obtained. Then, a range of estimated error of the launching angle to the regression line is obtained, and the results are shown in Table 23. Range of estimated error means the difference between the maximum value and the minimum value among the difference of launching angle and the regression line in each example. Specifically, it is a range between the farthest data from the regression line upward and the farthest data from the regression line downward. Smaller range of the estimated error means more linear correlation between order of the club number (order of size of the loft angle) and height of trajectory of a hit ball.

TABLE 23

| | Example 1 | Example 2 | Example 3 | Example 4 | Example 5 |
|---|---|---|---|---|---|
| Range of estimated error | 0.23 | 0.55 | 0.35 | 0.25 | 0.16 |
| | Example 6 | Example 7 | Example 8 | Example 9 | Comparative example 1 |
| Range of estimated error | 0.57 | 0.36 | 0.21 | 0.22 | 1.45 |
| | Example 10 | Example 11 | Example 12 | Example 13 | Example 14 |
| Range of estimated error | 0.25 | 0.68 | 0.38 | 0.19 | 0.20 |
| | Example 15 | Example 16 | Example 17 | Example 18 | Comparative example 2 |
| Range of estimated error | 0.61 | 0.43 | 0.15 | 0.20 | 1.41 |

As shown in Table 23, golf club sets in example 1 to 9 have smaller range of estimated error in comparison with golf club sets in comparative example 1 and it is understood that height of trajectory of a hit ball corresponding to loft angle is obtained through whole set. On the other hand, golf club sets in example 10 to 18 has smaller range of estimated error in comparison with golf club sets in comparative example 2 and it is understood that height of trajectory of a hit ball corresponding to loft angle is obtained through whole set.

In Table 24 to Table 43, club number, natural number X, loft angle θ (degree), golf club shaft length L (mm), frequency f1 (cpm), frequency f2 (cpm), the sum Y (cpm) of frequencies of a golf club set each in example 1 to 18 and comparative example 1 to 2 were shown. Here, frequency f1 is a frequency per unit time, the frequency being measured by vibrating a tip portion of a golf club shaft in a state that a rear end portion was fastened for a length of 178 mm from the rear end and a 200 g weight was loaded on the tip portion for a length of 30 mm from the tip end. Frequency f2 is a frequency per unit time, the frequency being measured by vibrating the rear end portion in a state that the tip portion was fastened for a length of 178 mm from the tip end and a 200 g weight was loaded on the rear portion for a length of 30 mm from the rear end. The sum Y of frequencies is a sum of frequency f1 and frequency f2

TABLE 24

Example 1

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 365 | 280 | 645 | 595 |
| #4 | 2 | 24 | 949 | 367 | 285 | 652 | 596 |
| #5 | 3 | 28 | 936 | 371 | 282 | 653 | 606 |
| #6 | 4 | 32 | 923 | 371 | 285 | 656 | 611 |
| #7 | 5 | 36 | 910 | 373 | 283 | 656 | 623 |
| #8 | 6 | 40 | 897 | 373 | 282 | 655 | 635 |

TABLE 25

Example 2

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 335 | 258 | 593 | 564 |
| #4 | 2 | 24 | 949 | 337 | 264 | 601 | 571 |
| #5 | 3 | 28 | 936 | 340 | 270 | 610 | 576 |
| #6 | 4 | 32 | 923 | 344 | 277 | 621 | 578 |

TABLE 25-continued

Example 2

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #7 | 5 | 36 | 910 | 345 | 282 | 627 | 590 |
| #8 | 6 | 40 | 897 | 340 | 283 | 623 | 615 |

TABLE 26

Example 3

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 376 | 301 | 677 | 633 |
| #4 | 2 | 24 | 949 | 384 | 307 | 691 | 632 |
| #5 | 3 | 28 | 936 | 386 | 308 | 694 | 649 |
| #6 | 4 | 32 | 923 | 387 | 309 | 696 | 667 |
| #7 | 5 | 36 | 910 | 394 | 315 | 709 | 665 |
| #8 | 6 | 40 | 897 | 393 | 314 | 707 | 691 |

TABLE 27

Example 4

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 362 | 265 | 627 | 581 |
| #4 | 2 | 24 | 949 | 365 | 271 | 636 | 588 |
| #5 | 3 | 28 | 936 | 369 | 275 | 644 | 594 |
| #6 | 4 | 32 | 923 | 372 | 278 | 650 | 605 |
| #7 | 5 | 36 | 910 | 371 | 281 | 652 | 623 |
| #8 | 6 | 40 | 897 | 373 | 284 | 657 | 635 |

TABLE 28

Example 5

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 354 | 262 | 616 | 570 |
| #4 | 2 | 24 | 949 | 363 | 270 | 633 | 579 |
| #5 | 3 | 28 | 936 | 370 | 272 | 642 | 603 |
| #6 | 4 | 32 | 923 | 376 | 281 | 657 | 612 |
| #7 | 5 | 36 | 910 | 384 | 284 | 668 | 629 |
| #8 | 6 | 40 | 897 | 388 | 288 | 676 | 653 |

TABLE 29

Example 6

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 370 | 265 | 635 | 602 |
| #4 | 2 | 24 | 949 | 385 | 277 | 662 | 609 |
| #5 | 3 | 28 | 936 | 395 | 280 | 675 | 641 |

TABLE 29-continued

Example 6

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #6 | 4 | 32 | 923 | 409 | 290 | 699 | 651 |
| #7 | 5 | 36 | 910 | 421 | 296 | 717 | 672 |
| #8 | 6 | 40 | 897 | 423 | 302 | 725 | 712 |

TABLE 30

Example 7

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 334 | 238 | 572 | 538 |
| #4 | 2 | 24 | 949 | 344 | 250 | 594 | 554 |
| #5 | 3 | 28 | 936 | 355 | 261 | 616 | 570 |
| #6 | 4 | 32 | 923 | 361 | 271 | 632 | 593 |
| #7 | 5 | 36 | 910 | 371 | 281 | 652 | 613 |
| #8 | 6 | 40 | 897 | 373 | 289 | 662 | 649 |

TABLE 31

Example 8

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 383 | 300 | 683 | 629 |
| #4 | 2 | 24 | 949 | 395 | 311 | 706 | 647 |
| #5 | 3 | 28 | 936 | 403 | 319 | 722 | 671 |
| #6 | 4 | 32 | 923 | 411 | 330 | 741 | 693 |
| #7 | 5 | 36 | 910 | 420 | 340 | 760 | 713 |
| #8 | 6 | 40 | 897 | 424 | 349 | 773 | 744 |

TABLE 32

Example 9

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 315 | 241 | 556 | 520 |
| #4 | 2 | 24 | 949 | 328 | 252 | 580 | 537 |
| #5 | 3 | 28 | 936 | 340 | 261 | 601 | 567 |
| #6 | 4 | 32 | 923 | 354 | 273 | 627 | 586 |
| #7 | 5 | 36 | 910 | 368 | 281 | 649 | 610 |
| #8 | 6 | 40 | 897 | 377 | 289 | 666 | 643 |

TABLE 33

Comparative example 1

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 352 | 273 | 625 | 609 |
| #4 | 2 | 24 | 949 | 359 | 293 | 652 | 596 |

TABLE 33-continued

Comparative example 1

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #5 | 3 | 28 | 936 | 366 | 293 | 659 | 622 |
| #6 | 4 | 32 | 923 | 373 | 303 | 676 | 630 |
| #7 | 5 | 36 | 910 | 380 | 297 | 677 | 668 |
| #8 | 6 | 40 | 897 | 387 | 298 | 685 | 691 |

TABLE 34

Example 10

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 297 | 238 | 535 | 497 |
| #4 | 2 | 24 | 949 | 314 | 252 | 566 | 518 |
| #5 | 3 | 28 | 936 | 328 | 262 | 590 | 550 |
| #6 | 4 | 32 | 923 | 343 | 275 | 618 | 576 |
| #7 | 5 | 36 | 910 | 357 | 286 | 643 | 609 |
| #8 | 6 | 40 | 897 | 367 | 298 | 665 | 642 |

TABLE 35

Example 11

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 284 | 219 | 503 | 482 |
| #4 | 2 | 24 | 949 | 305 | 237 | 542 | 499 |
| #5 | 3 | 28 | 936 | 321 | 252 | 573 | 530 |
| #6 | 4 | 32 | 923 | 337 | 266 | 603 | 562 |
| #7 | 5 | 36 | 910 | 353 | 277 | 630 | 599 |
| #8 | 6 | 40 | 897 | 362 | 291 | 653 | 647 |

TABLE 36

Example 12

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 360 | 266 | 626 | 589 |
| #4 | 2 | 24 | 949 | 379 | 285 | 664 | 608 |
| #5 | 3 | 28 | 936 | 391 | 299 | 690 | 648 |
| #6 | 4 | 32 | 923 | 404 | 315 | 719 | 685 |
| #7 | 5 | 36 | 910 | 427 | 327 | 754 | 708 |
| #8 | 6 | 40 | 897 | 435 | 341 | 776 | 756 |

TABLE 37

Example 13

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 377 | 290 | 667 | 617 |
| #4 | 2 | 24 | 949 | 396 | 305 | 701 | 643 |
| #5 | 3 | 28 | 936 | 414 | 318 | 732 | 675 |
| #6 | 4 | 32 | 923 | 428 | 331 | 759 | 716 |
| #7 | 5 | 36 | 910 | 449 | 343 | 792 | 743 |
| #8 | 6 | 40 | 897 | 462 | 355 | 817 | 784 |

TABLE 38

Example 14

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 321 | 233 | 554 | 515 |
| #4 | 2 | 24 | 949 | 343 | 252 | 595 | 545 |
| #5 | 3 | 28 | 936 | 361 | 270 | 631 | 584 |
| #6 | 4 | 32 | 923 | 378 | 285 | 663 | 629 |
| #7 | 5 | 36 | 910 | 399 | 302 | 701 | 662 |
| #8 | 6 | 40 | 897 | 416 | 318 | 734 | 708 |

TABLE 39

Example 15

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 354 | 278 | 632 | 599 |
| #4 | 2 | 24 | 949 | 385 | 298 | 683 | 625 |
| #5 | 3 | 28 | 936 | 411 | 315 | 726 | 672 |
| #6 | 4 | 32 | 923 | 435 | 331 | 766 | 717 |
| #7 | 5 | 36 | 910 | 461 | 349 | 810 | 760 |
| #8 | 6 | 40 | 897 | 481 | 361 | 842 | 823 |

TABLE 40

Example 16

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 274 | 220 | 494 | 467 |
| #4 | 2 | 24 | 949 | 300 | 244 | 544 | 499 |
| #5 | 3 | 28 | 936 | 320 | 265 | 585 | 544 |
| #6 | 4 | 32 | 923 | 343 | 285 | 628 | 586 |
| #7 | 5 | 36 | 910 | 360 | 303 | 663 | 641 |
| #8 | 6 | 40 | 897 | 381 | 323 | 704 | 687 |

TABLE 41

Example 17

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 342 | 262 | 604 | 559 |
| #4 | 2 | 24 | 949 | 367 | 284 | 651 | 596 |
| #5 | 3 | 28 | 936 | 391 | 300 | 691 | 643 |
| #6 | 4 | 32 | 923 | 411 | 320 | 731 | 692 |
| #7 | 5 | 36 | 910 | 441 | 336 | 777 | 730 |
| #8 | 6 | 40 | 897 | 458 | 356 | 814 | 783 |

TABLE 42

Example 18

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 383 | 262 | 645 | 598 |
| #4 | 2 | 24 | 949 | 409 | 286 | 695 | 640 |
| #5 | 3 | 28 | 936 | 433 | 307 | 740 | 688 |
| #6 | 4 | 32 | 923 | 457 | 331 | 788 | 735 |
| #7 | 5 | 36 | 910 | 479 | 355 | 834 | 783 |
| #8 | 6 | 40 | 897 | 501 | 374 | 875 | 840 |

TABLE 43

Comparative example 2

| Club # | Natural number X | Loft angle θ (degree) | Length of golf club shaft L (mm) | Frequency f1 (cpm) | Frequency f2 (cpm) | Sum of frequencies Y (cpm) | Sum-up marks |
|---|---|---|---|---|---|---|---|
| #3 | 1 | 20 | 962 | 296 | 222 | 518 | 510 |
| #4 | 2 | 24 | 949 | 317 | 240 | 557 | 543 |
| #5 | 3 | 28 | 936 | 338 | 267 | 605 | 560 |
| #6 | 4 | 32 | 923 | 359 | 278 | 637 | 605 |
| #7 | 5 | 36 | 910 | 380 | 297 | 677 | 634 |
| #8 | 6 | 40 | 897 | 401 | 297 | 698 | 704 |

In FIG. 95 to FIG. 114, relations between natural number X and the sum Y of frequencies of a golf club set each in example 1 to 18 and comparative example 1 to 2 are shown. Moreover, in FIG. 115 to FIG. 134, relations between loft angle θ and the sum Y of frequencies of a golf club set each in example 1 to 18 and comparative example 1 to 2 are shown. In FIG. 95 to FIG. 134, two parallel straight lines putting all plotted points therebetween are written together.

In Table 44, a slope and an intercept in a regression line of the sum of frequencies Y to natural number X, maximum value and minimum value of the difference between the sum Y of frequencies and the regression line, and a slope and an intercept in a regression line of the sum Y of frequencies to loft angle θ, maximum value and minimum value of the difference between the sum Y of frequencies and the regression line are shown. Further in FIG. 135 to FIG. 154, a regression line of the sum Y of frequencies to natural number X of a golf club set each in example 1 to 18 and comparative example 1 to 2 is shown. Further, in FIG. 155 to FIG. 174, a regression line of the sum Y of frequencies to loft angle θ of a golf club set each in example 1 to 18 and comparative example 1 to 2 is shown.

In Table 45, a slope and an intercept in a regression line of the sum Y of frequencies to golf club shaft length L, maximum value and minimum value of the difference between the sum Y of frequencies and the regression line are shown. Further, in FIG. 175 to FIG. 194, a regression line of the sum Y of frequencies to golf club shaft length L of a golf club set each in example 1 to 18 and comparative example 1 to 2 is shown.

TABLE 44

| | Regression line of sum Y of frequencies to natural number X | | | | Regression line of sum Y of frequencies to loft angle θ | | | |
|---|---|---|---|---|---|---|---|---|
| | Slope | Intercept | Max. | Min. | Slope | Intercept | Max. | Min. |
| Example 1 | 1.86 | 646 | 2.2 | −3.2 | 0.46 | 639 | 2.2 | −3.2 |
| Example 2 | 6.83 | 589 | 5.1 | −6.6 | 1.71 | 561 | 5.1 | −6.6 |
| Example 3 | 5.89 | 675 | 4.5 | −4.0 | 1.47 | 652 | 4.5 | −4.0 |
| Example 4 | 5.83 | 624 | 2.8 | −2.8 | 1.46 | 601 | 2.8 | −2.8 |
| Example 5 | 12.00 | 607 | 2.3 | −2.7 | 3.00 | 559 | 2.3 | −2.7 |

TABLE 44-continued

| | Regression line of sum Y of frequencies to natural number X | | | | Regression line of sum Y of frequencies to loft angle θ | | | |
|---|---|---|---|---|---|---|---|---|
| | Slope | Inter-cept | Max. | Min. | Slope | Inter-cept | Max. | Min. |
| Example 6 | 18.26 | 622 | 4.4 | −6.1 | 4.56 | 549 | 4.4 | −6.1 |
| Example 7 | 18.29 | 557 | 3.8 | −5.0 | 4.57 | 484 | 3.8 | −5.0 |
| Example 8 | 18.03 | 668 | 2.2 | −2.9 | 4.51 | 596 | 2.2 | −2.9 |
| Example 9 | 22.37 | 535 | 2.6 | −3.1 | 5.59 | 445 | 2.6 | −3.1 |
| Comparative example 1 | 11.20 | 623 | 8.1 | −9.3 | 2.80 | 578 | 8.1 | −9.3 |
| Example 10 | 25.97 | 512 | 2.2 | −2.9 | 6.49 | 408 | 2.2 | −2.9 |
| Example 11 | 29.83 | 480 | 4.1 | −6.4 | 7.46 | 360 | 4.1 | −6.4 |
| Example 12 | 29.97 | 600 | 4.2 | −3.9 | 7.49 | 480 | 4.2 | −3.9 |
| Example 13 | 30.00 | 640 | 2.3 | −2.7 | 7.50 | 520 | 2.3 | −2.7 |
| Example 14 | 35.71 | 521 | 2.5 | −3.0 | 8.93 | 378 | 2.5 | −3.0 |
| Example 15 | 42.03 | 596 | 3.8 | −6.2 | 10.51 | 428 | 3.8 | −6.2 |
| Example 16 | 41.43 | 458 | 4.3 | −5.4 | 10.36 | 292 | 4.3 | −5.4 |
| Example 17 | 41.94 | 565 | 2.8 | −2.5 | 10.49 | 397 | 2.8 | −2.5 |
| Example 18 | 46.14 | 601 | 2.1 | −3.2 | 11.54 | 417 | 2.1 | −3.2 |
| Comparative example 2 | 36.91 | 486 | 8.1 | −9.6 | 9.23 | 338 | 8.1 | −9.6 |

TABLE 45

| | Regression line of sum Y of frequencies to length L of golf club shaft | | | |
|---|---|---|---|---|
| | Slope | Intercept | Max. | Min. |
| Example 1 | −0.14 | 786 | 2.2 | −3.2 |
| Example 2 | −0.53 | 1101 | 5.1 | −6.6 |
| Example 3 | −0.45 | 1116 | 4.5 | −4.0 |
| Example 4 | −0.45 | 1061 | 2.8 | −2.8 |
| Example 5 | −0.92 | 1507 | 2.3 | −2.7 |
| Example 6 | −1.40 | 1991 | 4.4 | −6.1 |
| Example 7 | −1.41 | 1929 | 3.8 | −5.0 |
| Example 8 | −1.39 | 2020 | 2.2 | −2.9 |
| Example 9 | −1.72 | 2213 | 2.6 | −3.1 |
| Comparative example 1 | −0.86 | 1463 | 8.1 | −9.3 |
| Example 10 | −2.00 | 2460 | 2.2 | −2.9 |
| Example 11 | −2.29 | 2717 | 4.1 | −6.4 |
| Example 12 | −2.31 | 2848 | 4.2 | −3.9 |
| Example 13 | −2.31 | 2890 | 2.3 | −2.7 |
| Example 14 | −2.75 | 3200 | 2.5 | −3.0 |
| Example 15 | −3.23 | 3748 | 3.8 | −6.2 |
| Example 16 | −3.19 | 3565 | 4.3 | −5.4 |
| Example 17 | −3.23 | 3710 | 2.8 | −2.5 |

TABLE 45-continued

| | Regression line of sum Y of frequencies to length L of golf club shaft | | | |
|---|---|---|---|---|
| | Slope | Intercept | Max. | Min. |
| Example 18 | −3.55 | 4062 | 2.1 | −3.2 |
| Comparative example 2 | −2.84 | 3255 | 8.1 | −9.6 |

Figure 95:
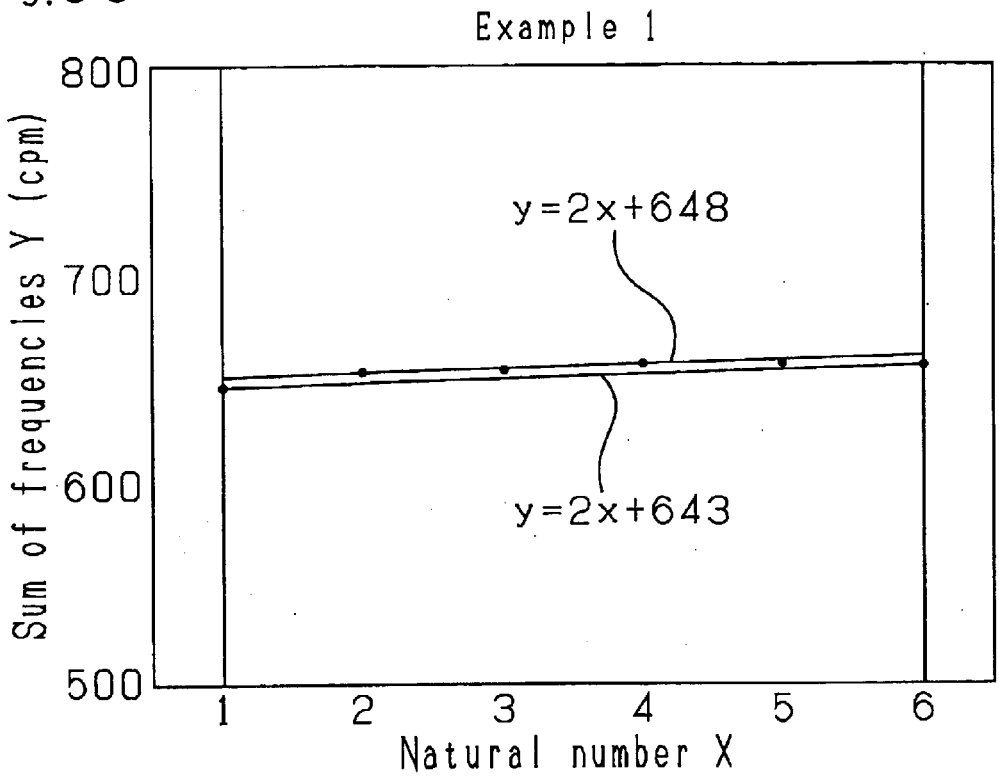
FIG. 95 to FIG. 114 are graphs showing relations between the natural numbers X and the sums Y of frequencies in the golf club sets in the examples 1 to 18 and the comparative examples 1 to 2, respectively.
Figure 96:
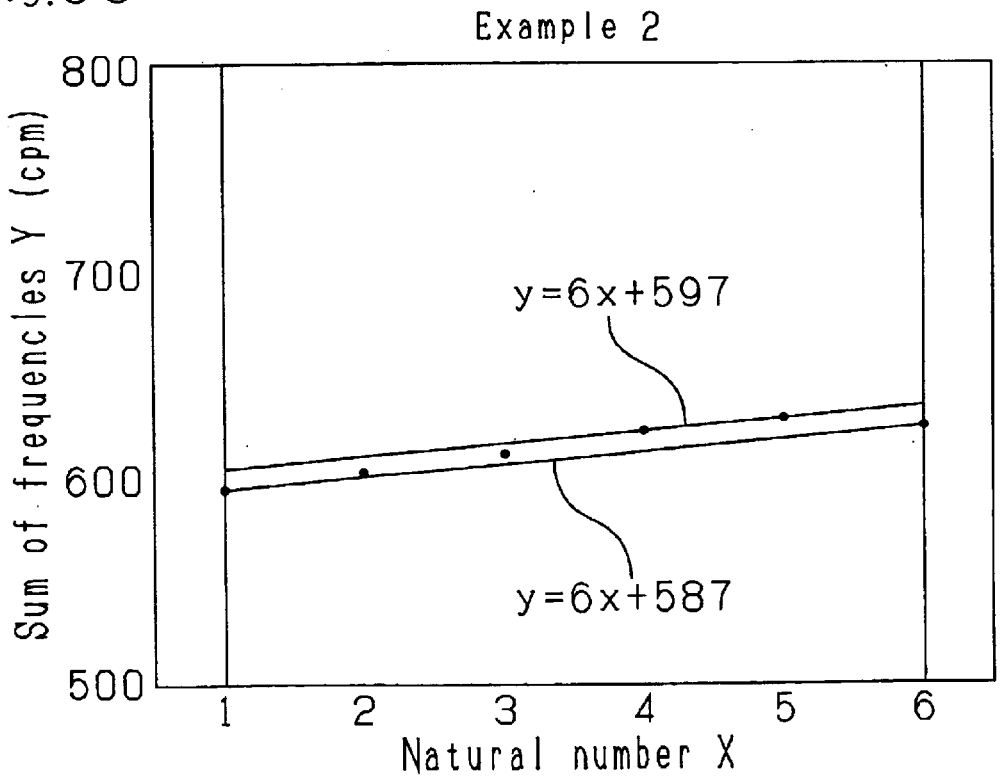
Figure 97:
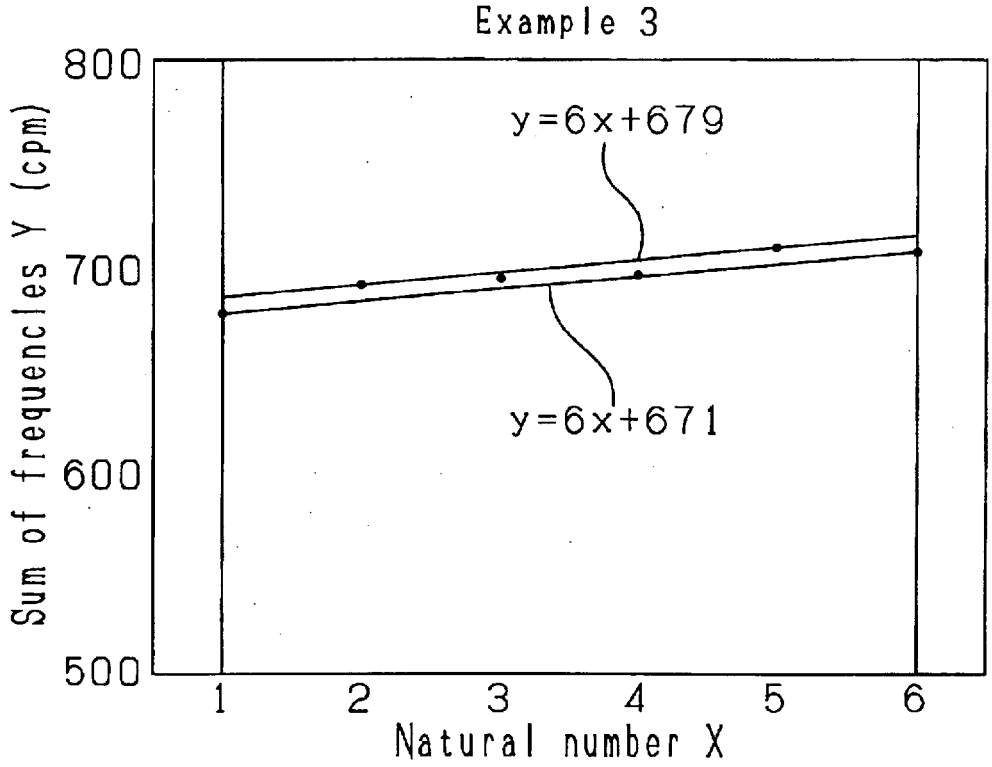
Figure 98:
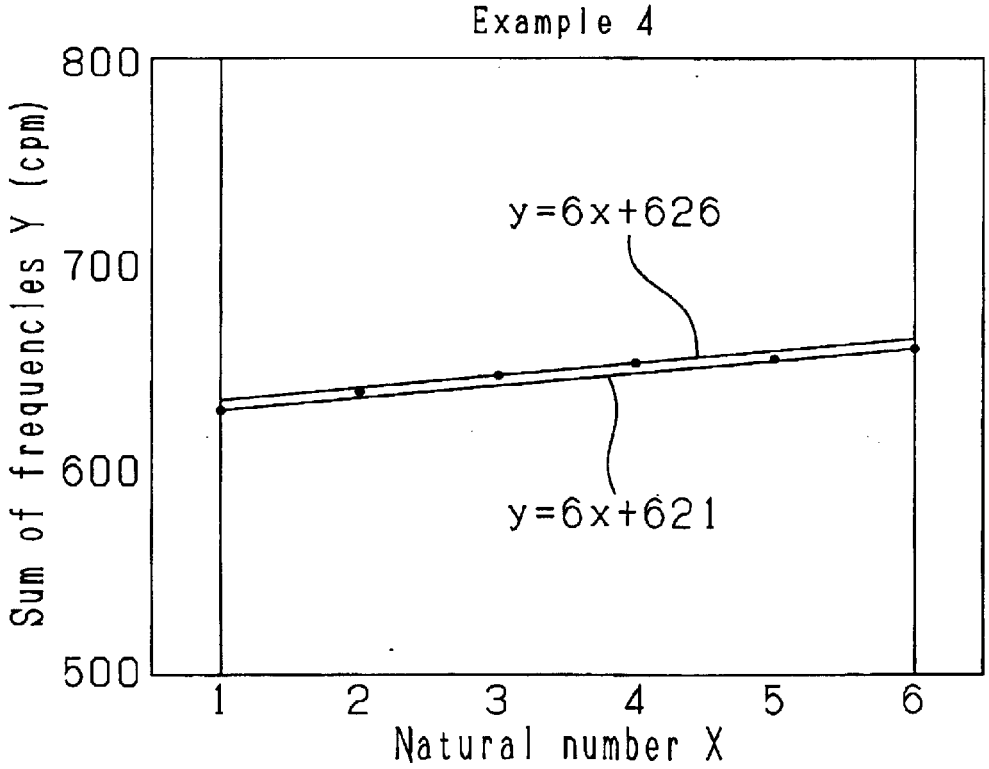
Figure 99:
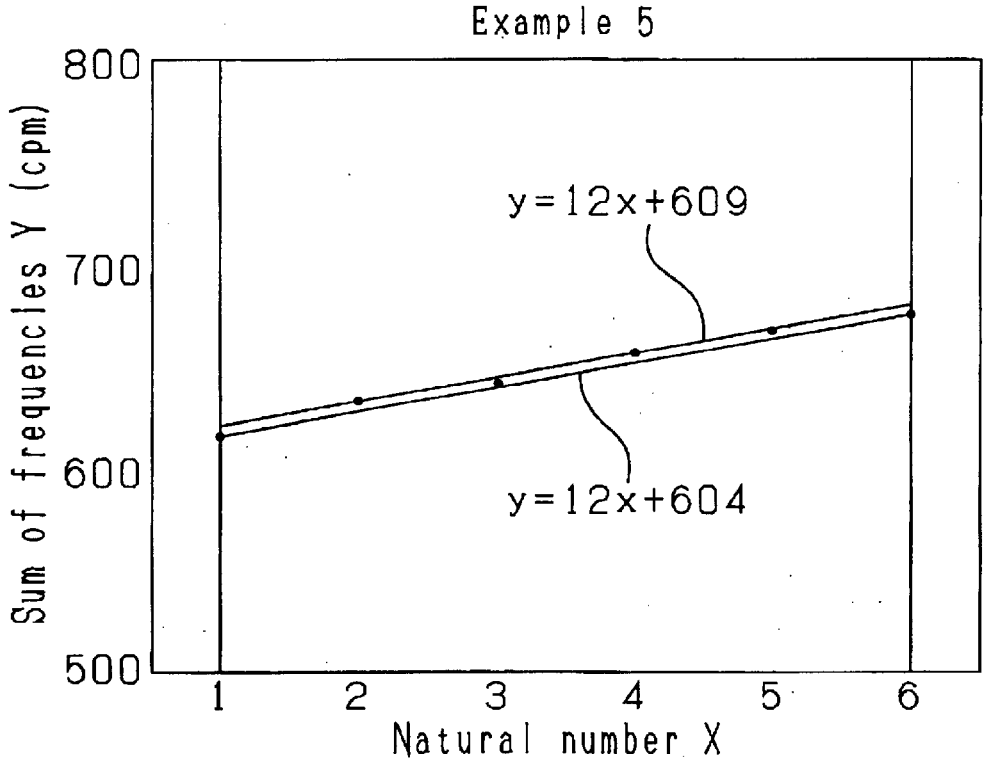
Figure 100:
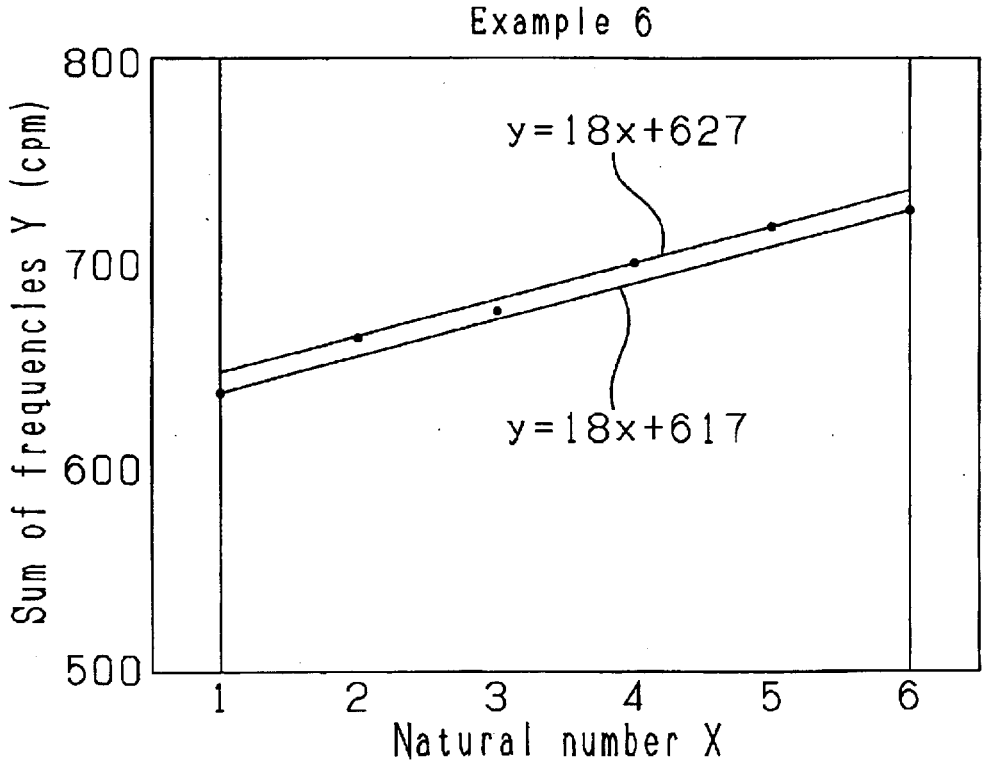
Figure 101:
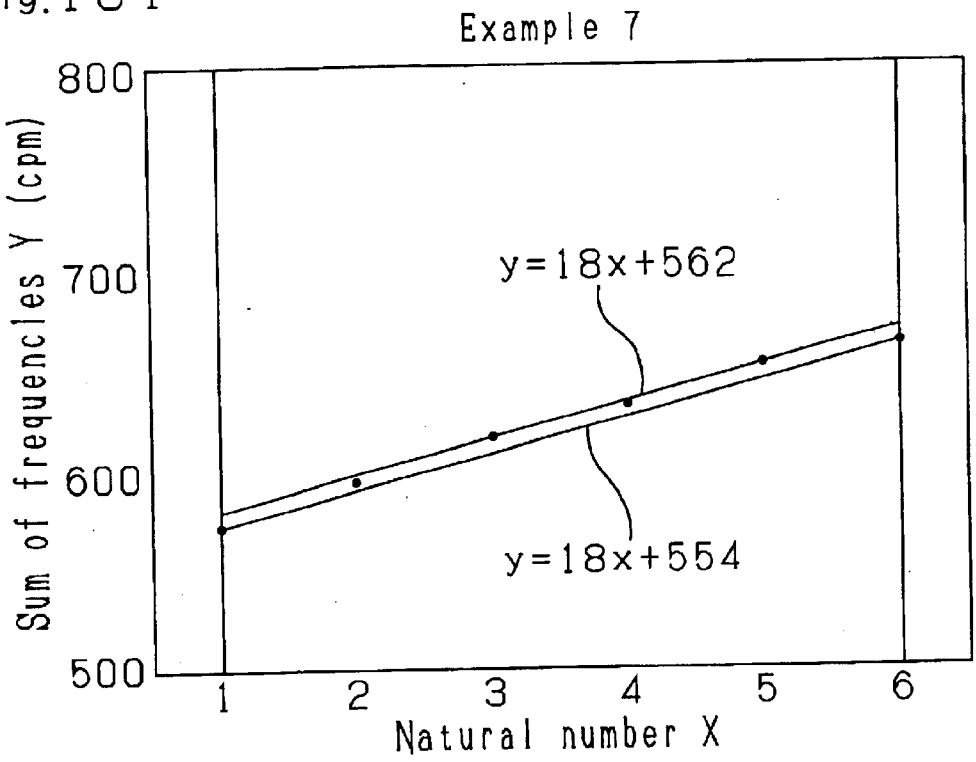
Figure 102:
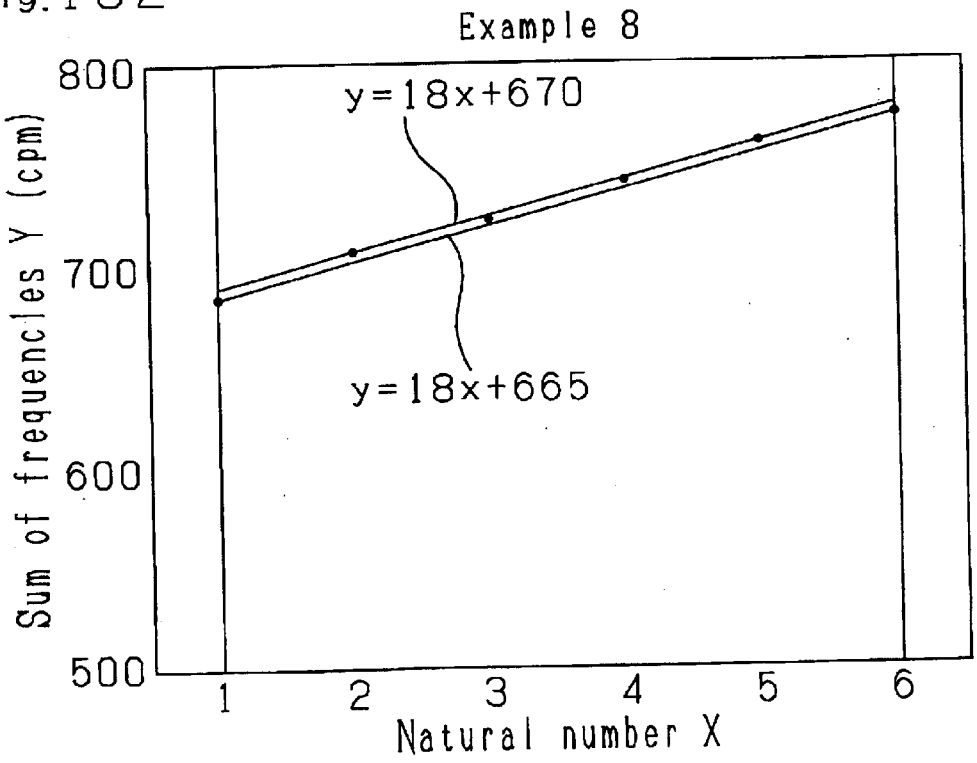
Figure 103:
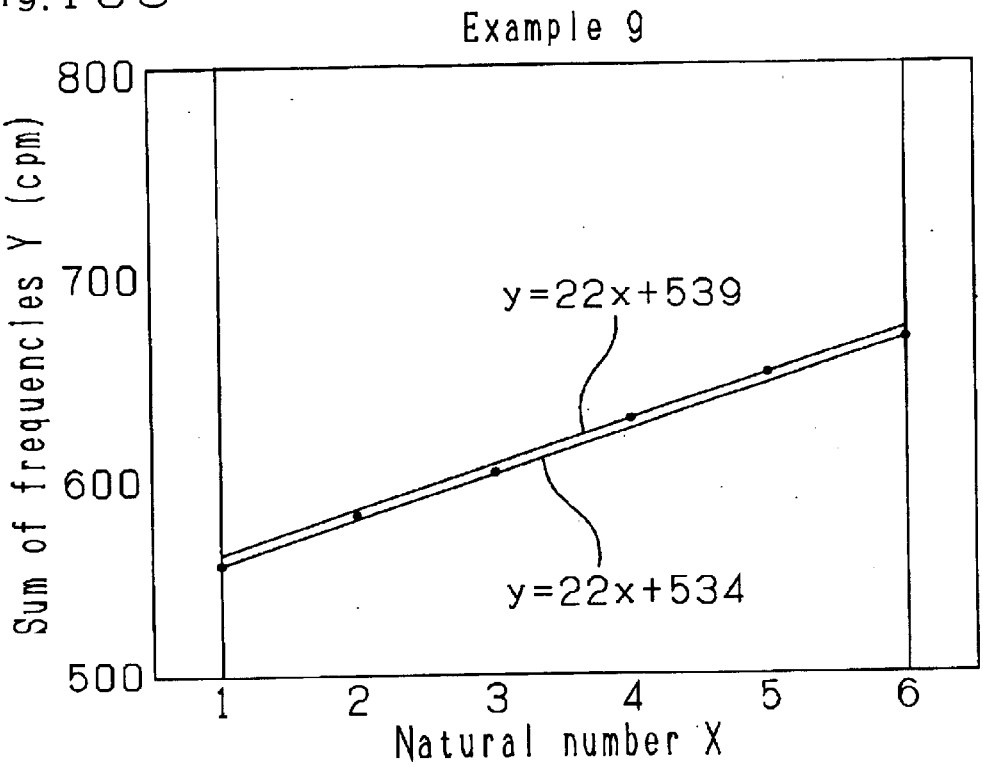
Figure 104:
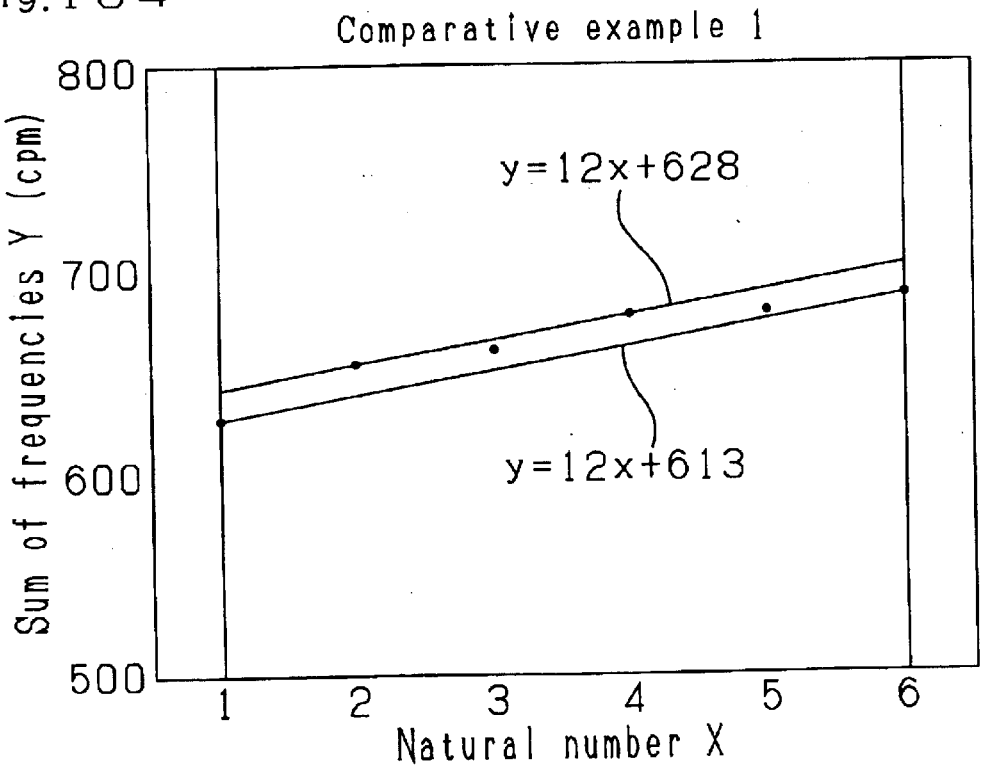
Figure 105:
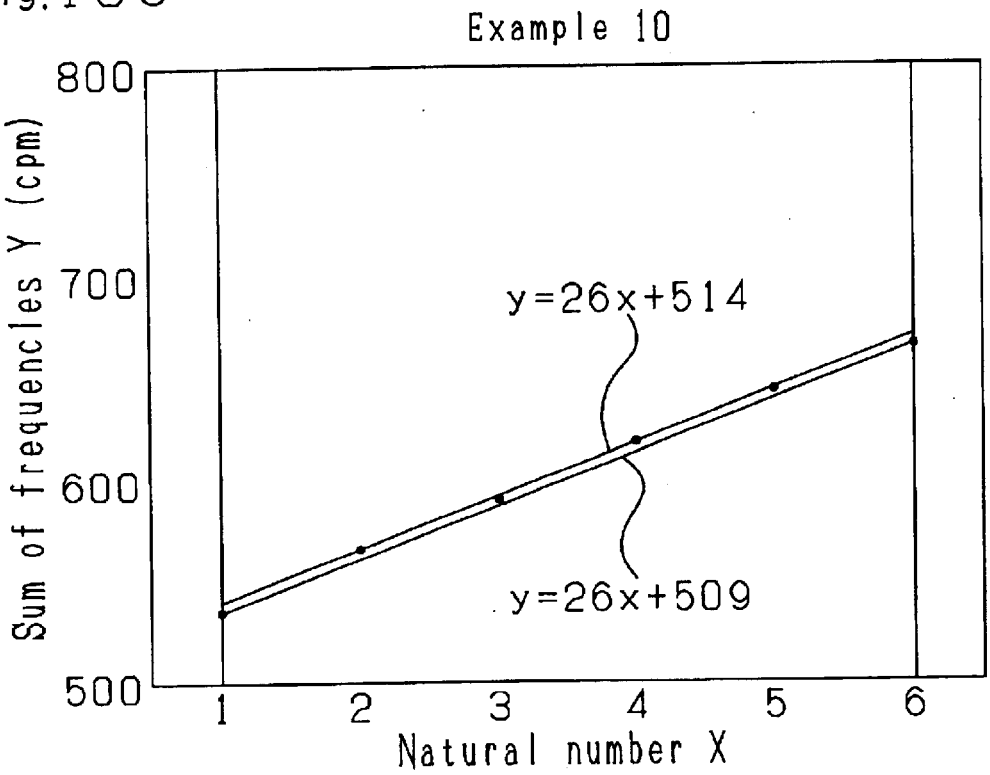
Figure 106:
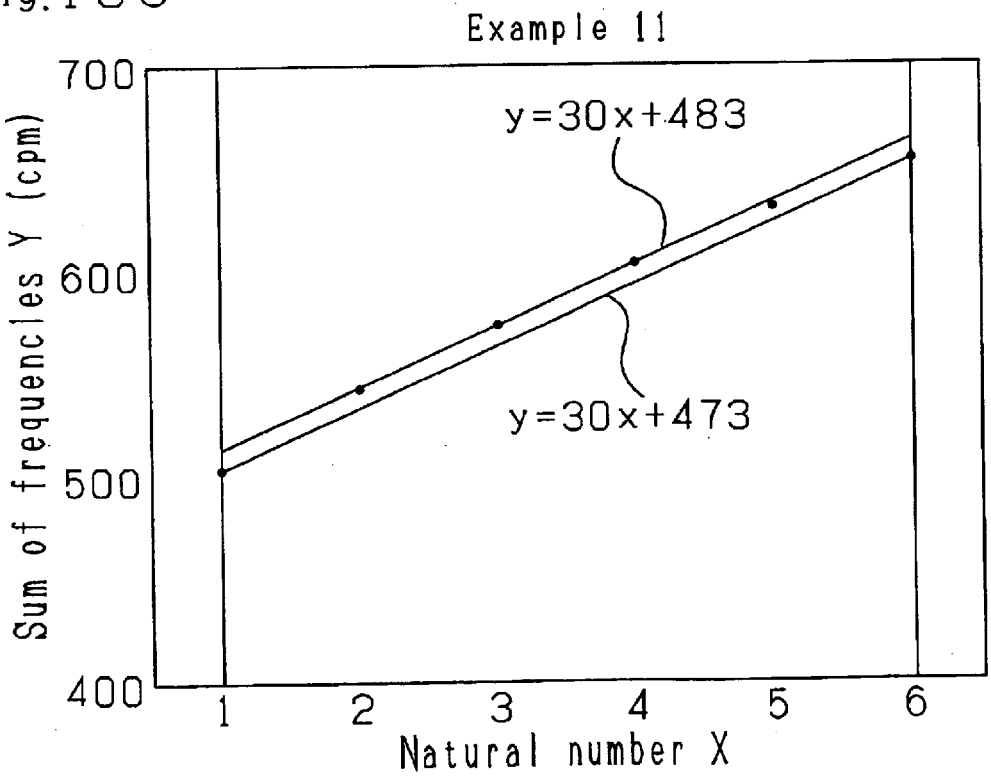
Figure 107:
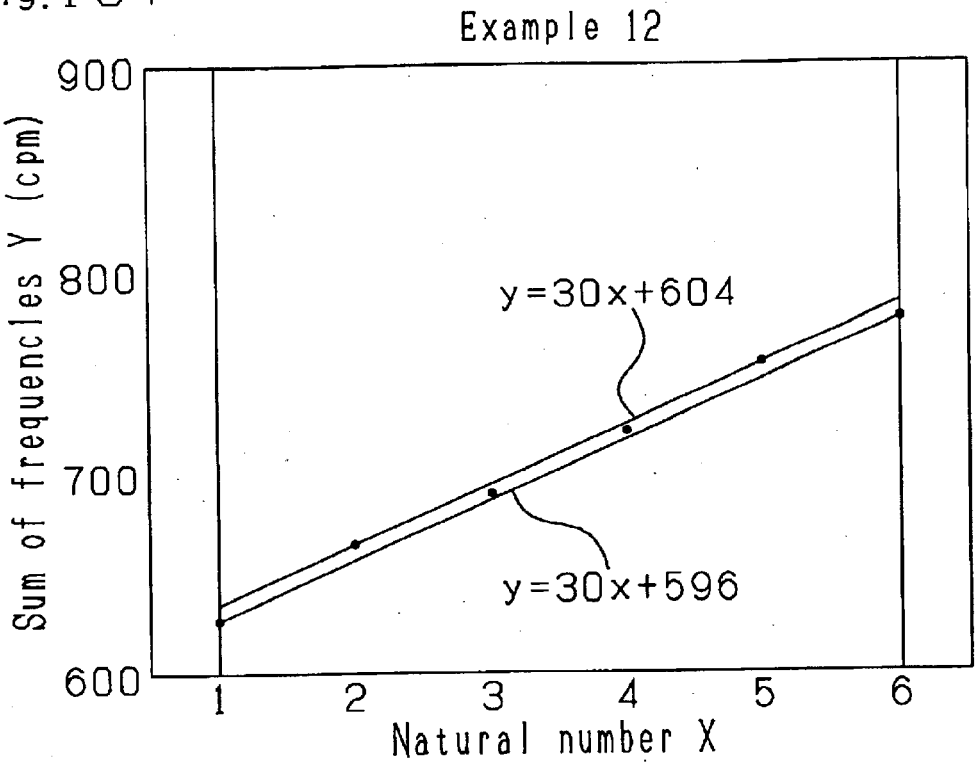
Figure 108:
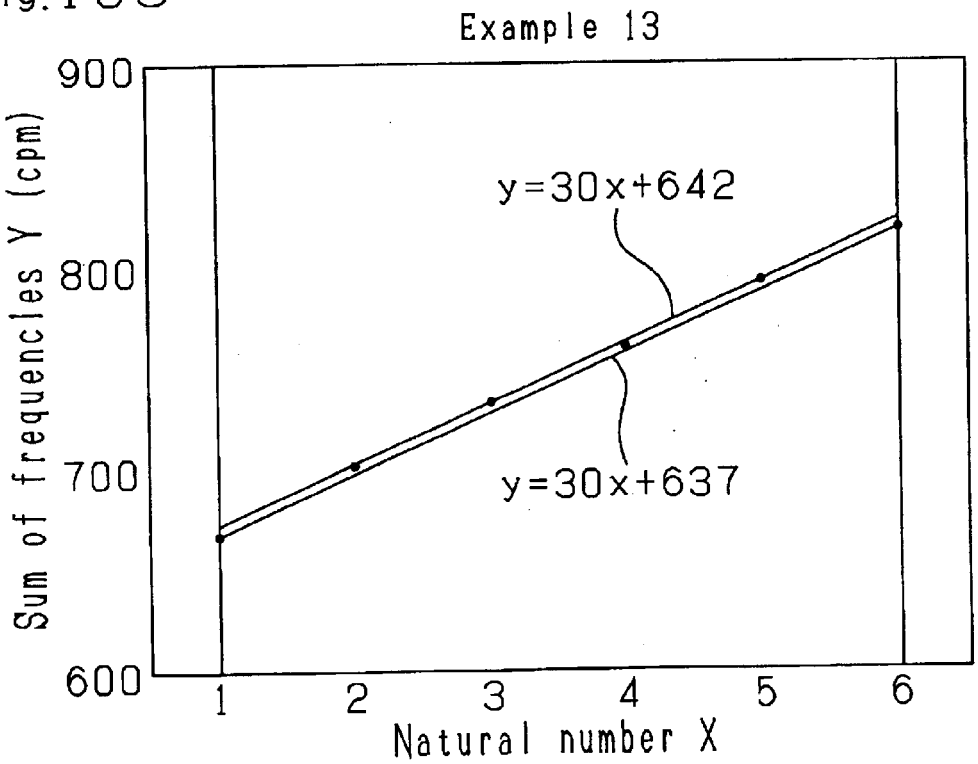
Figure 109:
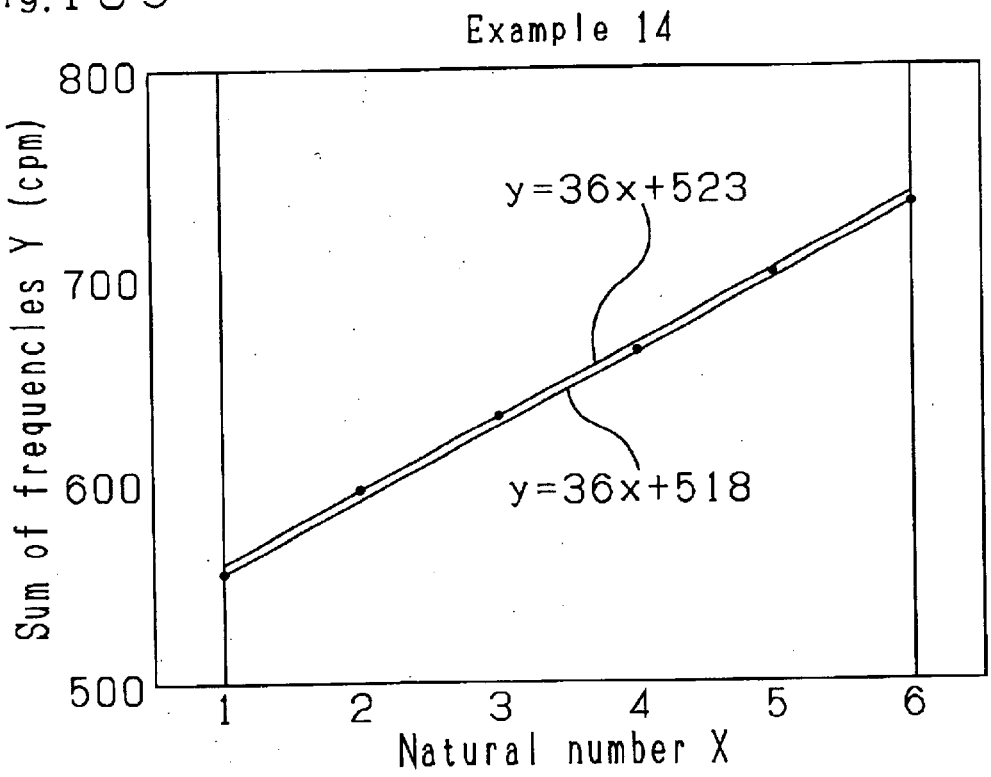
Figure 110:
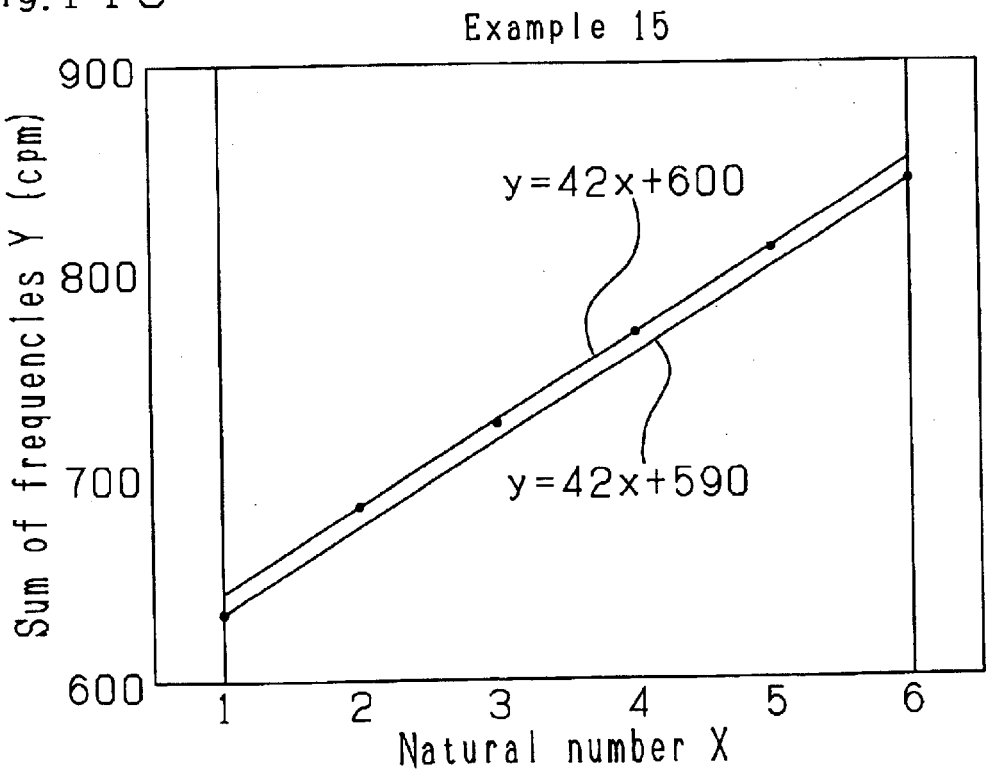
Figure 111:
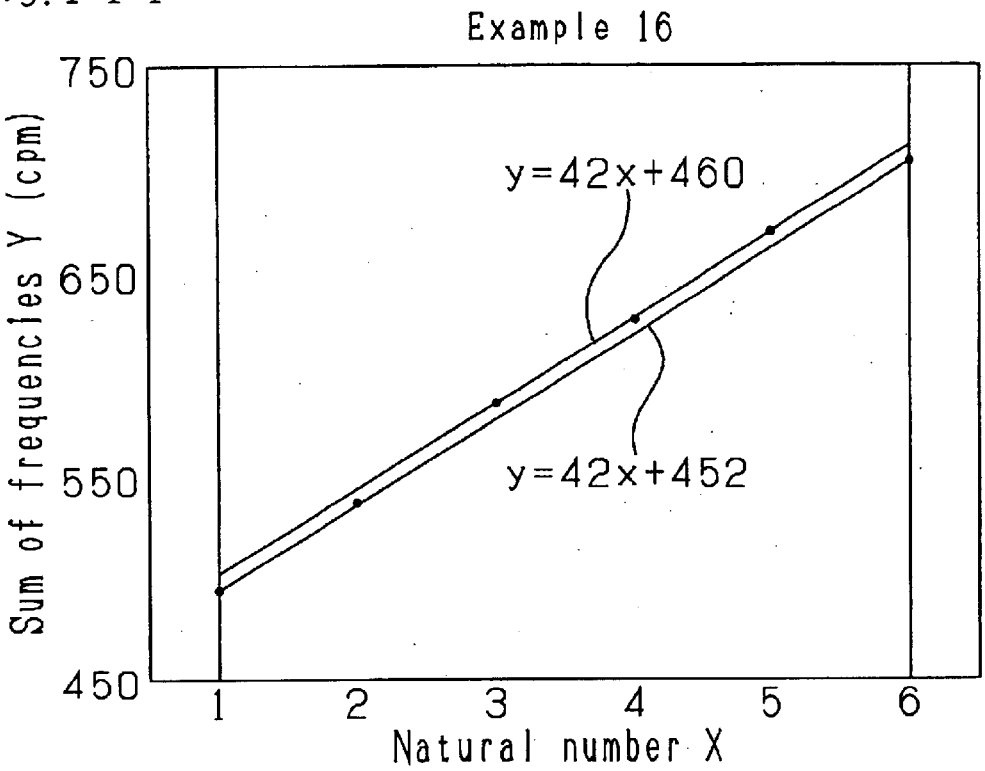
Figure 112:
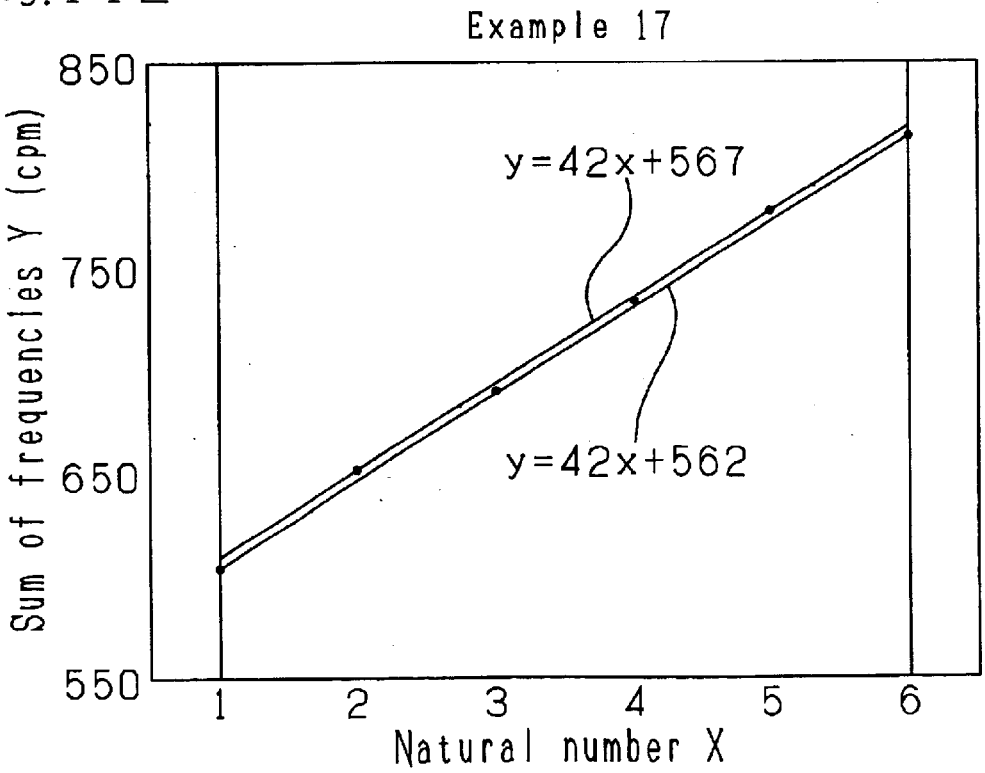
Figure 113:
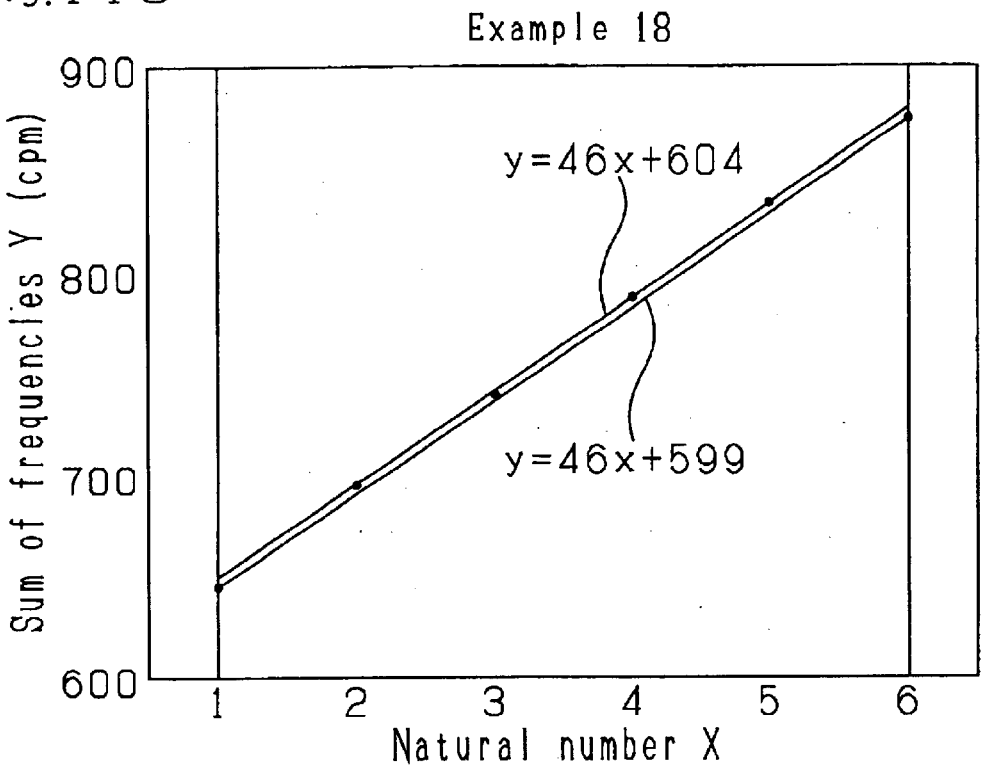
Figure 114:
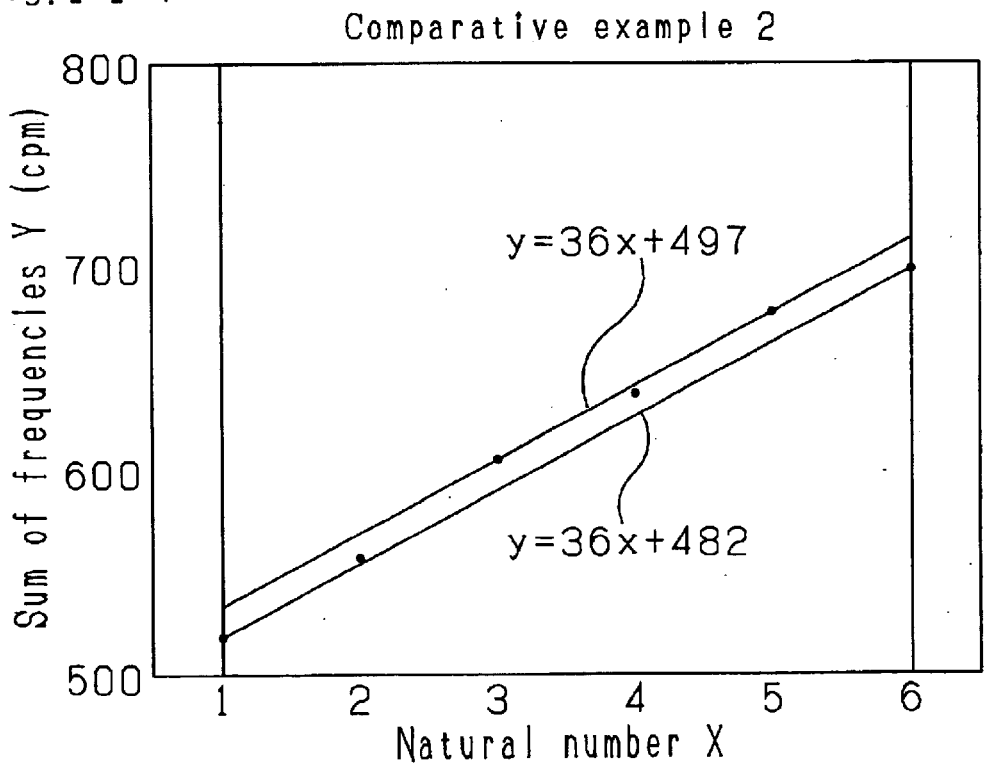
Figure 115:
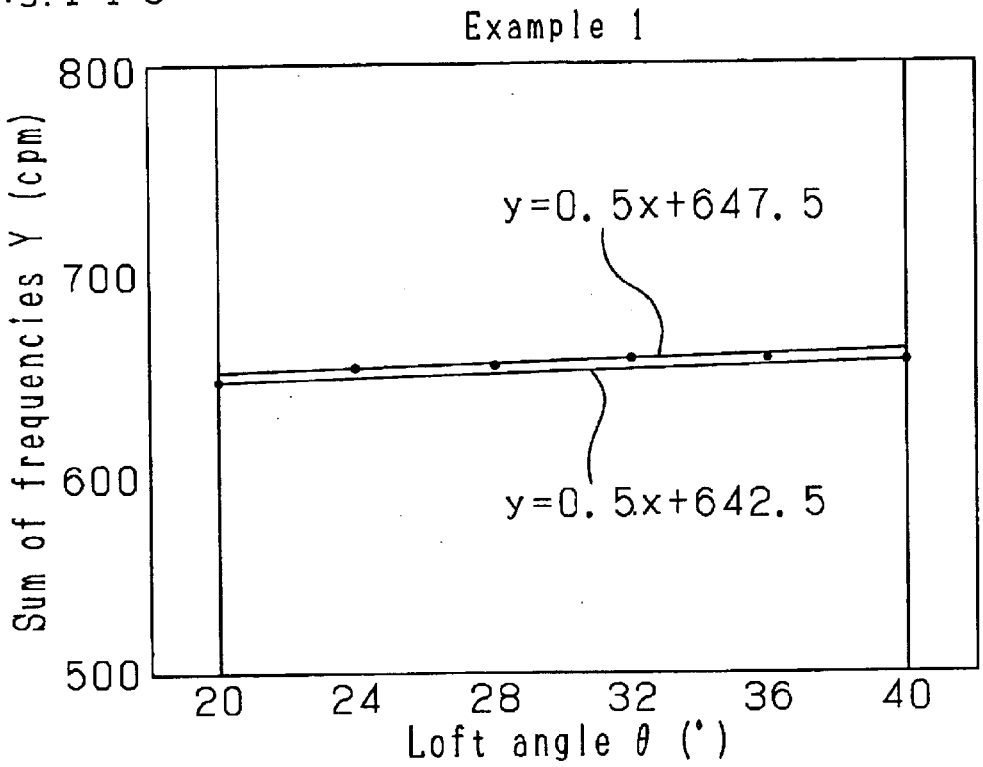
FIG. 115 to FIG. 134 are graphs showing relations between the loft angles θ and the sums Y of frequencies in the golf club sets in the examples 1 to 18 and the comparative examples 1 to 2, respectively.
Figure 116:
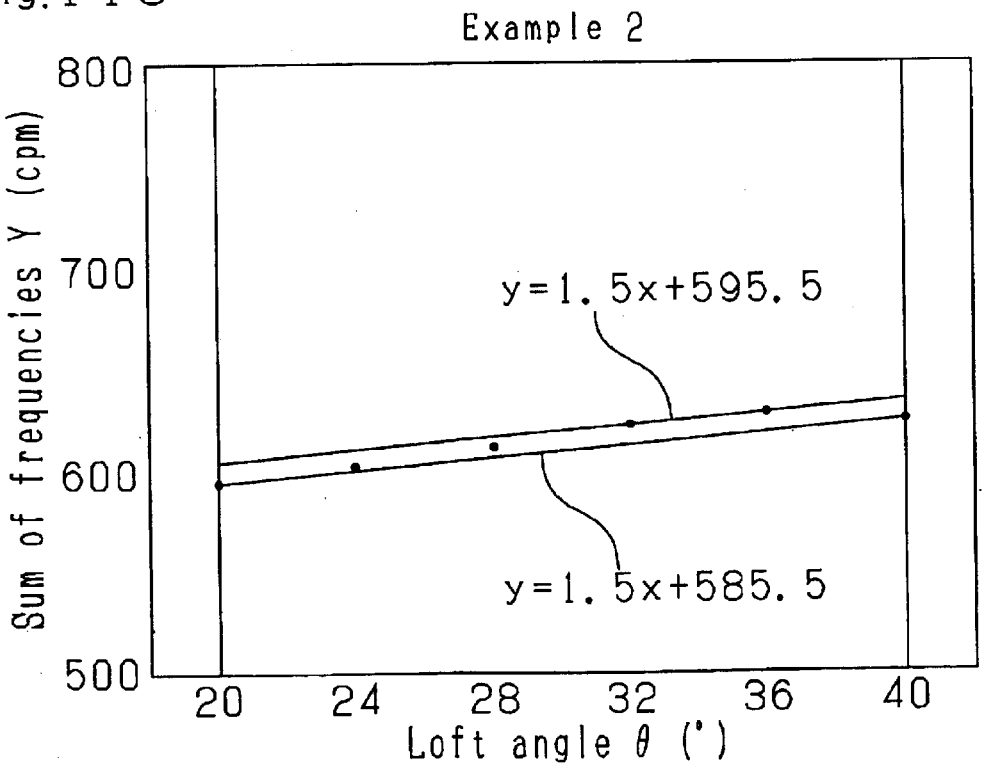
Figure 117:
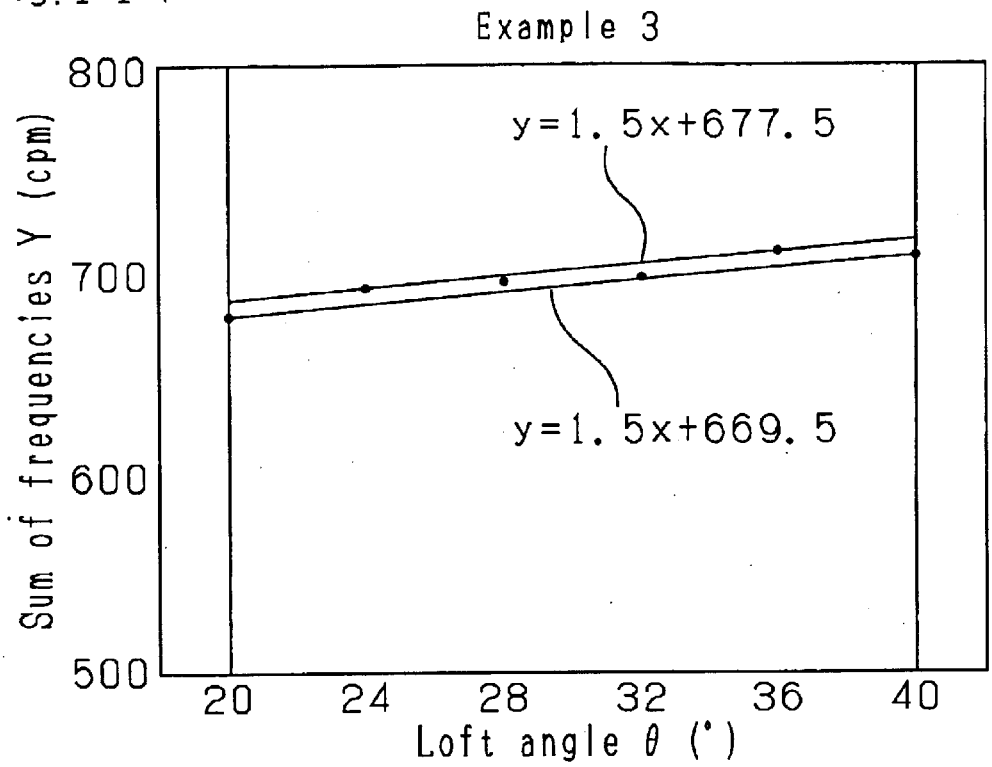
Figure 118:
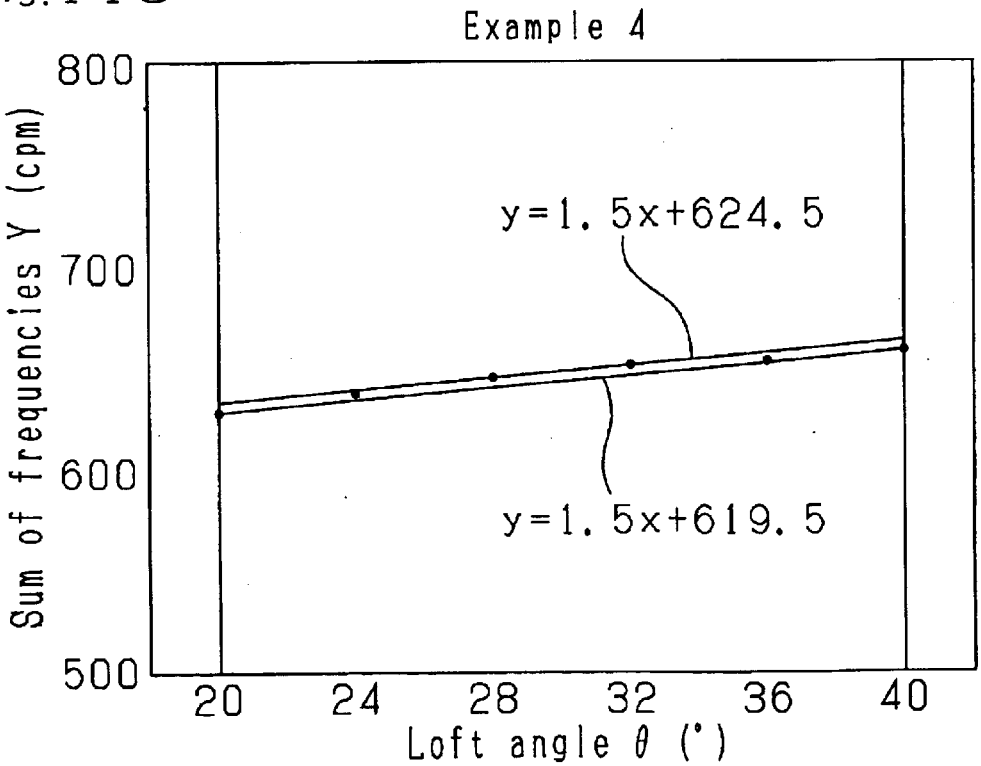
Figure 119:
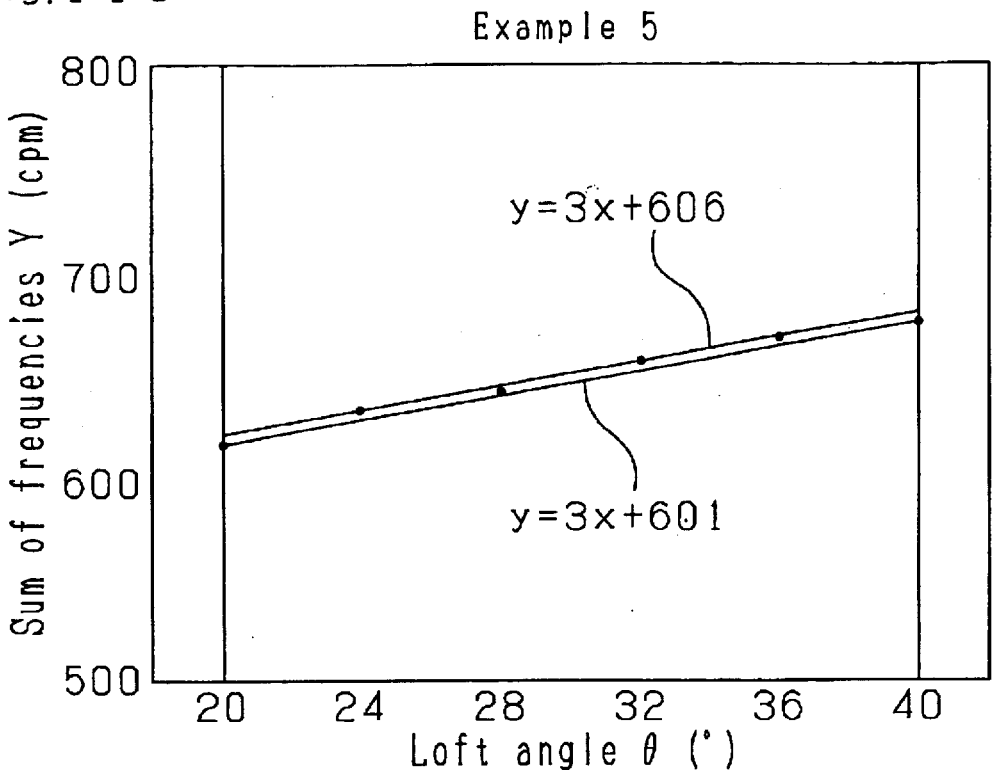
Figure 120:
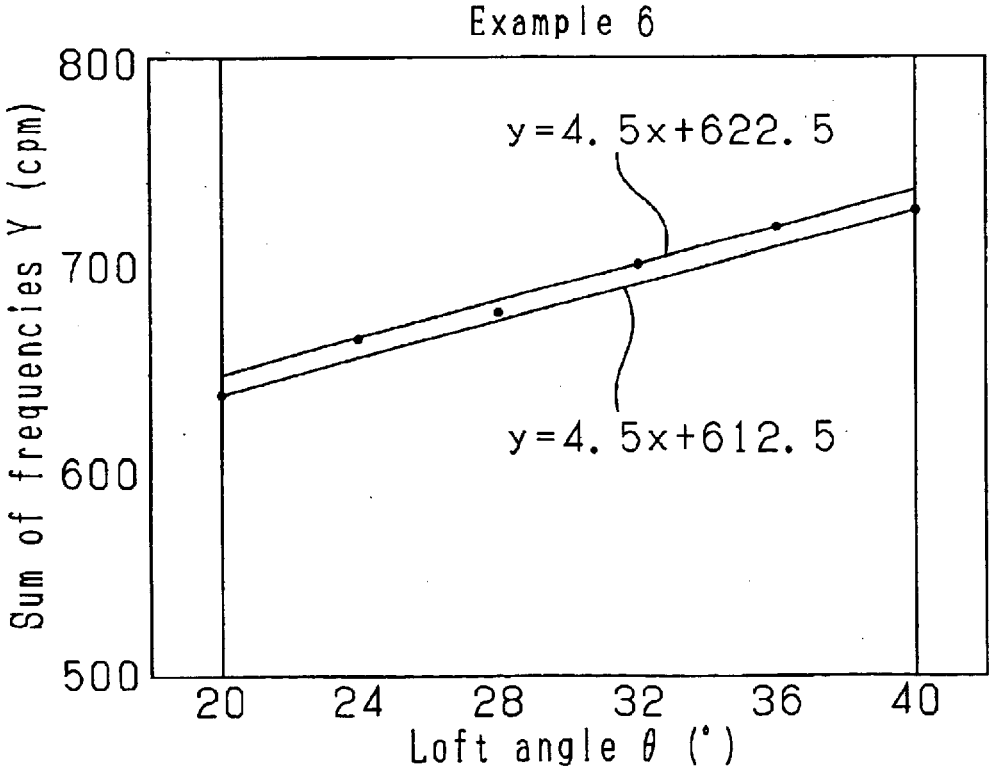
Figure 121:
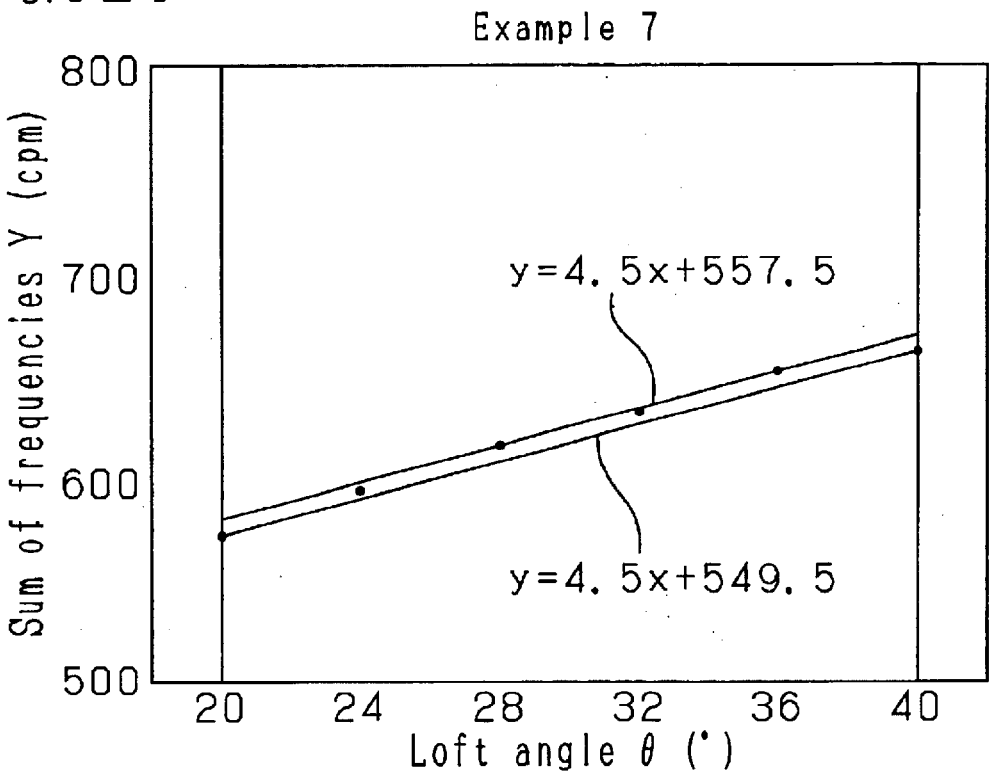
Figure 122:
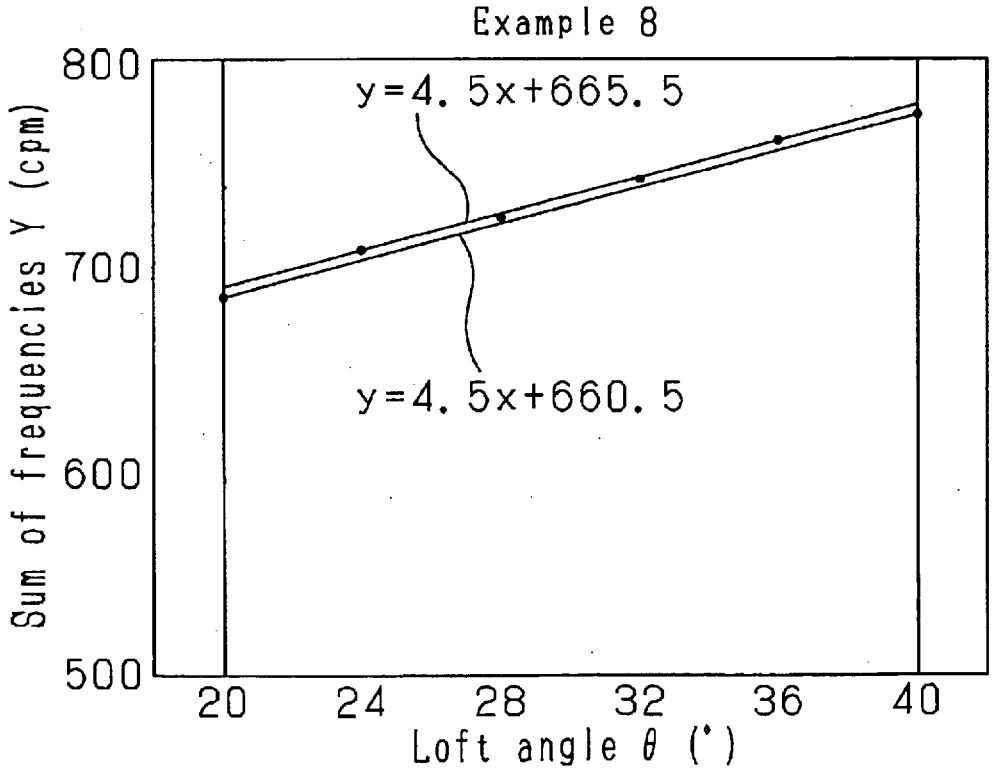
Figure 123:
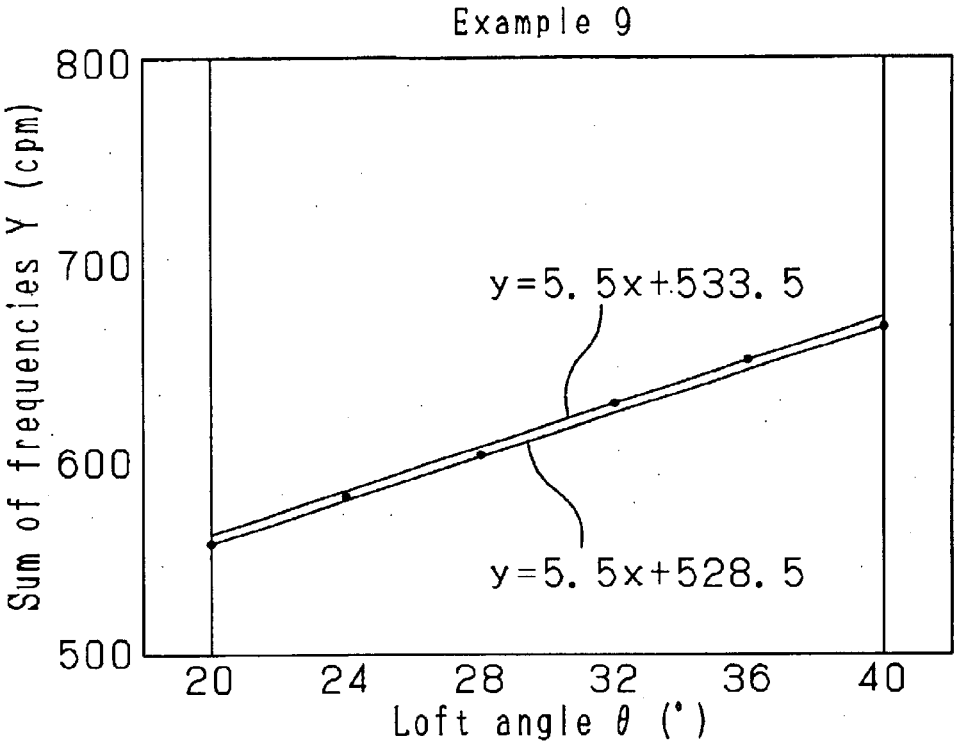
Figure 124:
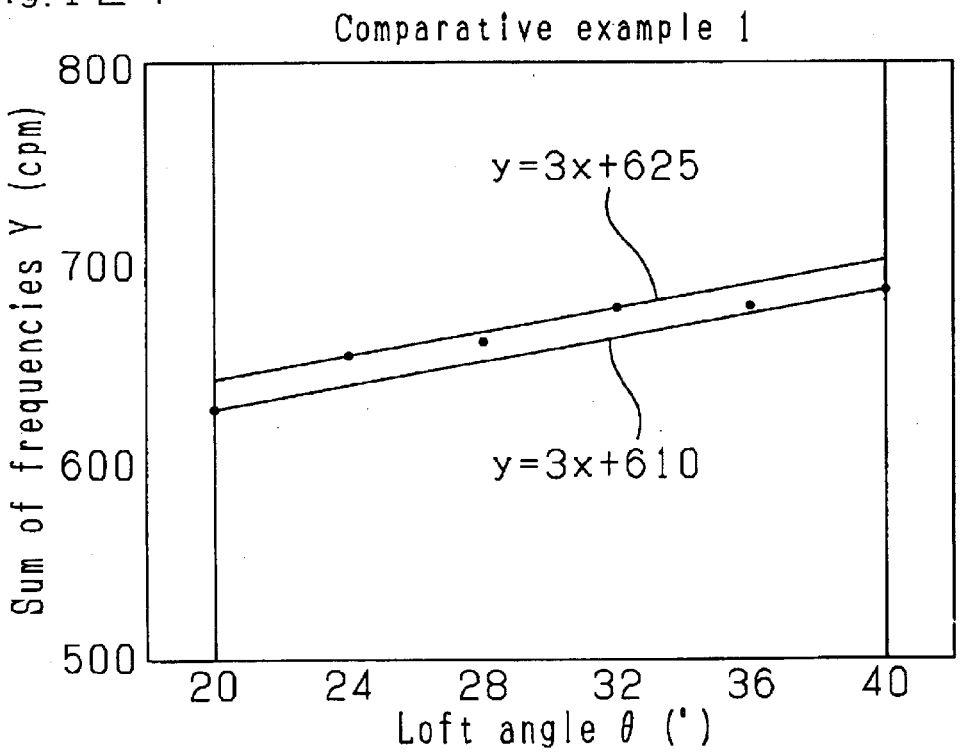
Figure 125:
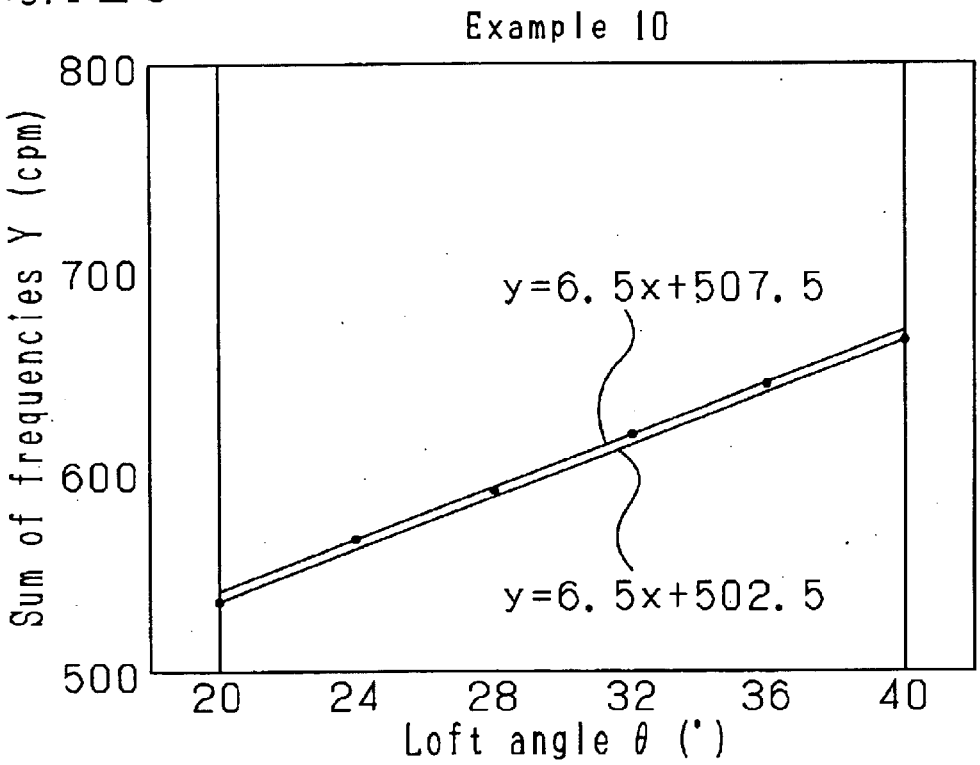
Figure 126:
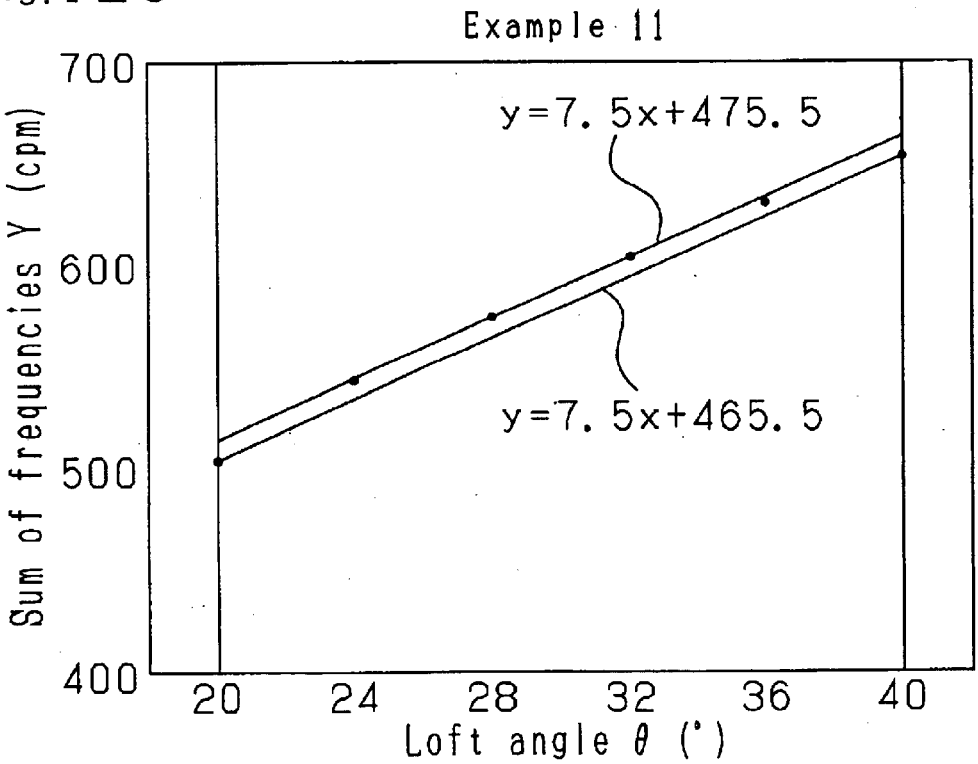
Figure 127:
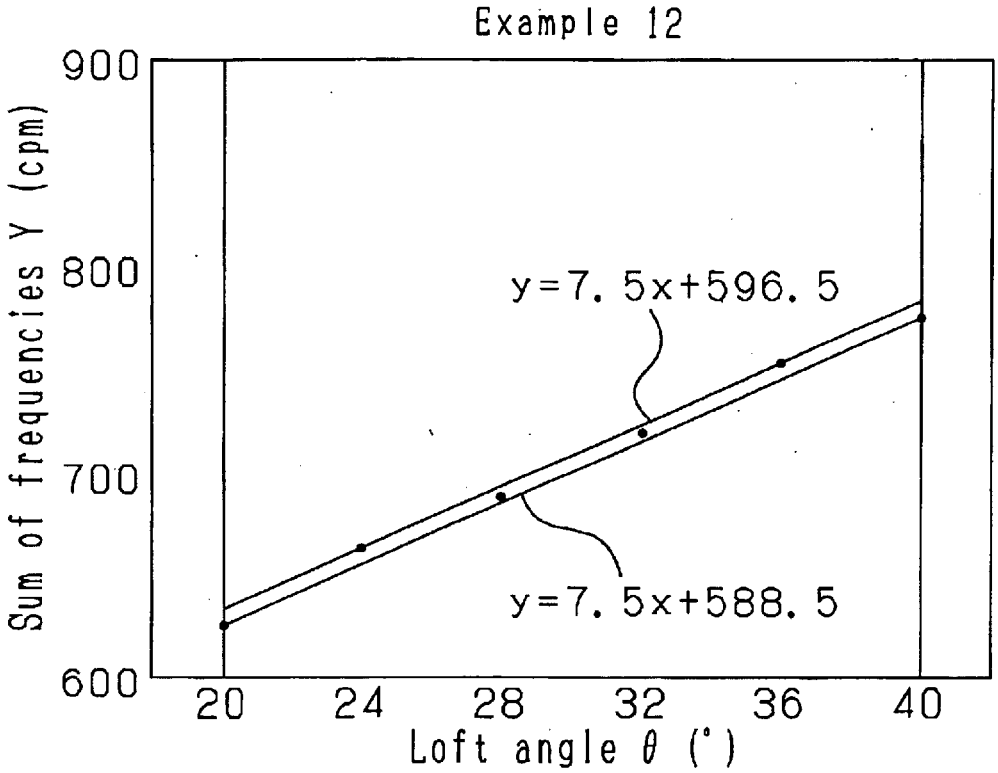
Figure 128:
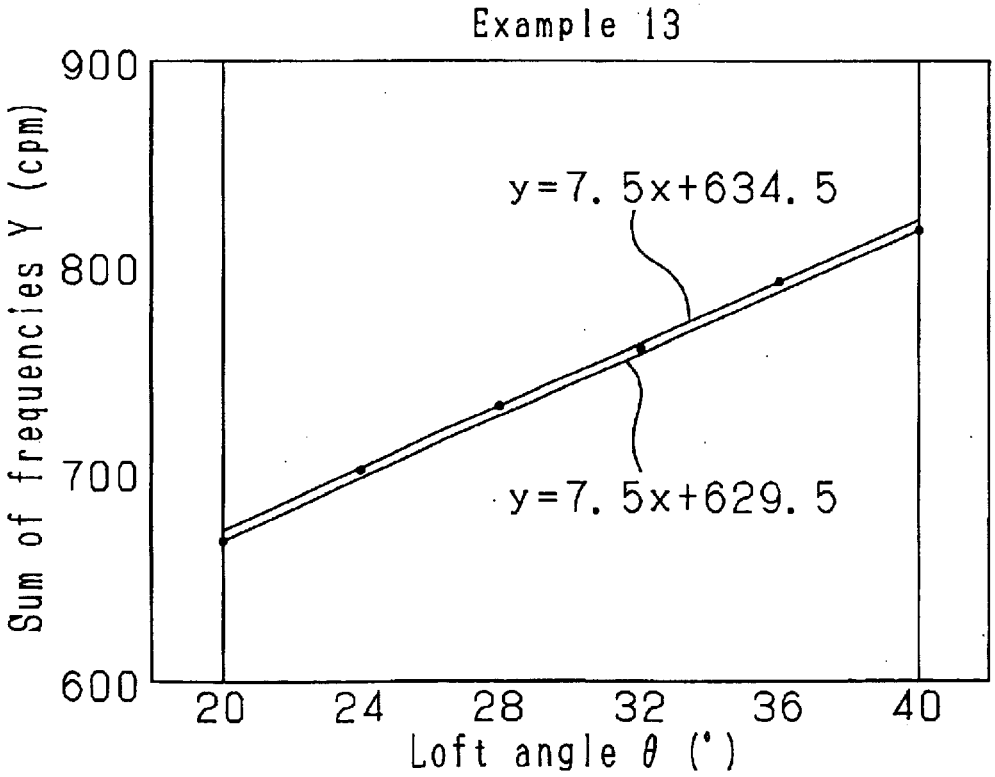
Figure 129:
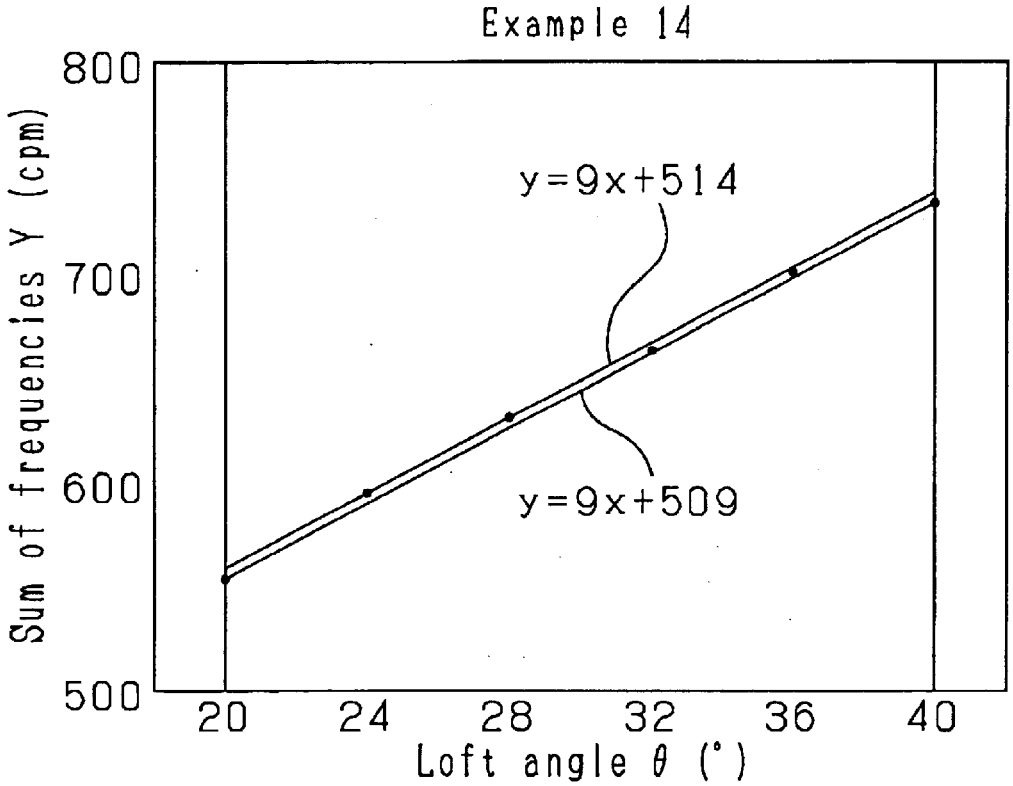
Figure 130:
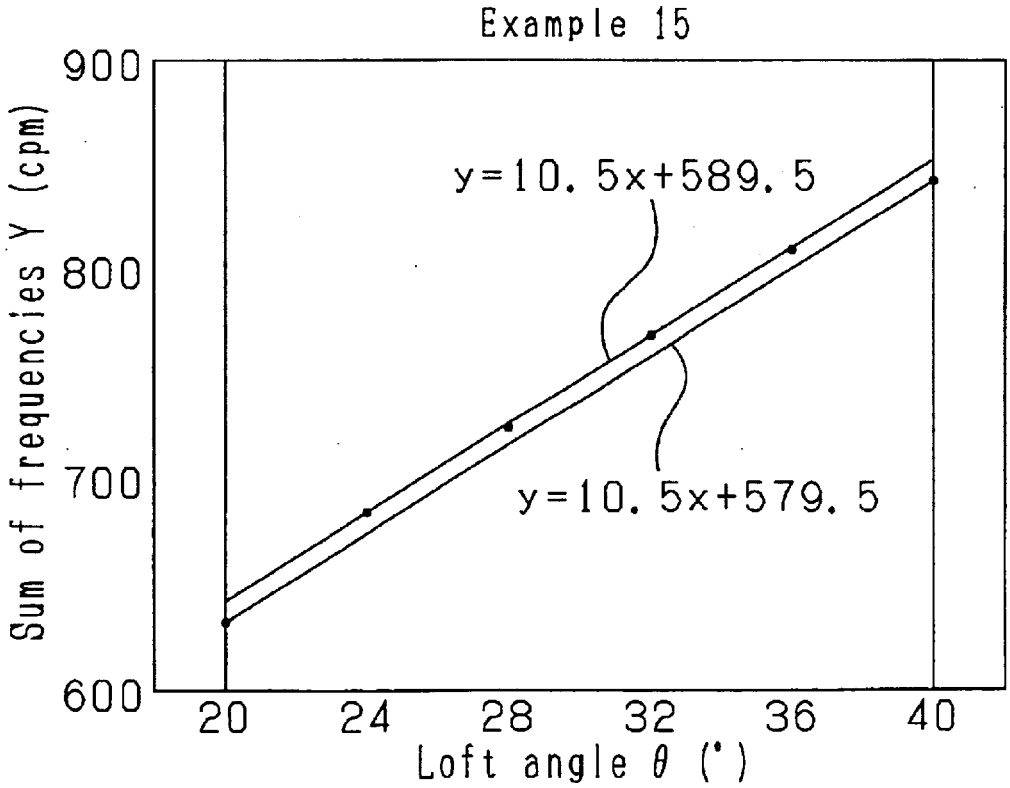
Figure 131:
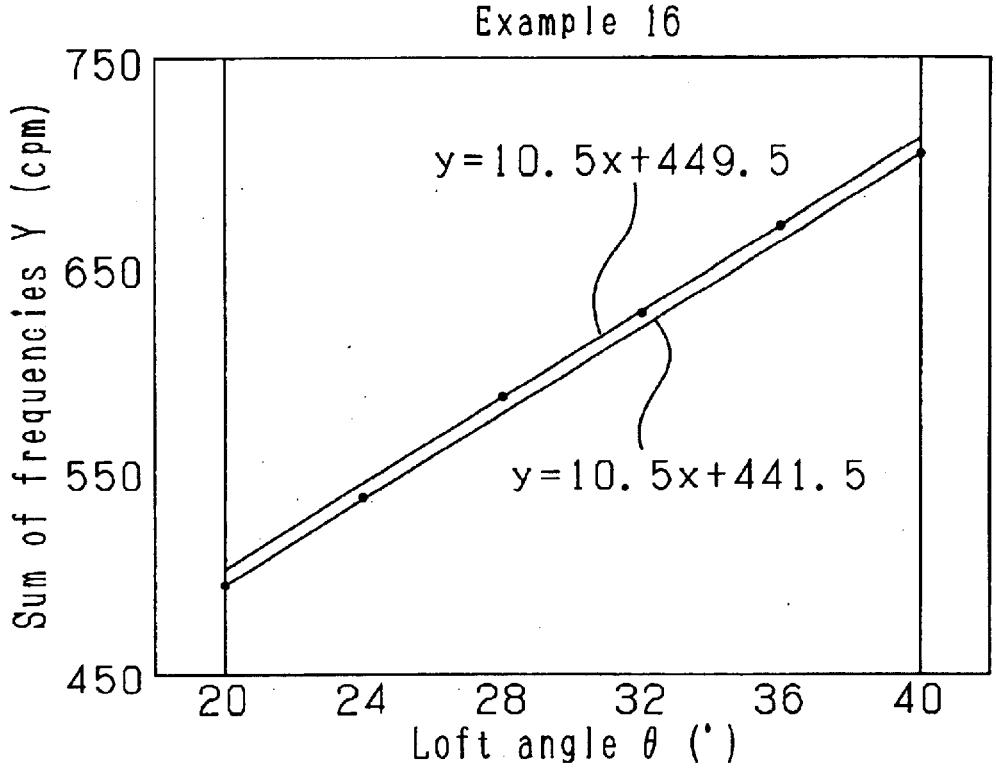
Figure 132:
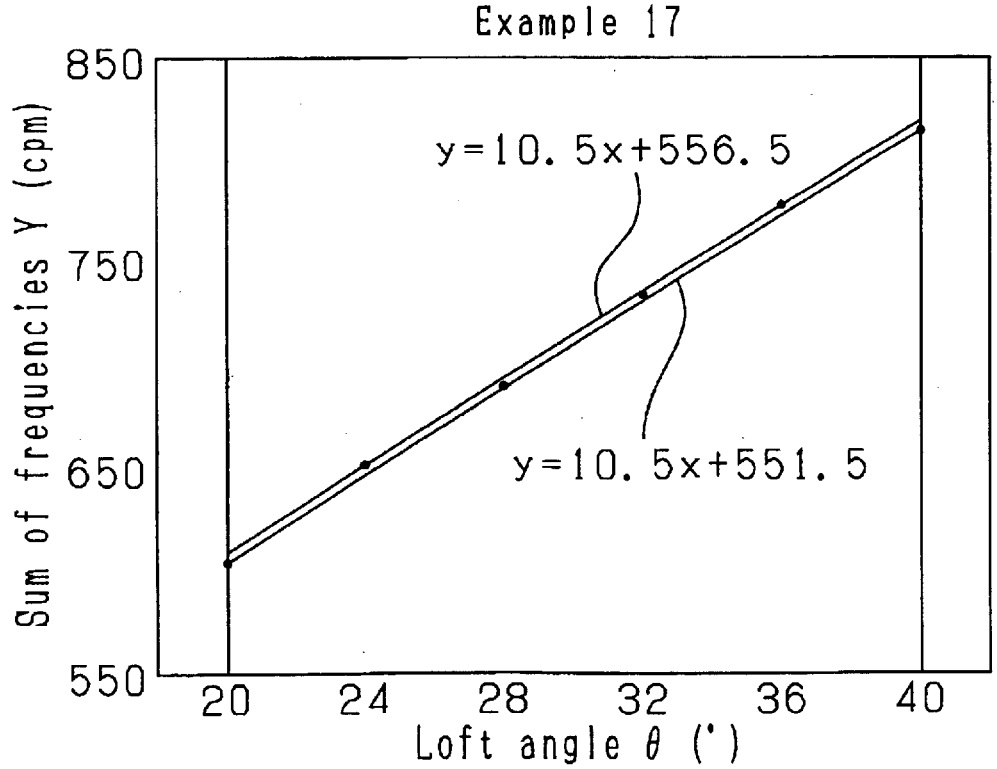
Figure 133:
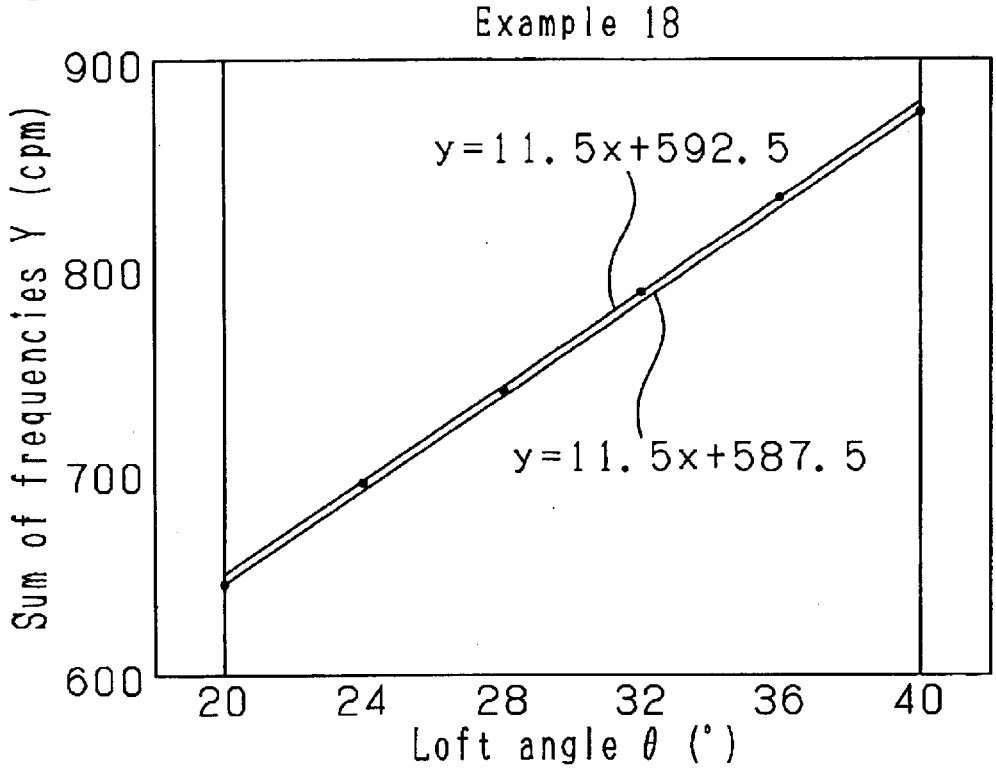
Figure 134:
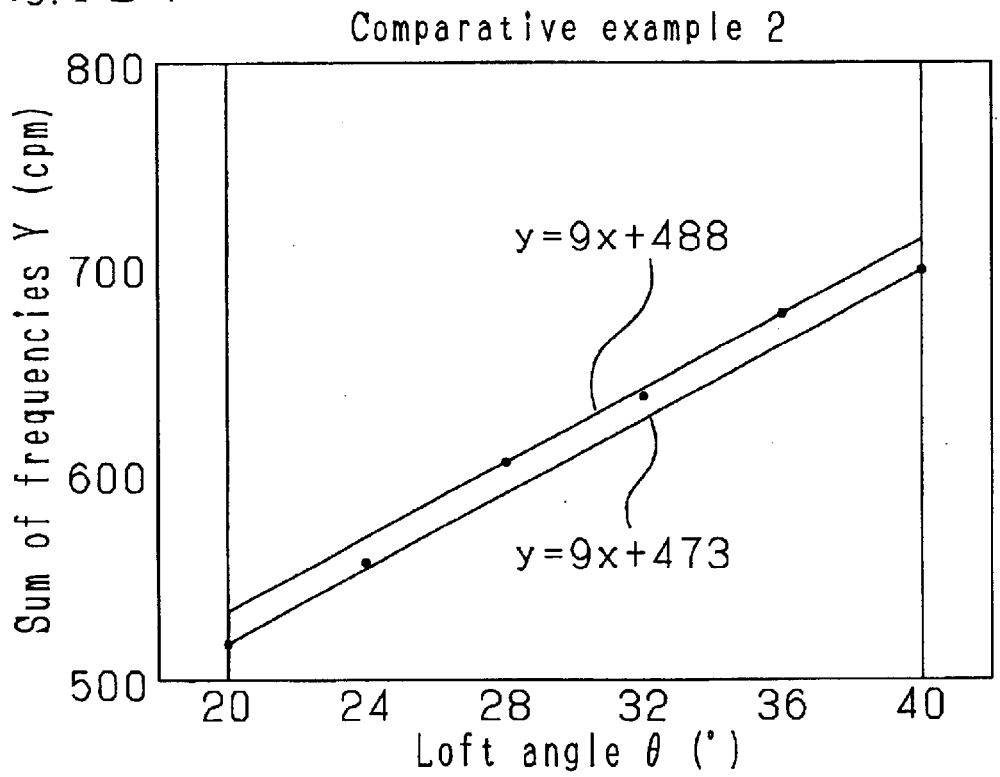
Figure 135:
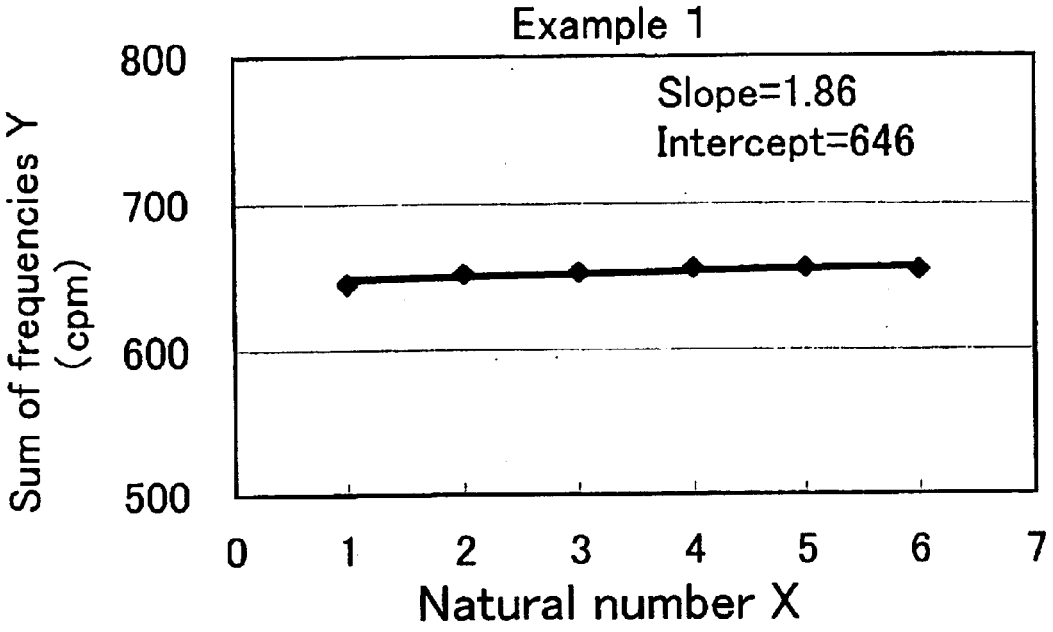
FIG. 135 to FIG. 154 are graphs showing regression lines of the sums Y of frequencies to the natural numbers X in the golf club sets in the examples 1 to 18 and the comparative examples 1 to 2, respectively.
Figure 136:
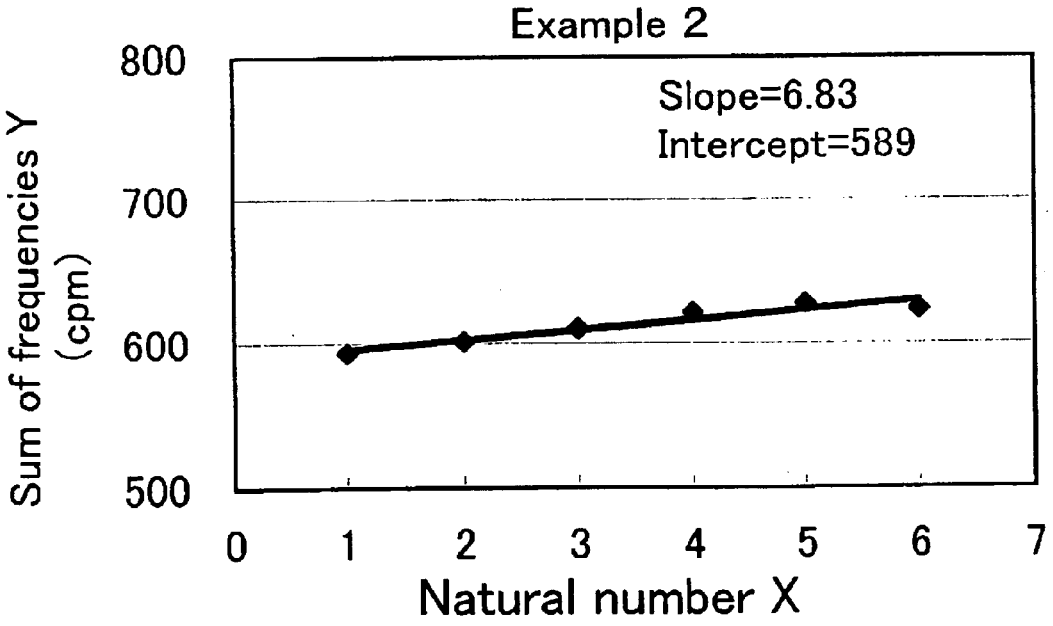
Figure 137:
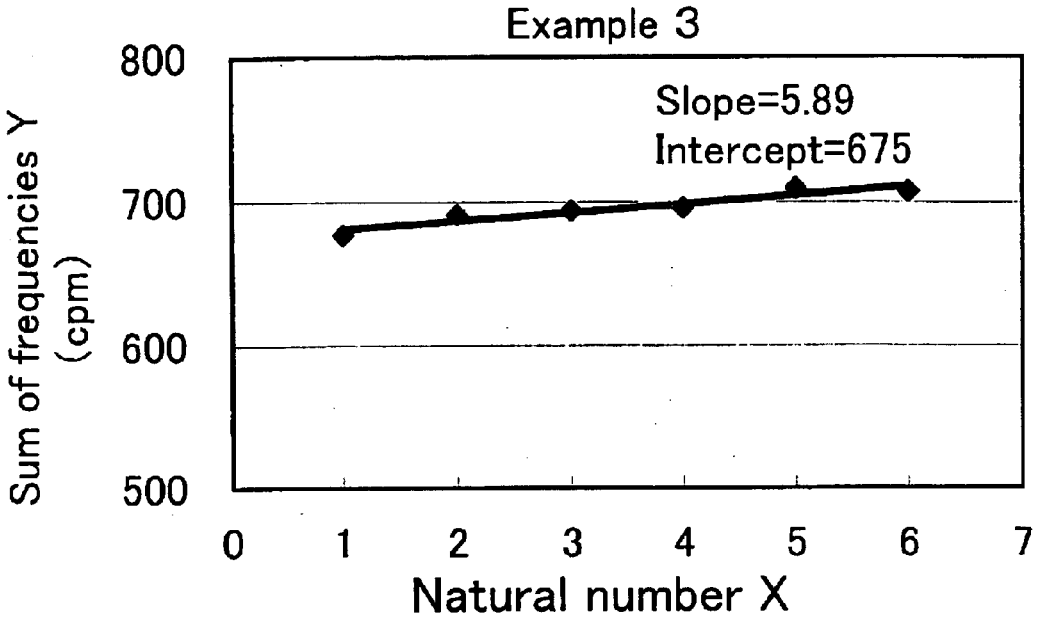
Figure 138:
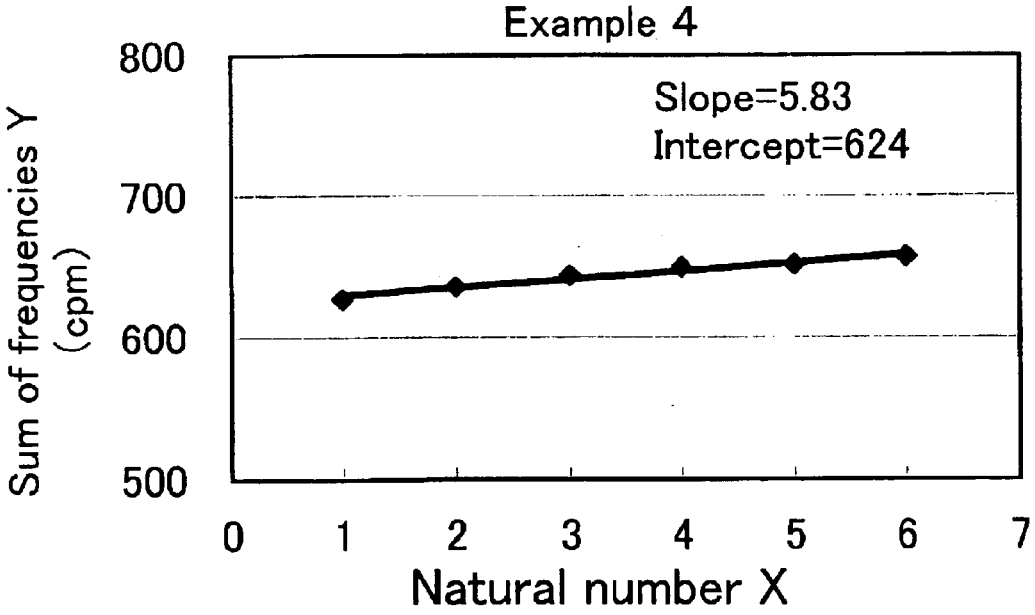
Figure 139:
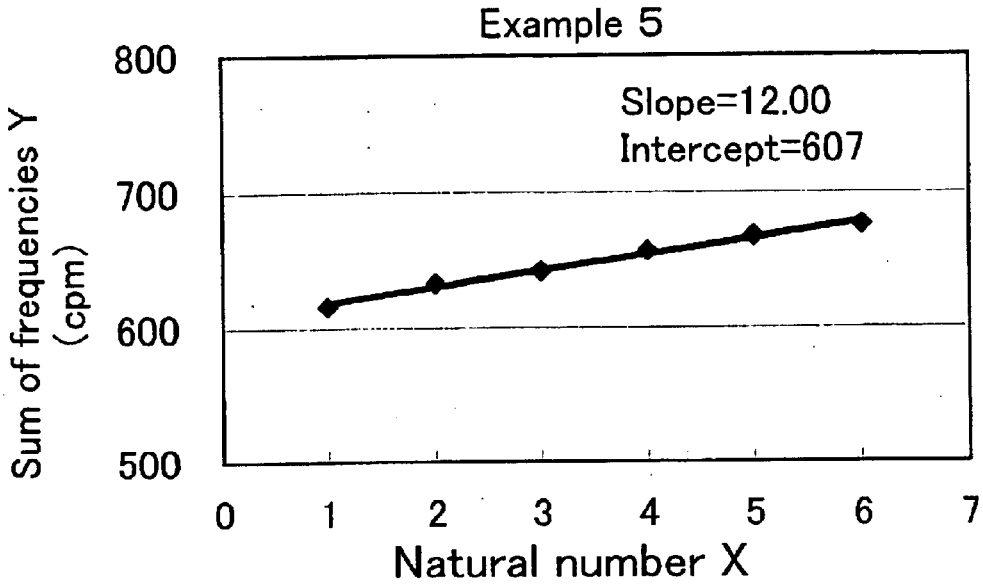
Figure 140:
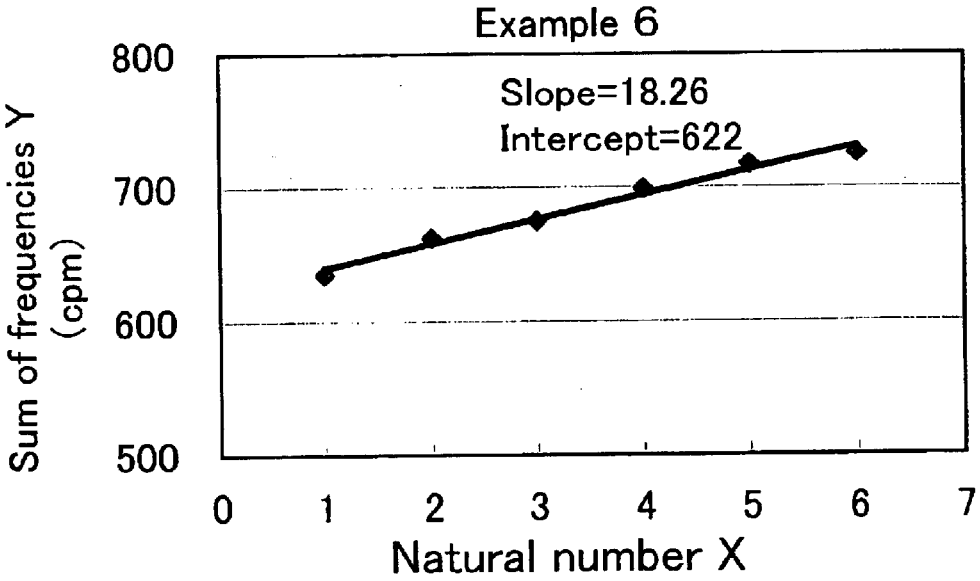
Figure 141:
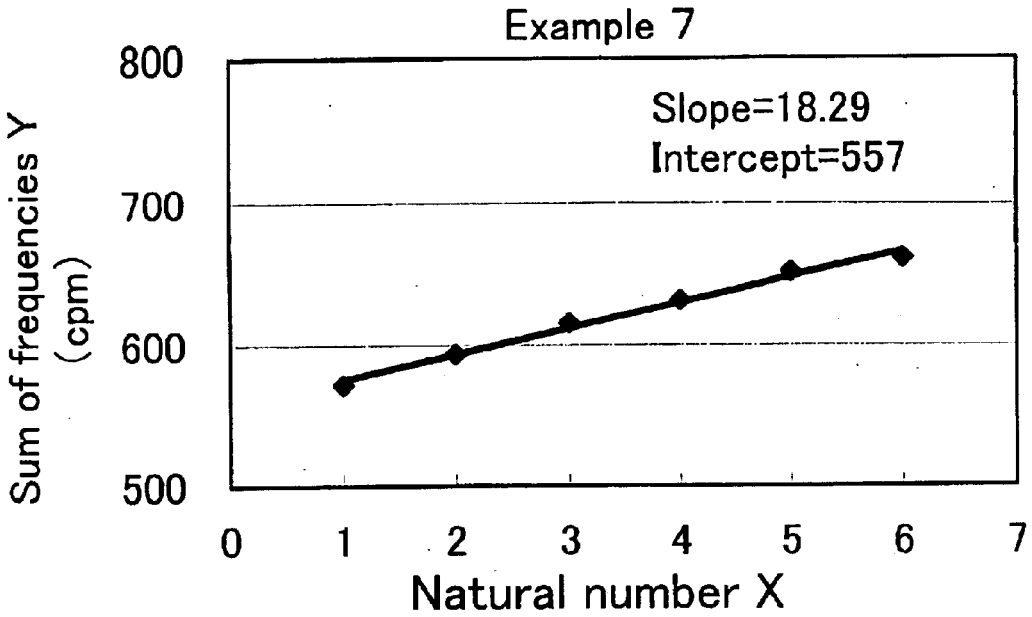
Figure 142:
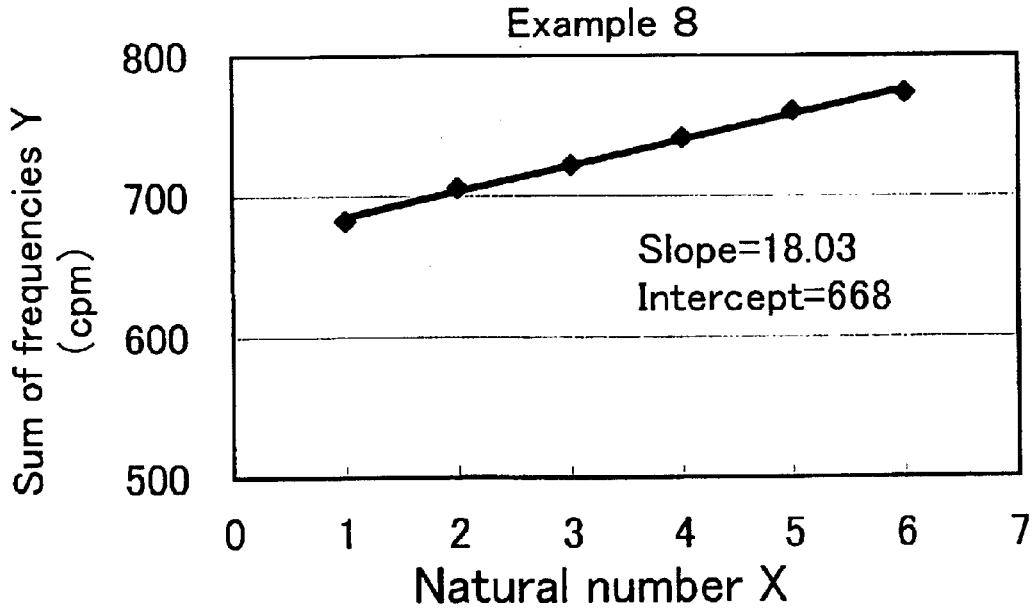
Figure 143:
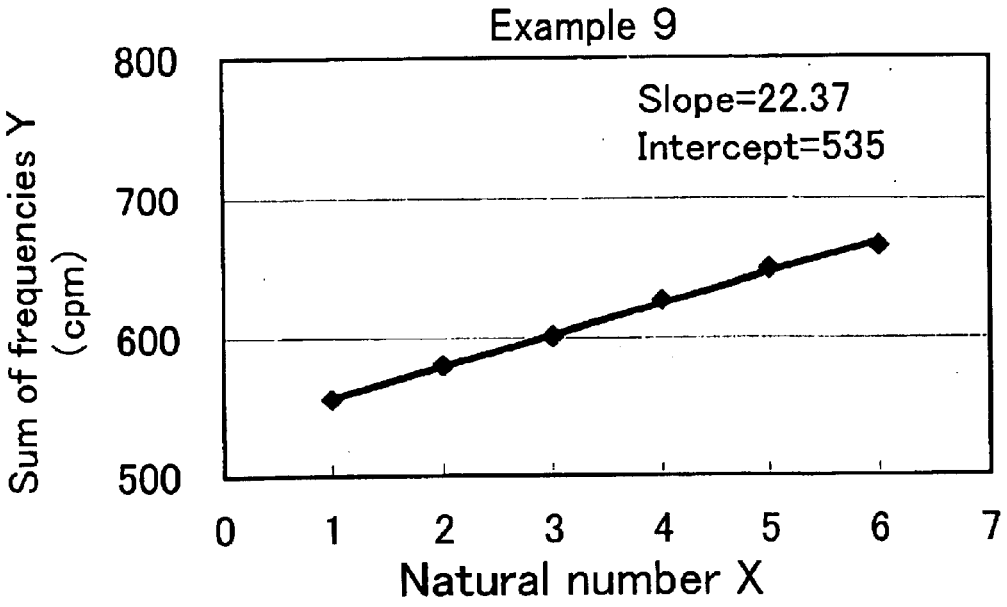
Figure 144:
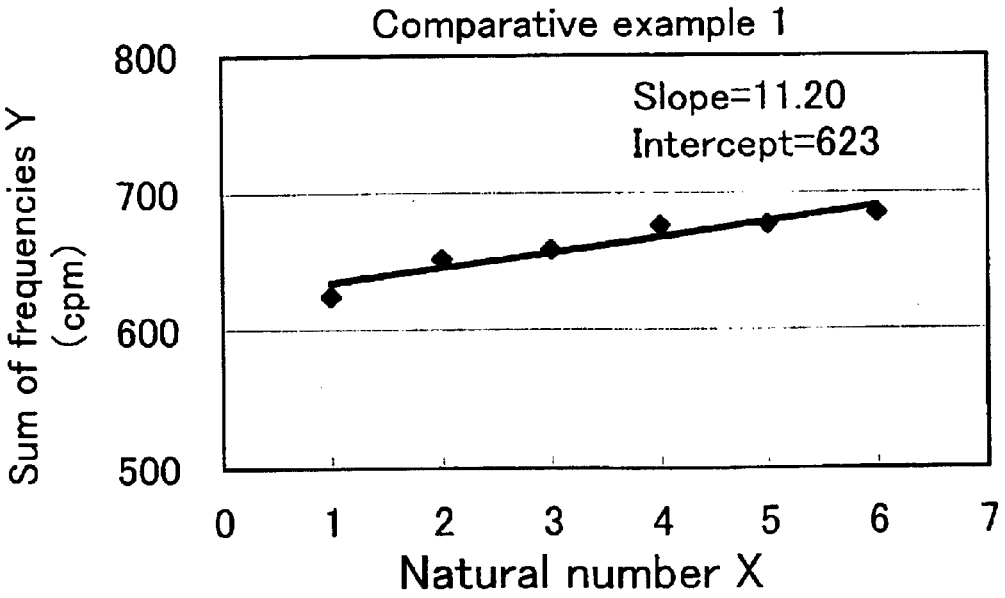
Figure 145:
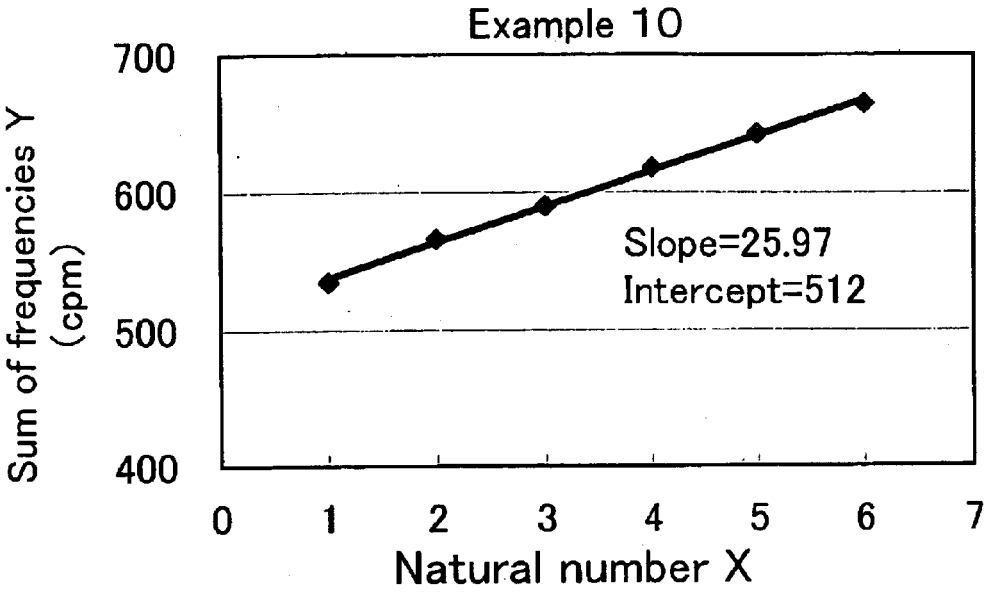
Figure 146:
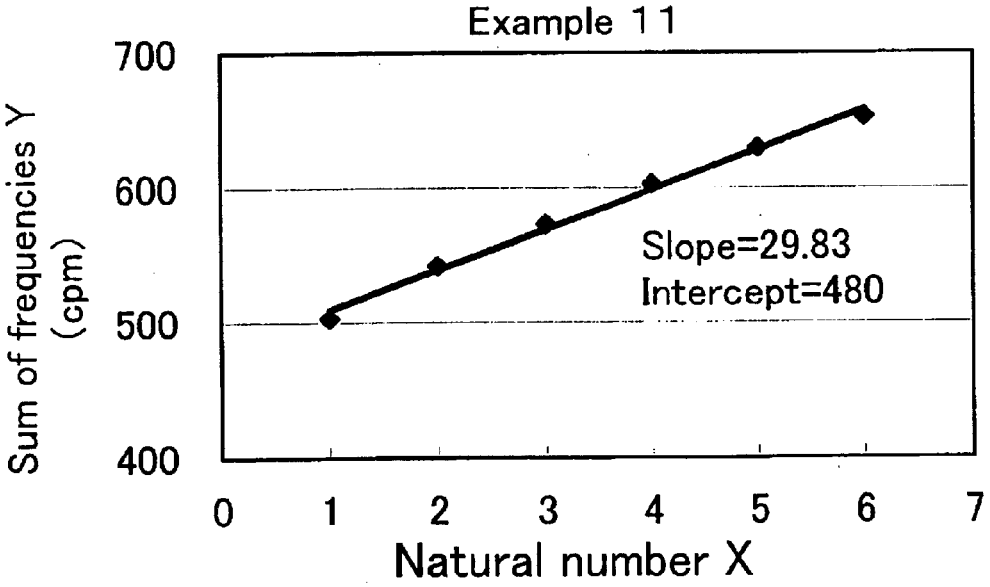
Figure 147:
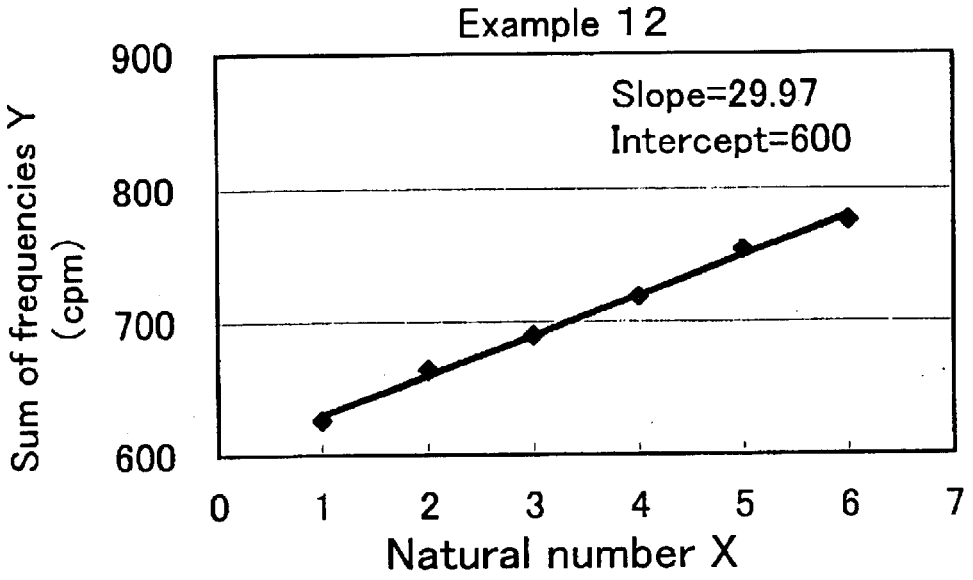
Figure 148:
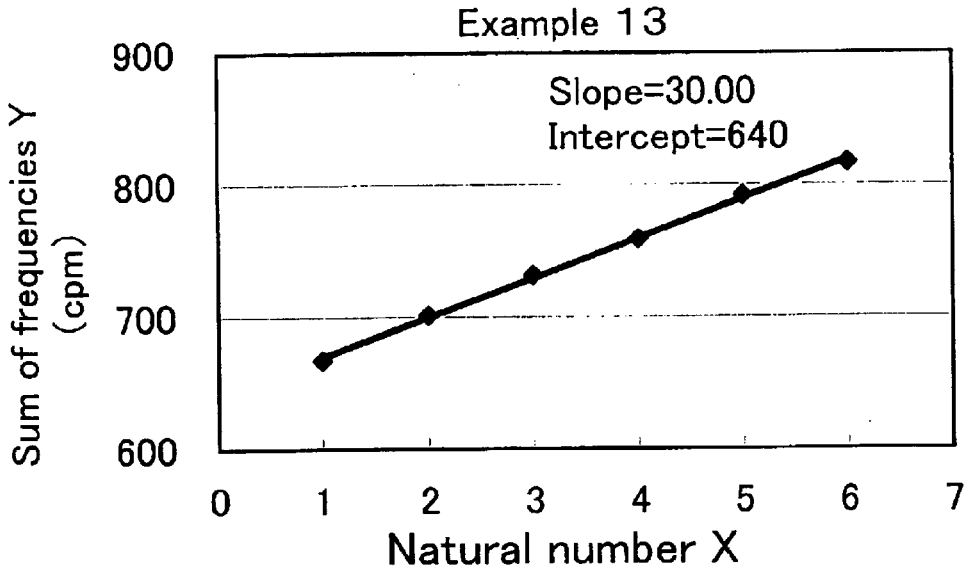
Figure 149:
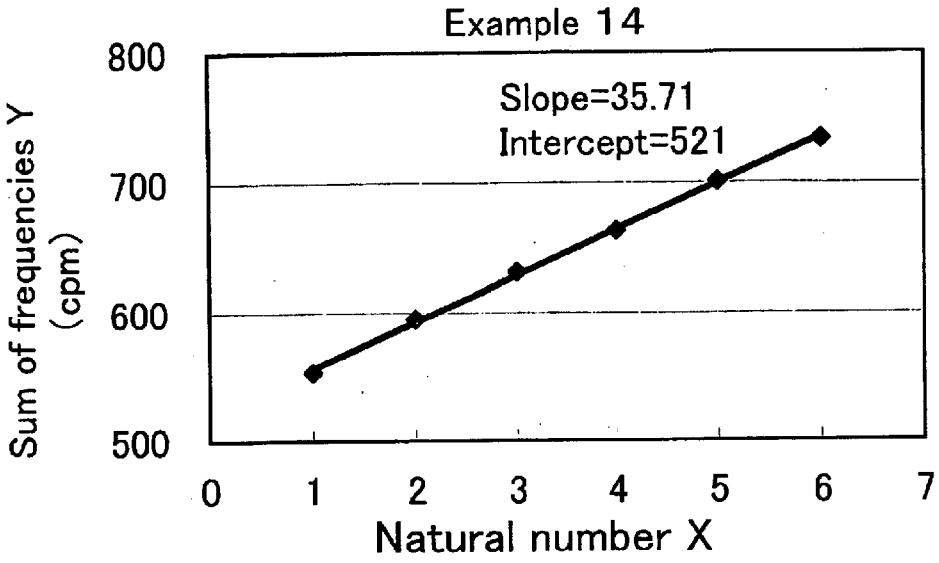
Figure 150:
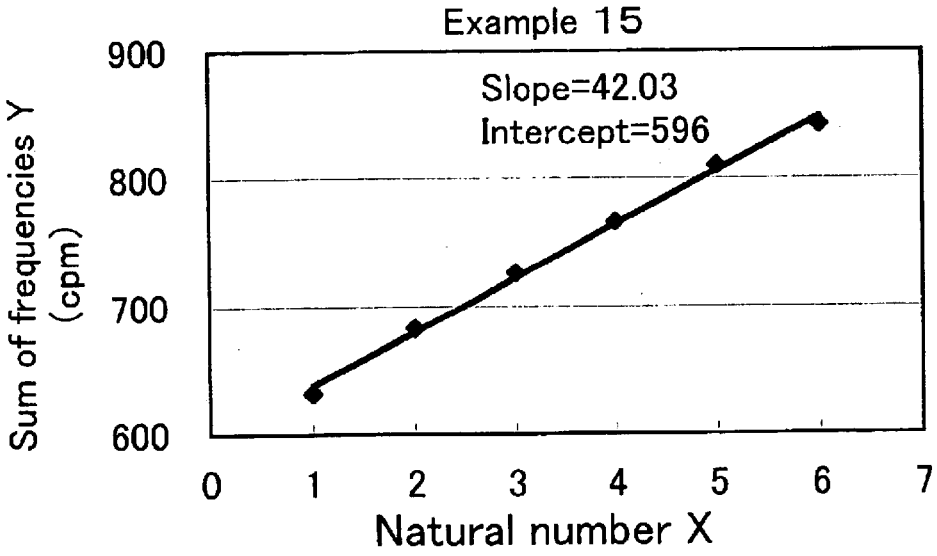
Figure 151:
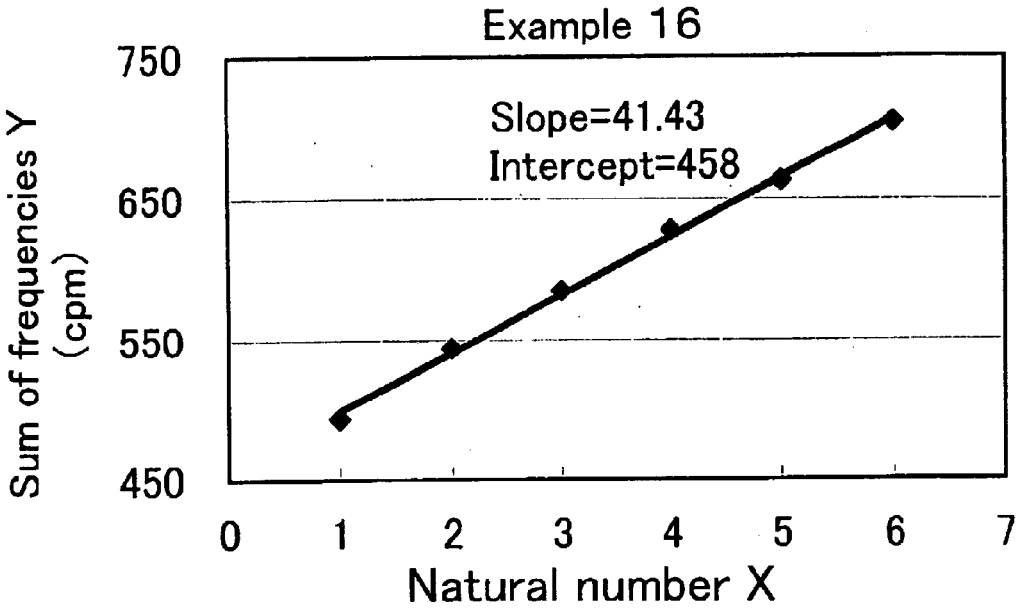
Figure 152:
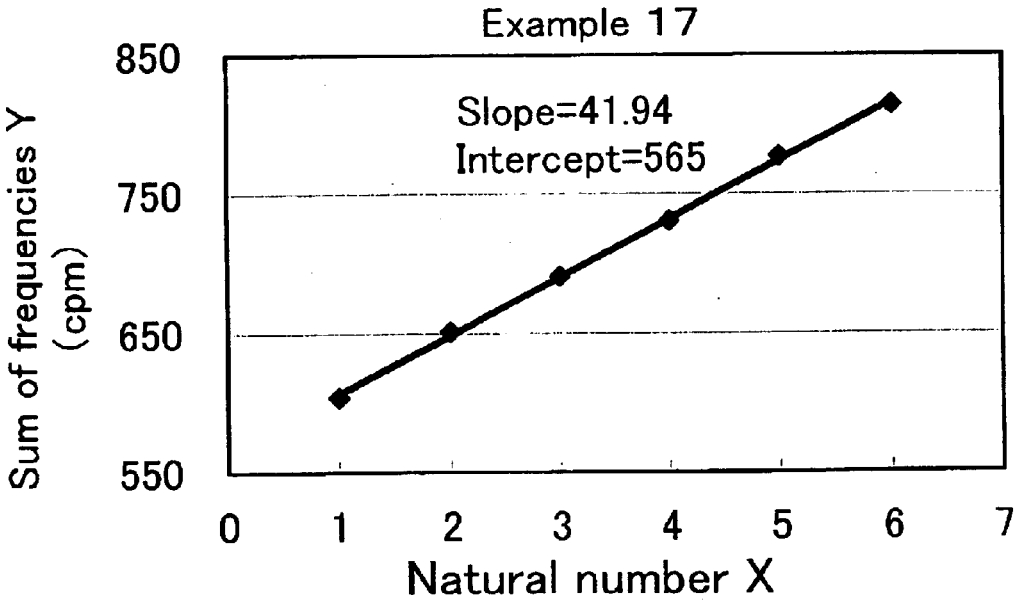
Figure 153:
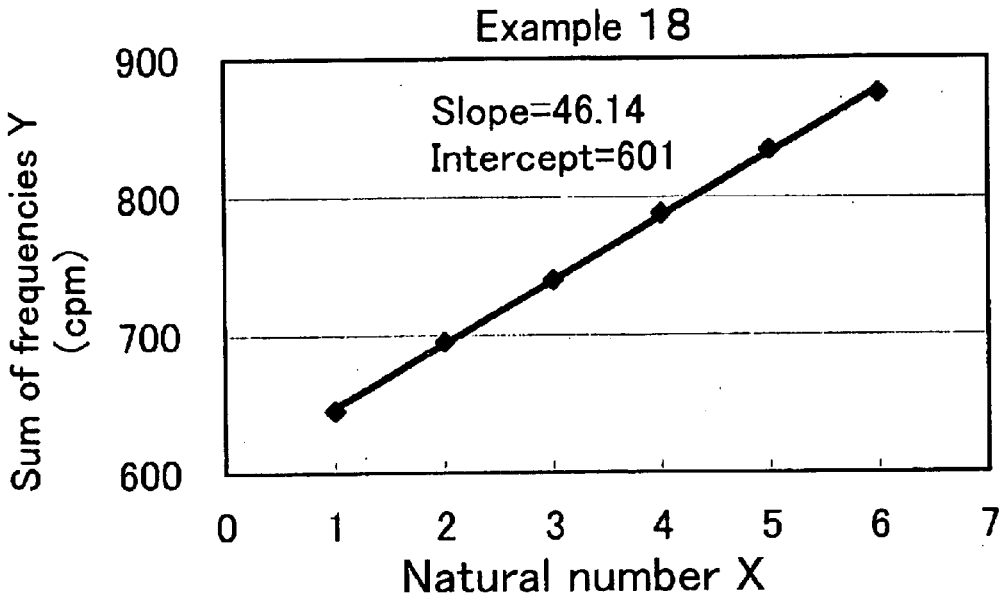
Figure 154:
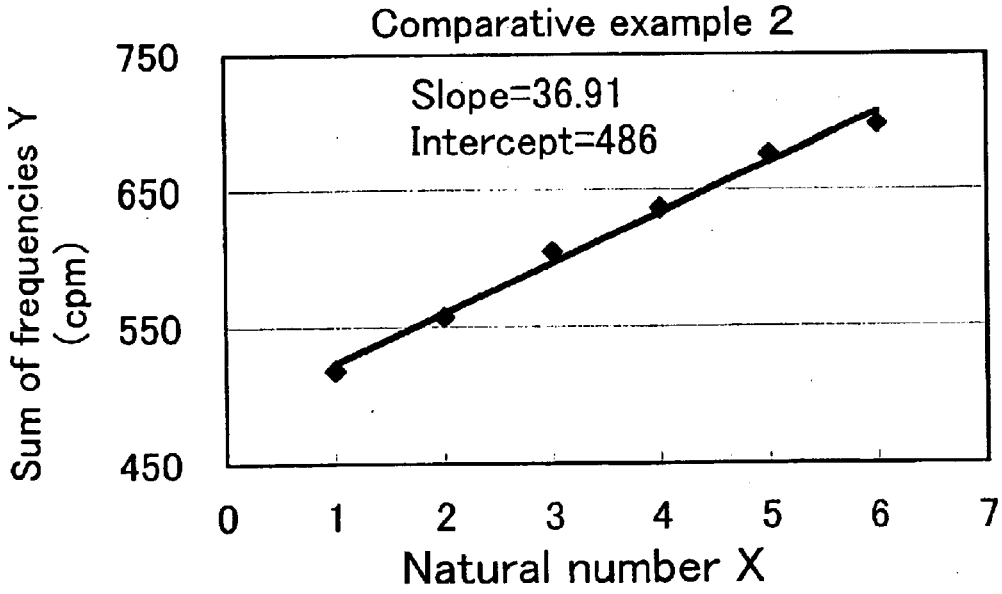
Figure 155:
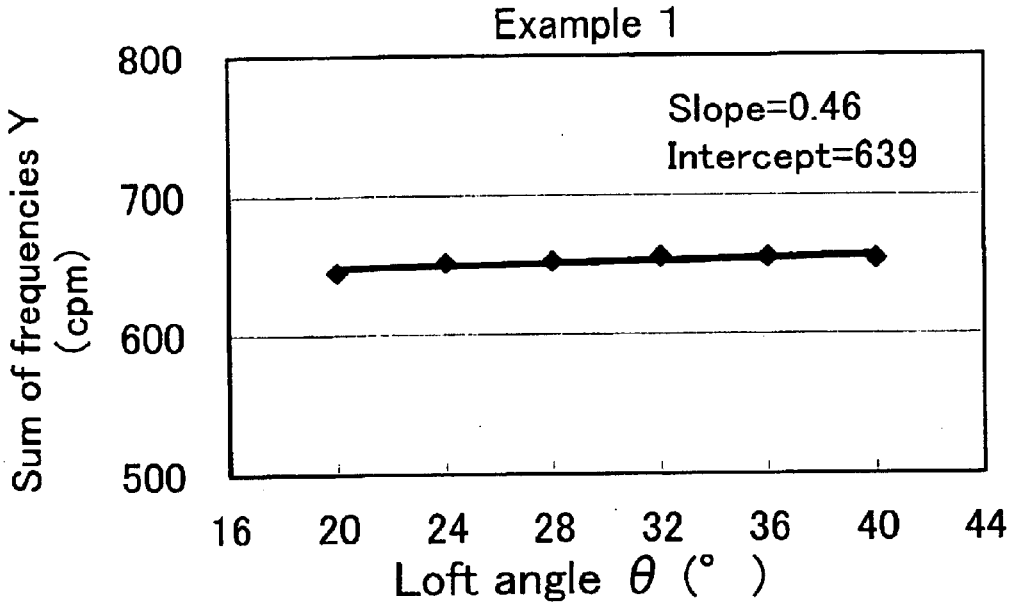
FIG. 155 to FIG. 174 are graphs showing regression lines of the sums Y of frequencies to the loft angles θ in the golf club sets in the examples 1 to 18 and the comparative examples 1 to 2, respectively.
Figure 156:
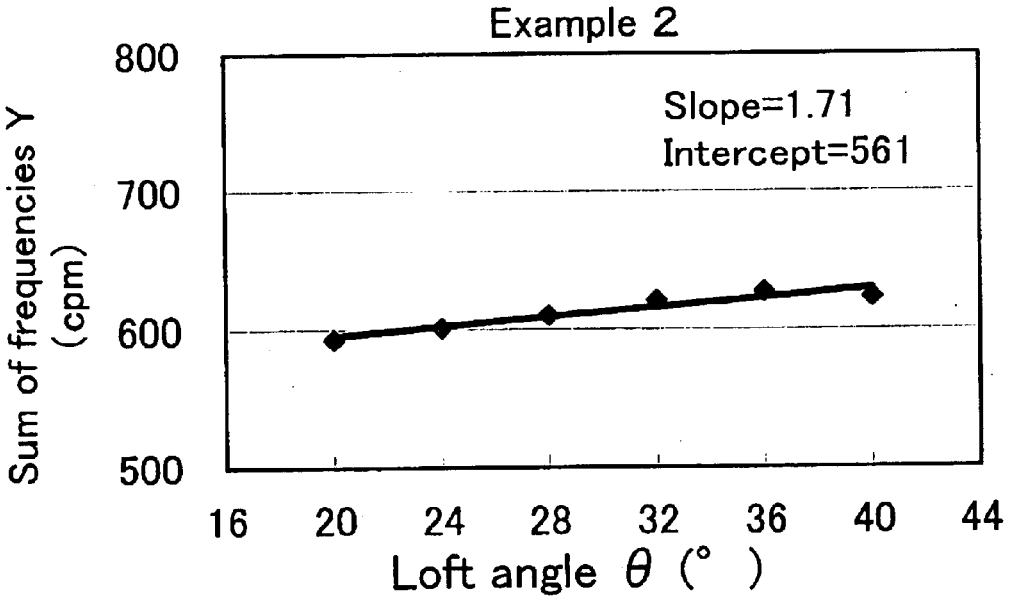
Figure 157:
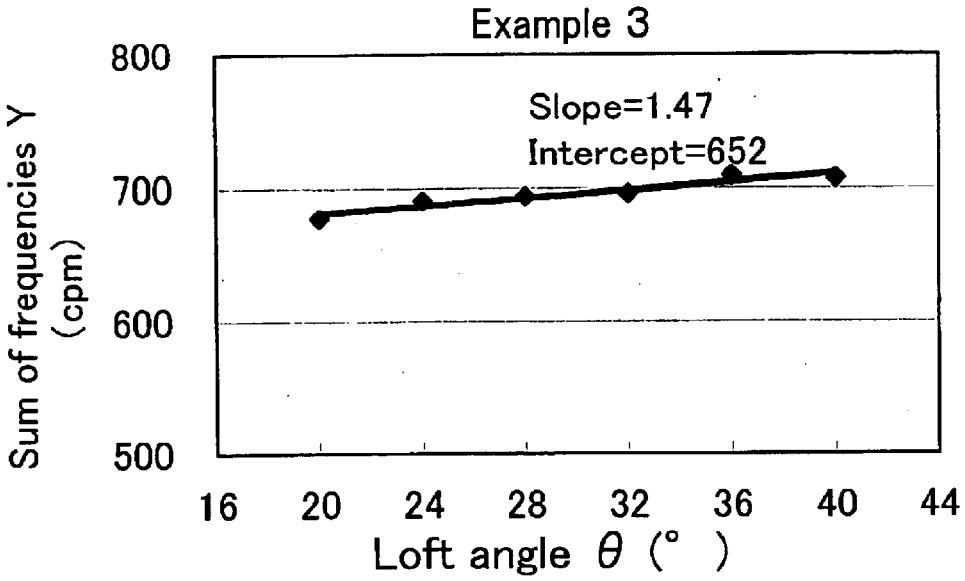
Figure 158:
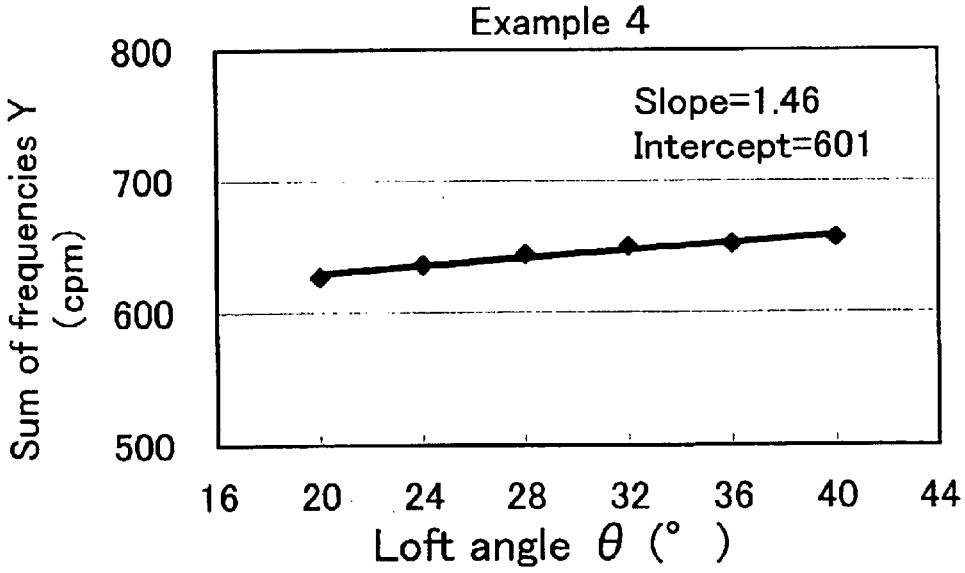
Figure 159:
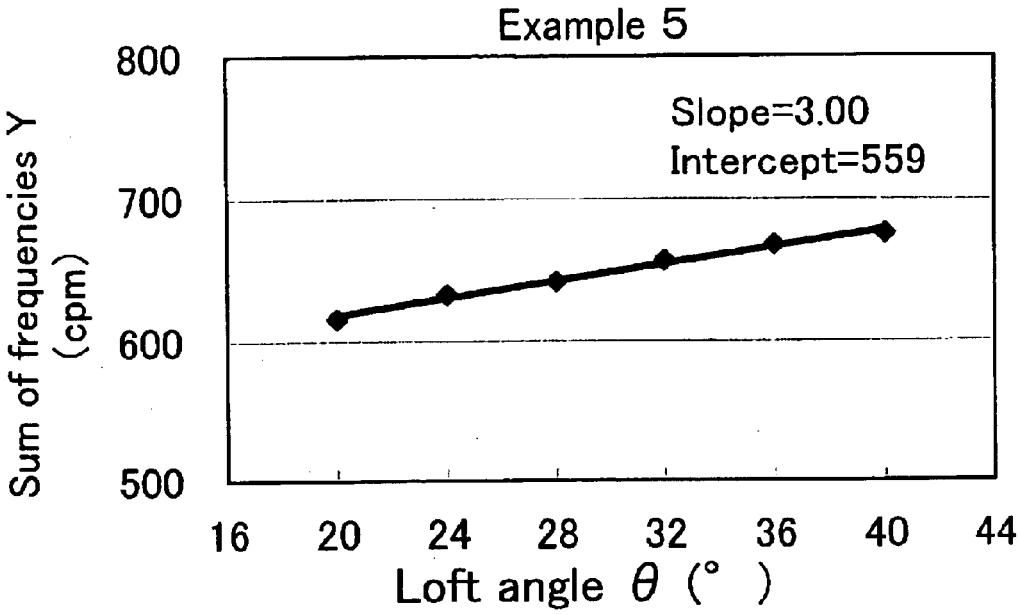
Figure 160:
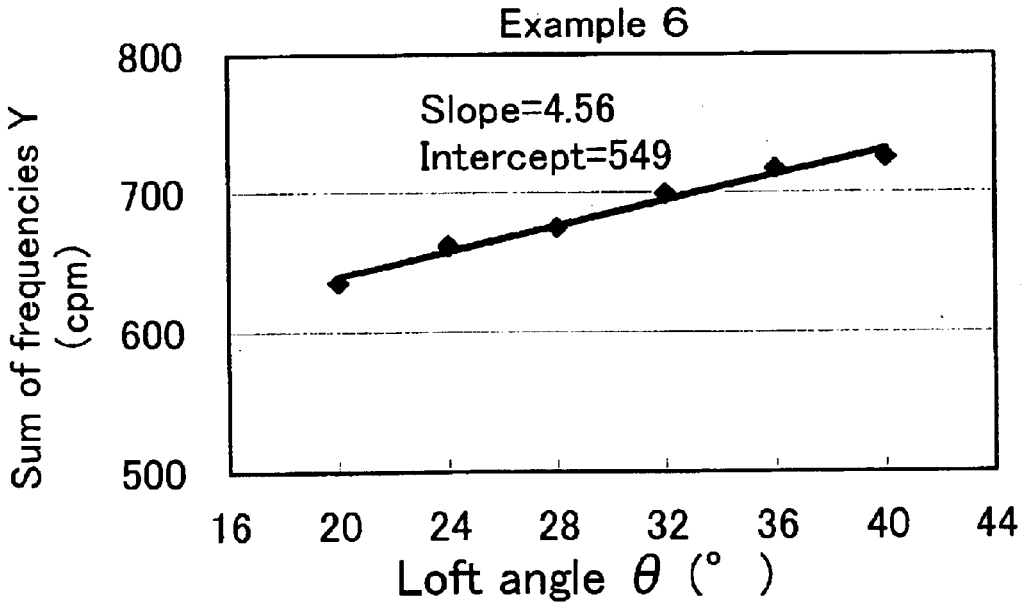
Figure 161:
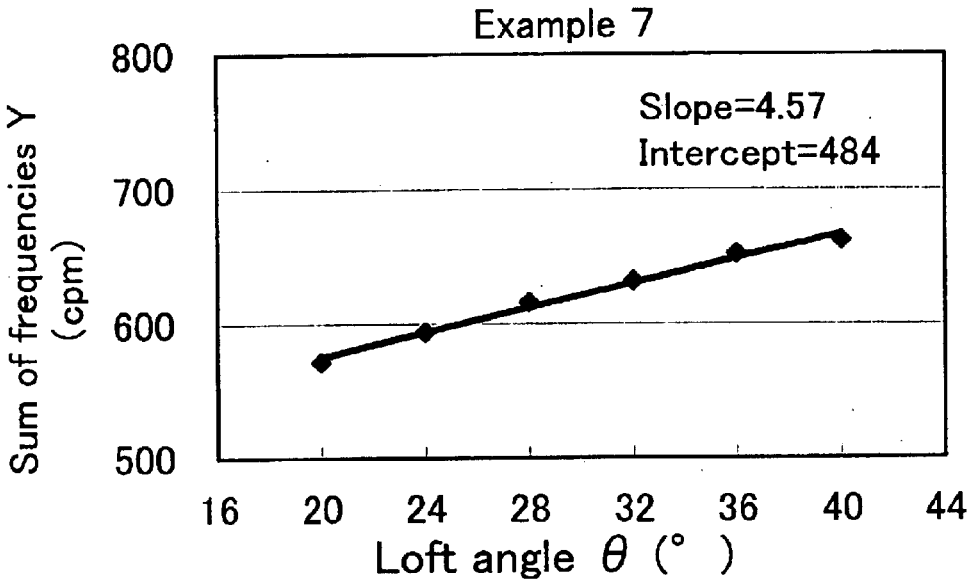
Figure 162:
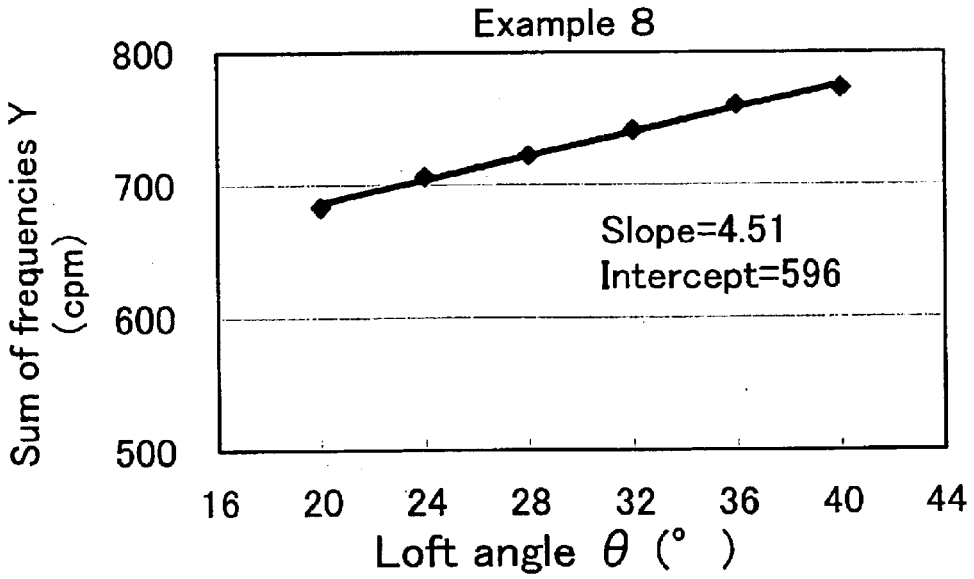
Figure 163:
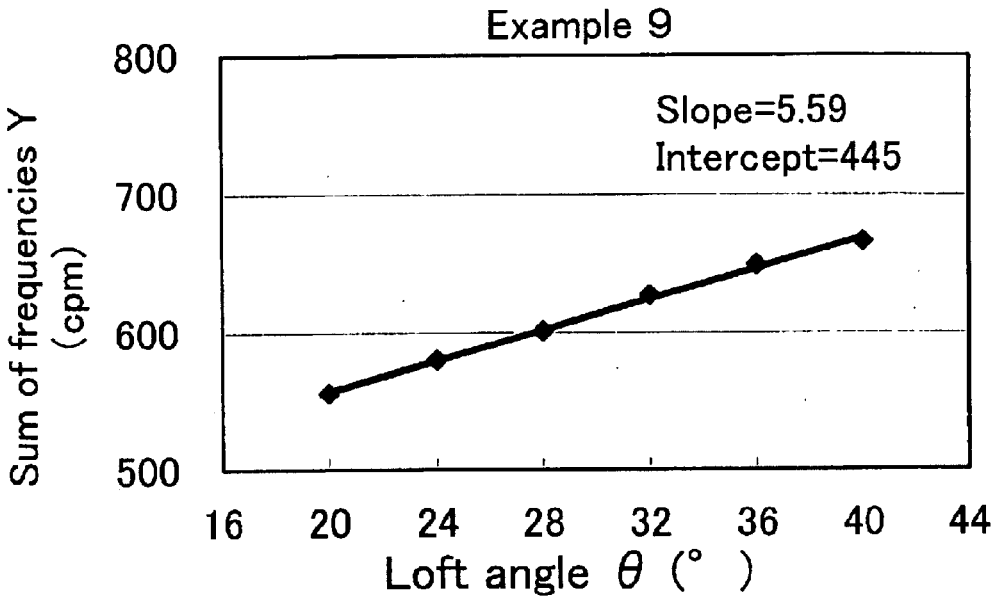
Figure 164:
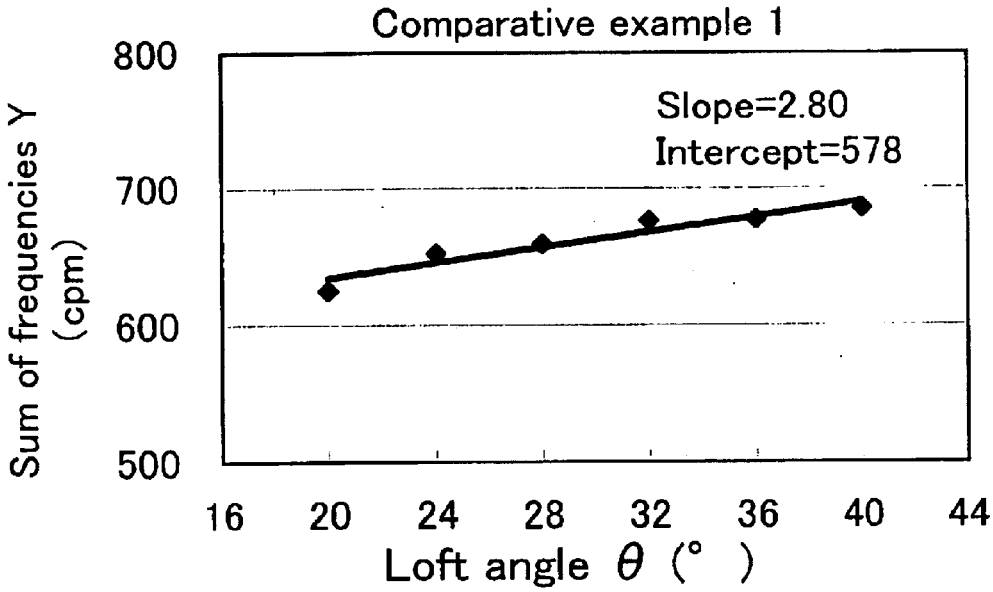
Figure 165:
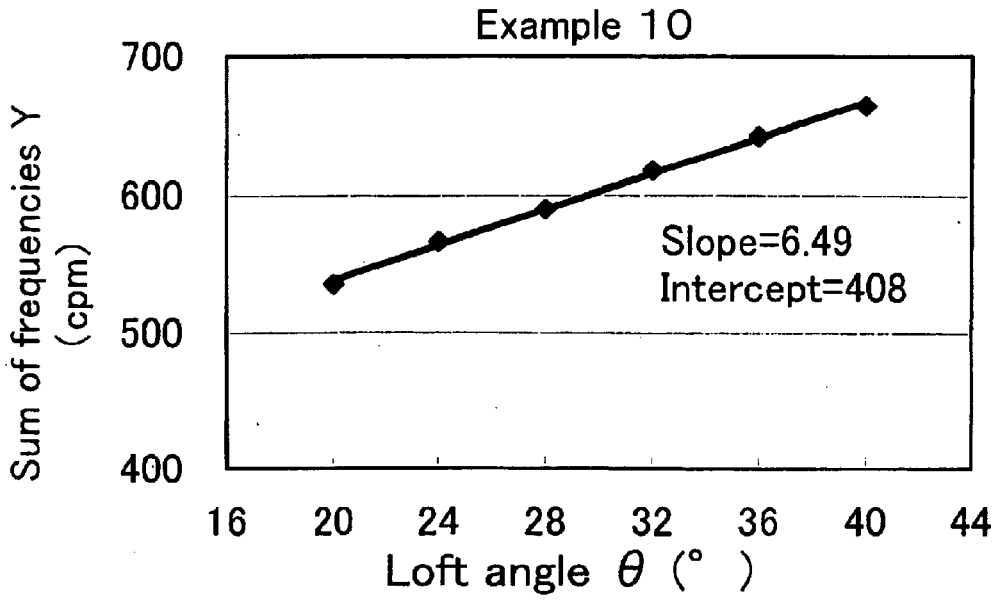
Figure 166:
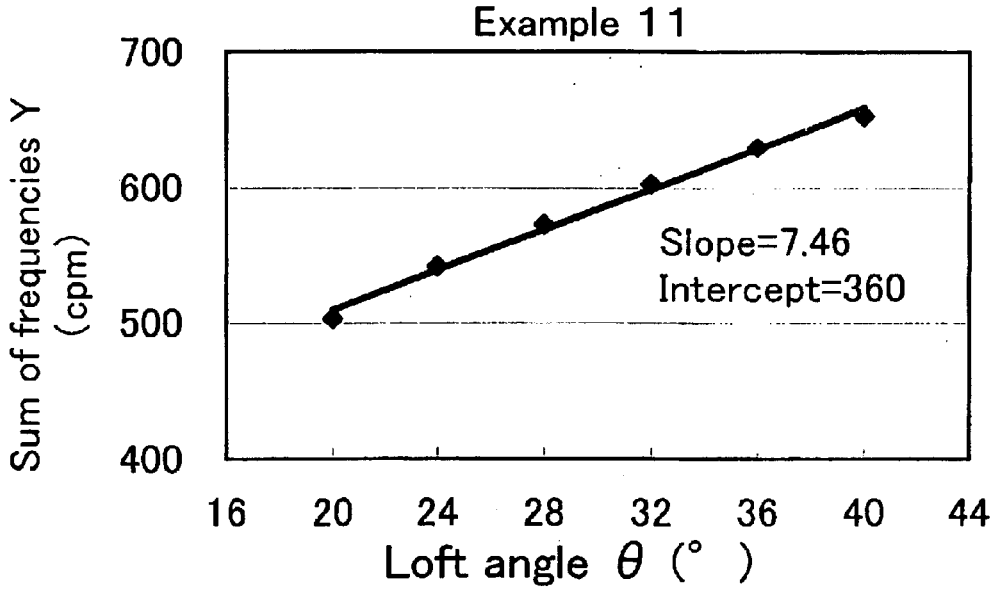
Figure 167:
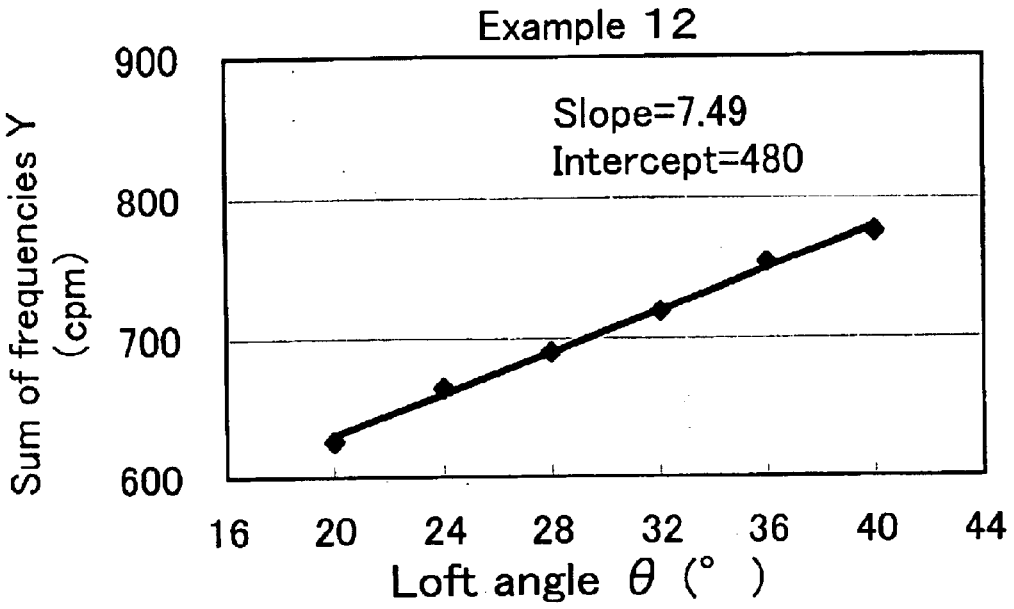
Figure 168:
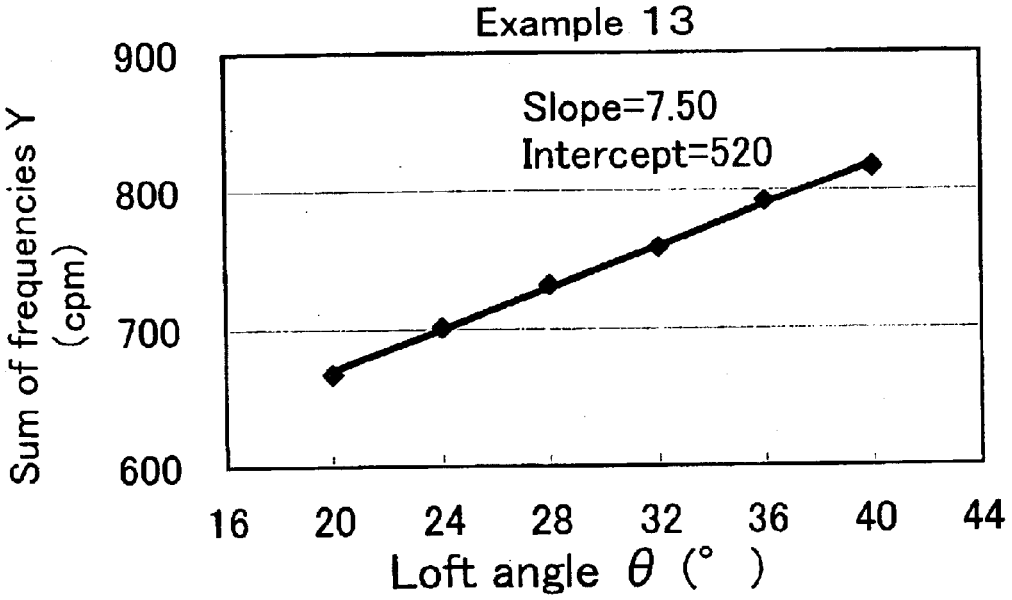
Figure 169:
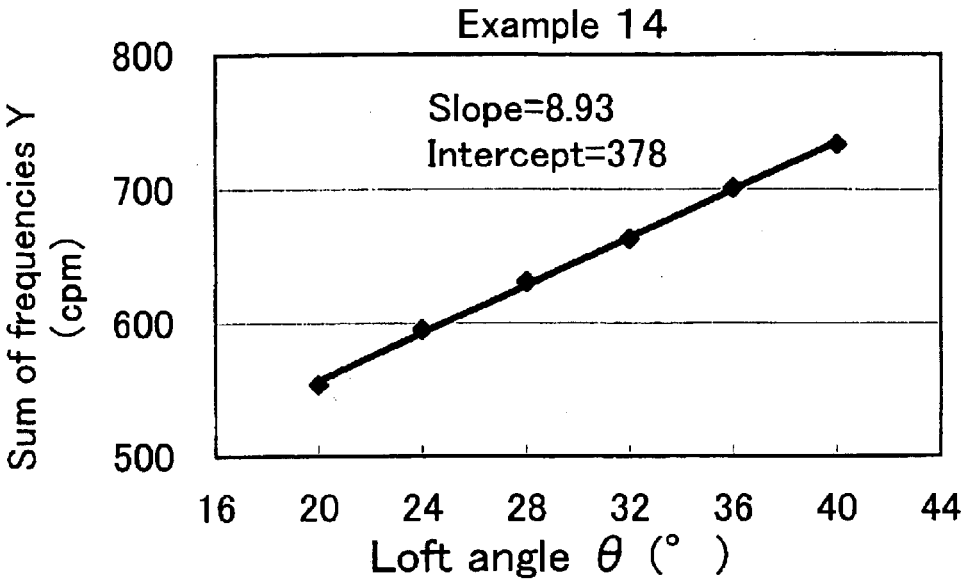
Figure 170:
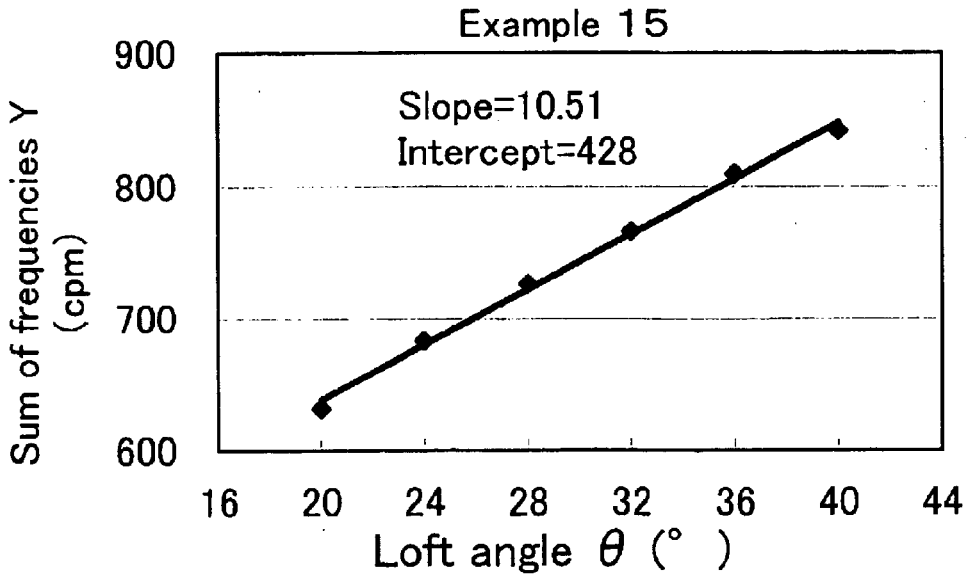
Figure 171:
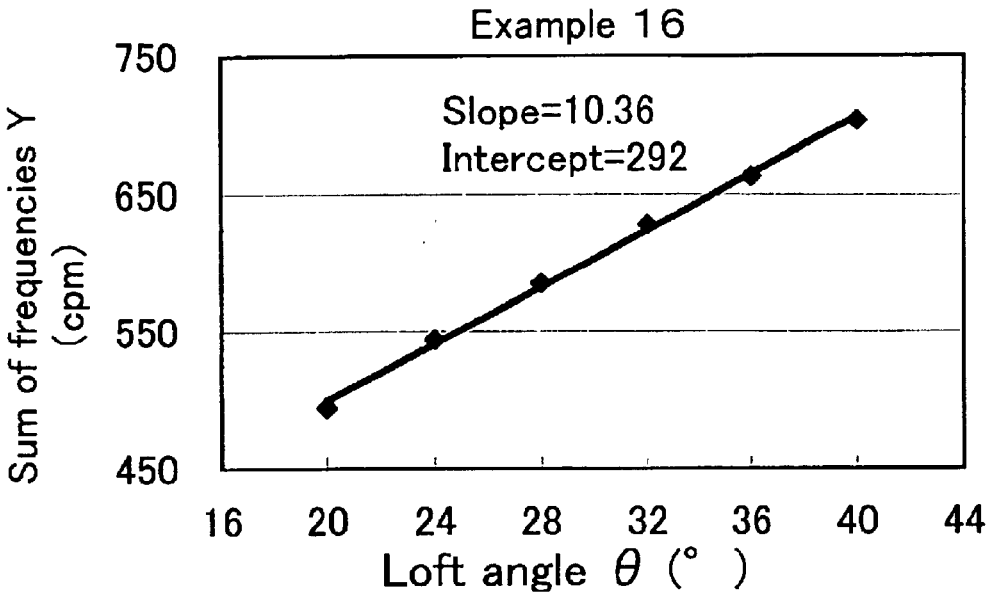
Figure 172:
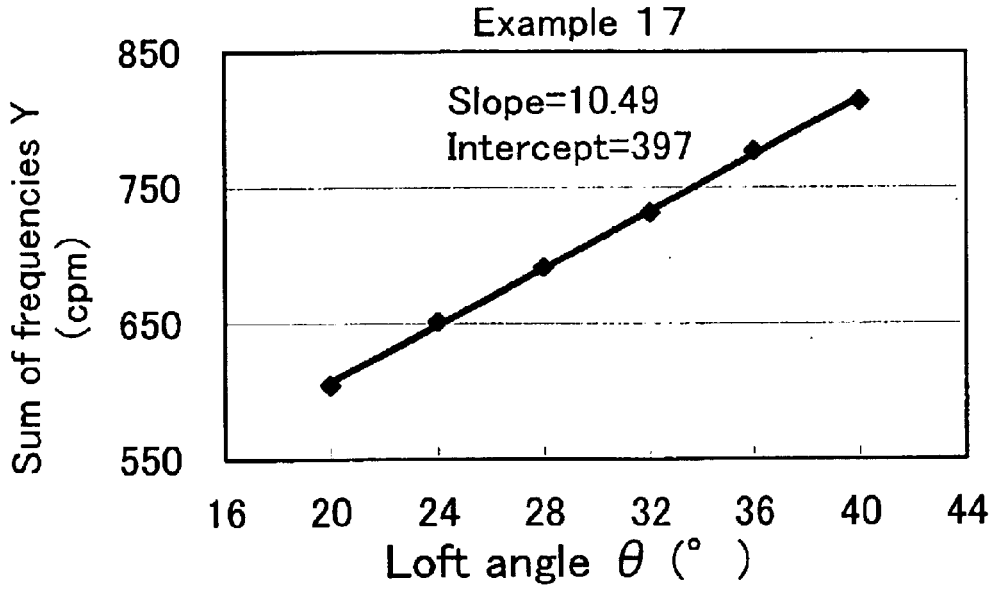
Figure 173:
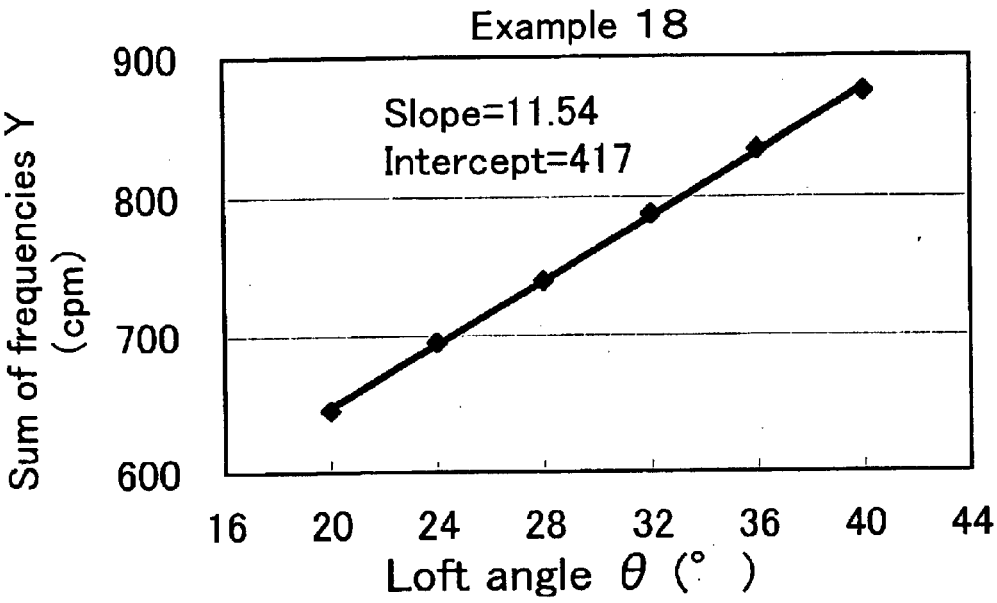
Figure 174:
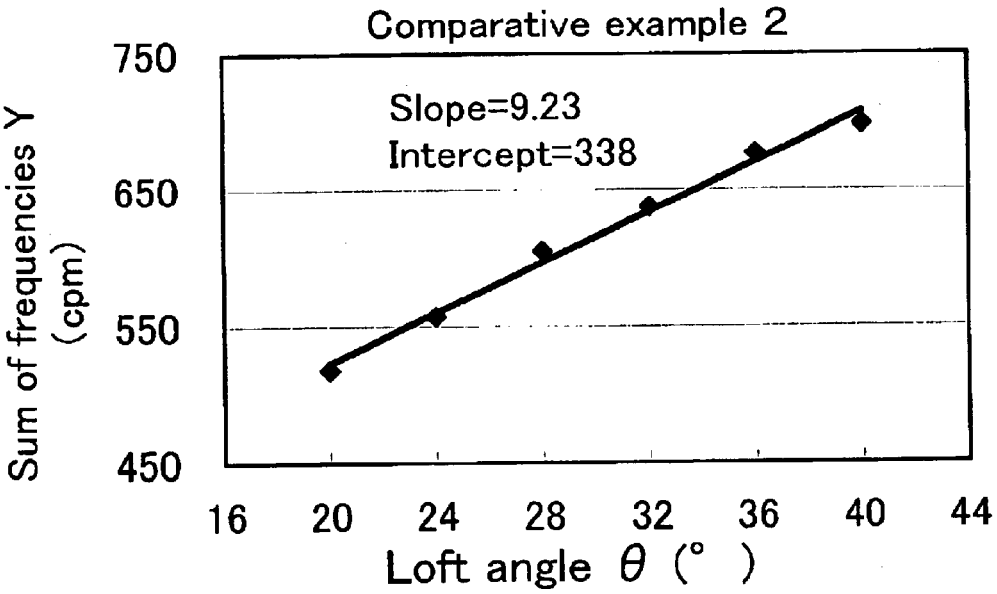
Figure 175:
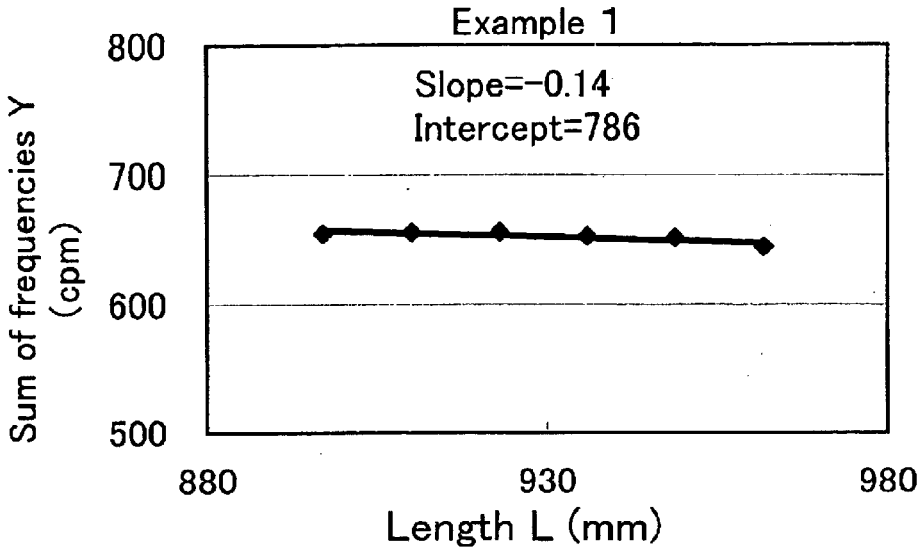
FIG. 175 to FIG. 194 are graphs showing regression lines of the sums Y of frequencies to the length L of golf club shafts in the golf club sets in the examples 1 to 18 and the comparative examples 1 to 2, respectively.
Figure 176:
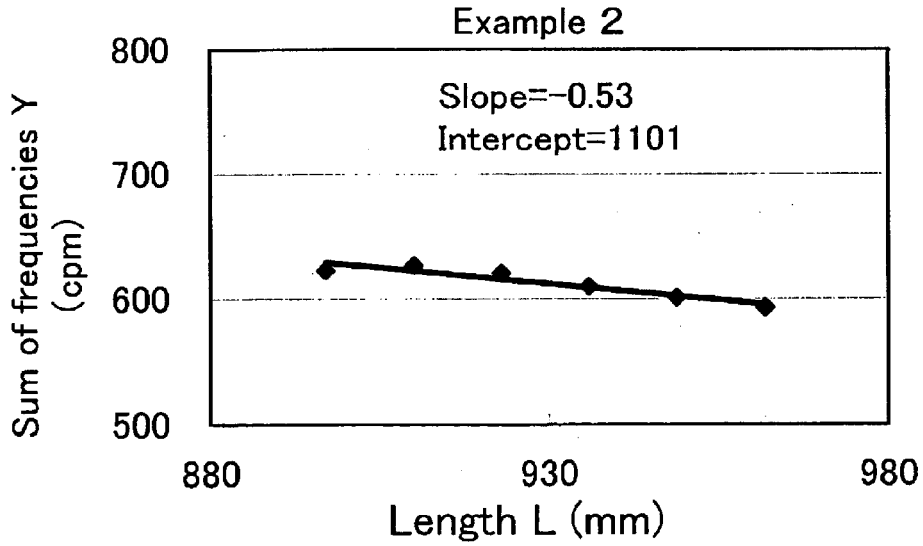
Figure 177:
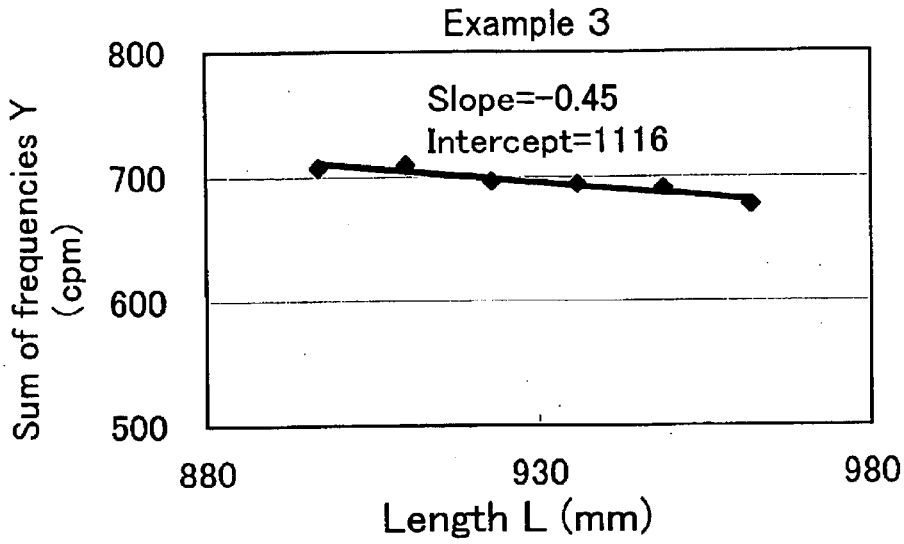
Figure 178:
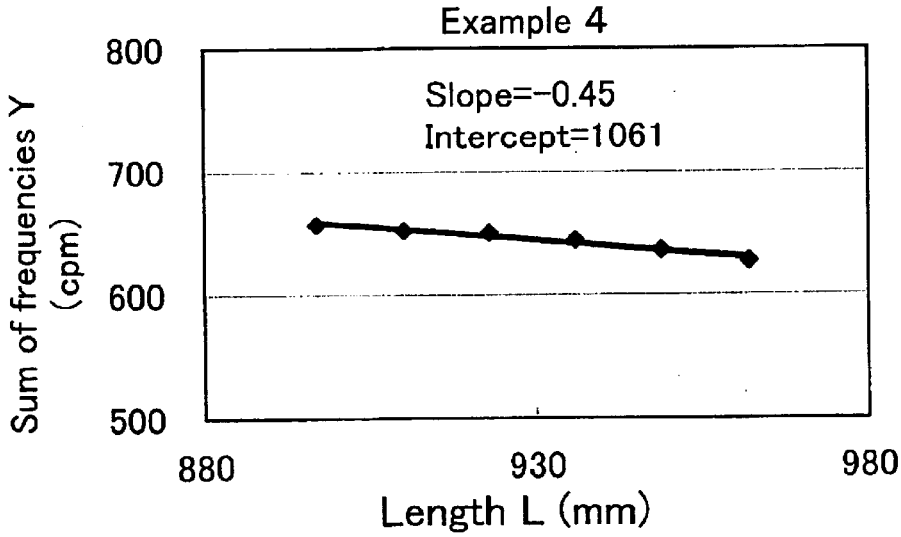
Figure 179:
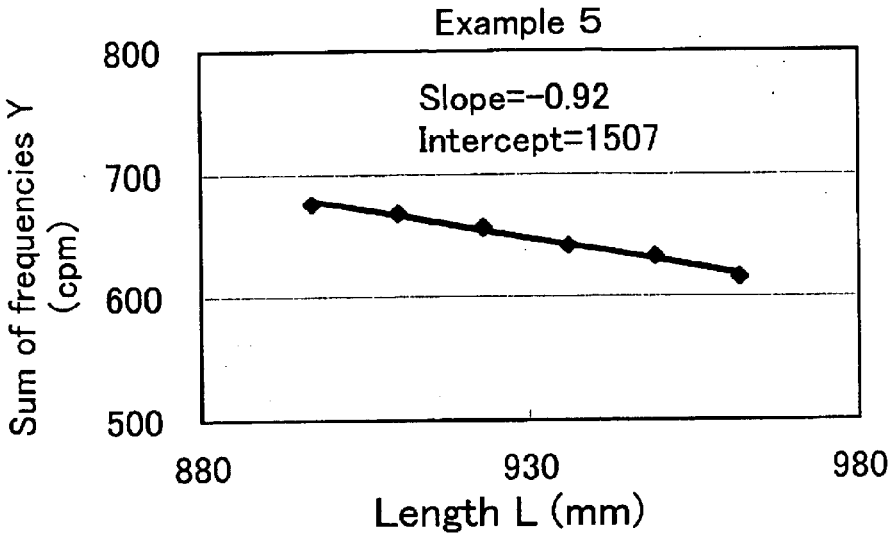
Figure 180:
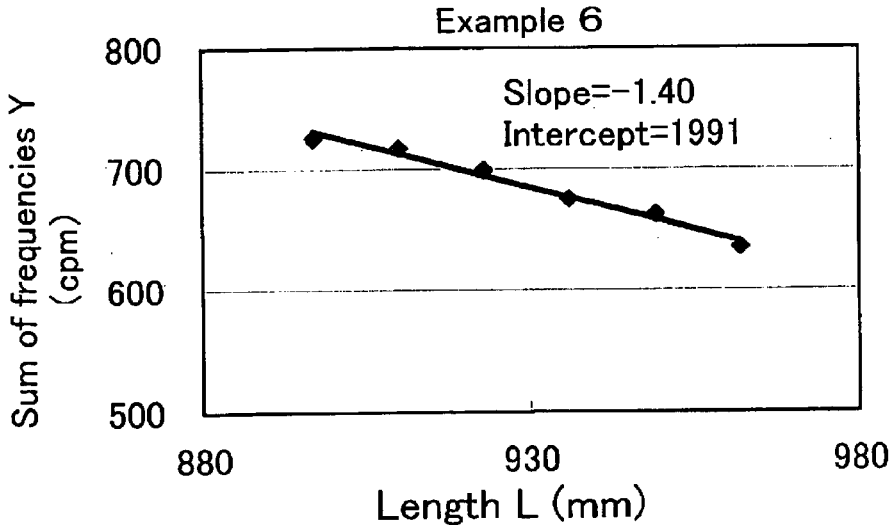
Figure 181:
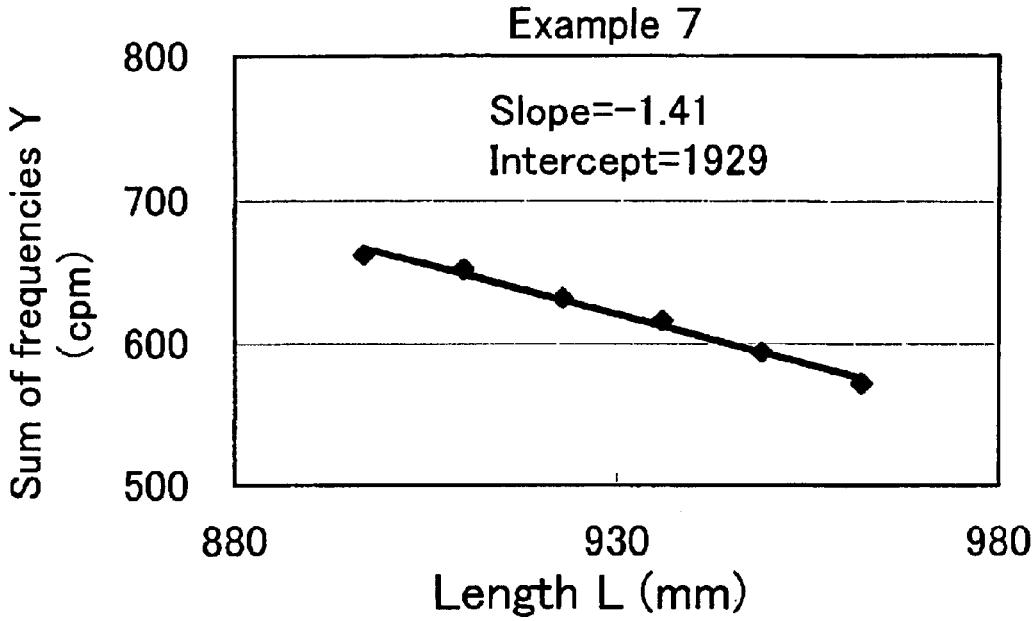
Figure 182:
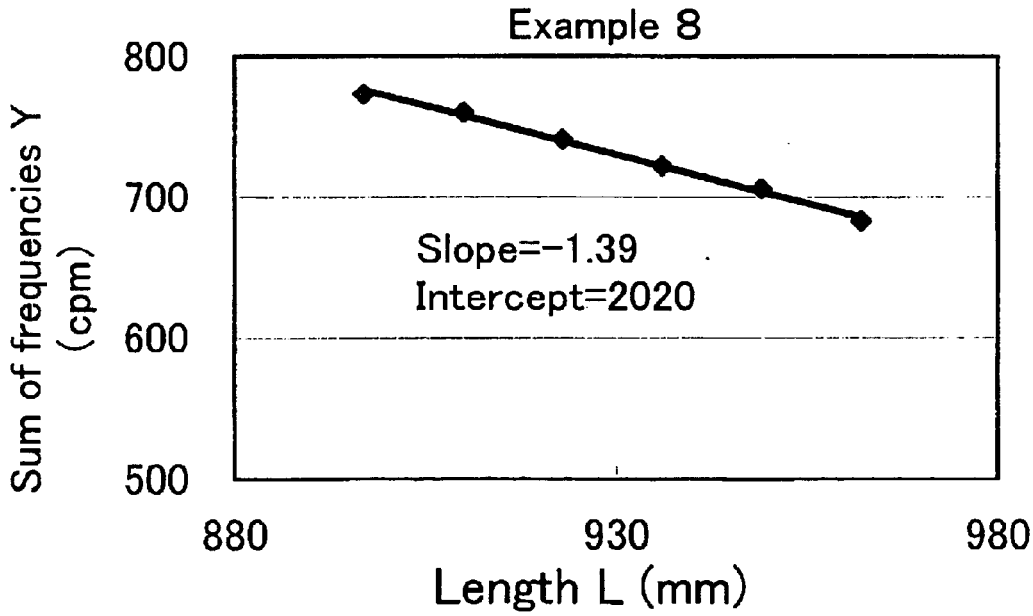
Figure 183:
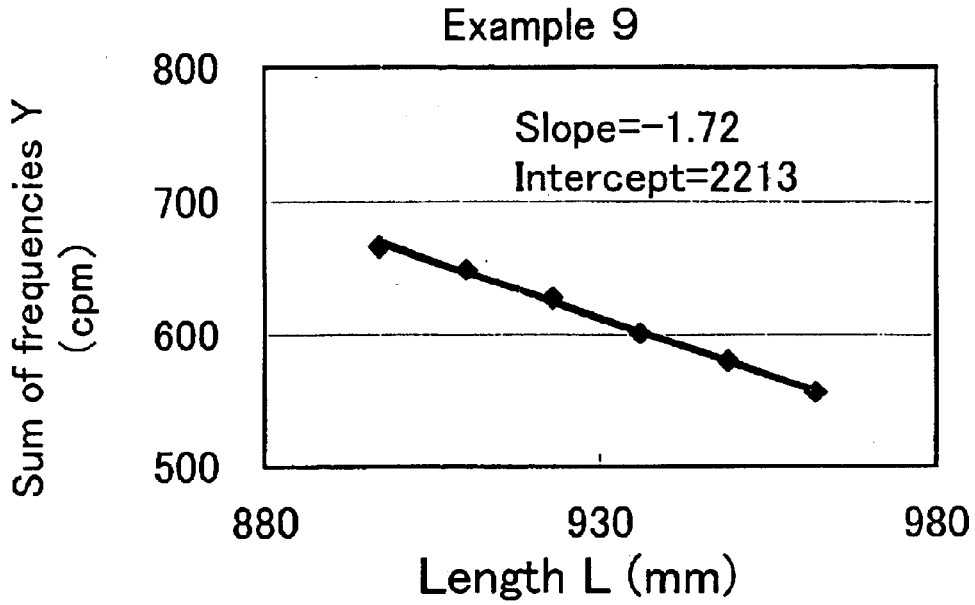
Figure 184:
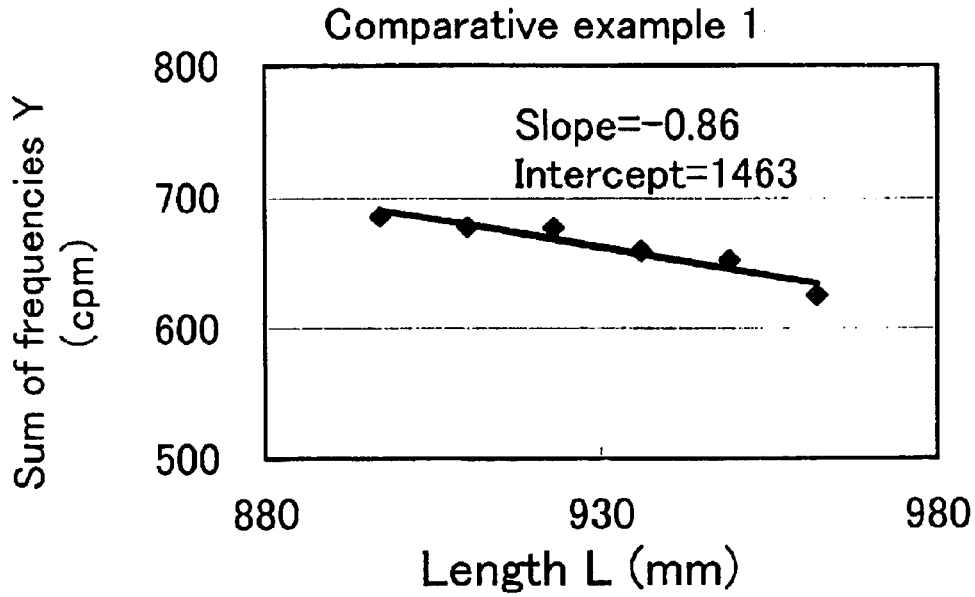
Figure 185:
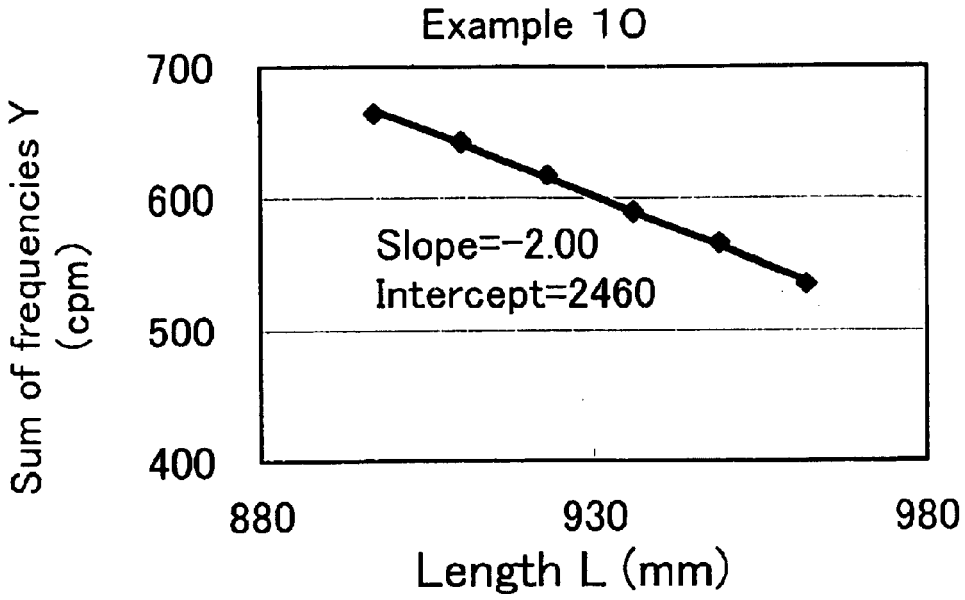
Figure 186:
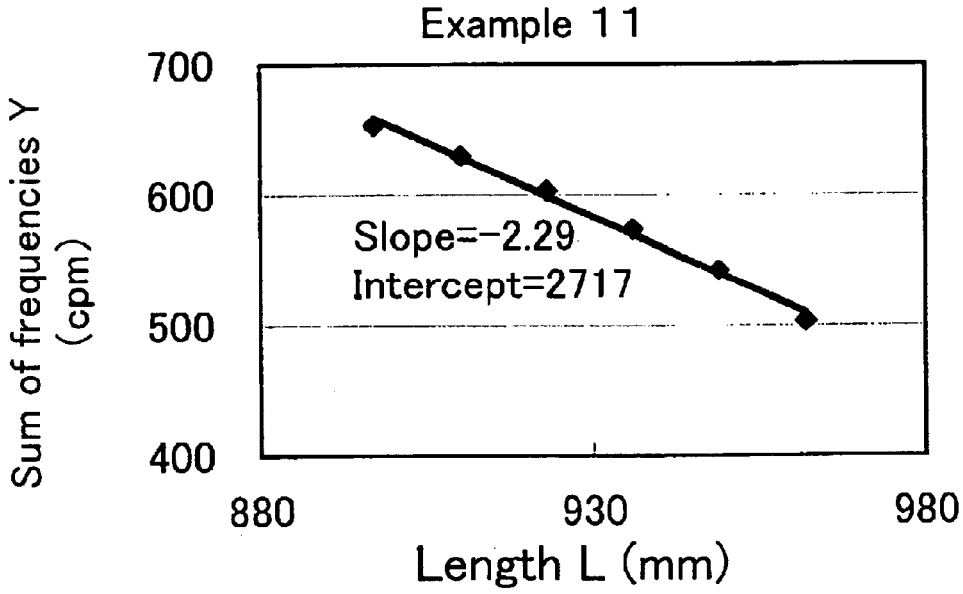
Figure 187:
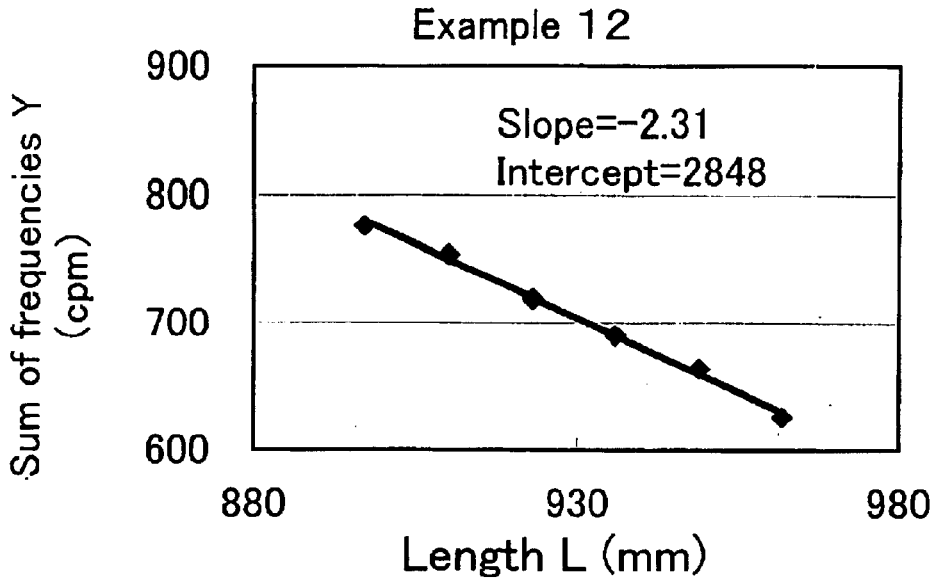
Figure 188:
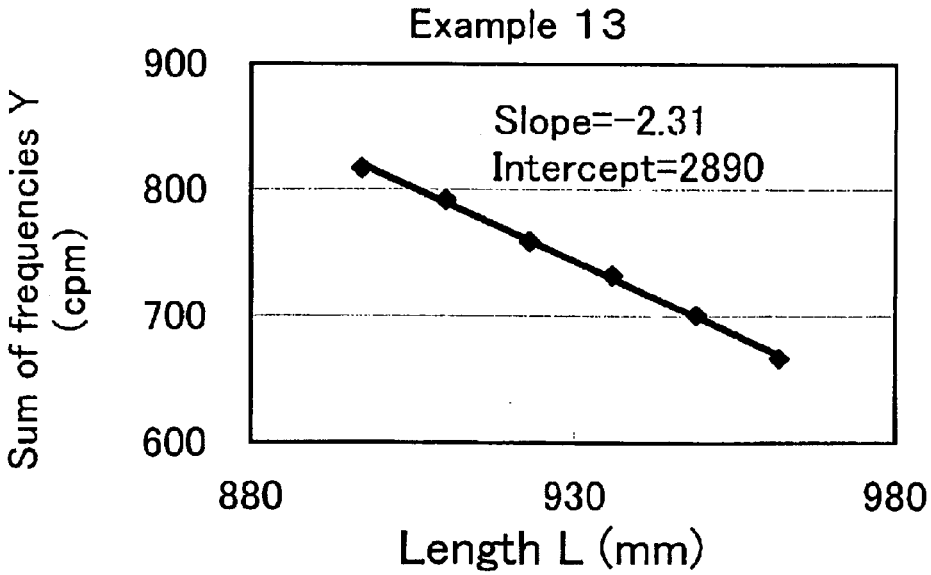
Figure 189:
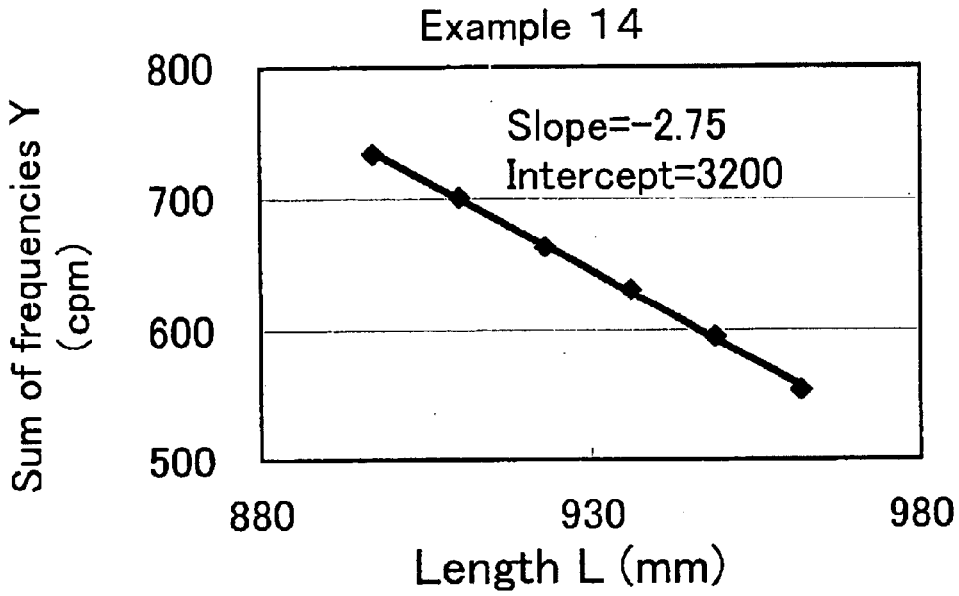
Figure 190:
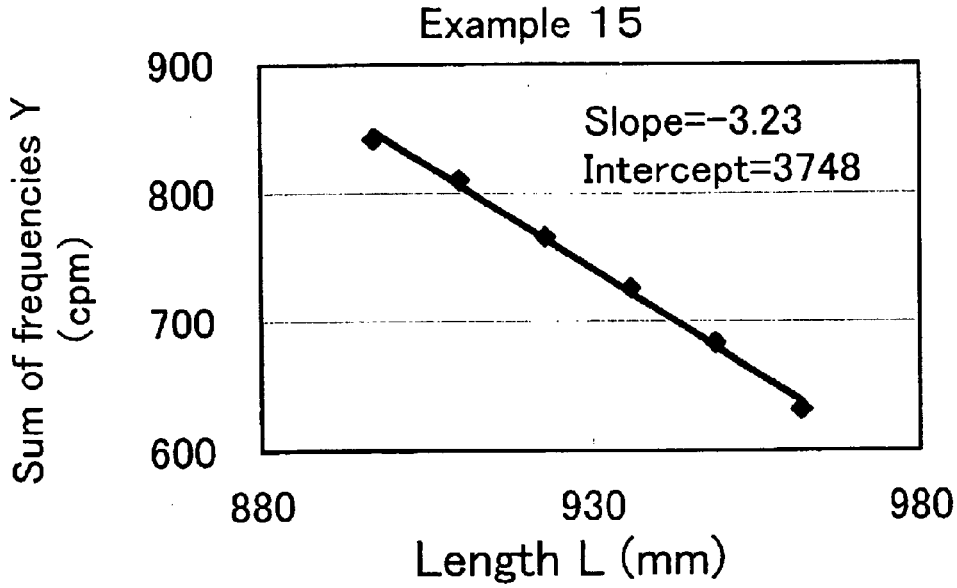
Figure 191:
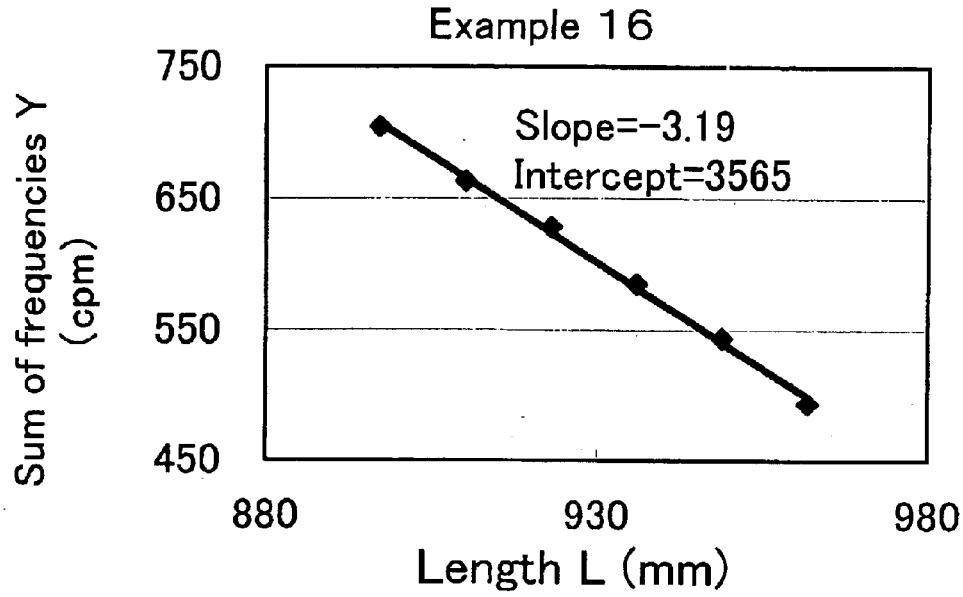
Figure 192:
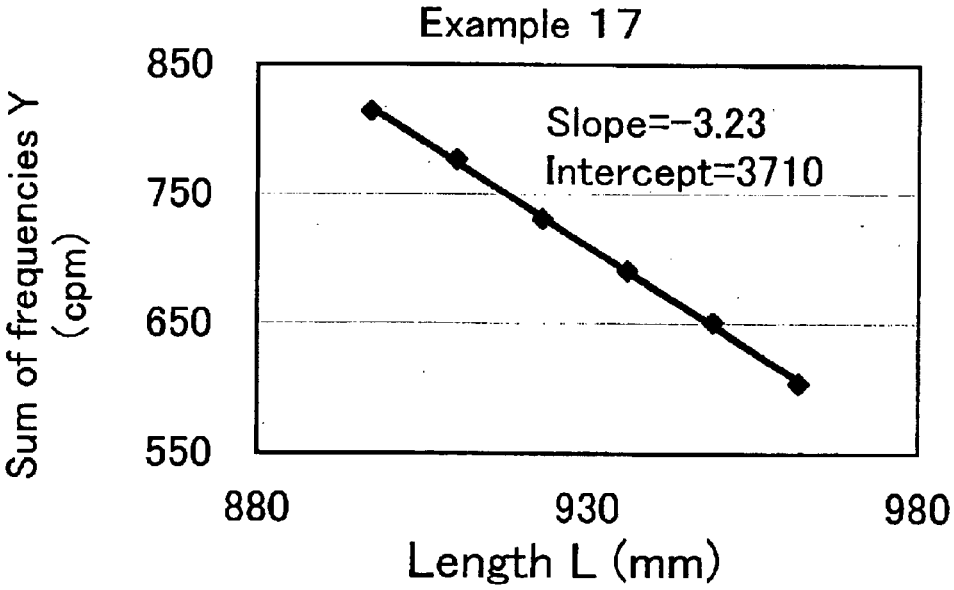
Figure 193:
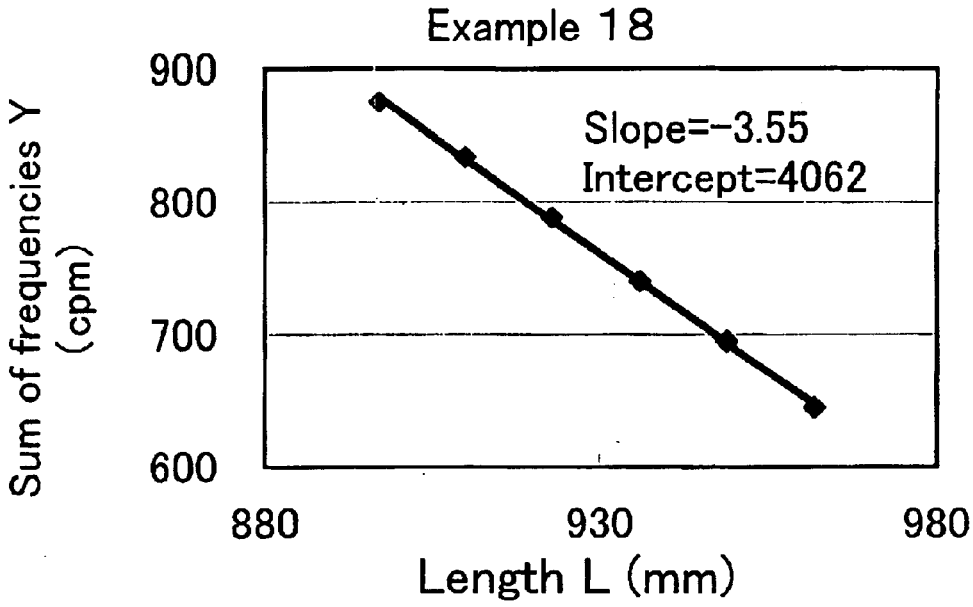
Figure 194:
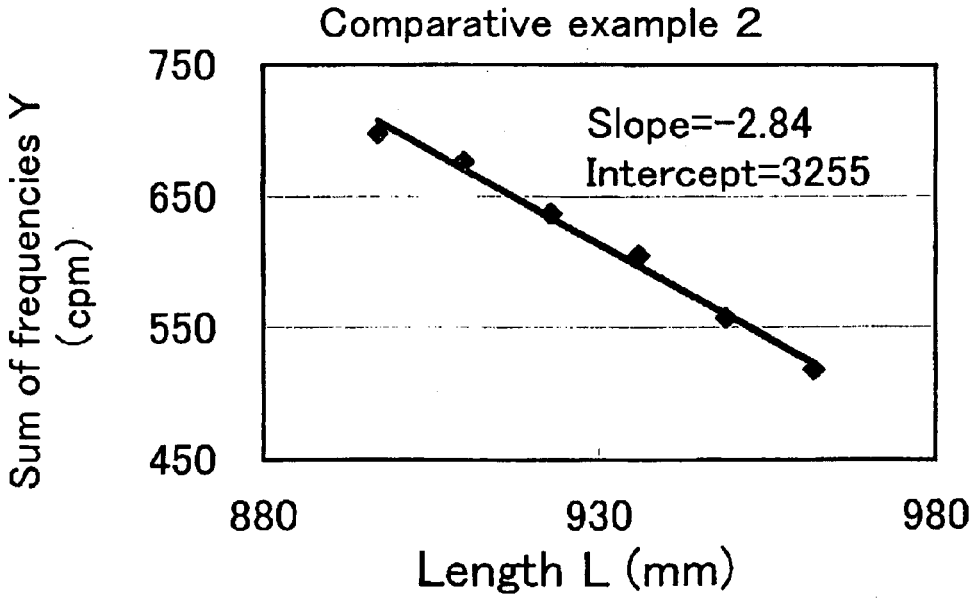

Referring to FIG. 95 to FIG. 194 and Table 44, 45, it is understood that golf club sets in example 1 to 18 satisfy conditions stipulated in the present invention and golf club sets in comparative example 1 to 2 do not satisfy conditions stipulated in the present invention.

Hitting tests of each golf club in the foregoing example 1 to 18 and comparative example 1 to 2 are carried out. In the hitting tests, a golfer hits 5 balls with each golf club and evaluated feeling of flexibility of golf club shafts. Evaluation marks are as follows: 1 is soft, 2 is slightly soft, 3 is normal, 4 is slightly stiff, 5 is stiff. A golfer hits 5 balls with a golf club but indicates one evaluation mark. Specifically, flexibility feeling of a golf club is evaluated as the result of hitting 5 balls with the golf club. Evaluation mentioned above is performed by 200 golfers.

With regard to the foregoing evaluation marks, marks by 200 people are summed up for each golf club to obtain sum-up marks. It may be said that full score is 5 (maximum score)×200 (number of golfers)=1000. This sum-up marks are written in Table 24 to Table 43 together. This numerical value of sum-up marks is based on marks evaluated on flexibility of golf club shafts by 200 golfers as mentioned above, and it can be said that it indicates flexibility of golf club shaft quantitatively.

Then a regression line of sum-up marks to natural number X of a golf club set each in example 1 to 18 and comparative example 1 to 2 is obtained, and range of estimated error of sum-up marks to the regression line is obtained. The results are shown in Table 46. The range of estimated error means the difference between maximum value and minimum value among difference between sum-up marks and a regression line in each example. Specifically, it is a range between the farthest data from the regression line upward and the farthest data from the regression line downward. Smaller range of the estimated error means more linear correlation between order of the club number (order of size of the loft angle) and flexibility of golf club shafts.

TABLE 46

| | Example 1 | Example 2 | Example 3 | Example 4 | Example 5 |
|---|---|---|---|---|---|
| Range of estimated error | 8.5 | 19.1 | 14.5 | 9.1 | 8.4 |
| | Example 6 | Example 7 | Example 8 | Example 9 | Comparative example 1 |
| Range of estimated error | 18.6 | 14.4 | 8.3 | 8.6 | 33.3 |
| | Example 10 | Example 11 | Example 12 | Example 13 | Example 14 |
| Range of estimated error | 8.8 | 19.2 | 14.9 | 9.2 | 8.9 |

TABLE 46-continued

| | Example 15 | Example 16 | Example 17 | Example 18 | Comparative example 2 |
|---|---|---|---|---|---|
| Range of estimated error | 18.9 | 15.4 | 8.5 | 8.8 | 33.6 |

As shown in Table 46, range of estimated error of golf club sets in example 1 to 9 is smaller than that of golf club sets in comparative example 1, and it is understood that flexibility of golf club shafts are well controlled through a whole set. On the other hand, range of estimated error of golf club sets in example 10 to 18 is smaller than that of golf club sets in comparative example 2, and it is understood that flexibility of golf club shafts are well controlled through a whole set.

As mentioned above, preferred embodiments in the present invention were described in detail, and it should be understood that various changes, substitutions and replacements to those can be performed as far as those do not digressed from spirit and scope in the present invention stipulated in the attached claim.

What is claimed is:

1. A golf club shaft set comprising a plurality of golf club shafts to constitute a golf club set, wherein the plurality of golf club shafts include a group of at least three golf club shafts, and, when all of the golf club shafts in the group are denoted by continuous natural numbers X starting at 1 in order of decreasing length of the golf club shaft from the longest length and a ratio of frequency calculated from a frequency per unit time as a numerator, the frequency being measured by vibrating a tip portion of the golf club shaft in a state that a rear end portion of the golf club shaft is fastened, and a frequency per unit time as a denominator, the frequency being measured by vibrating the rear end portion of the golf club shaft in a state that the tip portion of the golf club shaft is fastened, is denoted by Z, the ratio Z of frequencies is determined so that an estimated error to a regression line is 0.05 or less, when a distribution of the ratio Z of frequencies to the natural number X in all of the golf club shafts in the group is fitted on the regression line.

2. The golf club shaft set according to claim 1, wherein a slope of the regression line of the ratio Z of frequencies to the natural number X is −0.01 or less.

3. The golf club shaft set according to claim 1, wherein a slope of the regression line of the ratio Z of frequencies to the natural number X is −0.01 or more.

4. The golf club shaft set according to claim 1, wherein the group of the golf club shafts comprises golf club shafts to be assembled to golf clubs having loft angles in a range of 16 degree or more and 41 degree or less.

5. The golf club shaft set according to claim 1, wherein, when a sum of the frequency which is measured in the state that the rear end portion of the golf club shaft is fastened and the frequency which is measured in the state that the tip portion of the golf club shaft is fastened, is denoted by Y (cpm), the sum Y of frequencies is determined so that an estimated error to a regression line is 30 cpm or less, when a distribution of the sum Y of frequencies to the natural number X in all of the golf club shafts in the group is fitted on the regression line.

6. The golf club shaft set according to any one of claim 1 to 5, wherein the frequency which is measured in the state that the rear end portion of the golf club shaft is fastened, is a frequency per unit time, the frequency being measured by vibrating the tip portion of the golf club shaft in a state that the rear end portion is fastened for a length of 178 mm from the rear end and a 200 g weight is loaded on the tip portion for a length of 30 mm from the tip end, and the frequency which is measured in the state that the tip portion of the golf club shaft is fastened, is a frequency per unit time, the frequency being measured by vibrating the rear end portion of the golf club shaft in a state that the tip portion is fastened for a length of 178 mm from the tip end and a 200 g weight is loaded on the rear end portion for a length of 30 mm from the rear end.

7. The golf club shaft set according to any one of claim 1 to 5, wherein the club shaft is made of fiber reinforced plastics.

8. A golf club set comprising a plurality of golf clubs in which a golf club head is assembled on a tip portion of a golf club shaft, the plurality of golf clubs having loft angles different in each club number, wherein the plurality of golf clubs include a group of at least three golf clubs having loft angles in a range of 16 degrees to 41 degrees, and, when all of the golf clubs in the group are denoted by continuous natural numbers X starting at 1 in order of increasing loft angle from the smallest loft angle and a ratio of frequencies calculated from a frequency per unit time as a numerator, the frequency being measured by vibrating a tip portion of a golf club shaft constituting each of the golf clubs in a state that a rear end portion of the golf club shaft is fastened, and a frequency per unit time as a denominator, the frequency being measured by vibrating the rear end portion of the golf club shaft in a state that the tip portion of the golf club shaft is fastened, is denoted by Z, the ratio Z of frequencies is determined so that an estimated error to a regression line is 0.05 or less, when a distribution of the ratio Z of frequencies to the natural number X in all of the golf clubs in the group is fitted on the regression line and a slope of the regression line of the ratio Z of frequencies to the natural number X is in the range of −0.3 to −0.01.

9. The golf club set according to claim 8, wherein, when a sum of the frequency which is measured in the state that the rear end portion of the golf club shaft is fastened and the frequency which is measured in the state that the tip portion of the golf club shaft is fastened is denoted by Y (cpm), the sum Y of frequencies is determined so that an estimated error to a regression line is 30 cpm or less, when a distribution of the sum Y of frequencies to the natural number X in all of the golf clubs in the group is fitted on the regression line.

10. The golf club set according to claim 8, wherein the frequency which is measured in the state that the rear end portion of the golf club shaft is fastened, is a frequency per unit time, the frequency being measured by vibrating the tip portion of the golf club shaft in a state that the rear end portion is fastened for a length of 178 mm from the rear end and a 200 g weight is loaded on the tip portion for a length of 30 mm from the tip end, and the frequency which is measured in the state that the tip portion of the golf club shaft is fastened, is a frequency per unit time, the frequency being measured by vibrating the rear end portion of the golf club shaft in a state that the tip portion is fastened for a length of 178 mm from the tip end and a 200 g weight is loaded on the rear end portion for a length of 30 mm from the rear end.

11. The golf club set according to claim 8, wherein the golf club shaft is made of fiber reinforced plastics.

* * * * *

UNITED STATES PATENT AND TRADEMARK OFFICE

CERTIFICATE OF CORRECTION

PATENT NO. : 6,916,251 B2 
APPLICATION NO. : 10/135822
DATED : July 12, 2005
INVENTOR(S) : Takayuki Shiraishi et al.

It is certified that error appears in the above-identified patent and that said Letters Patent is hereby corrected as shown below:

In claim 4, column 53, lines 52-53, “16 degree” should read --16 degrees--.

In claim 4, column 53, line 53, “41 degree” should read --41 degrees--.

* In claim 6, column 53, lines 64-65, “claim 1 to 5,” should read --claims 1 to 5,--.

* In claim 7, column 54, lines 21-22, “claim 1 to 5,” should read --claims 1 to 5,--.

* In claim 7, column 54, line 22, before “club shaft” insert --golf--.

Signed and Sealed this

Twenty-eighth Day of August, 2007

JON W. DUDAS
*Director of the United States Patent and Trademark Office*